US007537299B2

(12) United States Patent
Tamura

(10) Patent No.: US 7,537,299 B2
(45) Date of Patent: May 26, 2009

(54) LIQUID EJECTION APPARATUS, DRIVE SIGNAL APPLICATION METHOD, AND LIQUID EJECTION METHOD

(75) Inventor: Noboru Tamura, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 418 days.

(21) Appl. No.: 11/238,052

(22) Filed: Sep. 29, 2005

(65) Prior Publication Data

US 2006/0071961 A1 Apr. 6, 2006

(30) Foreign Application Priority Data

| | | |
|---|---|---|
| Sep. 29, 2004 | (JP) | 2004-284789 |
| Sep. 29, 2004 | (JP) | 2004-284790 |
| Nov. 4, 2004 | (JP) | 2004-320371 |
| Dec. 9, 2004 | (JP) | 2004-356869 |
| Dec. 22, 2004 | (JP) | 2004-370760 |
| Dec. 28, 2004 | (JP) | 2004-381116 |

(51) Int. Cl.
*B41J 29/38* (2006.01)

(52) U.S. Cl. ..... 347/9; 347/10; 347/11

(58) Field of Classification Search ..... 347/9–11
See application file for complete search history.

(56) References Cited

U.S. PATENT DOCUMENTS

| | | | | |
|---|---|---|---|---|
| 6,412,895 | B1 | 7/2002 | Takemoto et al. | |
| 6,779,866 | B2 * | 8/2004 | Junhua et al. | 347/19 |
| 2005/0041073 | A1 * | 2/2005 | Fontaine et al. | 347/68 |

FOREIGN PATENT DOCUMENTS

| | | | |
|---|---|---|---|
| JP | 06-293135 | A | 10/1994 |
| JP | 07-001727 | A | 1/1995 |
| JP | 08-309974 | A | 11/1996 |
| JP | 9-11457 | A | 1/1997 |
| JP | 10-016217 | A | 1/1998 |
| JP | 10-81013 | A | 3/1998 |
| JP | 10-226073 | A | 8/1998 |
| JP | 10-278275 | A | 10/1998 |

(Continued)

*Primary Examiner*—Julian D Huffman
(74) *Attorney, Agent, or Firm*—Sughrue Mion, PLLC

(57) ABSTRACT

The liquid ejection apparatus includes: (A) a drive signal generation section generating first and second drive signals to be applied to an element that can execute a liquid-ejection operation; (B) a data output section outputting first selection data for setting an application state of the first drive signal to the element, and second selection data for setting an application state of the second drive signal to the element; (C) a data inspection section inspecting the first and second selection data having been output from the data output section, and outputting inspected first selection data and inspected second selection data, wherein if the first and second selection data indicate that the first and second drive signals are to be applied to the element simultaneously, then the data inspection section continues to output the inspected first- and inspected second selection data that had been output up to then; and (D) a switch section including a first switch that controls application of the first drive signal to the element based on the inspected first selection data, and a second switch that controls application of the second drive signal to the element based on the inspected second selection data. Accordingly, it is possible to prevent a plurality of switches from entering the ON state simultaneously.

10 Claims, 51 Drawing Sheets

FOREIGN PATENT DOCUMENTS

| | | | |
|---|---|---|---|
| JP | 11-077988 | A | 3/1999 |
| JP | 11-123831 | A | 5/1999 |
| JP | 2000-052570 | A | 2/2000 |
| JP | 2000-52570 | A | 2/2000 |
| JP | 2001-038926 | A | 2/2001 |
| JP | 2003-237113 | A | 8/2003 |

* cited by examiner

| q0 | q4 | OA |
|---|---|---|
| 0 | 0 | 1 |
| 1 | 0 | 1 |
| 0 | 1 | 1 |
| 1 | 1 | 0 |

| q3 | q7 | OD |
|---|---|---|
| 0 | 0 | 1 |
| 1 | 0 | 1 |
| 0 | 1 | 1 |
| 1 | 1 | 0 |

| OA | OB | OC | OD | OE |
|---|---|---|---|---|
| 0 | 0 | 0 | 0 | 1 |
| 0 | 0 | 0 | 1 | 1 |
| ⋮ | ⋮ | ⋮ | ⋮ | ⋮ |
| 1 | 1 | 1 | 0 | 1 |
| 1 | 1 | 1 | 1 | 0 |

| pixel data SI | first switch control signal SW_A | second switch control signal SW_B |
|---|---|---|
| 00 | q0 | q4 |
| 01 | q1 | q5 |
| 10 | q2 | q6 |
| 11 | q3 | q7 |

Fig.46

LIQUID EJECTION APPARATUS, DRIVE SIGNAL APPLICATION METHOD, AND LIQUID EJECTION METHOD

CROSS-REFERENCE TO RELATED APPLICATIONS

The present application claims priority upon Japanese Patent Application No. 2004-284789 and Japanese Patent Application No. 2004-284790 filed on Sep. 29, 2004, Japanese Patent Application No. 2004-320371 filed on Nov. 4, 2004, Japanese Patent Application No. 2004-356869 filed on Dec. 9, 2004, Japanese Patent Application No. 2004-370760 filed on Dec. 22, 2004, and Japanese Patent Application No. 2004-381116 filed on Dec. 28, 2004, which are herein incorporated by reference.

BACKGROUND OF THE INVENTION

1. Field of the Invention

The present invention relates to liquid ejection apparatuses, drive signal application methods, and liquid ejection methods.

2. Description of the Related Art

There are various types of liquid ejection apparatuses having elements that can execute an operation for ejecting ink, such as printing apparatuses, color filter manufacturing apparatuses, and dyeing apparatuses. In recent years, apparatuses with which a plurality of drive signals can be applied to a single element in order to broaden the range over which the amount of liquid that is ejected can be changed or to allow liquid to be ejected at higher frequencies have been proposed (for example, see JP 2000-52570A). With such apparatuses, a switch that controls the application of drive signals to the element is provided for each of the plurality of drive signals. Further, this apparatus is configured so that desired portions within each drive signal (i.e., a plurality of drive pulses included in each drive signal) can be selectively applied to the element. This allows the amount of ejected liquid to be selected variously.

To selectively apply a desired portion of a drive signal, selection data is set for each portion to be applied, and control is, performed based on the selection data (for example, see JP 10-81013A). In this apparatus, the selection data are stored on registers. The registers are configured of D-FF (delay flip flop) circuits, for example.

(1) Ordinarily, the above-mentioned registers store normal selection data. However, due to noise, for example, in practice there is also a possibility that abnormal data will be stored. For example, in the case of registers made of D-FF circuits, selection data are transferred to an adjacent register each time a transfer clock is input. If noise is propagated to the signal wire for the transfer clock, then this noise may be incorrectly recognized as the transfer clock. When noise is inadvertently recognized as the transfer clock, the registers will come to store selection data that are different from normal selection data. As a result, there is a possibility that a plurality of switches will enter the ON state simultaneously. When a plurality of switches enter the ON state simultaneously and there is a voltage difference between the drive signals, then there is a possibility that unanticipated current will flow and negatively affect the apparatus.

(2) Further, with the foregoing conventional apparatus, no special control is performed when switching between the drive signals that are applied to the elements. Thus, there is the possibility that a plurality of switches will be put into the ON state simultaneously at the timing at which the switches are switched. When a plurality of switches are in the ON state simultaneously and there is a voltage difference between the drive signals, a flow-through current can occur between a plurality of drive circuits. For example, there are instances where a current flows from a drive circuit that generates one drive signal and is drawn in by a drive circuit that generates an other drive signal. This flow-through current causes a sudden increase in current, for example, which may become a source of noise. There is a possibility that this noise will have a negative impact on, for example, the operation of the apparatus.

(3) Further, with the above-mentioned apparatus, a signal having a constant voltage is generated from the end of generation of one drive pulse to the start of generation of the next drive pulse. A control period is provided while this constant voltage signal is being generated. During this control period, a control for switching between applying and not applying the drive signal to the element is performed. With this apparatus, however, no special control is performed during this control period. As a result, there is a possibility that a plurality of switches may become on simultaneously at the timing at which the switches are switched. Consider a case in which the drive signal that is applied to an element is switched from one drive signal to another drive signal. In this case, the logic for switching the switch ON and OFF would be to switch the logic level corresponding to one drive signal from ON to OFF and switch the logic level corresponding to the other drive signal from OFF to ON. In practice, when trying to execute this control, the logic sometimes briefly fluctuates between ON and OFF during the transition period of this switching.

When a plurality of switches have simultaneously been put into the ON state and there is a difference in the voltage between the drive signals, then there is a possibility that an unexpected current will flow and have a negative influence on the apparatus. For example, there are instances in which a current flows from a drive circuit that generates one drive signal and is drawn in by a drive circuit that generates another drive signal. In other words, there are cases where a flow-through current occurs between a plurality of drive-circuits. This flow-through current causes a sudden increase in current, for example, which may become a source of noise. This noise may have a negative impact on, for example, the operation of the apparatus. This flow-through current also distorts the shape of the drive signals, and thus may also negatively affect the ejection of ink.

(4) Inkjet printers are known as one type of liquid ejection apparatus that ejects liquid droplets. With inkjet printers, ink droplets are ejected from nozzles provided in a head and land on paper, forming dots on the paper. Innumerable dots are formed on the paper to print a print image on the paper.

It is conceivable that the quality of the print image will be improved by changing the size of the dots that are formed on the paper. It goes without saying that forming a print image using dots of various sizes, such as large dots, medium dots, and small dots, will lead to a higher image quality than if dots of uniform size are used.

Forming dots of varying sizes, however, requires the size of the ink droplets that are ejected from the nozzles to be changed. To do this, it is necessary to apply various types of signals to the elements that are driven in order to eject liquid droplets. Conventionally, it has been necessary to provide a number of types of drive signals corresponding to the number of sizes of ink droplets to be ejected (see, for example, JP 9-11457A).

Increasing the types of drive signals, however, complicates the structure of the apparatus.

SUMMARY OF THE INVENTION

The present invention was arrived at in order to address the foregoing issues, and it is an object thereof to prevent a plurality of switches from entering the ON state simultaneously.

Further, the present invention was arrived at in order to address the foregoing issues, and it is an object thereof to prevent a plurality of switches from entering the ON state simultaneously when switching between drive signals.

Further, the present invention was arrived at in order to address the foregoing issues, and it is an object thereof to prevent a plurality of switches from entering the ON state simultaneously during a control period for switching between applying and not applying a drive signal.

It is a further object of the invention to allow numerous types of signals to be applied to the elements using only a few types of drive signals.

A first aspect of the invention for achieving the above objects is a liquid ejection apparatus comprising:

(A) a drive signal generation section that generates a first drive signal and a second drive signal to be applied to an element that can execute an operation for ejecting liquid;

(B) a data output section that outputs first selection data for setting a state of application of the first drive signal to the element, and second selection data for setting a state of application of the second drive signal to the element;

(C) a data inspection section that inspects the first selection data and the second selection data that have been output from the data output section, and outputs inspected first selection data and inspected second selection data, wherein if the first selection data and the second selection data indicate that the first drive signal and the second drive signal are to be applied to the element simultaneously, then the data inspection section continues to output the inspected first selection data and the inspected second selection data that had been output up to then; and (D) a switch section including a first switch that controls application of the first drive signal to the element based on the inspected first selection data, and a second switch that controls application of the second drive signal to the element based on the inspected second selection data.

A second aspect of the invention for achieving the above objects is a liquid ejection apparatus comprising:

(A) an element that can execute an operation for ejecting liquid;

(B) a drive signal generation section that generates a first drive signal and a second drive signal;

(C) a first switch that controls application of the first drive signal to the element;

(D) a second switch that controls application of the second drive signal to the element; and (E) a controller that puts both the first switch and the second switch into an OFF state when switching the drive signal that is to be applied to the element from the first drive signal to the second drive signal.

A third aspect of the invention for achieving the above objects is a liquid ejection apparatus comprising:

(A) an element that can execute an operation for ejecting liquid;

(B) a drive signal generation section that generates a first drive signal having a plurality of unit signals that define an operation of the element, and a second drive signal having an other unit signal that defines an operation of the element;

(C) a first switch that controls application of the unit signals to the element;

(D) a second switch that controls application of the other unit signal to the element; and (E) a controller that forcibly puts the first switch into an OFF state for a predetermined period, during a time from an end of generation of one unit signal to a start of generation of a next unit signal.

A fourth aspect of the invention for achieving the above objects is a liquid ejection apparatus comprising:

(A) a head having a plurality of elements each provided in correspondence with one of a plurality of nozzles that are for ejecting liquid droplets;

(B) a drive signal generation section that generates a first drive signal in which a plurality of waveform sections are repeated in a predetermined cycle, and a second drive signal that is different from the first drive signal and in which a plurality of waveform sections are repeated in the predetermined cycle;

(C) a memory that stores first drive-signal selection data for selecting one drive signal from among the first drive signal and the second drive signal in a particular period within the predetermined cycle, second drive-signal selection data for selecting one drive signal from among the first drive signal and the second drive signal in a separate period within the predetermined cycle, and waveform section selection data for selecting a predetermined waveform section from among the plurality of waveform sections; and (D) a controlling section that applies the waveform sections to the elements in order to drive the elements and cause an ejection of the liquid droplets from the nozzles, the controlling section, applying, in the particular period within the predetermined cycle, to the elements the waveform section that has been selected based on the waveform section selection data, from among the plurality of waveform sections included in the drive signal that has been selected based on the first drive-signal selection data, and applying, in the separate period within the predetermined cycle, to the elements the waveform section that has been selected based on the waveform section selection data, from among the plurality of waveform sections included in the drive signal that has been selected based on the second drive-signal selection data.

Other features of the present invention will become clear through the following description and the appended drawings.

BRIEF DESCRIPTION OF THE DRAWINGS

FIG. 46 is an explanatory diagram of the relationship between pixel data that are input to the decoder and switch control signals that are output from the decoder.

DETAILED DESCRIPTION OF THE INVENTION

===Overview of the Disclosure===

Figure 1:
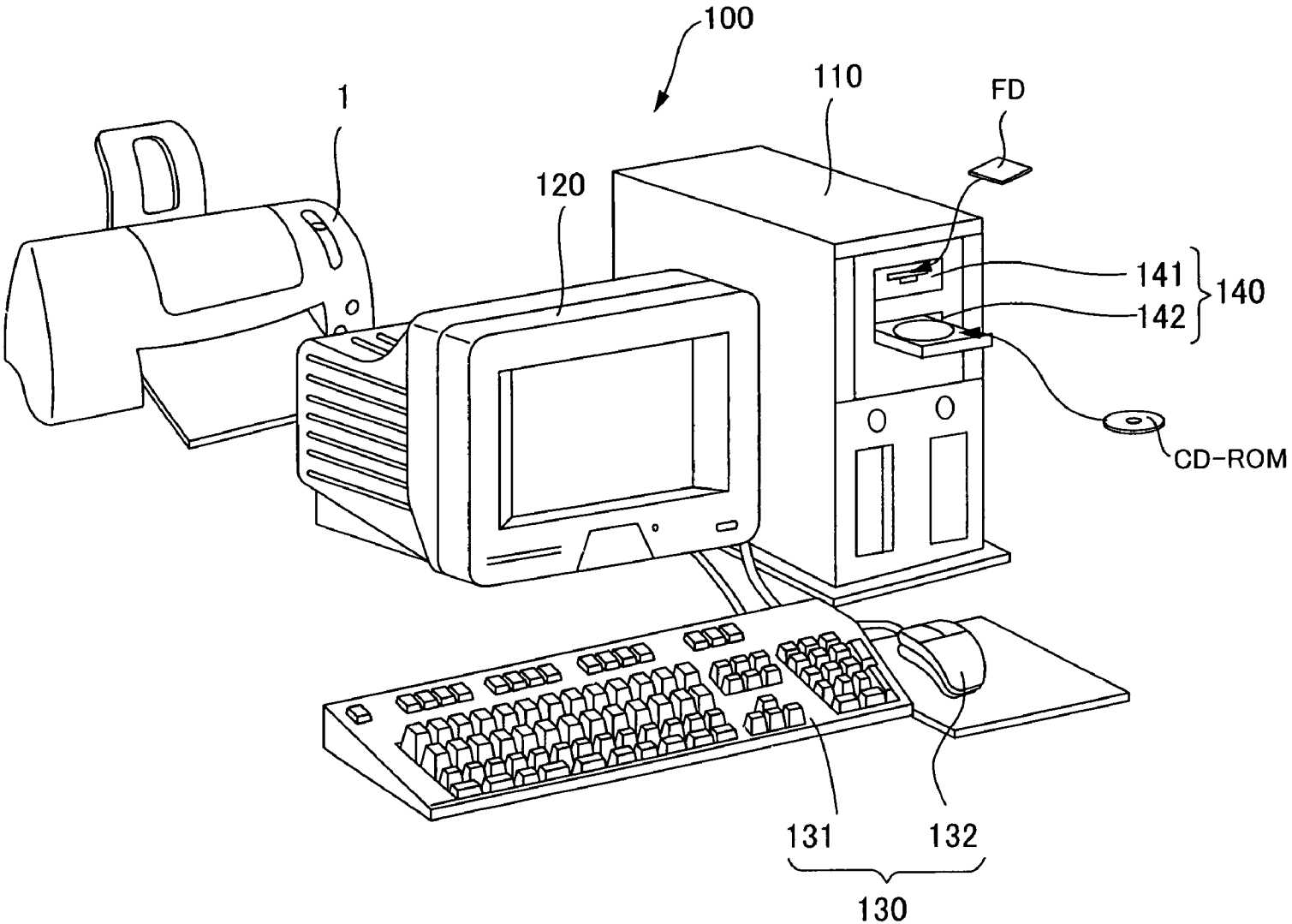
FIG. 1 is a diagram that describes a configuration of a printing system.

At least the following matters will become clear through the explanation in the present specification and the description of the accompanying drawings.

That is, it is possible to achieve a liquid ejection apparatus comprising: a drive signal generation section that generates a first drive signal and a second drive signal to be applied to an element that can execute an operation for ejecting liquid; a data output section that outputs first selection data for setting a state of application of the first drive signal to the element, and second selection data for setting a state of application of the second drive signal to the element; a data inspection section that inspects the first selection data and the second selection data that have been output from the data output section, and outputs inspected first selection data and inspected second selection data, wherein if the first selection data and the second selection data indicate that the first drive signal and the second drive signal are to be applied to the element simultaneously, then the data inspection section continues to output the inspected first selection data and the inspected second selection data that had been output up to then; and a switch section including a first switch that controls application of the first drive signal to the element based on the inspected first selection data, and a second switch that controls application of the second drive signal to the element based on the inspected second selection data.

With this liquid ejection apparatus, if the first selection data and the second selection data that have been output from the data output section indicate that the first drive signal and the second drive signal are to be applied to the element simultaneously, then the data inspection section continues to output the inspected first selection data and the inspected second selection data that had been output up to then. Here, the inspected first selection data and the inspected second selection data that had been output up to then are data that have been inspected by the data inspection section. That is, they are selection data that do not indicate a simultaneous application of the first drive signal and the second drive signal to the element. Because application of the first drive signal and the second drive signal to the element is controlled by the inspected first selection data and the inspected second selection data, it is possible to reliably prevent the first drive signal and the second drive signal from being simultaneously applied to the element.

In this liquid ejection apparatus, the data inspection section may continue to output the inspected first selection data and the inspected second selection data that had been output up to then, until a timing at which the drive signal that is to be applied to the element can be switched from one of the first drive signal and the second drive signal to the other.

With this liquid ejection apparatus, the application of the drive signals will be controlled based on new inspected first selection data and inspected second selection data at a timing at which one of the first drive signal and the second drive signal can be switched to the other. Thus, the control of application of the drive signals based on the new inspected first selection data and inspected second selection data can be performed smoothly.

In this liquid ejection apparatus, the data inspection section may continue to output the inspected first selection data and the inspected second selection data that had been output up to then, until an update timing at which ejection amount information indicating an amount of liquid to be ejected is updated.

With this liquid ejection apparatus, the control of application of the drive signals is performed based on new inspected first selection data and inspected second selection data at a timing at which the ejection amount information is updated. Thus, the control of application of the drive signals based on the new inspected first selection data and inspected second selection data can be performed smoothly.

In this liquid ejection apparatus, the data inspection section may comprise: a data determination section that determines whether or not the first selection data and the second selection data that have been output from the data output section indicate that the first drive signal and the second drive signal are to be simultaneously applied to the element; a determination result storage section that stores a result of determination by the data determination section; and a selective output section that selects and outputs the inspected first selection data and the inspected second selection data that had been output up to then, if either one of a determination result output from the data determination section or a determination result stored on the determination result storage section indicates that the first drive signal and the second drive signal are to be applied to the element simultaneously.

With this liquid ejection apparatus, the result of determination by the data determination section is stored on the determination result storage section, and thus using a simple configuration, it is possible to continue to output the inspected first selection data and the inspected second selection data that had been output up to then, based on the stored information of the determination result storage section.

In this liquid ejection apparatus, the data determination section may perform the determination regarding the first selection data and the second selection data at a timing of a forward edge of a timing pulse that defines a switch timing of the first drive signal and a switch timing of the second drive signal; and the selective output section may perform the selection of the inspected first selection data and the inspected second selection data at a timing of a rear edge of the timing pulse.

With this liquid ejection apparatus, the order in which the data determination section performs determination and the selection output section performs selection can be determined reliably. Thus, the determination regarding the first selection data and the second selection data that have been output from the data output section can be performed reliably.

In this liquid ejection apparatus, the determination result storage section may reset the determination result that has been stored based on a specific timing pulse among timing pulses defining a switch timing of the first drive signal and a switch timing of the second drive signal.

With this liquid ejection apparatus, the determination result storage section is reset at a switch timing of the first drive signal and the second drive signal. Thus, the control of application of the drive signals based on new inspected first selection data and inspected second selection data can be performed smoothly.

In this liquid ejection apparatus, the data output section may output a plurality of types of first selection data and a plurality of types of second selection data that are classified based on an ejection amount of the liquid; and the data determination section may perform the determination with respect to the first selection data and the second selection data of the same type.

With this liquid ejection apparatus, determination is performed with respect to first selection data and second selection data of the same type, and thus appropriate determination can be performed.

In this liquid ejection apparatus, the selective output section may comprise: a selection switch that selects the first selection data and the second selection data that have been output from the data output section if neither the determination result output from the data determination section nor the determination result stored on the determination result storage section indicate that the first drive signal and the second drive signal are to be applied to the element simultaneously, and that selects the inspected first selection data and the inspected second selection data if at least either one of the determination result output from the data determination section or the determination result stored on the determination result storage section indicates that the first drive signal and the second drive signal are to be applied to the element simultaneously; and a storage output section that stores and outputs data selected by the selection switch based on a timing pulse that defines a switch timing of the first drive signal and a switch timing of the second drive signal.

With this liquid ejection apparatus, the selection and output of data are performed by the selection switch that operates according to the determination result, and the storage output section that stores and outputs the data that have been selected by the selection switch. Thus, with this simple configuration, the selection of data can be performed reliably.

It is also possible to achieve a liquid ejection apparatus comprising: a drive signal generation section that generates a first drive signal and a second drive signal to be applied to an element that can execute an operation for ejecting liquid; a data output section that outputs a plurality of types of first selection data that are classified based on an ejection amount of the liquid and that are for setting a state of application of the first drive signal to the element, and a plurality of types of second selection data that are classified based on the ejection amount of the liquid and that are for setting a state of application of the second drive signal to the element; a data inspection section including: a data determination section that determines, at a timing of a forward edge of a timing pulse that define a switch timing of the first drive signal and a switch timing of the second drive signal, whether or not the first selection data and the second selection data of the same type that have been output from the data output section indicate that the first drive signal and the second drive signal are to be applied to the element simultaneously; a determination result storage section that stores a result of determination by the data determination section, and that resets the determination result that has been stored based on a specific timing pulse among the timing pulses; and a selective output section having: a selection switch that inspects the first selection data and the second selection data that have been output from the data output section, and outputs inspected first selection data and inspected second selection data, the selection switch selecting the first selection data and the second selection data that have been output from the data output section if neither the determination result output from the data determination section nor the determination result stored on the determination result storage section indicate that the first drive signal and the second drive signal are to be applied to the element simultaneously, and selecting the inspected first selection data and the inspected second selection data if at least either one of the determination result output from the data determination section or the determination result stored on the determination result storage section indicates that the first drive signal and the second drive signal are to be applied to the element simultaneously; and a storage output section that stores and outputs data selected by the selection switch based on the timing pulse that defines the switch timing of the first drive signal and the switch timing of the second drive signal; wherein the selective output section selects and outputs the inspected first selection data and the inspected second selection data that had been output up to then, at a timing of a rear edge of the timing pulse, if either one of the determination result output from the data determination section or the determination result stored on the determination result storage section indicates that the first drive signal and the second drive signal are to be applied to the element simultaneously; wherein, if the first selection data and the second selection data indicate that the first drive signal and the second drive signal are to be applied to the element simultaneously, then the data inspection section continues to output the inspected first selection data and the inspected second selection data that had been output up to then, until a timing at which the drive signal that is to be applied to the element can be switched from one of the first drive signal and the second drive signal to the other, or until an update timing at which ejection amount information indicating an amount of liquid to be ejected is updated; and a switch section that includes a first switch that controls application of the first drive signal to the element based on the inspected first selection data, and a second switch that controls application of the second drive signal to the element based on the inspected second selection data.

This liquid ejection apparatus attains substantially all of the effects mentioned above, and thus can achieve the object of the invention most effectively.

It is also possible to realize a method of applying drive signals, comprising: a drive signal generation step of generating a first drive signal and a second drive signal to be applied to an element that can execute an operation for ejecting liquid; a selection data output step of outputting first selection data for setting a state of application of the first drive signal to the element, and second selection data for setting a state of application of the second drive signal to the element; a data inspection step of inspecting the first selection data and the second selection data that have been output, and outputting inspected first selection data and inspected second selection data, wherein if the first selection data and the second selection data that have been output do not indicate that the first drive signal and the second drive signal are to be applied to the element simultaneously, then the first selection data and the second selection data are output as the inspected first selection data and the inspected second selection data, and if the first selection data and the second selection data that have been output indicate that the first drive signal and the second drive signal are to be applied to the element simultaneously, then the inspected first selection data and the inspected second selection data that had been output up to then are continued to be output; and a drive signal application step of applying the first drive signal to the element based on the inspected first selection data, and applying the second drive signal to the element based on the inspected second selection data.

It is further possible to realize a liquid ejection method comprising: a drive signal generation step of generating a first drive signal and a second drive signal to be applied to an element that can execute an operation for ejecting liquid; a selection data output step of outputting first selection data for setting a state of application of the first drive signal to the element, and second selection data for setting a state of application of the second drive signal to the element; a data inspection step of inspecting the first selection data and the second selection data that have been output, and outputting inspected first selection data and inspected second selection data, wherein if the first selection data and the second selection data that have been output do not indicate that the first drive signal and the second drive signal are to be applied to the element simultaneously, then the first selection data and the second selection data are output as the inspected first selection data and the inspected second selection data, and if the first selection data and the second selection data that have been output indicate that the first drive signal and the second drive signal are to be applied to the element simultaneously, then the inspected first selection data and the inspected second selection data that had been output up to then are continued to be output; and a drive signal application step of applying the first drive signal to the element based on the inspected first selection data, and applying the-second drive signal to the element based on the inspected second selection data.

It is also possible to realize a liquid ejection apparatus comprising: an element that can execute an operation for ejecting liquid; a drive signal generation section that generates a first drive signal and a second drive signal; a first switch that controls application of the first drive signal to the element; a second switch that controls application of the second drive signal to the element; and a controller that puts both the first switch and the second switch into an OFF state when switching the drive signal that is to be applied to the element from the first drive signal to the second drive signal.

With this liquid ejection apparatus, the first switch and the second switch both can be put into the OFF state when the drive signal to be applied to the element is to be switched. It is therefore possible to prevent the two switches from both entering the ON state at the same time. Thus, even if there is a voltage difference between the first drive signal and the second drive signal when the drive signal is switched, it is possible to prevent the problem of a flow-through current flowing.

In this liquid ejection apparatus, the first switch may control application of the first drive signal to the element based on a first switch control signal; the second switch may control application of the second drive signal to the element based on a second switch control signal; and the controller may put both the first switch and the second switch into the OFF state, regardless of the first switch control signal and the second switch control signal.

With this liquid ejection apparatus, the first switch and the second switch are both put in the OFF state when the drive signal to be applied to the element is switched, even if the first switch control signal and the second switch control signal both indicate the ON state. Thus, the problem of a flow-through current flowing at the time of switching the drive signal can be reliably prevented.

In this liquid ejection apparatus, the controller may put both the first switch and the second switch into the OFF state based on a timing pulse that defines a switch timing of the first switch control signal and the second switch control signal.

With this liquid ejection apparatus, the timing at which the first switch and the second switch are put into the OFF state can be matched to the timing at which the first switch control signal and the second switch control signal are switched. Thus, the problem of a flow-through current flowing at the time of switching the drive signal can be reliably prevented.

In this liquid ejection apparatus, the controller may disable the first switch control signal and the second switch control signal at a timing of a forward edge of the timing pulse, and may enable the first switch control signal and the second switch control signal at a timing of a rear edge of the timing pulse.

With this liquid ejection apparatus, control of the first switch and the second switch is performed based on the timing of the forward edge and the timing of the rear edge of the timing pulse. It is thus possible to reliably match the control timing for the first switch and the second switch.

In this liquid ejection apparatus, the controller may disable the first switch control signal and the second switch control signal based on the timing pulse, and may enable the first switch control signal and the second switch control signal after a predetermined time has passed from when the disablement has been effected.

With this liquid ejection apparatus, the OFF time during which the first switch and the second switch are off (the predetermined time) can be determined independent of the duration of the timing pulse, allowing the OFF time to be optimized.

In this liquid ejection apparatus, the controller may have a timer that measures the predetermined time.

With this liquid ejection apparatus, the predetermined time is measured by the timer, and thus the OFF time can be accurately determined.

In this liquid ejection apparatus, the controller may comprise: a first gate to which the first switch control signal and a gate control signal are input, wherein if the gate control signal is at a predetermined level, then the first gate outputs the first switch control signal to the first switch, and if the gate control signal is at an other predetermined level, then the first gate disables the first switch control signal and outputs, to the first switch, a first OFF control signal for putting the first switch into an OFF state; and a second gate to which the second switch control signal and the gate control signal are input, wherein if the gate control signal is at the predetermined level, then the second gate outputs the second switch control signal to the second switch, and if the gate control signal is at the other predetermined level, then the second gate disables the second switch control signal and outputs a second OFF control signal, to the second switch, for putting the second switch into an OFF state; and the controller may set the gate control signal to the other predetermined level over a period during which the first switch and the second switch are to be put into the OFF state.

With this liquid ejection apparatus, the configuration is such that the first gate and the second gate are controlled by a gate control signal, and thus is suited for high-speed operation.

In this liquid ejection apparatus, the first switch may switch between an ON state and an OFF state due to a change in a resistance value; and the second switch may switch between an ON state and an OFF state due to a change in a resistance value.

With this liquid ejection apparatus, it is unlikely that switching noise will occur when the states of the first switch and the second switch are switched. Thus, the problem of a flow-through current flowing when the drive signal is switched can be reliably prevented.

In this liquid ejection apparatus, it is preferable that the liquid is a liquid ink for printing.

It is also possible to realize a liquid ejection apparatus comprising: an element that can execute an operation for ejecting liquid ink for printing; a drive signal generation section that generates a first drive signal and a second drive signal; a first switch that switches between an ON state and an OFF state due to a change in a resistance value, and that controls application of the first drive signal to the element based on a first switch control signal; a second switch that switches between an ON state and an OFF state due to a change in a resistance value, and that controls application of the second drive signal to the element based on a second switch control signal; and a controller including: a first gate to which the first switch control signal and a gate control signal are input, wherein if the gate control signal is at a predetermined level, then the first gate outputs the first switch control signal to the first switch, and if the gate control signal is at an other predetermined level, then the first gate disables the first switch control signal and outputs, to the first switch, a first OFF control signal for putting the first switch into the OFF state; and a second gate to which the second switch control signal and the gate control signal are input, wherein if the gate control signal is at the predetermined level, then the second gate outputs the second switch control signal to the second switch, and if the gate control signal is at the other predetermined level, then the second gate disables the second switch control signal and outputs, to the second switch, a second OFF control signal for putting the second switch into the OFF state; wherein, when switching the drive signal that is to be applied to the element from the first drive signal to the second drive signal, then, regardless of the first switch control signal and the second switch control signal, at a timing of a forward edge of a timing pulse that defines a switch timing of the first switch control signal and the second switch control signal, the controller disables the first switch control signal and the second switch control signal to put both the first switch and the second switch into the OFF state by setting the gate control signal to the other predetermined level; and at a timing of a rear edge of the timing pulse, the controller enables the first switch control signal and the second switch control signal by setting the gate control signal to the predetermined level; or wherein the controller further includes a timer for measuring a predetermined time; and wherein, when switching the drive signal that is to be applied to the element from the first drive signal to the second drive signal, then, regardless of the first switch control signal and the second switch control signal, the controller disables the first switch control signal and the second switch control signal based on the timing pulse by setting the gate control signal to the other predetermined level to put both the first switch and the second switch into the OFF state; and the controller enables the first switch control signal and the second switch control signal by setting the gate control signal to the predetermined level after the predetermined time has passed from when the first switch and the second switch were put into the OFF state.

This liquid ejection apparatus attains substantially all of the effects mentioned above, and thus can most effectively achieve the object of the invention.

It is also possible to realize a method of applying drive signals, comprising: a drive signal generation step of generating a first drive signal and a second drive signal; a first drive signal application step of putting, into an ON state, a first switch that controls application of the first drive signal to an element that can execute an operation for ejecting liquid, and applying the first drive signal to the element; a switch off step of putting both the first switch and a second switch that controls application of the second drive signal to the element into an OFF state; and a second drive signal application step of putting the second switch into an ON state and applying the second drive signal to the element.

It is further possible to realize a liquid ejection method comprising: a drive signal generation step of generating a first drive signal and a second drive signal; a first drive signal application step of putting, into an ON state, a first switch that controls application of the first drive signal to an element that can execute an operation for ejecting liquid, and applying the first drive signal to the element; a switch off step of putting both the first switch and a second switch that controls application of the second drive signal to the element into an OFF state; and a second drive signal application step of putting the second switch into an ON state and applying the second drive signal to the element.

It is possible to achieve a liquid ejection apparatus comprising: an element that can execute an operation for ejecting liquid; a drive signal generation section that generates a first drive signal having a plurality of unit signals that define an operation of the element, and a second drive signal having an other unit signal that defines an operation of the element; a first switch that controls application of the unit signals to the element; a second switch that controls application of the other unit signal to the element; and a controller that forcibly puts the first switch into an OFF state for a predetermined period, during a time from an end of generation of one unit signal to a start of generation of a next unit signal.

With this liquid ejection apparatus, the controller forcibly puts the first switch into the OFF state for a predetermined period that is set within a time from the end of generation of one unit signal to a start of generation of the next unit signal. By performing control during this predetermined period to switch between applying and not applying the first drive signal, it is possible to prevent the first switch and the second switch from entering the ON state simultaneously. The problem of an unexpected current flowing therefore can be prevented.

In this liquid ejection apparatus, the first switch may control application of the unit signals to the element based on a switch control signal; and the controller may put the first switch into the OFF state for the predetermined period regardless of the switch control signal.

With this liquid ejection apparatus, the controller puts the first switch in the OFF state even if the switch control signal indicates the ON state during the predetermined period, due to the occurrence of an undesirable logic level during the transition period of the switching operation. It is therefore possible to prevent the problem of a plurality of switches turning ON simultaneously, and thus the problem of unanticipated current flowing can be reliably prevented.

In this liquid ejection apparatus, the controller may put the first switch into the OFF state based on a timing pulse that defines a switch timing of the switch control signal.

With this liquid ejection apparatus, the timing at which the first switch is put into the OFF state can be matched with the timing at which switching of the switch control signal occurs. Thus, the problem of an unanticipated current flowing can be reliably prevented.

In this liquid ejection apparatus, the controller may disable the switch control signal at a timing of a forward edge of the timing pulse, and may enable the switch control signal at a timing of a rear edge of the timing pulse.

With this liquid ejection apparatus, the first switch is controlled in accordance with the timing of the forward edge and the timing of the rear edge of the timing pulse. Thus, the period during which the first switch is put in the OFF state can be reliably matched with the period during which switching of the switch control signal takes place.

In this liquid ejection apparatus, the controller may disable the switch control signal based on the timing pulse, and may enable the switch control signal after the predetermined period has passed from when the disablement has been effected.

With this liquid ejection apparatus, the OFF time of the first switch can be determined independent of the duration of the timing pulse, and this allows the OFF time to be optimized.

In this liquid ejection apparatus, the controller may comprise: a gate circuit to which the switch control signal and a gate control signal are input, wherein if the gate control signal is at a predetermined level, then the gate circuit outputs the switch control signal to the first switch, and if the gate control signal is at an other predetermined level, then the gate circuit outputs, to the first switch, an OFF control signal for putting the first switch into the OFF state; and the controller may set the gate control signal to the other predetermined level over a period during which the first switch is to be put into the OFF state.

With this liquid ejection apparatus, the configuration is such that the gate circuit is controlled by a gate control signal, and thus is suited for high-speed operation.

In this liquid ejection apparatus, the second drive signal generated by the drive signal generation section may have a plurality of the other unit signals; and the controller may forcibly put the second switch into an OFF state for an other predetermined period, during a time from an end of generation of one other unit signal to a start of generation of a next other unit signal.

With this liquid ejection apparatus, the controller forcibly puts the second switch into the OFF state for an other predetermined period that is set within a time from the end of generation of one other unit signal to a start of generation of the next other unit signal. By performing control to switch between applying and not applying the second drive signal during this other predetermined period, it is possible to prevent the first switch and the second switch from entering the ON state simultaneously, and therefore the problem of an unexpected current flowing can be prevented.

In this liquid ejection apparatus, the second switch may control application of the other unit signals to the element based on an other switch control signal; and the controller may put the second switch into the OFF state for the other predetermined period regardless of the other switch control signal.

With this liquid ejection apparatus, the controller puts the second switch in the OFF state even if the other switch control signal indicates the ON state during the other predetermined period due to the occurrence of an undesirable logic level during the transition period of the switching operation. It is therefore possible to prevent the problem of a plurality of switches turning ON simultaneously, and thus the problem of unanticipated current flowing can be reliably prevented.

In this liquid ejection apparatus, the controller may put the second switch into the OFF state based on an other timing pulse that defines a switch timing of the other switch control signal.

With this liquid ejection apparatus, the timing at which the second switch is put into the OFF state can be matched with the timing at which switching of the other switch control signal occurs. Thus, the problem of an unanticipated current flowing can be reliably prevented.

In this liquid ejection apparatus, the controller may disable the other switch control signal at a timing of a forward edge of the other timing pulse, and may enable the other switch control signal at a timing of a rear edge of the other timing pulse.

With this liquid ejection apparatus, the second switch is controlled in accordance with the timing of the forward edge and the timing of the rear edge of the other timing pulse. Thus, the period during which the second switch is put in the OFF state can be reliably matched with the period during which switching of the other switch control signal takes places.

In this liquid ejection apparatus, the controller may disable the other switch control signal based on the other timing pulse, and may enable the other switch control signal after the other predetermined period has passed from when the disablement has been effected.

With this liquid ejection apparatus, the OFF time of the second switch can be determined independent of the duration of the other timing pulse, and this allows the OFF time to be optimized.

In this liquid ejection apparatus, the controller may comprise: an other gate circuit to which the other switch control signal and an other gate control signal are input, wherein if the other gate control signal is at a predetermined level, then the other gate circuit outputs the other switch control signal to the second switch, and if the other gate control signal is at an other predetermined level, then the other gate circuit outputs, to the second switch, an other OFF control signal for putting the second switch into the OFF state; and the controller may set the other gate control signal to the other predetermined level over a period during which the second switch is to be put into the OFF state.

With this liquid ejection apparatus, the configuration is such that the other gate circuit is controlled by the other gate control signal, and thus is suited for high-speed operation.

In this liquid ejection apparatus, it is preferable that the liquid is liquid ink for printing.

It is also possible to achieve a liquid ejection apparatus comprising: an element that can execute an operation for ejecting liquid ink for printing; a drive signal generation section that generates a first drive signal having a plurality of unit signals that define an operation of the element, and a second drive signal having a plurality of other unit signals that define an operation of the element; a first switch that controls application of the unit signals to the element based on a switch control signal; a second switch that controls application of the other unit signals to the element based on an other switch control signal; a controller including: a gate circuit to which the switch control signal and a gate control signal are input, wherein if the gate control signal is at a predetermined level, then the gate circuit outputs the switch control signal to the first switch, and if the gate control signal is at an other predetermined level, then the gate circuit outputs, to the first switch, an OFF control signal for putting the first switch into an OFF state; an other gate circuit to which the other switch control signal and an other gate control signal are input, wherein if the other gate control signal is at a predetermined level, then the other gate circuit outputs the other switch control signal to the second switch, and if the other gate control signal is at an other predetermined level, then the other gate circuit outputs, to the second switch, an other OFF control signal for putting the second switch into an OFF state; wherein, during a time from an end of generation of one, unit signal to a start of generation of a next unit signal, the controller forcibly puts the first switch into the OFF state over a predetermined period, regardless of the switch control signal, based on a timing pulse that defines a switch timing of the switch control signal by: disabling the switch control signal at a timing of a forward edge of the timing pulse by setting the gate control signal to the other predetermined level, and enabling the switch control signal at a timing of a rear edge of the timing pulse by setting the gate control signal to the predetermined level; or disabling the switch control signal based on the timing pulse by setting the gate control signal to the other predetermined level, and enabling the switch control signal by setting the gate control signal to the predetermined level after the predetermined period has passed from when the disablement has been effected, and wherein, during a time from an end of generation of one other unit signal to a start of generation of a next other unit signal, the controller forcibly puts the second switch into the OFF state over an other predetermined period, regardless of the other switch control signal, based on an other timing pulse that defines a switch timing of the other switch control signal by: disabling the other switch control signal at a timing of a forward edge of the other timing pulse by setting the other gate control signal to the other predetermined level, and enabling the other switch control signal at a timing of a rear edge of the other timing pulse by setting the other gate control signal to the predetermined level; or disabling the other switch control signal based on the other timing pulse by setting the other gate control signal to the other predetermined level, and enabling the other switch control signal by setting the other gate control signal to the predetermined level after the other predetermined period has passed from when the disablement has been effected.

This liquid ejection apparatus attains substantially all of the effects mentioned above, and thus can most effectively achieve the object of the invention.

It is also possible to realize a method of applying drive signals, comprising: a drive signal generation step of generating a first drive signal having a plurality of unit signals that define an operation of an element that can execute an operation for ejecting liquid, and a second drive signal having an other unit signal that defines an operation of the element; and a switch off step of forcibly putting a first switch into an OFF state for a predetermined period, during a time from an end of generation of one unit signal to a start of generation of a next unit signal.

It is also possible to realize a liquid ejection method comprising: a drive signal generation step of generating a first drive signal having a plurality of unit signals that define an operation of an element that can execute an operation for ejecting liquid, and a second drive signal having an other unit signal that defines an operation of the element; and a switch off step of forcibly putting a first switch into an OFF state for a predetermined period, during a time from an end of generation of one unit signal to a start of generation of a next unit signal.

It is also possible to achieve a liquid ejection apparatus comprising:

(A) a head having a plurality of elements each provided in correspondence with one of a plurality of nozzles that are for ejecting liquid droplets;

(B) a drive signal generation section that generates a first drive signal in which a plurality of waveform sections are repeated in a predetermined cycle, and a second drive signal that is different from the first drive signal and in which a plurality of waveform sections are repeated in the predetermined cycle;

(C) a memory that stores first drive-signal selection data for selecting one drive signal from among the first drive signal and the second drive signal in a particular period within the predetermined cycle, second drive-signal selection data for selecting one drive signal from among the first drive signal and the second drive signal in a separate period within the predetermined cycle, and waveform section selection data for selecting a predetermined waveform section from among the plurality of waveform sections; and (D) a controlling section that applies the waveform sections to the elements in order to drive the elements and cause an ejection of the liquid droplets from the nozzles, the controlling section, applying, in the particular period within the predetermined cycle, to the elements the waveform section that has been selected based on the waveform section selection data, from among the plurality of waveform sections included in the drive signal that has been selected based on the first drive-signal selection data, and applying, in the separate period within the predetermined cycle, to the elements the waveform section that has been selected based on the waveform section selection data, from among the plurality of waveform sections included in the drive signal that has been selected based on the second drive-signal selection data.

With this liquid ejection apparatus, it is possible to prevent the two drive signals from being applied to the elements simultaneously and also to switch the drive signal during a predetermined cycle.

In this liquid ejection apparatus, it is preferable that, in the particular period or in the separate period, the number of the waveform sections included in the first drive signal and the number of the waveform sections included in the second drive signal are different. In this way, it is possible to form liquid droplets of different sizes in the same period.

In this liquid ejection apparatus, it is preferable that, in the particular period or in the separate period, a period of one waveform section included in the first drive signal and a period of one waveform section included in the second drive signal are different. In this way, it is possible to form liquid droplets of different sizes in the same period.

In this liquid ejection apparatus, it is preferable that the controlling section includes a first switch for controlling application of the waveform sections included in the first drive signal to the elements, and a second switch for controlling application of the waveform sections included in the second drive signal to the elements; and, when one of the first switch and the second switch is in an ON state, the controlling section puts the other switch in an OFF state. It is also preferable that the controlling section puts the other switch in the OFF state based on the first drive-signal selection data or the second drive-signal selection data. In this way, it is possible to prevent both switches from entering the ON state simultaneously.

In this liquid ejection apparatus, it is preferable that the liquid ejection apparatus further comprises a carriage that can be moved with respect to a body of the apparatus, and a cable for transmitting signals from the body of the apparatus to the memory provided in/on the carriage; and the cable transmits the first drive signal, the second drive signal, and a setting signal for setting the first drive-signal selection data, the second drive-signal selection data, and the waveform section selection data to the memory. This configuration would have an environment in which the setting signal is easily affected by noise and in which errors are prone to occur in the settings of the waveform section selection data, for example. However, these would not become a problem because the switches are kept from both entering the ON state at the same time.

In this liquid ejection apparatus, it is preferable that the liquid ejection apparatus further comprises a carriage that can be moved with respect to a body of the apparatus, and a cable for transmitting signals from the body of the apparatus to the memory provided in/on the carriage; and the cable transmits the first drive signal, the second drive signal, and a clock signal for causing operation of the memory. This configuration would have an environment in which the clock signal is easily affected by noise and in which errors are prone to occur in the settings of the waveform section selection data, for example. However, these would not become a problem because the switches are kept from both entering the ON state at the same time.

In this liquid ejection apparatus, it is preferable that the elements are piezoelectric elements. In this configuration, noise is prone to occur at the periphery of the signal lines for the drive signals. However, these would not become a problem because the switches are kept from entering the ON state at the same time.

It is also possible to achieve a liquid ejection method comprising:

(A) a step of generating a first drive signal in which a plurality of waveform sections are repeated in a predetermined cycle, and a second drive signal that is different from the first drive signal and in which a plurality of waveform sections are repeated in the predetermined cycle;

(B) a step of storing first drive-signal selection data for selecting one drive signal from among the first drive signal and the second drive signal in a particular period within the predetermined cycle, second drive-signal selection data for selecting one drive signal from among the first drive signal and the second drive signal in a separate period within the predetermined cycle, and waveform section selection data for selecting a predetermined waveform section from among the plurality of waveform sections; and (C) a step of applying, in the particular period within the predetermined cycle, to an element the waveform section that has been selected based on the waveform section selection data, from among the plurality of waveform sections included in the drive signal that has been selected based on the first drive-signal selection data, applying, in the separate period within the predetermined cycle, to the element the waveform section that has been selected based on the waveform section selection data, from among the plurality of waveform sections included in the drive signal that has been selected based on the second drive-signal selection data, and driving the element by applying the waveform section to the element, to cause an ejection of a liquid droplet from a nozzle.

With this liquid ejection method, the two drive signals can be prevented from being applied to the element simultaneously, and also the drive signal can be switched during the predetermined cycle.

It is also possible to achieve a method of applying drive signals, comprising:

(A) a step of generating a first drive signal in which a plurality of waveform sections are repeated in a predetermined cycle, and a second drive signal that is different from the first drive signal and in which a plurality of waveform sections are repeated in the predetermined cycle;

(B) a step of storing first drive-signal selection data for selecting one drive signal from among the first drive signal and the second drive signal in a particular period within the predetermined cycle, second drive-signal selection data for selecting one drive signal from among the first drive signal and the second drive signal in a separate period within the predetermined cycle, and waveform section selection data for selecting a predetermined waveform section from among the plurality of waveform sections; and (C) a step of applying, in the particular period within the predetermined cycle, to an element the waveform section that has been selected based on the waveform section selection data, from among the plurality of waveform sections included in the drive signal that has been selected based on the first drive-signal selection data, and applying, in the separate period within the predetermined cycle, to the element the waveform section that has been selected based on the waveform section selection data, from among the plurality of waveform sections included in the drive signal that has been selected based on the second drive-signal selection data.

With this method of applying drive signals, the two drive signals can be prevented from being applied to the element simultaneously, and also the drive signal can be switched during the predetermined cycle.

(1) First Embodiment

===(1) Target of the Description===

<(1) Liquid Ejection Apparatus>

A variety of apparatuses fall within the scope of liquid ejection apparatuses, including printing apparatuses, color filter manufacturing apparatuses, display manufacturing apparatuses, semiconductor manufacturing apparatuses, and DNA chip manufacturing apparatuses, and to include all of these in the following description would be difficult. Accordingly, this specification is described with respect to a printer that serves as a printing apparatus and a printing system that includes this printer as examples. It should be noted that the printing system is a system that has at least a printing apparatus and a print control apparatus that controls the operation of this printing apparatus, and corresponds to an implementation of a liquid ejection system that has a liquid ejection apparatus and an ejection control apparatus.

===(1) Configuration of the Printing System===

<(1) Overall Configuration>

First, a printing apparatus will be described along with a printing system 100. Here, FIG. 1 is a diagram that illustrates the configuration of the printing system 100. This illustrative printing system 100 shown here includes a printer 1 as a printing apparatus and a computer 110 as a print control apparatus. Specifically, the printing system 100 includes the printer 1, the computer 110, a display device 120, an input device 130, and a record/play device 140.

The printer 1 prints images on media such as paper, cloth, and film. It should be noted that in the following description, a paper S (see FIG. 3A), which is a representative medium, serves as an illustrative example of such media. The computer 110 is communicably connected to the printer 1. In order to make the printer 1 print an image, the computer 110 outputs print data corresponding to that image to the printer 1. Computer programs such as an application program and a printer driver are installed on the computer 110. The display device 120 has a display. The display device 120 is for example a device for displaying a user interface of the computer programs. The input device 130 is for example a keyboard 131 and a mouse 132. The record/play device 140 is for example a flexible disk drive device 141 and a CD-ROM drive device 142.

===(1) Computer===

<(1) Configuration of the Computer 110>

Figure 2:
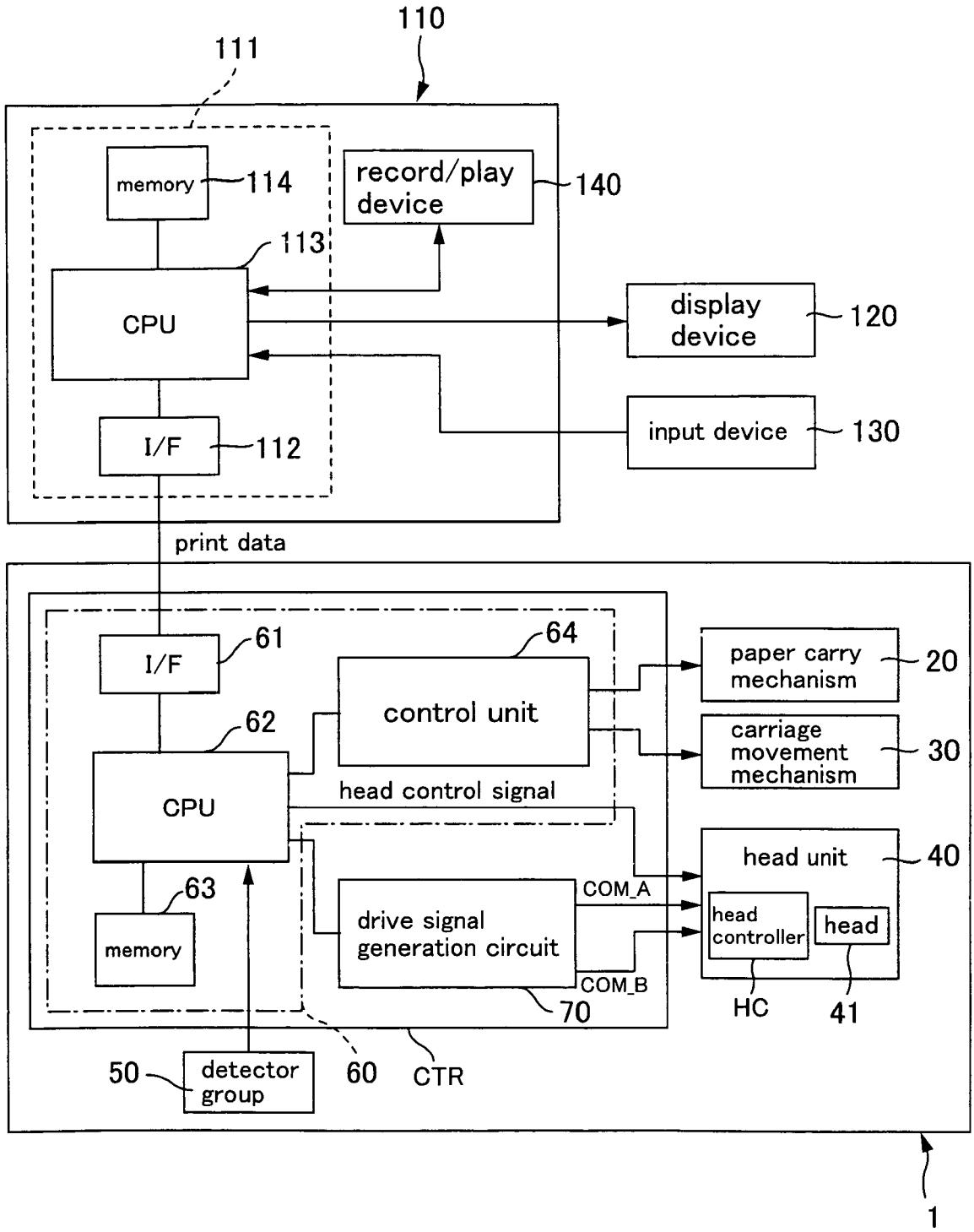
FIG. 2 is a block diagram for describing a configuration of a computer and a printer.

FIG. 2 is a block diagram that describes the configuration of the computer 110 and the printer 1. First, the configuration of the computer 110 is described in brief. The computer 110 has the record/play device 140 described above and a host-side controller 111. The record/play device 140 is communicably connected to the host-side controller 111, and for example is attached to the housing of the computer 110. The host-side controller 111 performs various controls in the computer 110, and is also communicably connected to the display device 120 and the input device 130 mentioned above. The host-side controller 111 has an interface section 112, a CPU 113, and a memory 114. The interface section 112 is interposed between the computer 110 and the printer 1, and sends and receives data between the two. The CPU 113 is a computation processing device for performing the overall control of the computer 110. The memory 114 is for reserving a working area and an area for storing computer programs used by the CPU 113, and is constituted by a RAM, EEPROM, ROM, or magnetic disk device, for example. Examples of computer programs that are stored on the memory 114 include the application program and printer driver mentioned above. The CPU 113 performs various controls in accordance with the computer programs stored on the memory 114.

Figure 6:
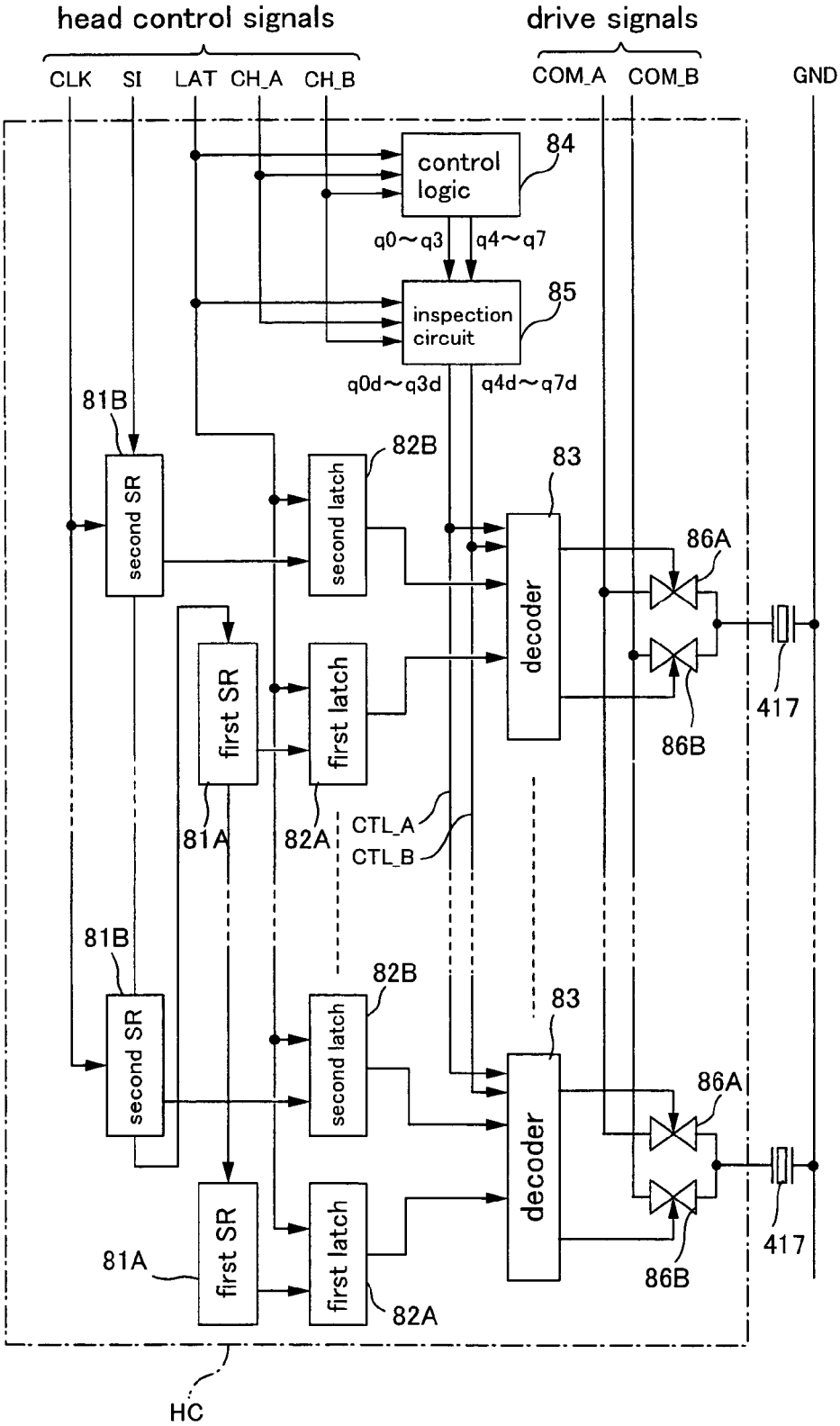
FIG. 6 is a block diagram for describing a configuration of a head controller.

The print data are data in a form that can be interpreted by the printer 1, and include various command data and pixel data SI (see FIG. 6, etc.). Command data are data for ordering the printer 1 to execute a specific operation. Among the command data are command data that order the supply of paper, command data that indicate a carry amount, and command data that order the discharge of paper. The pixel data SI are data relating to the pixels of the image to be printed. Here, the pixels are matrix-like squares virtually set on the paper S, and indicate a region in which a dot is to be formed. The pixel data SI in the print data are also data relating to the dots to be formed on the paper S (for example, the gradation values). In this embodiment, the pixel data SI are each made of two bits of data. That is, the pixel data SI are a data value [00] corresponding to no dot, a data value [01] corresponding to a small dot, a data value [10] corresponding to the formation of a medium dot, or a data value [11] corresponding to a large dot. The printer 1 can thus form dots at four gradation levels.

===(1) Printer===

<(1) Configuration of the Printer 1>

Figure 3A:
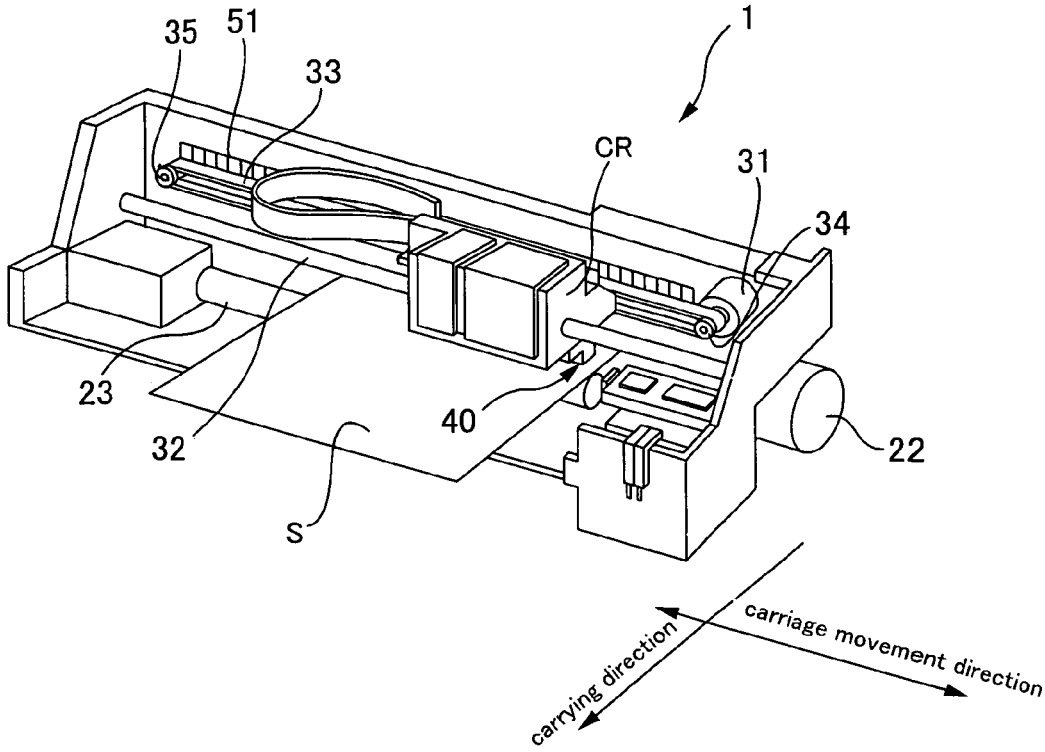
FIG. 3A is a diagram showing the configuration of the printer.
Figure 3B:
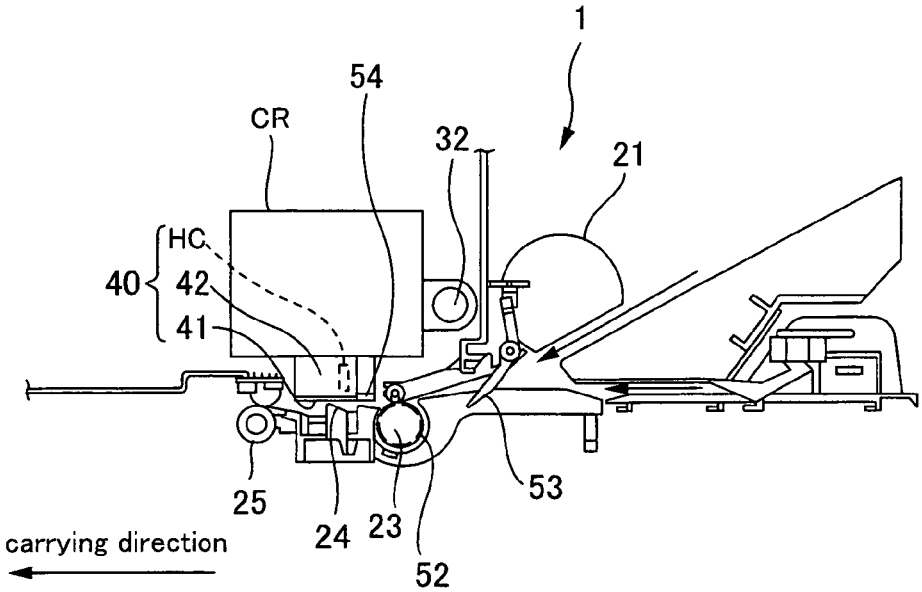
FIG. 3B is a lateral view illustrating the configuration of the printer.

The configuration of the printer 1 is described next. Here, FIG. 3A is a diagram that shows the configuration of the printer 1 of the embodiment, and FIG. 3B is a lateral view illustrating the configuration of the printer 1 of the embodiment. It should be noted that FIG. 2 also is referred to in the following description.

As shown in FIG. 2, the printer 1 has a paper carry mechanism 20, a carriage movement mechanism 30, a head unit 40, a detector group 50, a printer-side controller 60, and a drive signal generation circuit 70. It should be noted that in this embodiment the printer-side controller 60 and the drive signal generation circuit 70 are provided in a common controller board CTR. Also, the head unit 40 has a head controller HC and a head 41.

In the printer 1, the printer-side controller 60 controls the control targets, that is, the paper carry mechanism 20, the carriage movement mechanism 30, the head unit 40 (the head controller HC and the head 41), and the drive signal generation circuit 70. Thus, the printer-side controller 60 causes an image to be printed on a paper S based on the print data obtained from the computer 110. The detectors of the detector group 50 monitor conditions within the printer 1. The detectors output the result of this detection to the printer-side controller 60. The printer-side controller 60 receives the detection results from the detectors and controls the control targets based on those detection results.

<(1) Paper Carry Mechanism 20>

The paper carry mechanism 20 corresponds to the medium carry section for carrying media. The paper carry mechanism 20 feeds the paper S up to a printable position, as well as carries the paper S by a predetermined carry amount in the carrying direction. The carrying direction is a direction that intersects the carriage movement direction described below. As shown in FIG. 3A and FIG. 3B, the paper carry mechanism 20 has a paper feed roller 21, a carry motor 22, a carry roller 23, a platen 24, and a discharge roller 25. The paper feed roller 21 is a roller for automatically delivering a paper S that has been inserted into a paper insertion opening into the printer 1, and in this example has a cross-sectional shape that resembles the letter D. The carry motor 22 is a motor for carrying the paper S in the carrying direction, and its operation is controlled by the printer-side controller 60. The carry roller 23 is a roller for carrying the paper S that has been delivered by the paper feed roller 21 up to a printable region. The operation of the carry roller 23 also is controlled by the carry motor 22. The platen 24 is a member that supports the paper S from below during printing. The discharge roller 25 is a roller for carrying the paper S for which printing has ended.

<(1) Carriage Movement Mechanism 30>

The carriage movement mechanism 30 is for moving a carriage CR, to which the head unit 40 is attached, in a carriage movement direction. The carriage movement direction includes the direction of movement from one side to the other side and the direction of movement from that other side to the one side. It should be noted that because the head unit 40 includes the head 41, the carriage movement direction corresponds to the movement direction of the head 41, and the carriage movement mechanism 30 corresponds to a head movement section that moves the head 41 in the movement direction. The carriage movement mechanism 30 has a carriage motor 31, a guide shaft 32, a timing belt 33, a drive pulley 34, and a driven pulley 35. The carriage motor 31 corresponds to the drive source for moving the carriage CR. The operation of the carriage motor 31 is controlled by the printer-side controller 60. The drive pulley 34 is attached to the rotation shaft of the carriage motor 31, and is disposed on one end side in the carriage movement direction. The driven pulley 35 is disposed on the other end side in the carriage movement direction on the side opposite from the drive pulley 34. The timing belt 33 is connected to the carriage CR and is engaged between the drive pulley 34 and the driven pulley 35. The guide shaft 32 supports the carriage CR in a manner that permits movement thereof. The guide shaft 32 is attached in the carriage movement direction. Thus, operation of the carriage motor 31 causes the carriage CR to move in the carriage movement direction along the guide shaft 32.

<(1) Head Unit 40>

The head unit 40 is for ejecting ink toward the paper S. The head unit 40 is attached to the carriage CR. The head 41 of the head unit 40 is provided on the lower surface of a head case 42, and the head controller HC of the head unit 40 is provided within the head case 42. It should be noted that the head controller HC is described in greater detail later.

Figure 4:
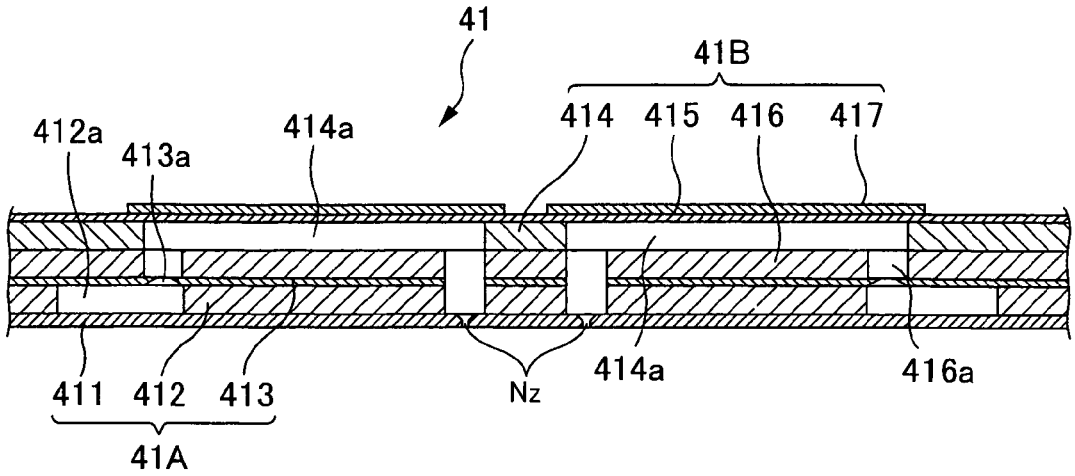
FIG. 4 is a cross-sectional view for describing a structure of a head.

The structure of the head 41 is described next. Here, FIG. 4 is a cross-sectional diagram for describing the structure of the head 41. The illustrative head 41 shown here has a channel unit 41A and an actuator unit 41B. The channel unit 41A has a nozzle plate 411 in which nozzles Nz are provided, a storage chamber formation substrate 412 in which open portions that become ink storage chambers 412*a* are formed, and a supply opening formation substrate 413 in which ink supply openings 413*a* are formed. The actuator unit 41B has a pressure chamber formation substrate 414 in which open portions that become pressure chambers 414*a* are formed, a vibration plate 415 that defines a portion of the pressure chambers 414*a*, a lid member 416 in which open portions that become supply-side communication openings 416*a* are formed, and piezo elements 417 formed on the surface of the vibration plate 415. A series of channels leading from the ink storage chambers 412*a* to the nozzles Nz through the pressure chambers 414*a* are formed in the head 41. At the time of use, the channels become filled with ink, and by deforming the piezo elements 417, ink can be ejected from the corresponding nozzles Nz.

Thus, in the head 41, the piezo elements 417 correspond to the elements that can execute an operation for ejecting ink.

With the printer 1, as discussed above, four types of control are possible, these being no dot formation corresponding to pixel data SI having a data value [00], formation of a small dot corresponding to the data value [01], formation of a medium dot corresponding to the data value [10], and formation of a large dot corresponding to the data value [11]. Thus, it is possible to eject a plurality of types of ink in differing quantities from the nozzles Nz. For example, from each nozzle Nz it is possible to eject three different ink types, these being a large ink droplet of a quantity that allows the formation of a large dot, a medium ink droplet of a quantity that allows the formation of a medium dot, and a small ink droplet of a quantity that allows the formation of a small dot.

<(1) Detector Group 50>

The detector group 50 is for monitoring the conditions within the printer 1. As shown in FIG. 3A and FIG. 3B, the detector group 50 includes a linear encoder 51, a rotary encoder 52, a paper detector 53, and a paper width detector 54. The linear encoder 51 is for detecting the position of the carriage CR (head 41, nozzles Nz) in the carriage movement direction. The rotary encoder 52 is for detecting the amount of rotation of the carry roller 23. The paper detector 53 is for detecting the position of the front end of the paper S being printed. The paper width detector 54 is for detecting the width of the paper S being printed.

<(1) Printer-Side Controller 60>

The printer-side controller 60 performs control of the printer 1. As shown in FIG. 2, the printer-side controller 60 has an interface section 61, a CPU 62, a memory 63, and a control unit 64. The interface section 61 sends and receives data to and from the computer 110, which is an external device. The CPU 62 is a computation processing device for performing the overall control of the printer 1. The memory 63 is for reserving a working area and an area for storing the programs of the CPU 62, and is constituted by a storage element such as a RAM, EEPROM, or ROM. The CPU 62 controls the control targets in accordance with computer programs stored on the memory 63. For example, the CPU 62 controls the paper carry mechanism 20 and the carriage movement mechanism 30 via the control unit 64.

The CPU 62 also outputs head control signals for controlling the operation of the head 41 to the head controller HC and outputs control signals for causing the generation of drive signals COM to the drive signal generation circuit 70. The head control signals, as shown for example in FIG. 6, are a transfer clock CLK, pixel data SI, a latch signal LAT, a fist change signal CH_A, and a second change signal CH_B. The control signal for causing the generation of a drive signal COM is for example a DAC value. The DAC value is information for indicating a voltage of the signal output from a first drive signal generation section 70A and a second drive signal generation section 70B (see FIG. 5) of the drive signal generation circuit 70, and is updated at a very short update cycle. The DAC value is also a type of generation information for causing the generation of a drive signal COM.

<(1) Drive Signal Generation Circuit 70>

Figure 5:
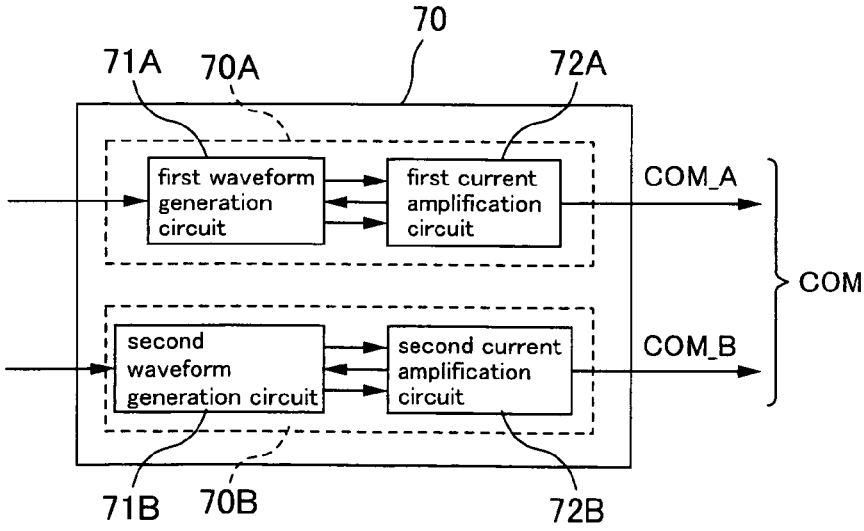
FIG. 5 is a block diagram that illustrates a configuration of a drive signal generation circuit.

The drive signal generation circuit 70 is for generating drive signals COM that are used in common, and corresponds to the drive signal generation section. The drive signals COM in this embodiment are used in common for all of the piezo elements 417 corresponding to a single nozzle row. Here, FIG. 5 is a block diagram illustrating the configuration of the drive signal generation circuit 70. The drive signal generation circuit 70 is capable of simultaneously generating a plurality of types of drive signals COM. The drive signal generation circuit 70 of this embodiment has a first drive signal generation section 70A that generates a first drive signal COM_A and a second drive signal generation section 70B that generates a second drive signal COM_B. The first drive signal generation section 70A has a first waveform generation circuit 71A that outputs a signal having a voltage that corresponds to the DAC value (generation information), and a first current amplification circuit 72A that amplifies the current of the signal that is generated by the first waveform generation circuit 71A. The second drive signal generation section 70B has a second waveform generation circuit 71B and a second current amplification circuit 72B. It should be noted that the first waveform generation circuit 71A and the second waveform generation circuit 71B have the same structure, and that the first current amplification circuit 72A and the second current amplification circuit 72B have the same structure.

<(1) Regarding the Generated Drive Signals COM>

Figure 9:
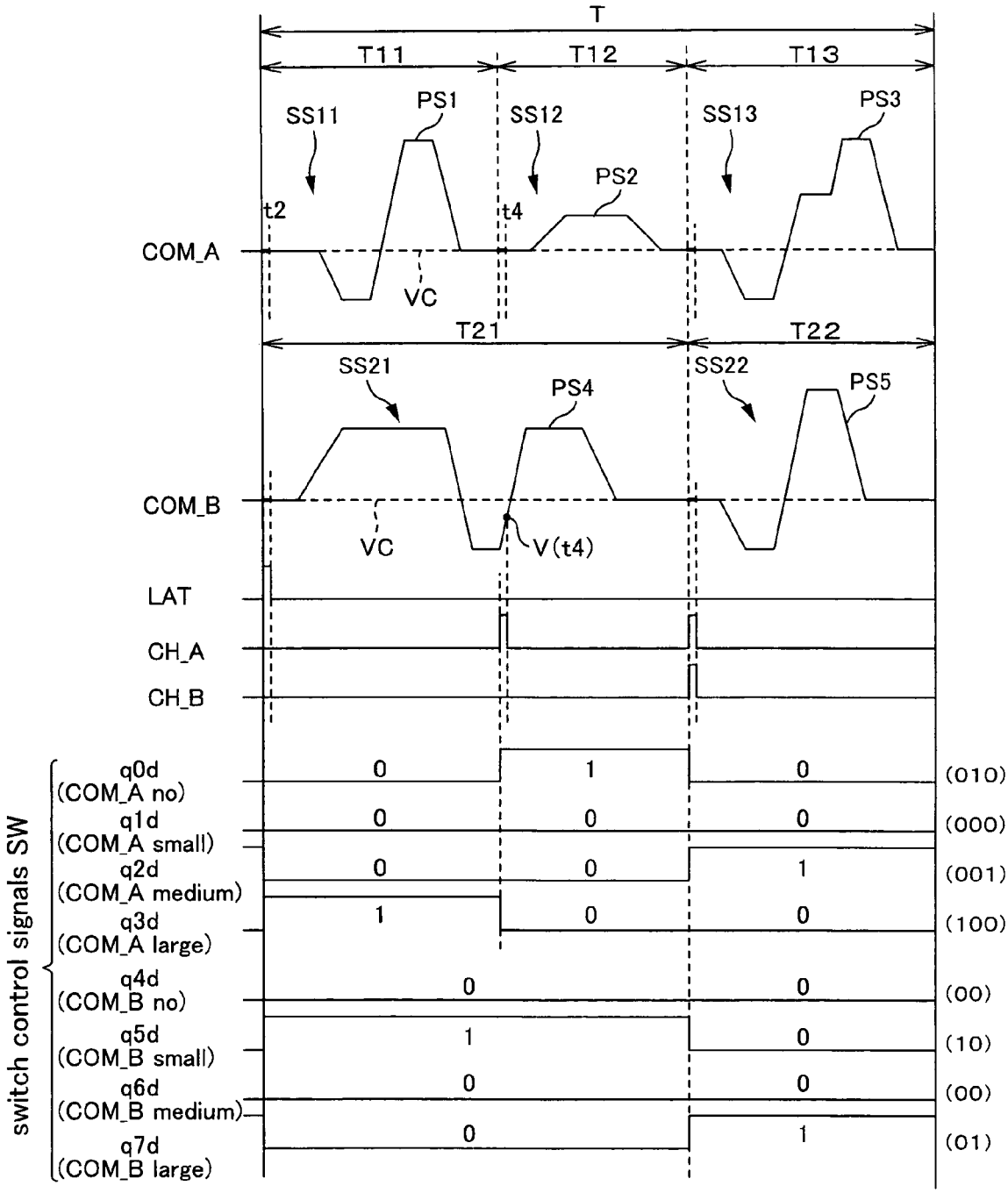
FIG. 9 is a diagram that describes a first drive signal, a second drive signal, and necessary control signals.

The drive signals COM that are generated by the drive signal generation circuit 70 are described next. The drive signal generation circuit 70 that is illustratively shown here generates a first drive signal COM_A and a second drive signal COM_B, which are shown in FIG. 9. That is, the first waveform generation circuit 70A generates the first drive signal COM_A based on a first DAC value (this corresponds to the first generation information). Similarly, the second waveform generation section 70B generates the second drive signal COM_B based on a second DAC value (this corresponds to the second generation information).

The first drive signal COM_A has a first waveform section SS11 that is generated during a period T11 of a repeating cycle T, a second waveform section SS12 that is generated in a period T12, and a third waveform section SS13 that is generated in a period T13. Here, the first waveform section SS11 has a drive pulse PS1. Similarly, the second waveform section SS12 has a drive pulse PS2 and the third waveform section SS13 has a drive pulse PS3. The drive pulse PS1 is applied to the piezo elements 417 when a large dot is to be formed. That is, the drive pulse PS1 defines the period from the start until the finish of the ink ejection operation when a large dot is to be formed. The drive pulse PS2 is a micro-vibration pulse for causing slight vibration of the meniscus, and is applied to the piezo elements 417 when no dots are to be formed. The drive pulse PS3 is applied to the piezo elements 417 when a medium dot is to be formed. The drive pulse PS3 defines the period from the start until the finish of the ink ejection operation when a medium dot is to be formed. By applying the drive pulse PS3 to the piezo elements 417, medium-sized ink droplets are ejected from the head 41 (the corresponding nozzles Nz).

The second drive signal COM_B has a first waveform section SS21 that is generated in a period T21, and a second waveform section SS22 that is generated in a period T22. In the second drive signal COM_B, the first waveform section SS21 has a drive pulse PS4 and the second waveform section SS22 has a drive pulse PS5. Here, the drive pulse PS4 is applied to the piezo elements 417 when a small dot is to be formed. By applying the drive pulse PS4 to the piezo elements 417, small-sized ink droplets are ejected from the head 41. The drive pulse PS4 therefore defines the period from the start until the finish of the operation for ejecting ink when a small dot is to be formed. The drive pulse PS5 is applied to the piezo elements 417 when a large dot is to be formed. That is, the drive pulse PS5 also defines the period from the start until the finish of the operation for ejecting ink when a large dot is to be formed. In this embodiment, the period T22 has the same start timing and length as the period T13 in the first drive signal COM_A. In other words, the combined length of the period T11 and the period T12 of the first drive signal COM_A is the same as, the length of the period T21 of the second drive signal COM_B.

Each of these drive pulses PS1 to PS5 defines an operation of the piezo elements 417. Of the drive pulses PS1 to PS5, the drive pulses PS1 to PS3 of the first drive signal COM_A correspond to a group of unit signals. The drive pulses PS4 and PS5 of the second drive signal COM_B correspond to a group of other unit signals.

The first drive signal COM_A and the second drive signal COM_B can be applied to the piezo elements 417 per each waveform section. That is, a portion of the first drive signal COM_A or the second drive signal COM_B can be selectively applied to the piezo elements 417. It is also possible to combine a portion of the first drive signal COM_A and a portion of the second drive signal COM_B and apply this to the piezo elements 417. In this example, at the start timing of the repeating cycle T (the timing at which the latch pulse of the latch signal LAT occurs), it is possible to select whether or not to apply the first waveform section SS11 of the first drive signal COM_A or the first waveform section SS21 of the second drive signal COM_B to the piezo elements 417. Further, at the timing of the first change pulse of the first change signal CH_A, it is possible to select whether or not to apply the second waveform section of the first drive signal COM_A to the piezo elements 417.

Here, when a large dot is to be formed, the drive pulse PS1 is output from the first drive signal COM_A and the drive pulse PS5 is output from the second drive signal COM_B, and this has the following advantages. During high-density printing in which a large amount of ink is ejected, the number of ink ejections is large and a large amount of heat is generated by the drive signal generation circuits. Furthermore, large dots are frequently used when making high-density prints. In this embodiment, the two large dot pulses in the repeating cycle T are split between the first drive signal generation section 70A and the second drive signal generation section 70B, and thus when performing high-density printing, the concentration of heat in one of the drive signal generation sections can be avoided, thereby allowing for a simple thermal design.

As described above, the waveform sections are the single units (application units) that are applied to the piezo elements 417. Additionally, the first waveform section SS11, the second waveform section SS12, and the third waveform section SS13 of the first drive signal COM_A constitute a waveform section group and the first waveform section SS21 and the second waveform section SS22 of the second drive signal COM_B constitute another waveform section group. It should be noted that the control for applying these waveform sections to the piezo elements 417 is described in greater detail later.

<(1) Head Controller HC>

Figure 7:
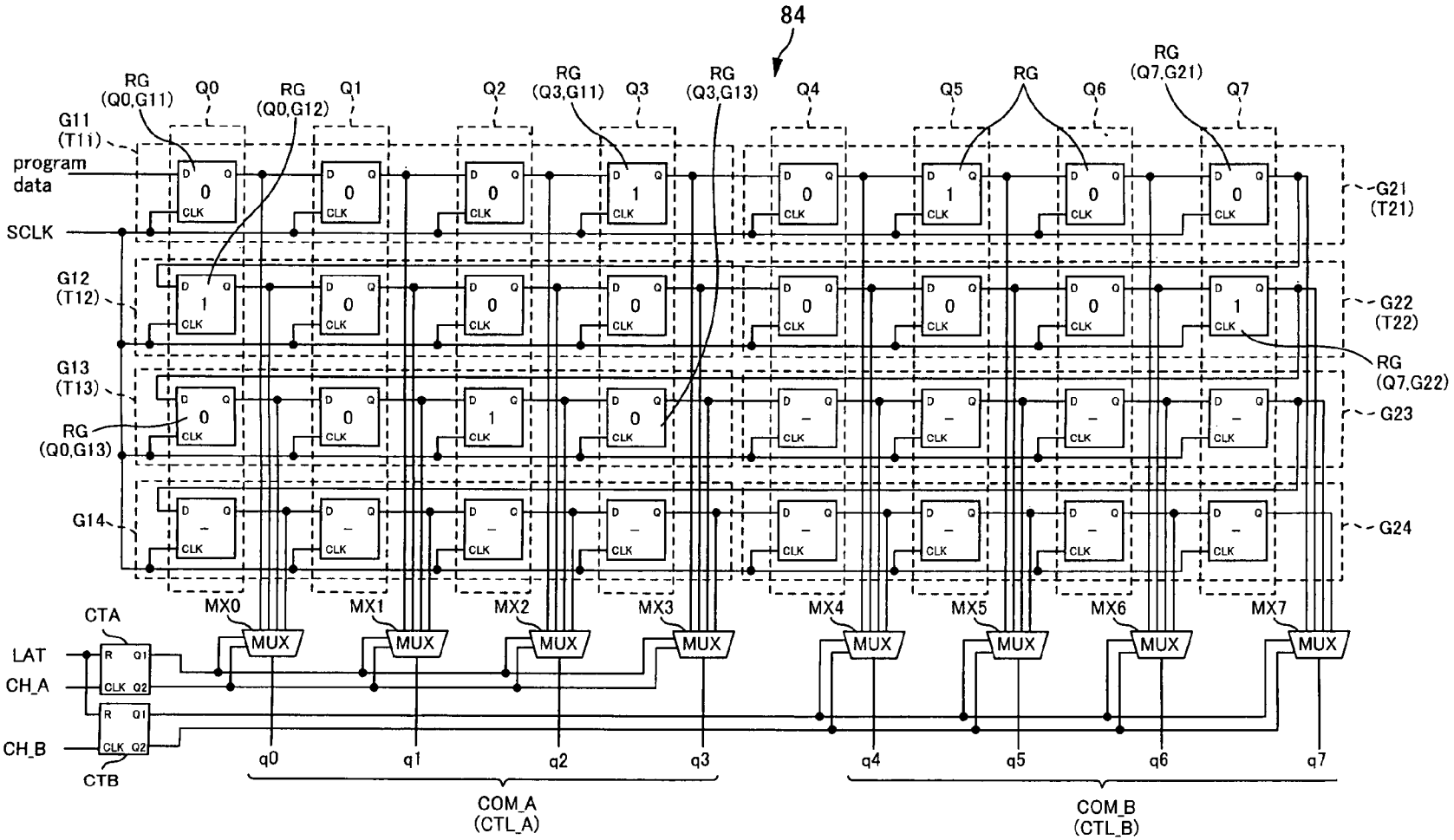
FIG. 7 is an explanatory diagram of a control logic.
Figure 8:
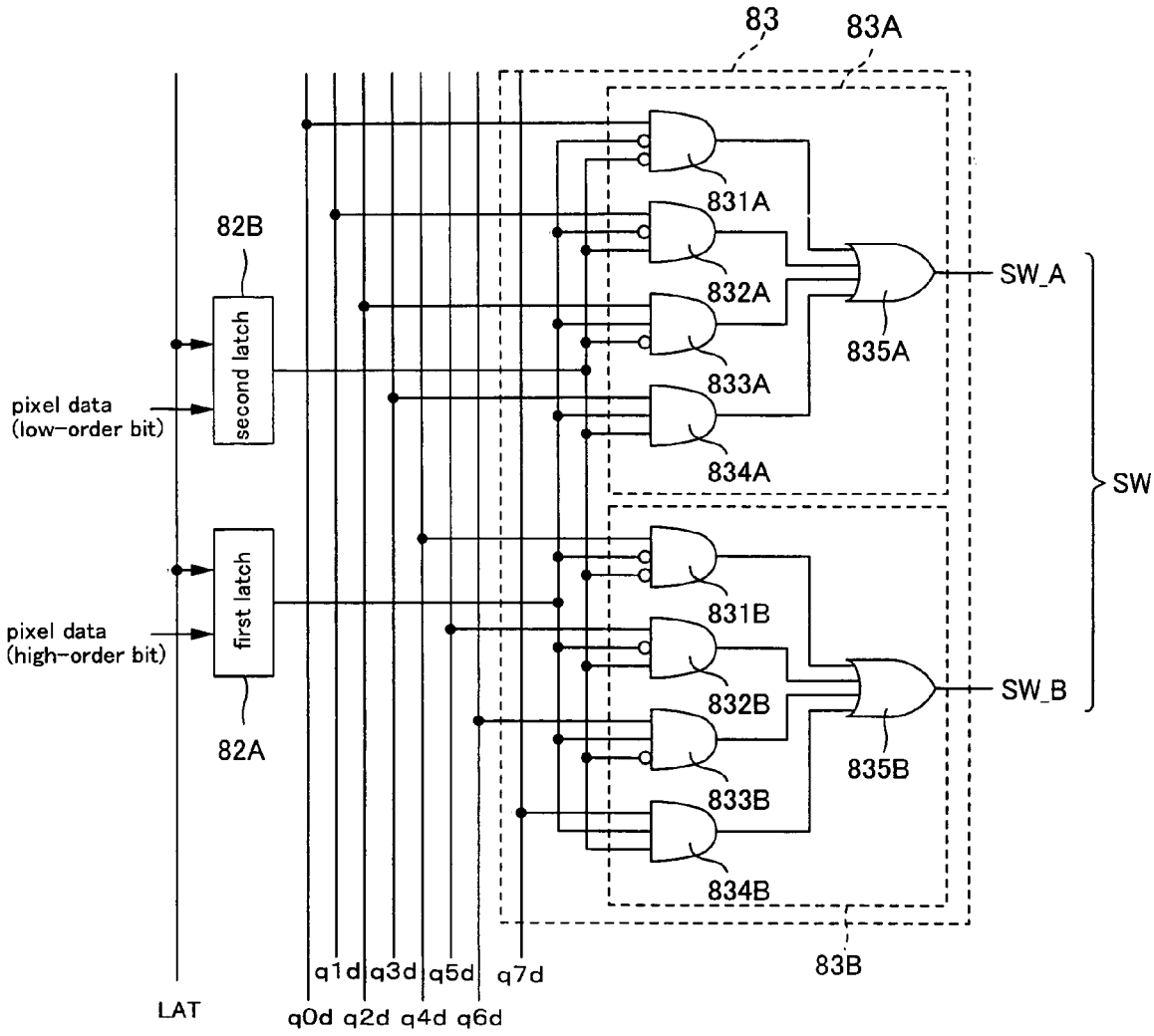
FIG. 8 is an explanatory diagram of a decoder.

The head controller HC is described next. Here, FIG. 6 is a block diagram that describes the configuration of the head controller HC. FIG. 7 is an explanatory diagram of a control logic. FIG. 8 is an explanatory diagram of a decoder.

As shown in FIG. 6, the head controller HC is provided with a first shift register 81A, a second shift register 81B, a first latch circuit 82A, a second latch circuit 82B, a decoder 83, a control logic 84, an inspection circuit 85, a first switch 86A, and a second switch 86B. Each of the sections other than the control logic 84 and the inspection circuit 85 (that is, the first shift register 81A, the second shift register 81B, the first latch circuit 82A, the second latch circuit 82B, the decoder 83, the first switch 86A, and the second switch 86B) is provided for each one of the piezo elements 417. The pair of the first switch 86A and the second switch 86B provided for the same piezo element 417 correspond to a switch section. Because a piezo element 417 is provided for each nozzle Nz from which ink is ejected, each of these sections is provided for each nozzle Nz.

The head controller HC performs control for ejecting ink based on the pixel data SI from the printer-side controller 60. That is, the head controller HC controls the first switches 86A and the second switches 86B based on print data and causes the necessary sections of the first drive signal COM_A and the second drive signal COM_B to be selectively applied to the piezo elements 417. In this embodiment, each pixel data SI is made of two bits. Further, the pixel data SI are delivered to the recording head 41 in synchronization with the transfer clock CLK. The high-order bit group of the pixel data SI is set in the first shift registers 81A, and the low-order bit group is set in the second shift registers 81B. The first shift registers 81A are electrically connected to the first latch circuits 82A, and the second shift registers 81B are electrically connected to the second latch circuits 82B. When the latch signal LAT from the printer-side controller 60 becomes the high (H) level, then the first latch circuit 82A latches the high-order bit of the corresponding pixel data SI and the second latch circuit 82B latches the low-order bit of the pixel data SI. Each pixel data SI that has been latched by the first latch circuit 82A and the second latch circuit 82B (the pair of the high-order bit and the low-order bit) is input to the decoder 83.

The decoder 83 performs a decoding operation based on the high-order bit and the low-order bit of the pixel data SI, and outputs switch control signals SW (first switch control signal SW_A and second switch control signal SW_B; see FIG. 8) for controlling the first switch 86A and the second switch 86B. The switch control signals SW are output based on the combination of the inspected selection data q0*d* through q7*d* that have been inspected by the inspection circuit 85, and the pixel data SI that has been latched by the first latch circuit 82A and the second latch circuit 82B. Here, the inspected selection data q0*d* through q7*d* are obtained by the inspection circuit 85 inspecting the selection data q0 through q7 stored on the control logic 84. Simply put, the inspection circuit 85 inspects the first selection data q0 through q3 for the first drive signal COM_A and the second selection data q4 through q7 for the second drive signal COM_B. If the first selection data q0 through q3 and the second selection data q4 through q7 are normal, then the first selection data q0 through q3 and the second selection data q4 through q7 are output as the inspected first selection data q0*d* through q3*d* and inspected second selection data q4*d* through q7*d*. On the other hand, if the first selection data q0 through q3 and the second selection data q4 through q7 are abnormal, that is, if they indicate that the first drive signal COM_A and the second drive signal COM_B are to be applied to the piezo element 417 simultaneously, then the inspected first selection data q0*d* through q3*d* and the inspected second selection data q4*d* through q7*d* that were output until then continue to be output. It should be noted that the inspection circuit 85, and the relationship between the selection data q0 through q7 and the inspected selection data q0*d* through q7*d*, are described in detail later.

The control logic 84 and the selection data q0 through q7 stored on the control logic 84 are described next. As shown in FIG. 7, the control logic 84 has a plurality of registers RG each capable of storing one bit of data. Each register RG is constituted by a D-FF (delay flip flop) circuit or the like. Each register RG stores predetermined selection data. The selection data are continually updated at a predetermined timing. For example, the data are updated during the period from the output timing of one latch pulse until the output timing of the next latch pulse. It should be noted that in this embodiment, the content of the selection data is the same in each repeating cycle T. Thus, selection data having the same contents are set repeatedly. The contents of the selection data is changed if the print mode is changed, for example.

For the sake of simplifying the description, in FIG. 7 the registers RG are disposed in a matrix of four registers in the column direction (vertical direction) and eight registers in the row direction (horizontal direction). The four registers RG belonging to the same column are grouped together, and starting from the group on the left are assigned numbers Q0 through Q7. The registers RG are divided between register groups located on the left side in the row direction (groups Q0 to Q3) and register groups located on the right side in the row direction (groups Q4 to Q7). Regarding the register groups located on the left side, the four registers RG belonging to the same row are grouped together and assigned numbers G11 to G14 in order from the group located at the top. Likewise, regarding the register groups located on the right side, the four registers belonging to the same row are grouped together and assigned numbers G21 to G24 in order from the group located at the top.

The above groupings are made based on the role of the registers RG. First, the registers RG belonging to the groups Q0 to Q3 located on the left side in the row direction are capable of storing first selection data q0 to q3 for the first drive signal COM_A. Similarly, the registers RG belonging to the four groups Q4 to Q7 located on the right side in the row direction are capable of storing second selection data q4 to q7 for the second drive signal COM_B. Furthermore, the registers RG belonging to the same column can store selection data used for the same gradation value. To describe this more specifically, the registers RG belonging to the group Q0 and the group Q4 are capable of storing selection data q0 and q4, respectively, which correspond to the pixel data SI for no dot formation (data value [00]). The registers RG belonging to the group Q1 and the group Q5 are capable of storing selection data q1 and q5, respectively, which correspond to the pixel data SI for a small dot (data value [01]). Similarly, the registers RG belonging to the group Q2 and the group Q6 are capable of storing selection data q2 and q6, respectively, which correspond to the pixel data SI for a medium dot (data value [10]), and the registers RG belonging to the group Q3 and the group Q7 are capable of storing selection data q3 and q7, respectively, which correspond to the pixel data SI for a large dot (data value [11]).

Further, the registers RG belonging to the same row can store selection data of the same waveform section. More specifically, the registers RG belonging to the group G11 can store selection data for the first waveform section SS11, which is generated in the period T11. Likewise, the registers RG belonging to the group G12 can store selection data for the second waveform section SS12, which is generated in the period T12. Furthermore, the registers RG belonging to the group G13 can store selection data for the third waveform section SS13, which is generated in the period T13. It should be noted that the registers RG belonging to the group G14 are not used in this embodiment. In a case where the first drive signal COM_A is made of four waveform sections, then the registers RG of this group G14 store the selection data for a fourth waveform section. On the other hand, the registers RG belonging to the group G21 store the selection data for the first waveform section SS21, which is generated in period T21, and the registers RG belonging to the group G22 store the selection data for the second waveform section SS22, which is generated in period T22. In this embodiment, the registers RG belonging to the group G23 and the registers RG belonging to the group G24 are not used.

To summarize the above, the registers RG of the control logic 84 can be said to store selection data determined by factors including the type of the corresponding drive signal COM (first drive signal COM_A, second drive signal COM_B), the corresponding pixel data SI (data value [00] through data value [11]), and the corresponding waveform section (for example, first waveform section SS11 or second waveform section SS22). For example, the register RG (Q0, G11) belonging to both group Q0 and group G11 stores the selection data corresponding to the first waveform section SS11 of the first drive signal COM_A in pixel data SI for no dot formation (data value [00]). The register RG (Q3, G13) belonging to both group Q3 and group G13 stores selection data corresponding to the third waveform section SS13 of the first drive signal COM_A in pixel data SI for a large dot (data value [11]). Similarly, the register RG (Q7, G22) belonging to both group Q7 and group G22 stores selection data corresponding to the second waveform section SS22 of the second drive signal COM_B in pixel data SI for a large dot.

Due to multiplexers MX0 through MX7, the selection data stored on the registers RG are sequentially selected at a timing defined by the latch pulse of the latch signal LAT, the change pulse of the first change signal CH_A, and the change pulse of the second change signal CH_B. That is, the timing defined by these pulses corresponds to the switch timing of the waveform data. Here, the latch pulse and the change pulses are input unchanged (without being inverted) to counters CTA and CTB that generate signals instructing how the multiplexers MX0 to MX7 should perform selection. In addition, the multiplexers MX0 to MX7 operate at the positive edge of the pulses (the edge where the voltage rises from the low (L) level to the high (H) level) in accordance with the output of the counters CTA and CTB. Thus, the multiplexers MX0 to MX7 update the selection data at the timing of the forward edge of the latch pulse and the change pulses. The selection data that have been selected by the multiplexers MX0 to MX7 are then output through the control signal line groups CTL_A and CTL_B as first selection data q0 to q3 for the first drive signal COM_A and second selection data q4 to q7 for the second drive signal COM_B.

Here, the first selection data q0 are selection data corresponding to the gradation value for no dot. The first selection data q1 are selection data corresponding to the gradation value for a small dot. Likewise, the first selection data q2 are selection data corresponding to the gradation value for a medium dot, and the first selection data q3 are selection data corresponding to the gradation value for a large dot. On the other hand, the second selection data q4 are selection data corresponding to the gradation value for no dot, and the second selection data q5 are selection data corresponding to the gradation value for a small dot. Further, the second selection data q6 are selection data corresponding to the gradation value for a medium dot, and the second selection data q7 are selection data corresponding to the gradation value for a large dot. The amount of ink that is ejected differs for no-dot formation, a small dot, a medium dot, and a large dot. Thus, the gradation value can be regarded as information that expresses the amount of ink that is to be ejected. The first selection data q0 to q3 and the second selection data q4 to q7 thus can be regarded as having a plurality of types of data that are classified based on the ejection amount of ink.

The decoder 83 is described next. The decoder 83 selects the inspected selection data, from among the inspected first selection data q0*d* to q3*d* and the inspected second selection data q4*d* to q7*d*, that correspond to the pixel data SI that have been latched, and outputs these as a switch control signal SW. The decoder 83 has a first decoding section 83A that outputs a first switch control signal SW_A and a second decoding section 83B that outputs a second switch control signal SW_B.

The first decoding section 83A has four AND gates 831A to 834A, and a single OR gate 835A. Each AND gate 831A to 834A has three input terminals and one output terminal, and receives, as its input, one of the inspected selection data from among the inspected first selection data q0*d* to q3*d*, the high-order bit data of the pixel data SI, and the low-order bit data of the pixel data SI. The AND gates 831A to 834A differ in the manner in which they receive the high-order bit data and the low-order bit data of the pixel data SI. That is, the AND gate 831A receives, as its input, the inspected first selection data q0*d* for no-dot formation, the inverted data of the high-order bit, and the inverted data of the low-order bit of the pixel data SI. Thus, if the pixel data SI are the data value [00], then the output from the AND gate 831A is in accordance with the inspected first selection data q0*d* for no-dot formation. The AND gate 832A receives, as its input, the inspected first selection data q1*d* for a small dot, the inverted data of the high-order bit, and the data of the low-order bit of the pixel data SI. Thus, if the pixel data SI are the data value [01], then the output from the AND gate 832A is in accordance with the inspected first selection data q1*d* for a small dot. Similarly, the AND gate 833A receives, as its input, the inspected first selection data q2*d* for a medium dot, the data of the high-order bit, and the inverted data of the low-order bit of the pixel data SI. Thus, if the pixel data SI are the data value [10], then the output from the AND gate 833A is in accordance with the inspected first selection data q2*d* for a medium dot. Likewise, the AND gate 834A receives, as its input, the inspected first selection data q3*d* for a large dot, the data of the high-order bit, and the data of the low-order bit of the pixel data SI. Thus, if the pixel data SI are the data value [11], then the output from the AND gate 834A is in accordance with the inspected first selection data q3*d* for a large dot.

The OR gate 835A has four input terminals and one output terminal. Its four input terminals receive the output of the AND gates 831A to 834A, respectively. The OR gate 835A outputs a first switch control signal SW_A. That is, it outputs the inspected first selection data, of among the inspected first selection data q0*d* to q3*d*, that corresponds to the latched pixel data SI as the first switch control signal SW_A.

The second decoding section 83B also has four AND gates 831B to 834B and a single OR gate 835B. The second decoding section 83B has the same configuration as the first decoding section 83A. That is, the AND gate 831B receives, as its input, the inspected second selection data q4*d* for no-dot formation, the inverted data of the high-order bit, and the inverted data of the low-order bit of the pixel data SI. The AND gate 832B receives, as its input, the inspected second selection data q5*d* for a small dot, the inverted data of the high-order bit, and the data of the low-order bit of the pixel data SI. The AND gate 833B receives, as its input, the inspected second selection data q6*d* for a medium dot, the data of the high-order bit, and the inverted data of the low-order bit of the pixel data SI. The AND gate 834B receives, as its input, the inspected second selection data q7*d* for a large dot, the data of the high-order bit, and the data of the low-order bit of the pixel data SI. The OR gate 835B receives the output of the four AND gates 831B to 834B. The OR gate 835B then outputs the inspected second selection data, of among the inspected second selection data q4*d* to q7*d*, that corresponds to the latched pixel data SI as a second switch control signal SW_B.

The first switch control signal SW_A and the second switch control signal SW_B that are output from the decoder 83 are input to a first switch 86A and a second switch 86B. The first switch 86A and the second switch 86B switch between an ON state and an OFF state by changing their resistance. For example, in the ON state their resistance is on the order of 100 Ω, whereas in the OFF state their resistance is on the order of several MΩ. The first drive signal COM_A from the drive signal generation circuit 70 is applied to the input side of the first switch 86A, and the second drive signal COM_B from the drive signal generation circuit 70 is applied to the input side of the second switch 86B. The piezo element 417 is electrically connected to the output side of both the first switch 86A and the second switch 86B. The first switch 86A and the second switch 86B are switches that are provided for each drive signal COM that is generated, and selectively apply the waveform sections SS11 to SS13 making up the first drive signal COM_A and the waveform sections SS21 and SS22 making up the second drive signal COM_B to the corresponding piezo element 417.

The first switch control signal SW_A controls the operation of the first switch 86A, and the second switch control signal SW_B controls the operation of the second switch 86B. That is, the first switch control signal SW_A corresponds to the switch control signal SW for the first switch 86A. Similarly, the second switch control signal SW_B corresponds to the other switch control signal SW for the second switch 86B. Specifically, if the first switch control signal SW_A takes the data value [1], then the first switch 86A becomes on and the first drive signal COM_A is applied to the piezo element 417. If the first switch control signal SW_A takes the data value [0], then the first switch 86A becomes off and thus the first drive signal COM_A is not applied to the piezo element 417. Similarly, if the second switch control signal SW_B takes the data value [1], then the second switch 86B becomes on and the second drive signal COM_B is applied to the piezo element 417. If the second switch control signal SW_B takes the data value [0], then the second switch 86B becomes off and thus the second drive signal COM_B is not applied to the piezo element 417.

It should be noted that the piezo elements 417 act like capacitors. Thus, if application of the drive signal COM is stopped, then the piezo elements 417 retain the potential immediately before that stoppage. Consequently, during the time that application of a drive signal COM is stopped, the piezo elements 417 maintain the deformed state that they were in immediately prior to the stoppage of application of the drive signal COM.

<(1) Gradation Control>

Figure 10:
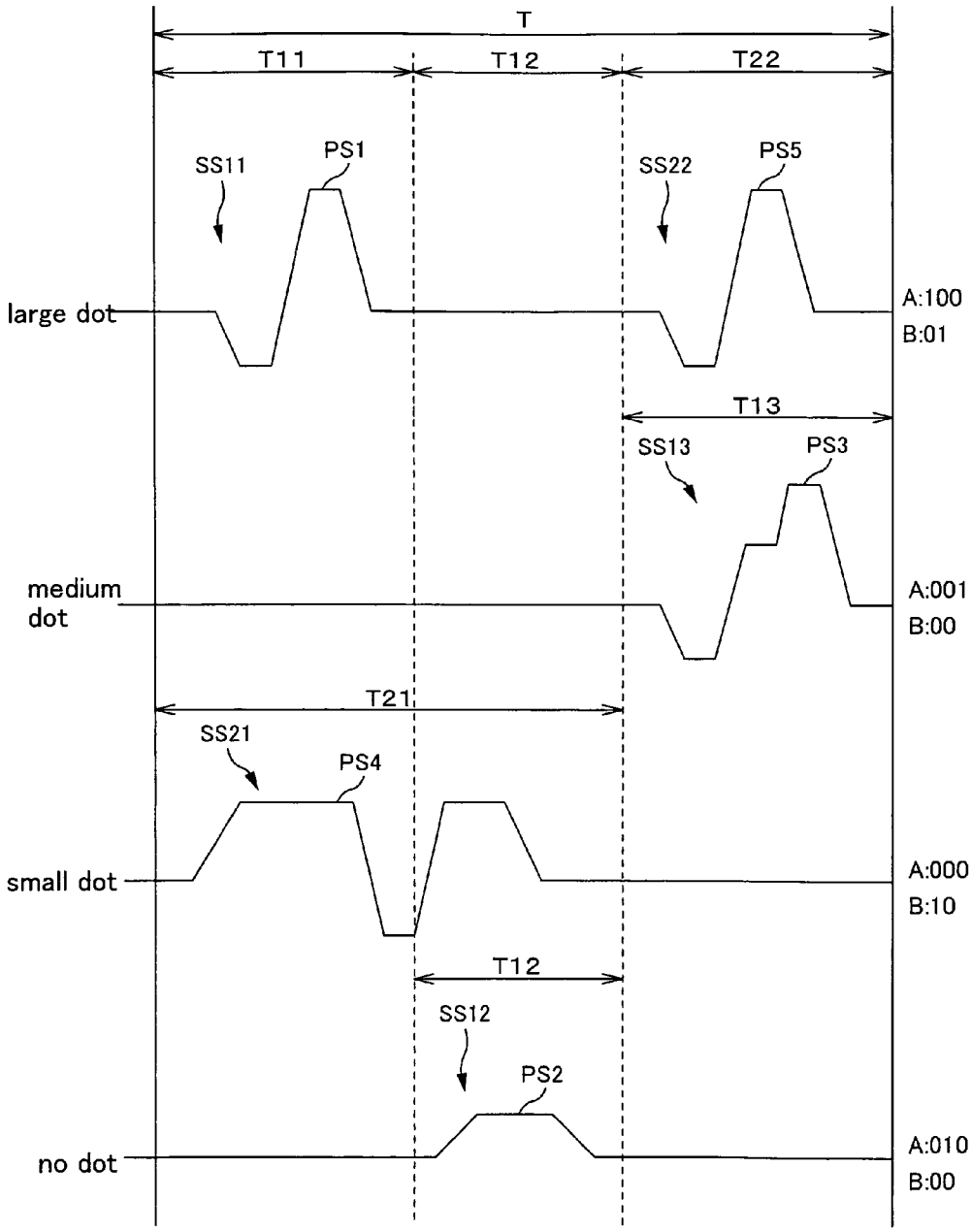
FIG. 10 is a diagram that illustrates waveform sections that are applied to piezo elements when forming a large dot, when forming a medium dot, and when forming a small dot.

Gradation control in the printer 1 is described next. Here, FIG. 9 is a diagram that describes the first drive signal COM_A, the second drive signal COM_B, and the necessary control signals. FIG. 10 is a diagram illustrating the waveform sections that are applied to a piezo element 417 when forming a large dot, when forming a medium dot, and when forming a small dot. In this gradation control, the operation of the first switch 86A and the operation of the second switch 86B are controlled based on the first switch control signal SW_A and the second switch control signal SW_B, as mentioned above.

The case of forming a large dot (pixel data SI of [11]) is described first. In this case, the decoder 83 selects the inspected first selection data q3*d* and the inspected second selection data q7*d* in response to pixel data SI that indicate the formation of a large dot. Then, the inspected first selection data q3*d* is output as the first switch control signal SW_A and the inspected second selection data q7*d* is output as the second switch control signal SW_B. In this embodiment, the first switch control signal SW_A is the data [100] according to the time series T11, T12, and T13, and the second switch control signal SW_B is the data value [01] according to the time series T21 and T22. Thus, as shown in the uppermost stage of FIG. 10, the first drive signal COM_A is applied to the piezo element 417 in period T11, and the second drive signal COM_B is applied to the piezo element 417 in period T22. As a result, the drive pulse PS1 of the first waveform section SS11 of the first drive signal COM_A and the drive pulse PS5 of the second waveform section SS22 of the second drive signal COM_B are applied to the piezo element 417 in order, leading to an amount of ink that corresponds to a large dot being ejected from the nozzle Nz.

The case of forming a medium dot (pixel data SI of [10]) is described next. In this case, the decoder 83 selects the inspected first selection data q2*d* and the inspected second selection data q6*d* in response to pixel data SI that indicate the formation of a medium dot, and outputs these as the first switch control signal SW_A and the second switch control signal SW_B. In this embodiment, the first switch control signal SW_A becomes the data value [001], and the second switch control signal SW_B becomes the data value [00]. Thus, as shown in the upper middle stage of FIG. 10, the first drive signal COM_A is applied to the piezo element 417 in period T13, and the second drive signal COM_B is not applied to the piezo element 417. Consequently, the drive pulse PS3 of the third waveform section SS13 of the first drive signal COM_A is applied to the piezo element 417, leading to an amount of ink that corresponds to a medium dot being ejected from the nozzle Nz.

The case of forming a small dot (pixel data SI of [01]) is described next. In this case, the decoder 83 selects the inspected first selection data q1*d* and the inspected second selection data q5*d* in response to pixel data SI that indicate the formation of a small dot, and outputs these as the first switch control signal SW_A and the second switch control signal SW_B. In this embodiment, the first switch control signal SW_A becomes the data value [000], and the second switch control signal SW_B becomes the data value [10]. Thus, as shown in the lower middle stage of FIG. 10, the second drive signal COM_B is applied to the piezo element 417 in period T21, and the first drive signal COM_A is not applied to the piezo element 417. Consequently, the drive pulse PS4 of the first waveform section SS21 of the second drive signal COM_B is applied to the piezo element 417, leading to an amount of ink that corresponds to a small dot being ejected from the nozzle Nz.

It should be noted that in the case of no dot formation (pixel data SI having the data value [00]), the decoder 83 selects the inspected first selection data q0*d* and the inspected second selection data q4*d* in response to pixel data SI that indicate no dot formation, and outputs these as the first switch control signal SW_A and the second switch control signal SW_B. In this embodiment, the first switch control signal SW_A becomes the data value [010], and the second switch control signal SW_B becomes the data value [00]. Thus, as shown in the lowermost stage of FIG. 10, the first drive signal COM_A is applied to the piezo element 417 in period T12, slightly vibrating the meniscus due to the drive pulse PS2.

<(1) Printing Operation>

Figure 11:
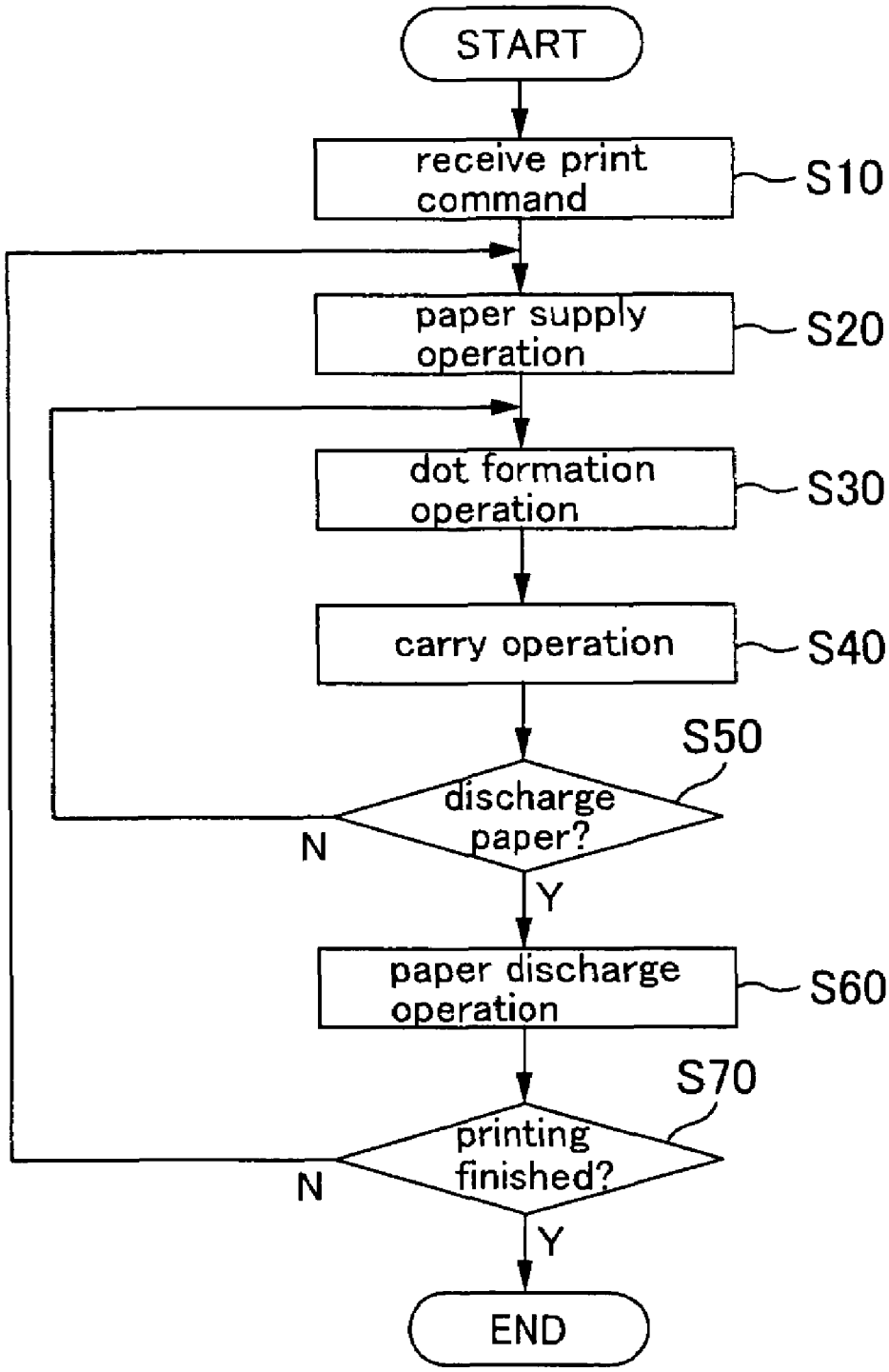
FIG. 11 is a flowchart describing a printing operation.

With the printer 1 having the above configuration, the printer-side controller 60 controls the control targets (the paper carry mechanism 20, the carriage movement mechanism 30, the head unit 40, and the drive signal generation circuit 70) in accordance with a computer program that is stored on the memory 63. Thus, this computer program has program codes for allowing execution of this control. The operation of printing a paper S is carried out by controlling the control targets. Here, FIG. 11 is a flowchart that describes the printing operation. This illustrative printing operation includes a print command receiving operation (S10), a paper supply operation (S20), a dot formation operation (S30), a carry operation (S40), a paper discharge determination (S50), a paper discharge process (S60), and a determination of whether or not printing is finished (S70). These operations are briefly described below.

The print command receiving operation (S10) is an operation of receiving a print command from the computer 110. In this operation, the printer-side controller 60 receives the print command through the interface section 61. The paper supply operation (S20) is an operation of moving the paper S to be printed to position it at a print start position (the so-called indexed position). In this operation, the printer-side controller 60 drives the carry-motor 22, for example, to rotate the paper feed roller 21 and the carry roller 23. The dot formation operation (S30) is an operation for forming dots on the paper S. In this operation, the printer-side controller 60 drives the carriage motor 31 and outputs control signals to the drive signal generation circuit 70 and the head 41. In this way, ink is ejected from the nozzles Nz while the head 41 is moving, forming dots on the paper S. The carry operation (S40) is an operation of moving the paper S in the carrying direction. In this operation, the printer-side controller 60 drives the carry motor 22 to rotate the carry roller 23. Through this carry operation, it becomes possible to form dots at positions that are different from those dots formed in the previous dot formation operation. The paper discharge determination (S50) is an operation of determining whether or not it is necessary to discharge the paper S that is being printed. This determination is made by the printer-side controller 60 based on whether or not there are print data, for example. The paper discharge process (S60) is a process for discharging the paper S, and is performed if the result of the above-mentioned paper discharge determination is "discharge paper." In this case, the printer-side controller 60 causes rotation of the paper discharge roller 25 so that the paper S, for which printing has finished, is discharged to the outside. The print end determination (S70) is a determination of whether or not to continue printing. This determination also is performed by the printer-side controller 60.

===(1) Inspection Circuit===

<(1) Reason Behind Providing the Inspection Circuit 85>

The purpose of the above description was to describe the configuration of the printer 1, and assumes ideal conditions. However, when the printer 1 is operated in practice, there is the possibility that the pair of corresponding first selection data q0 to q3 and the second selection data q4 to q7 will both simultaneously indicate the data value [1]. Specifically, any one of the pair of the first selection data q0 and the second selection data q4 corresponding to the pixel data SI for no-dot formation, the pair of the first selection data q1 and the second selection data q5 corresponding to the pixel data SI for a small dot, the pair of the first selection data q2 and the second selection data q6 corresponding to the pixel data SI for a medium dot, and the pair of the first selection data q3 and the second selection data q7 corresponding to the pixel data SI for a large dot, has the possibility of simultaneously indicating the data value [1].

Figure 12:
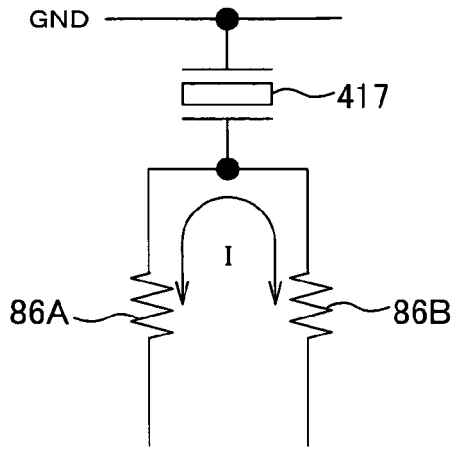
FIG. 12 is a diagram that schematically illustrates a state in which a first switch and a second switch are in the ON state simultaneously.

This problem is thought to occur primarily due to noise. For example, if noise coincides with the transfer clock CLK, then the selection data q0 to q7 may be stored on registers RG that are different from the correct registers RG. Further, if noise coincides with the selection data q0 to q7, then there is a possibility that the content of the selection data q0 to q7 will be altered. In this case, there is a possibility that the pair of corresponding first selection data q0 to q3 and second selection data q4 to q7 will simultaneously indicate the data value [1]. If the pair of corresponding first selection data q0 to q3 and second selection data q4 to q7 simultaneously indicate the data value [1], then the first switch 86A and the second switch 86B both will be put in the ON state simultaneously. Here, FIG. 12 is a diagram that schematically describes a state in which the first switch 86A and the second switch 86B are in the ON state simultaneously. As shown in FIG. 12, when there is a difference between the voltage of the first drive signal COM_A and the voltage of the second drive signal COM_B when the first switch 86A and the second switch 86B are in the ON state simultaneously, then this voltage difference causes an unanticipated current I to flow. This problem will occur not only at that particular nozzle but will also simultaneously occur at other nozzles with identical pixel data (in a worst case scenario, it will occur at all nozzles.) There is a possibility that the sum of the unanticipated current I will have an adverse effect, such as exceeding the allowable current of the drive signal generation sections 70A and 70B.

Accordingly, in this embodiment, an inspection circuit 85 is provided in order to prevent such adverse effects. The inspection circuit 85 corresponds to the data inspection section, and is connected to the control logic 84, which serves as the data output section, and inspects the first selection data q0 to q3 and the second selection data q4 to q7 that are output from the control logic 84. As long as the first selection data q0 to q3 and the second selection data q4 to q7 are normal, the inspection circuit 85 outputs those first selection data q0 to q3 and the second selection data q4 to q7 unchanged as the inspected first selection data q0*d* to q3*d* and the inspected second selection data q4*d* to q7*d*. On the other hand, if the first selection data q0 to q3 and the second selection data q4 to q7 indicate that the first drive signal COM_A and the second drive signal COM_B are to be simultaneously applied to the piezo elements 417 (that is, if they indicate an abnormal condition), then the inspection circuit 85 continues to output the inspected first selection data q0*d* to q3*d* and the inspected second selection data q4*d* to q7*d* that had been output up to that point. Here, the inspected first selection data q0*d* to q3*d* and the inspected second selection data q4*d* to q7*d* that continue to be output have already been inspected by the inspection circuit 85. Put differently, they are normal selection data that do not indicate that the first drive signal COM_A and the second drive signal COM_B are to be applied simultaneously to the piezo elements 417. Consequently, by providing the inspection circuit 85, the inspected first selection data q0*d* to q3*d* and the inspected second selection data q4*d* to q7*d* continue to be output in place of the first selection data q0 to q3 and the second selection data q4 to q7 if there is a problem with those first selection data q0 to q3 and second selection data q4 to q7. The result is that the simultaneous application of the first drive signal COM_A and the second drive signal COM_B to the elements is reliably prevented.

<(1) Configuration of the Inspection Circuit 85>

Figure 13:
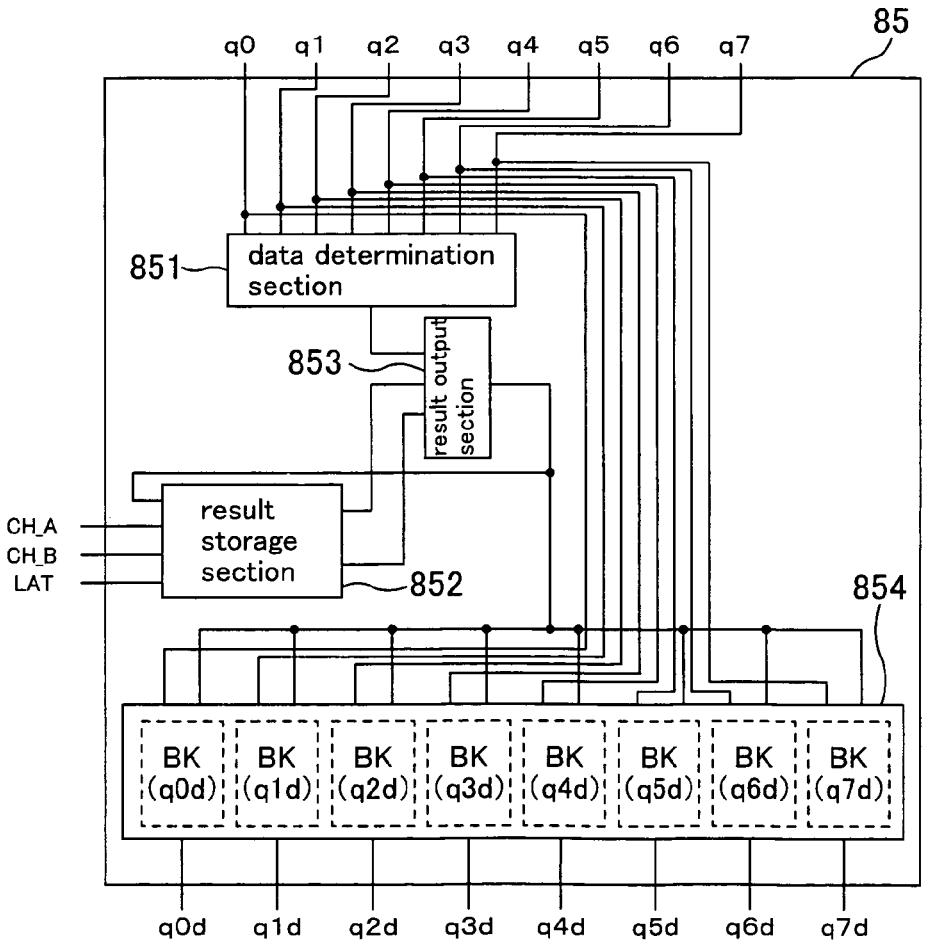
FIG. 13 is a block diagram that describes a configuration of an inspection circuit.

First, the configuration of the inspection circuit 85 is described. Here, FIG. 13 is a block diagram that describes the configuration of the inspection circuit 85. As shown in FIG. 13, the inspection circuit 85 has a data determination section 851, a result storage section 852, a result output section 853, and a data selection section 854. The data determination section 851 is a section that performs a determination with respect to the first selection data q0 to q3 and the second selection data q4 to q7 that are output from the control logic 84. That is, it determines whether or not the first selection data q0 to q3 and the second selection data q4 to q7 indicate that the first drive signal COM_A and the second drive signal COM_B are to be simultaneously applied to the piezo elements 417. The result storage section 852 corresponds to the determination result storage section, and stores the result of the determination by the data determination section 851. The result output section 853 outputs the result of the determination by the data determination section 851 and the determination result stored on the result storage section 852. The data selection section 854 corresponds to the selective output section, and selects to output the inspected first selection data q0*d* to q3*d* and the inspected second selection data q4*d* to q7*d* that had been output until then if either one of the determination result output from the data determination section 851 or the determination result stored on the result storage section 852 indicates that the first drive signal COM_A and the second drive signal COM_B are to be applied to the piezo element 417 simultaneously. These sections are described in further detail below.

<(1) Data Determination Section 851>

Figure 14:
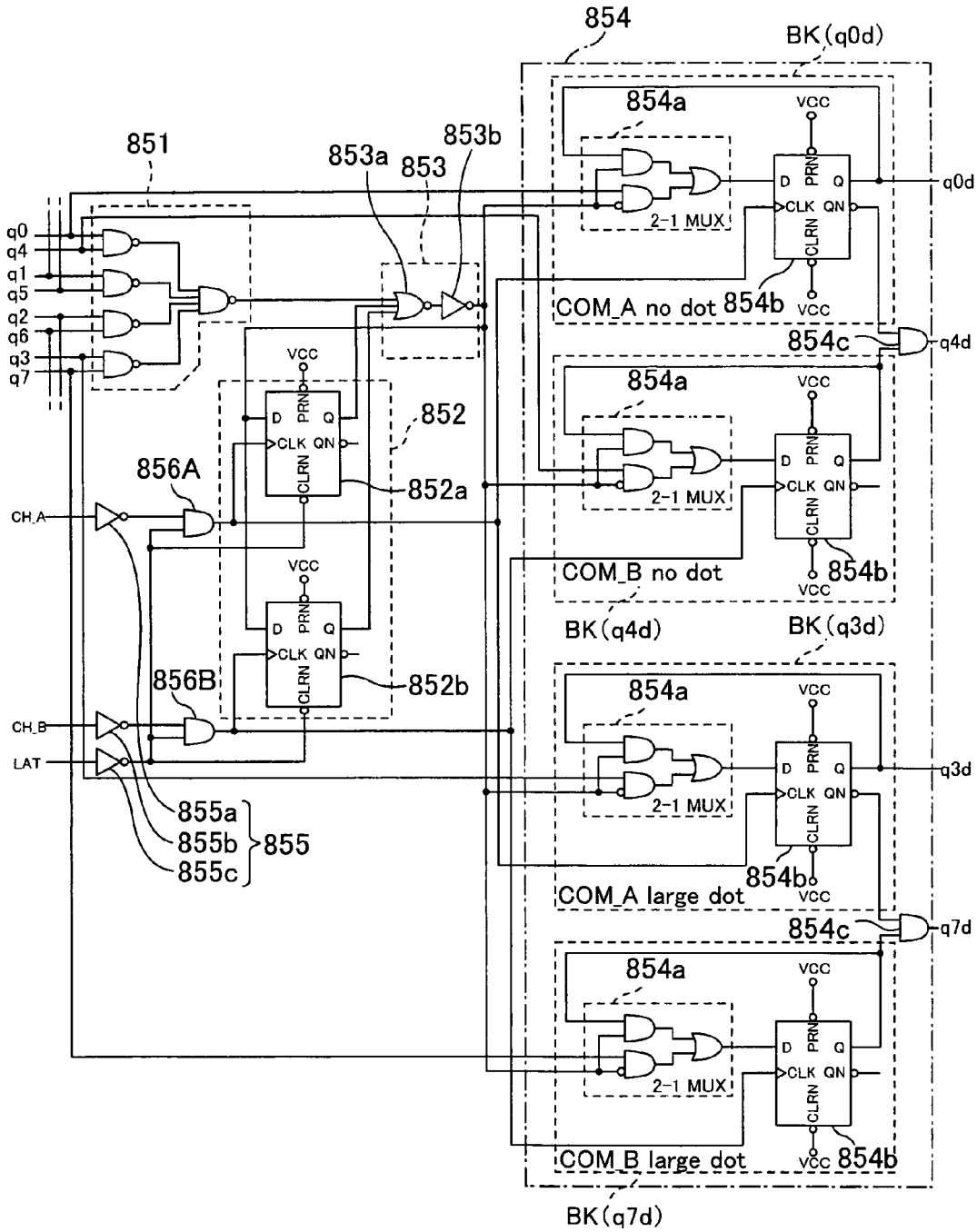
FIG. 14 is a diagram that describes a specific example of the inspection circuit.
Figures 15A, 15B, 15C:
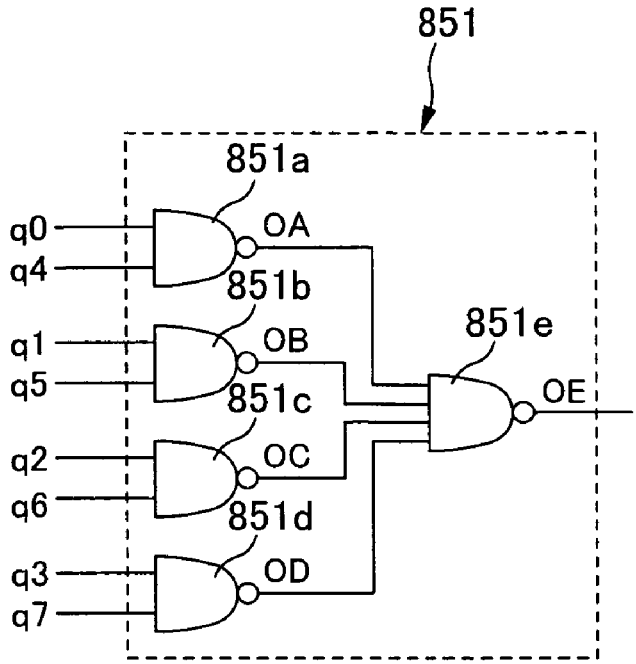
FIG. 15A is a diagram that describes a specific configuration of a data determination section.
FIG. 15B is a truth value table that describes an operation of a NAND gate of the data determination section.
FIG. 15C is a truth value table that describes an operation of an other NAND gate of the data determination section 851.

The data determination section 851 will be described in detail first. Here, FIG. 14 is a diagram that describes a specific example of the inspection circuit 85. FIG. 15A is a diagram illustrating a specific configuration of the data determination section 851. FIG. 15B is a truth value table that describes the operation of NAND gates 851*a* to 851*d* of the data determination section 851. FIG. 15C is a truth value table that describes the operation of a NAND gate 851*e* of the data determination section 851. As shown in these diagrams, the data determination section 851 has five NAND gates 851*a* to 851*e*. These NAND gates 851*a* to 851*e* can be divided into two groups based on their function. Specifically, they can be divided into one group of NAND gates 851*a* to 851*d*, and another of the NAND gate 851*e*.

The NAND gates 851*a* to 851*d* compare corresponding first selection data q0 to q3 and second selection data q4 to q7 with one another. That is, the NAND gate 851*a* has two input terminals and one output terminal. The NAND gate 851*a* compares the first selection data q0 and the second selection data q4 for no-dot formation, and if both the first selection data q0 and the second selection data q4 are a data value [1], which indicates the application of a drive signal COM, then the NAND gate 851*a* outputs a data value [0] to indicate this. In other cases, the NAND gate 851*a* outputs the data value [1]. The NAND gates 851*b* to 851*d* are the same. That is, the NAND gate 851*b* compares the first selection data q1 and the second selection data q5 for a small dot, and if both the first selection data q1 and the second selection data q5 are the data value [1], which indicates the application of a drive signal COM, then the NAND gate 851*b* outputs a data value [0] to indicate this. Similarly, the NAND gate 851*c* compares the first selection data q2 and the second selection data q6 for a medium dot, and the NAND gate 851*d* compares the first selection data q3 and the second selection data q7 for a large dot.

The NAND gate 851*e* is for outputting the result of the comparisons by the NAND gates 851*a* to 851*d*. That is, the NAND gate 851*e* has four input terminals and one output terminal, and at its input terminals receives the outputs OA to OD from the NAND gates 851*a* to 851*d*, respectively. Thus, if even one of the output OA of the NAND gate 851*a* to the output OD of the NAND gate 851*d* is the data value [0], then the output OE of the NAND gate 851*e* is the data value [1]. That is, if there are abnormal data that indicate that the first drive signal COM_A and the second drive signal COM_B are to be applied simultaneously, then the output OE is the data value [1]. If the output OA of the NAND gate 851*a* to the output OD of the NAND gate 851*d* are all the data value [1], that is, if they are normal data that do not indicate simultaneous application of the first drive signal COM_A and the second drive signal COM_B, then the output OE is the data value [0]. Thus, the NAND gate 851*e* can be said to output a determination result that indicates whether or not there are any pairs of the first selection data q0 to q3 and the second selection data q4 to q7 that will cause simultaneous application of the first drive signal COM_A and the second drive signal COM_B to the piezo element 417.

<(1) Result Storage Section 852>

The result storage section 852 is described next. As shown in FIG. 14, the result storage section 852 has a first storage circuit 852*a* for the first drive signal COM_A and a second storage circuit 852*b* for the second drive signal COM_B.

The first storage circuit 852*a* is a circuit that stores the output of the result output section 853, and updates its stored content each time a first timing pulse for the first drive signal COM_A is input. The first storage circuit 852*a* of this embodiment is made of a D-FF circuit, and its output is input to the result output section 853. Here, the first timing pulse is a pulse for determining the update timing of the first selection data, and corresponds to the latch pulse of the latch signal LAT and the change pulse of the first change signal CH_A. More specifically, the first change signal CH_A is inverted by a first inverter 855*a* of an inverter group 855 and the latch signal LAT is inverted by a third inverter 855*c* of the inverter group 855. Then, the logical product of the inverted latch signal LAT and the inverted first change signal CH_A is calculated by an AND gate 856A and is input to the clock terminal of the first storage circuit 852*a*.

Figure 16:
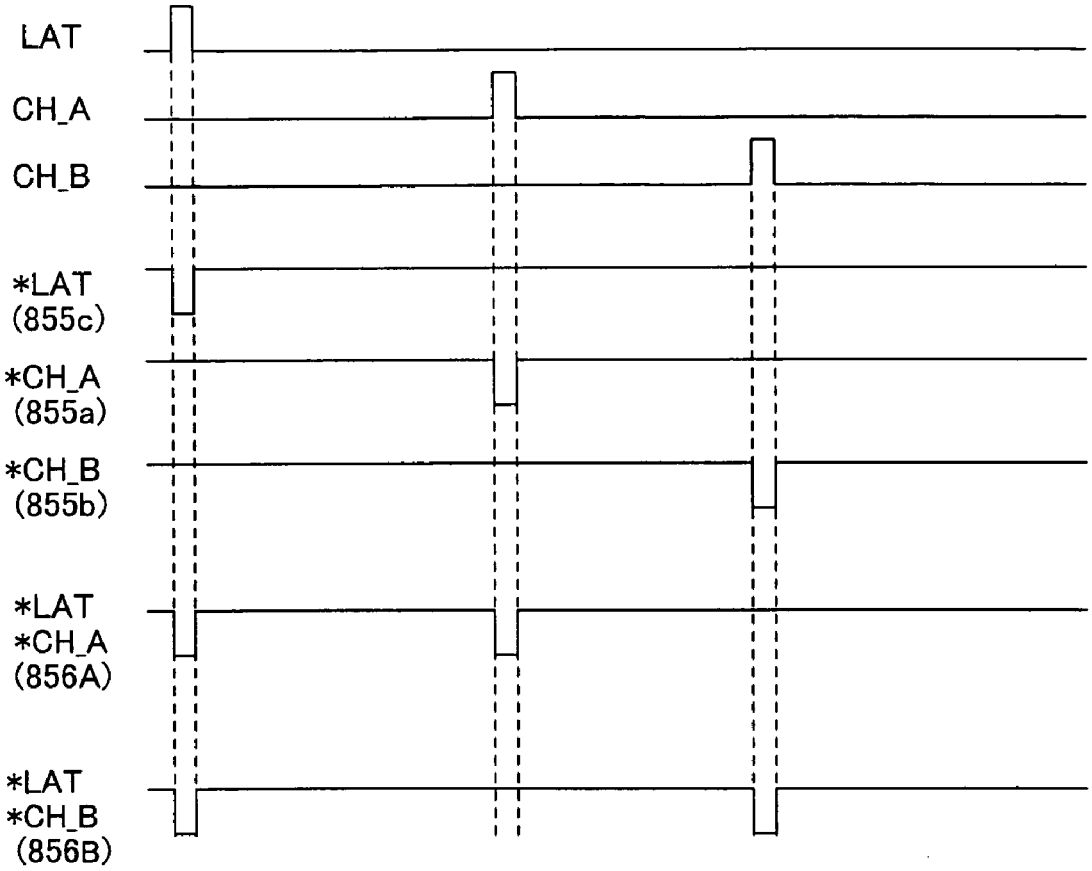
FIG. 16 is a timing chart describing an operation of AND gates 856A and 856B.

Here, FIG. 16 is a timing chart illustrating the operation of the AND gates 856A and 856B. That is, it is a timing chart that describes the relationship among the latch signal LAT, the first change signal CH_A, the second change signal CH_B, the output obtained by inverting these signals (the output of the first inverter 855*a* through the third inverter 855*c*), and the output of the AND gates 856A and 856B. As shown in this diagram, the output of the AND gate 856A (calculated result) is at H level when the latch signal LAT and the first change signal CH_A both are at L level, and is at L level during the period that the latch pulse and the change pulse are output. Thus, the output of the AND gate 856A drops from the H level to the L level at the timing of the forward edge of the latch pulse and the change pulse, and rises from the L level to the H level at the timing of the rear edge of the latch pulse and the change pulse. Then, because the first storage circuit 852*a* is operated at the positive edge of the pulse that is input to its clock terminal, it stores the output from the result storage section 852 at the timing of the rear edge of the latch pulse and the change pulse.

The second storage circuit 852*b* also is a circuit that stores the output of the result output section 853. The second storage circuit 852*b* updates its stored content each time it receives a second timing pulse for the second drive signal COM_B. Like the first storage circuit 852*a*, the second storage circuit 852*b* also is made of a D-FF circuit and its output is input to the result output section 853. Here, the second timing pulse is a pulse for determining the update timing of the second selection data. More specifically, the second change signal CH_B is inverted by a second inverter 855*b* of the inverter group 855 and the latch signal LAT is inverted by the third inverter 855*c* as mentioned above. Then, an AND gate 856B calculates the logical product of the inverted latch signal LAT and the inverted second change signal CH_B and inputs this to the clock terminal of the second storage circuit 852*b*. Consequently, as shown in FIG. 16, the output of the AND gate 856B also drops from the H level to the L level at the timing of the forward edge of the latch pulse and the change pulse, and rises from the L level to the H level at the timing of the rear edge of the latch pulse and the change pulse. Then, because the second storage circuit 852*b* is operated at the positive edge of the pulse that is input to its clock terminal, it stores the output from the result storage section 852 at the timing of the rear edge of the latch pulse and the change pulse.

The first storage circuit 852*a* and the second storage circuit 852*b* are reset each time they receives the latch pulse. In this embodiment, the inverted latch signal LAT is input to the reset terminal of the first storage circuit 852*a* and to the reset terminal of the second storage circuit 852*b*. Then, since the first storage circuit 852*a* and the second storage circuit 852*b* are reset at the negative edge of the pulse that is input to their reset terminal, they are reset at the timing of the forward edge of the latch pulse. The latch pulse therefore corresponds to a "specific timing pulse". It should be noted that the resetting of the first storage circuit 852*a* and the second storage circuit 852*b* is stopped at the timing of the rear edge of the latch pulse, and as mentioned above, the clock is input substantially concurrent with the clock of the first storage circuit 852*a* and the second storage circuit 852*b*, but due to the transmission delay of the AND gates 856A and 856B, latching can be performed reliably because the clock is input after the resetting has been stopped.

Incidentally, the result output section 853 receives the output of the first storage circuit 852*a* and the output of the second storage circuit 852*b*, but also receives the determination result from the data determination section 851, and outputs a data value [1] if either of these inputs are [1] (this is discussed later). Thus, when the determination result from the data determination section 851 is the data value [1], the first storage circuit 852*a* stores this data value [1] and outputs it to the result output section 853 at the timing of the rear edge of the latch pulse or the change pulse of the first change signal CH_A. Similarly, the second storage circuit 852*b* stores this data value [1] and outputs it to the result output section 853 at the timing of the rear edge of the latch pulse or the change pulse of the second change signal CH_B. Consequently, if the output from the data determination section 851 become the data value [1] and the output of the first storage circuit 852*a* and the second storage circuit 852*b* also are the data value [1], then the subsequent output of the result output section 853 stay at the data value [1] until both the first storage circuit 852*a* and the second storage circuit 852*b* are reset, regardless of the output from the data determination section 851. In other words, if the data determination section 851 has determined that there is a pair of selection data that indicates that the first drive signal COM_A and the second drive signal COM_B are to be simultaneously applied to the piezo elements 417, then the output from the result output section 853 stays at the data value [1] until both the first storage circuit 852*a* and the second storage circuit 852*b* are reset.

<(1) Result Output Section 853>

The result output section 853 is described next. As shown in FIG. 14, the result output section 853 has a NOR gate 853*a* and an inverter 853*b*. The NOR gate 853*a* has three input terminals and a single output terminal, and receives the determination result from the data determination section 851, the output from the first storage circuit 852*a*, and the output from the second storage circuit 852*b*. The output of the NOR gate 853*a* is input to the inverter 853*b*. Thus, the output from the result output section 853, that is, the output from the inverter 853*b*, is the data value [1] if even one of the determination result from the data determination section 851, the output from the first storage circuit 852*a*, and the output from the second storage circuit 852*b* is the data value [1].

<(1) Data Selection Section 854>

The data selection section 854 is described next. The data selection section 854 has a two-channel multiplexer 854*a*, a storage circuit 854*b*, and an AND gate 854*c*. The pair of the multiplexer 854*a* and the storage circuit 854*b* is provided for each of the inspected selection data q0*d* to q7*d*. Consequently, the data selection section 854 has eight blocks BK, from the block BK(q0*d*) for the inspected selection data q0*d* to the block BK(q7*d*) for the inspected selection data q7*d*.

The multiplexer 854*a* corresponds to the selection switch. One of the input terminals of the multiplexer 854*a* receives the corresponding selection data q0 to q7 from the control logic 84, and its other input terminal receives the output from the storage circuit 854*b*, that is, it receives the corresponding inspected selection data q0*d* to q7*d* that have been output already. If the data value that is output from the result output section 853 is [0], then the multiplexers 854*a* output the selection data q0 to q7 of the control logic 84, and if the data value that is output from the result output section 853 is [1], that is, if the data value is abnormal and indicates that the first drive signal COM_A and the second drive signal COM_B are to be simultaneously applied to the piezo elements 417, then the multiplexers 854*a* output the inspected selection data q0*d* to q7*d* that have already been output. More specifically, the multiplexer 854*a* of the block BK(q0*d*) outputs the selection data q0 if the result output section 853 outputs the data value [0]. On the other hand, it outputs the inspected selection data q0*d* if the output of the result output section 853 is the data value [1]. Similarly, the multiplexer 854*a* of the block BK(q1*d*) outputs either the selection data q1 or the inspected selection data q1*d*. The other blocks BK are the same, and the multiplexer 854*a* of the block BK(q7*d*) outputs either the selection data q7 or the inspected selection data q7*d*.

The storage circuits 854*b* correspond to the storage output section. The storage circuits 854*b* in this embodiment are each constituted by a D-FF circuit. The output from the multiplexer 854*a* is input to an input terminal of the corresponding storage circuit 854*b*. A timing pulse based on the latch pulse of the latch signal LAT and either the change pulse of the first change signal CH_A or the change pulse of the second change signal CH_B is input to the clock terminal of the storage circuits 854*b*. That is, the output from the AND gate 856A is input to the clock terminals of the storage circuits 854*b* of the blocks BK(q0*d*) to BK(q3*d*), and the output from the AND gate 856B is input to the clock terminals of the storage circuits 854*b* of the blocks BK(q4*d*) to BK(q7*d*). The storage circuits 854*b* of the blocks BK(q0*d*) to BK(q7*d*) operate at the positive edge of the pulse, and thus update their stored contents at the timing of the rear edge of the latch pulse and the change pulse.

<(1) Operation of the Inspection Circuit 85>

Figure 17:
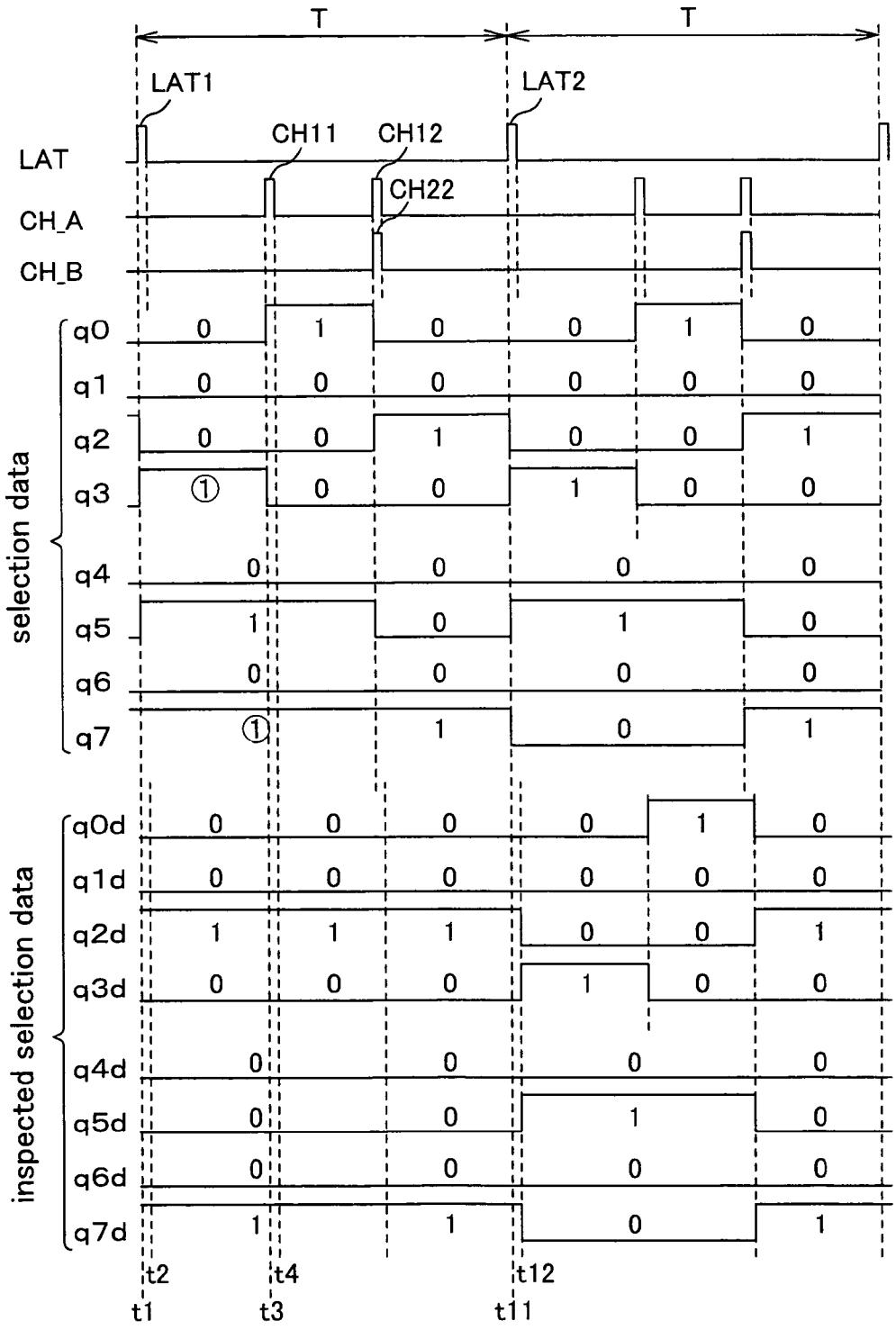
FIG. 17 is a diagram for describing an example of the operation of the printer.

The operation of the inspection circuit 85 having the above configuration is described next. Here, FIG. 17 is a diagram that illustrates an example of the operation of the printer 1. Specifically, it is a diagram that describes an example of the operation in a case where the register RG (Q7, G21) of the control logic 84 in which the selection data value [0] should be stored actually stores the selection data value [1]. It should be noted that in this operation example, the selection data q0 to q7 are abnormal in the repeating cycle T that starts at the timing t1, and the selection data q0 to q7 of the previous repeating cycle T and the subsequent repeating cycle T are normal. That is, it is an example of the operation in a case where an abnormality has occurred due to noise or the like when the selection data q0 to q7 for the repeating cycle T that begins at the timing t1 are transferred to the control logic 84.

In this operation example, first, the drive signal generation circuit 70 generates the first drive signal COM_A and the second drive signal COM_B (drive signal generation step). Then, at the timing t1 of the forward edge of the latch pulse LAT1, the control logic 84 outputs the selection data stored on the registers RG of group G11 and the selection data stored on the registers RG of group G21 (selection data output step). Here, normally the register RG (Q7, G21) should store the data value [0], but due to noise it stores the data value [1]. For this reason, at the timing t1 the selection data q7 becomes the data value [1]. It should be noted that for the other selection data q0 to q6, ordinary data are output. As a result, the selection data q7 and the selection data q3 both become the data value [1].

These selection data q0 to q7 are inspected by the inspection circuit 85 (data inspection step). The selection data q0 to q7 are first input to the data determination section 851 and the data selection section 854 of the inspection circuit 85. Here, as can be understood from FIG. 15B and FIG. 15C, the outputs OA to OC of the NAND gates 851*a* to 851*c* of the data determination section 851 are the data value [1] but the output OD of the NAND gate 851*d* is the data value [0] because both the selection data q3 and the selection data q7 are the data value [1]. Along with this, the output OE of the NAND gate 851*e* also becomes the data value [1]. That is, the result of the determination by the data determination section 851 is the data value [1], which indicates that the first drive signal COM_A and the second drive signal COM_B are to be simultaneously applied to the piezo elements 417.

Based on the fact the output of the result output section 853 is the data value [1], the multiplexers 854*a* of the data selection section 854 select the inspected selection data q0*d* to q7*d*. As a result, the inspected selection data q0*d* to q7*d* that have already been output are input to the input terminals of the storage circuits 854*b* of the data selection section 854. Specifically, the inspected selection data q0*d* to q7*d* in the periods T13 and T22 of the previous repeating cycle T are input. It should be noted that at the timing t1, the first storage circuit 852*a* and the second storage circuit 852*b* of the result storage section 852 are reset by the forward edge of the latch pulse.

Next, the storage circuits 854*b* of the data selection circuit 854 are operated at the timing t2 of the rear edge of the latch pulse LAT1. That is, at the timing t2, the storage circuits 854*b* store and then output the inspected selection data q0*d* to q7*d* that have been input to their input terminals. For example, the storage circuit 854*b* of the block BK(q0*d*) continues to output the inspected selection data q0*d* that had been output until then. Likewise, the storage circuit 854*b* of the block BK(q4*d*) continues to output the inspected selection data q4*d* that had been output until then. The same applies for the other blocks BK as well.

The decoder 83 outputs the first switch control signal SW_A and the second switch control signal SW_B based on these inspected selection data q0*d* to q7*d*. The first switch 86A and the second switch 86B are activated by the first switch control signal SW_A and the second switch control signal SW_B, and control the application of the first drive signal COM_A and the second drive signal COM_B to the piezo elements 417 (drive signal application step). Here, the inspected selection data q0*d* to q7*d* that had been output up to then have already been inspected by the inspection circuit 85. That is, they are normal selection data that do not indicate that the first drive signal COM_A and the second drive signal COM_B are to be simultaneously applied to the piezo elements 417. Consequently, it is possible to reliably prevent the first drive signal COM_A and the second drive signal COM_B from being simultaneously applied to the element.

Incidentally, in this embodiment, as regards block pairs that output inspected first selection data and inspected second selection data that have the same gradation value (ink ejection amount), the inverted output of the storage circuit 854*b* of one of the blocks BK is used to mask the output of the storage circuit 854*b* of the other block BK. In this embodiment, masking is carried out through the AND gate 854*c*. For example, in the case of the gradation value for no-dot formation, the block BK(q0*d*) that outputs the inspected first selection data q0*d* and the block BK(q4*d*) that outputs the inspected second selection data q4*d* correspond to one another. In this embodiment, the inverted output (QN) of the storage circuit 854*b* of one block BK(q0*d*) and the output (Q) of the storage circuit 854*b* of the other block BK(q4*d*) are input to the AND gate 854*c*, and the output of the AND gate 854*c* is output as the inspected second selection data q4*d*.

Here, if the data value [1] is output from the block BK(q0*d*) as the inspected first selection data q0*d*, then the inverted output (QN) of the storage circuit 854*b* becomes the data value [0]. The output of the AND gate 854*c*, which receives this inverted output [0] as its input, that is, the inspected second selection data q4*d*, is always the data value [0], regardless of the value of the storage circuit 854*b* of the block BK(q4*d*). That is, if the inspected first selection data q0*d* from the block BK(q0*d*) is the data value [1], then the inspected second selection data q4*d* from the block BK(q4*d*) forcibly becomes the data value [0]. As a result, it is possible to prevent the problem of the first drive signal COM_A and the second drive signal COM_B being applied to the piezo elements 417 simultaneously. It should be noted that this function is effective in situations where the selection data q0 to q7 are undefined, such as when turning on the power.

At the timing t2, the rear edge of the latch pulse causes the first storage circuit 852*a* and the second storage circuit 852*b* of the result storage section 852 to store the output of the result output section 853. That is, the first storage circuit 852*a* and the second storage circuit 852*b* store the data value [1] output by the result output section 853, which indicates an abnormality. As mentioned above, the data stored on the first storage circuit 852*a* and the second storage circuit 852*b* are output to the result output section 853, and thus the output from the result output section 853 stays at the data value [1], which indicates an abnormality, until the first storage circuit 852*a* and the second storage circuit 852*b* are reset, even if the first selection data q0 to q3 and the second selection data q4 to q7 return to normal at the subsequent update timing.

Next, the change pulse CH11 of the first change signal CH_A is output. At the timing t3 of the forward edge of this change pulse CH11, the control logic 84 outputs the selection data stored on the registers RG of the group G12. That is, the first selection data q0 to q3 are updated. Then, the updated first selection data q0 to q3 and the non-updated second selection data q4 to q7 are input to the data determination section 851 and the data selection section 854. At this time, all of the selection data q0 to q7 are normal. Thus, the outputs OA to OD of the NAND gates 851*a* to 851*d* of the data determination section 851 all are the data value [1]. As a result, the determination result of the data determination section 851 does not indicate that the first drive signal COM_A and the second drive signal COM_B are to be simultaneously applied to the piezo element 417 (that is, it indicates the normal condition), and become the data value [0]. This determination result is output to the result output section 853. Here, as discussed above, the first storage circuit 852*a* and the second storage circuit 852*b* output the data value [1], which indicates an abnormality. Thus, the output from the result output section 853 becomes the data value [1]. As a result, the multiplexers 854*a* of the data selection section 854 select the inspected selection data q0*d* to q7*d*. Thus, the inspected selection data q0*d* to q7*d* that have already been output are input to the input terminals of the storage circuits 854*b* of the data selection section 854.

Next, the storage circuits 854*b* of the data selection section 854 are operated at the timing t4 of the rear edge of the change pulse CH11. That is, at the timing t4 the storage circuits 854*b* store and output the inspected selection data q0*d* to q7*d* that are input to their input terminals. In other words, the inspected selection data q0*d* to q7*d* that have been output up to then continue to be output. As discussed above, the inspected selection data q0*d* to q7*d* have already been inspected by the inspection circuit 85 and are normal. Consequently, at the timing t4 as well, it is possible to reliably prevent the first drive signal COM_A and the second drive signal COM_B from being simultaneously applied to the element.

Next, the change pulse CH12 of the first change signal CH_A and the change pulse CH21 of the second change signal CH_B are output simultaneously. The operations following from these change pulses CH12 and CH21 are the same as the operation when the change pulse CH11 is output. That is to say, the determination result from the data determination section 851 indicates a normal state (the data value [0]) but the outputs of the first storage circuit 852*a* and the second storage circuit 852*b* indicate an abnormal state (the data value [1]), and thus the output from the result output section 853 also indicates an abnormal state (the data value [1]). This results in the inspected selection data q0*d* to q7*d* that had been output up to then continuing to be output.

Next, at the timing t11 of the forward edge of the latch pulse LAT2, the multiplexers MX0 to MX7 of the control logic 84 select the selection data stored on the registers RG of group G11 and the selection data stored on the registers RG of group G21. The selection data q0 to q7 are accordingly output from the control logic 84. The selection data q0 to q7 that are output here are normal selection data. This is because the selection data stored on the registers RG of the control logic 84 have been updated during the previous repeating cycle T (more specifically, during the period from the timing of the rear edge of the change pulse CH22 to the timing t11). Thus, at the timing t11, the determination result that is output from the data determination section 851 is the data value [0] indicating the normal state. Further, at this timing t11, the first storage circuit 852*a* and the second storage circuit 852*b* of the result storage section 852 are reset by the forward edge of the latch pulse. Thus, the output from the first storage circuit 852*a* and the output from the second storage circuit 852*b* both are the data value [0], which indicates a normal state. Since the determination result of the data determination section 851, the output from the first storage circuit 852*a*, and the output from the second storage circuit 852*b* that are input to the result output section 853 each are the data value [0], the output from the result output section 853 also becomes the data value [0] to indicate a normal state. Based on the fact that the output of the result output section 853 is the data value [0], the multiplexers 854*a* of the data selection section 854 select the selection data q0 to q7 from the control logic 84. That is, those selection data q0 to q7 are input to the input terminals of the storage circuits 854*b* of the data selection section 854.

Next, the storage circuits 854*b* of the data selection section 854 start operating at the timing t12 of the rear edge of the latch pulse LAT2. That is, at the timing t12, the storage circuits 854*b* store the selection data q0 to q7 that are input to their input terminals, and output these as inspected selection data q0*d* to q7*d*. For example, the storage circuit 854*b* of the block BK(q0*d*) outputs the data value [0] and the storage circuit 854*b* of the block BK(q4*d*) also outputs the data value [0]. The storage circuit 854*b* of the block BK(q3*d*) outputs the data value [1] and the storage circuit 854*b* of the block BK(q7*d*) outputs the data value [0]. The inspected selection data that are output here have been inspected by the inspection circuit 85, and are normal. Thus, it is possible to reliably prevent the first drive signal COM_A and the second drive signal COM_B from being simultaneously applied to the elements.

With this configuration, in the printer 1 of the present embodiment, the inspected first selection data and the inspected second selection data that had been output up to then continue to be output if the selection data that are stored on the control logic 84 have become abnormal data due to noise or the like. In this way, it is possible to effectively prevent the simultaneous application of the first drive signal COM_A and the second drive signal COM_B to the piezo elements 417. Also, this control is performed with reference to the timing of the forward edge and the timing of the rear edge of the latch pulse and the timing pulses. That is, the determination with respect to the selection data q0 to q7 from the control logic 84 is performed at the timing of the forward edge, and selection based on the determination results is performed at the timing of the rear edge. In this way, control is efficient because the forward edge and the rear edge of a single pulse are used. Also, the timing of the control can be appropriately determined. For example, the order of the determination operation by the data determination section 851 and the selection operation by the data selection section 854 can be reliably determined. Further, the pairs of the first selection data q0 to q3 and the second selection data q4 to q7 to be compared have the same gradation value. This allows the determination to be performed in a suitable manner.

It should be pointed out that the configuration is such that at the timing t4 discussed above, the inspected selection data q0*d* to q7*d* that had been output up to that point are output regardless of the whether or not the determination result from the data determination section 851 is normal. The reason for this is that the timing t4 is a switch timing that is set for only the first drive signal COM_A. That is, switching to a control according to new inspected selection data q0*d* to q7*d* based on the selection data q0 to q7 at the timing t4 will suddenly change the potential of the piezo elements 417, and this puts an excessive burden on the piezo elements 417.

For example, if pixel data SI for a large dot have been set, then during the period up to the timing t4, the inspected second selection data q7*d* is the data value [1]. The second drive signal COM_B is therefore applied to the piezo element 417 corresponding to that pixel data SI. Then, if the data is switched to the new inspected selection data at the timing t4, then, since the new inspected first selection data q3*d* is the data value [1] (that is, the selection data q3 from the control logic 84 stays unchanged and becomes the inspected selection data q3*d*), the first drive signal COM_A will be applied to the piezo element 417 from the timing t4 onward. Here, as shown in FIG. 9, at the timing t4 the voltage V(t4) of the second drive signal COM_B is lower than the voltage of the first drive signal COM_A (intermediate voltage VC). Thus, the piezo element 417 is suddenly charged from the potential corresponding to the voltage V(t4) up to the potential corresponding to the intermediate voltage VC. This places excessive burden on the piezo element 417.

With regard to this matter, in the present embodiment, if the determination result of the data determination section 851 is the data value [1] indicating an abnormal state, then that data value is stored on the first storage circuit 852*a* and the second storage circuit 852*b*. This configuration allows the inspected first selection data q0*d* to q3*d* and the inspected second selection data q4*d* to q7*d* that had been output up to that point to continue to be output, even if the first selection data q0 to q3 and the second selection data q4 to q7 return to the normal state at one of the update timings.

Sudden potential changes in the piezo element 417 can be reliably prevented because the first storage circuit 852*a* and the second storage circuit 852*b* are reset at the timing of the latch pulse. That is, the timing of the latch pulse is the timing at which the pixel data SI (gradation values) are updated. Put differently, it is the timing at which the drive signal COM that is to be applied to the piezo element 417 can be switched from the first drive signal COM_A to the second drive signal COM_B, or vice versa. The result of this is that at the timing of the latch pulse, the voltage of the first drive signal COM_A and the voltage of the second drive signal COM_B match one another. Consequently, sudden changes in the potential are unlikely to occur even if the drive signal COM that is applied to the piezo element 417 has been switched due to switching to the control based on the new inspected selection data q0*d* to q7*d*. As a result, application of the drive signal COM can be controlled smoothly based on the new inspected first selection data q0*d* to q3*d* and inspected second selection data q4*d* to q7*d*.

===(1) Alternative Embodiment===

Figure 18:
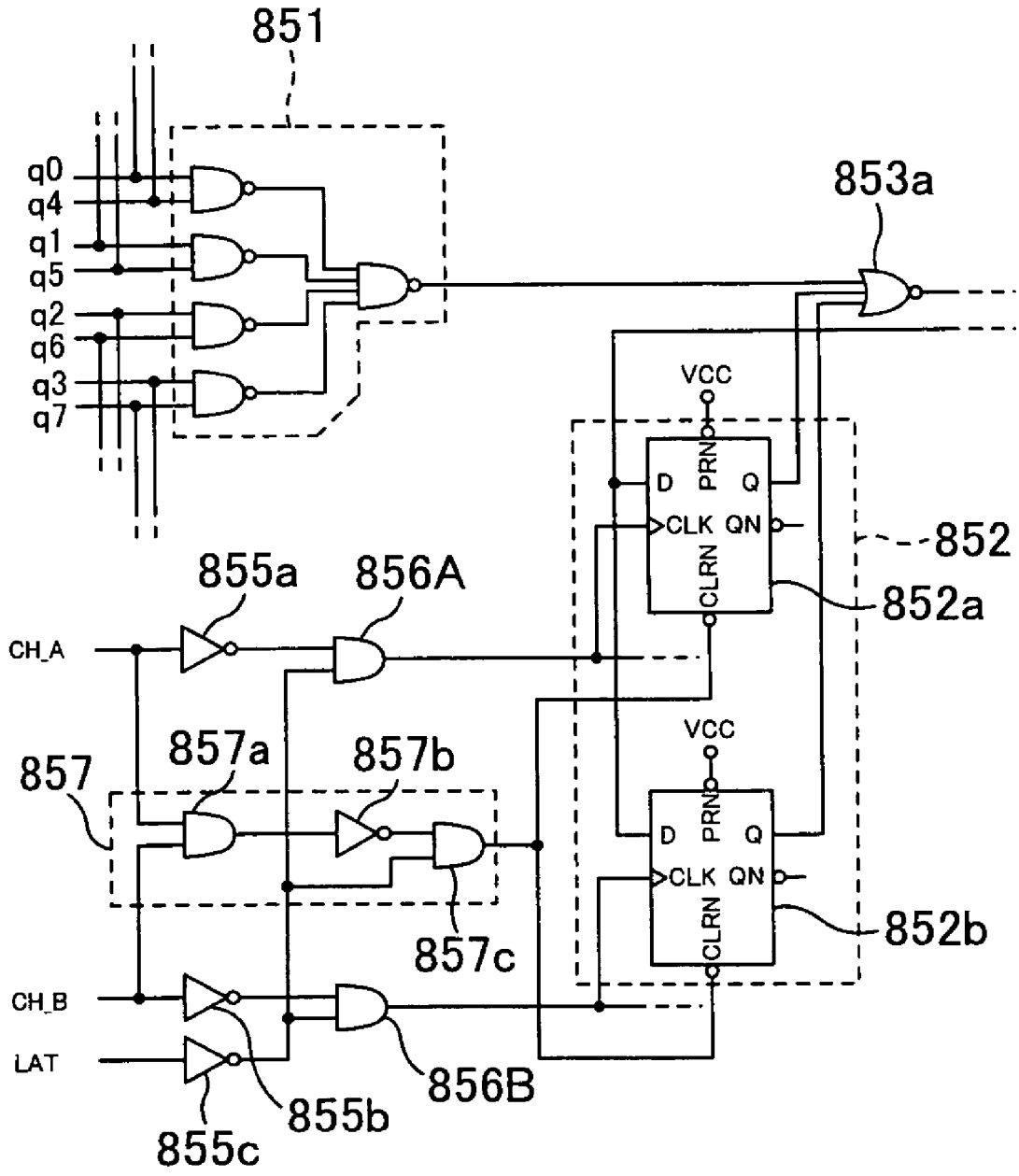
FIG. 18 is a diagram that describes a configuration according to an alternative embodiment.

In the foregoing embodiment, the first storage circuit 852*a* and the second storage circuit 852*b* are reset at the timing of the latch pulse. That is, the configuration is such that control based on new inspected selection data q0*d* to q7*d* can be executed. However, the timing at which to allow execution of control based on new inspected selection data q0*d* to q7*d* is not limited to the timing of the latch pulse. That is, it is only necessary that it is a timing at which the drive signal COM that is applied to the piezo element 417 is switched from one of the first drive signal COM_A and the second drive signal COM_B to the other. An alternative embodiment regarding a different timing at which control is executed based on new inspected selection data q0*d* to q7*d* is described below. Here, FIG. 18 is a diagram for describing the configuration of this other embodiment. It should be noted that constitutional elements that are not diagrammed are the same as those of the foregoing embodiment.

As shown in FIG. 18, in this printer 1, the inspection circuit 85 is provided with a reset pulse generation section 857. The reset pulse generation section 857 has an AND gate 857*a*, an inverter 857*b*, and an AND gate 857*c*. The AND gate 857*a* has two input terminals and one output terminal. The first change signal CH_A is input to one of its input terminals and the second change signal CH_B is input to its other input terminal. Thus, the AND gate 857*a* outputs a signal that is at H level when both the first change signal CH_A and the second change signal CH_B are at H level. In other words, it outputs a pulse over the period in which the change pulse of the first change signal CH_A and the change pulse of the second change signal CH_B are output simultaneously. This pulse is generated based on the change pulse CH12 of the first change signal CH_A, and the change pulse CH21 of the second change signal CH_B, which are output simultaneously, of the timing pulses such as the latch pulse and the change pulses (see FIG. 17). It can therefore be said that the change pulses CH12 and CH21 correspond to the "specific timing pulse".

The output of the AND gate 857*a* is input to the inverter 857*b*. The inverter 857*b* thus outputs an inverted signal that is at L level over the period during which the change pulse CH12 of the first change signal CH_A and the change pulse CH21 of the second change signal CH_B are output simultaneously. That is, a signal that drops to the L level from the H level at the timing of the forward edge, and that rises to the H level from the L level at the timing of the rear edge, in the change pulse CH12 of the first change signal CH_A and the change pulse CH21 of the second change signal CH_B, is output.

The output of the inverter 857*b* is input to one of the input terminals of the AND gate 857*c*. The AND gate 857*c* has two input terminals and one output terminal. A latch signal LAT that has been inverted by the third inverter 855*c* (hereinafter, also referred to as inverted latch signal) is input to the other input terminal of the AND gate 857*c*. With this inverted latch signal, as described in the above embodiment, a signal that drops from the H level to the L level at the timing of the forward edge of the latch pulse and that rises from the L level to the H level at the timing of the rear edge of the latch pulse, is output. Thus, the output of the AND gate 857*c* is a signal that is at the L level over the period during which the latch pulse is output and also over the period in which the change pulse CH12 of the first change signal CH_A and the change pulse CH21 of the second change signal CH_B are output simultaneously (for the sake of convenience, this will also be called the reset timing signal).

Then, the reset timing signal that is output from the AND gate 857*c* is input to the reset terminal of the first storage circuit 852*a* and the reset terminal of the second storage circuit 852*b*. Here, the first storage circuit 852*a* and the second storage circuit 852*b* of this embodiment are reset at the [0] level of the reset timing signal. Thus, the first storage circuit 852*a* and the second storage circuit 852*b* are reset at the timing of the forward edge of the latch pulse and the timing of the forward edges of the change pulse CH12 and the change pulse CH21.

For example, with the first drive signal COM_A and the second drive signal COM_B shown in FIG. 9, the first storage circuit 852*a* and the second storage circuit 852*b* are reset at the start timing of period T11 and the start timing of period T13 (period T22). Then, once the first storage circuit 852*a* and the second storage circuit 852*b* have been reset, the control based on new inspected selection data q0*d* to q7*d* is performed. This configuration achieves the same action and effects as those of the foregoing embodiment.

===(1) Other Embodiments===

The foregoing embodiment primarily describes a printing system 100 that includes a printer 1, but it also includes the disclosure of a method of applying drive signals COM and a liquid ejection system, etc. The foregoing embodiment is for the purpose of elucidating the present invention, and is not to be interpreted as limiting the present invention. The invention can of course be altered and improved without departing from the gist thereof, and includes equivalents. In particular, the embodiments mentioned below also fall within the scope of the invention.

<(1) Inspection Circuit 85>

The inspection circuit 85 of the above embodiment is only one example thereof. Since the inspection circuit 85 is constituted by a logic circuit, its circuit configuration can be different but still it may be capable of performing equivalent operations. Consequently, inspection circuits 85 that perform an equivalent operation are within the scope of the invention. The inspection circuit 85 can also be arrived at without using a logic circuit and instead using the CPU 62.

<(1) Drive Signals COM>

The foregoing embodiment described in detail an example of a printer 1 that simultaneously generates two types of drive signals COM, namely the first drive signal COM_A and the second drive signal COM_B, but there is no limitation to this configuration. That is, it is also possible to adopt a printer 1 that is capable of simultaneously generating three or more types of drive signals COM. Further, the first drive signal COM_A and the second drive signal COM_B described above are only examples, and they can have alternative waveforms.

<(1) Regarding the Ink>

The foregoing embodiment is an embodiment of a printer 1, and thus dye ink or pigment ink in liquid form was ejected from the nozzles Nz. However, as long as the ink that is ejected from the nozzles Nz is a liquid, then there is no limitation to such inks.

<(1) Other Application Examples>

A printer 1 was described in the above embodiment, but this is not a limitation. For example, it is also possible to adopt the same technology as that of the embodiment to various types of liquid ejection apparatuses that employ inkjet technology, such as a color filter manufacturing device, a dyeing device, a fine processing device, a semiconductor manufacturing device, a surface processing device, a three-dimensional shape forming machine, a liquid vaporizing device, an organic EL manufacturing device (particularly a macromolecular EL manufacturing device), a display manufacturing device, a film formation device, and a DNA chip manufacturing device, for example. The methods therefor and manufacturing methods thereof are also within the scope of application.

(2) Second Embodiment

===(2) Target of the Description===

The discussion of the section <Liquid Ejection Apparatus> in the second embodiment is substantially the same as the discussion of the section <Liquid Ejection Apparatus> in the first embodiment, and thus is not repeated here.

===(2) Configuration of the Printing System===

The discussion of the section <Overall Configuration> in the second embodiment is substantially the same as the discussion of the section <Overall Configuration> in the first embodiment, and thus is not repeated here.

===(2) Computer===

The discussion of the section <Configuration of the Computer 110> in the second embodiment is substantially the same as the discussion of the section <Configuration of the Computer 110> in the first embodiment, and thus is not repeated here.

===(2) Printer===

The discussion of the sections <Configuration of the Printer 1>, <Paper Carry Mechanism 20>, <Carriage Movement Mechanism 30>, <Head Unit 40>, <Detector Group 50>, <Printer-Side Controller 60>, <Drive Signal Generation Circuit 70>, and <Printing Operation> in the second embodiment are substantially the same as the discussion in those sections of the first embodiment, and thus is not repeated here.

<(2) Regarding the Generated Drive Signals COM>

The drive signals that are generated by the drive signal generation circuit 70 are described next. The drive signal generation circuit 70 that is illustratively shown here generates the first drive signal COM_A and the second drive signal COM_B shown in FIG. 22. That is, a first drive signal generation section 70A generates the first drive signal COM_A based on a first DAC value (this corresponds to the first generation information). Similarly, a second drive signal generation section 70B generates the second drive signal COM_B based on a second DAC value (this corresponds to the second generation information).

The first drive signal COM_A has a first waveform section SS211 that is generated in a period T211, a second waveform section SS212 that is generated in a period T212, and a third waveform section SS213 that is generated in a period T213, of a repeating cycle T. Here, the first waveform section SS211 has a drive pulse PS21. Similarly, the second waveform section SS212 has a drive pulse PS22 and the third waveform section SS213 has a drive pulse PS23. The drive pulse PS21 and the drive pulse PS22 are applied to the piezo elements 417 when a large dot is to be formed, and have the same waveform. That is, the drive pulse PS21 and the drive pulse PS22 correspond to the unit signals that define the period from the start until the finish of the operation for ejecting ink when a large dot is to be formed. The drive pulse PS23 is applied to the piezo elements 417 when a medium dot is to be formed. The drive pulse PS23 corresponds to a unit signal that defines the period from the start until the finish of the operation for ejecting ink when a medium dot is to be formed. By applying the drive pulse PS23 to the piezo elements 417, medium-sized ink droplets are ejected from the head 41 (corresponding nozzles Nz).

The second drive signal COM_B has a first waveform section SS221 that is generated in a period T221, and a second waveform section SS222 that is generated in a period T222. As for the second drive signal COM_B, the first waveform section SS221 has a drive pulse PS24 and the second waveform section SS222 has a drive pulse PS25. Here, the drive pulse PS24 is applied to the piezo elements 417 when a small dot is to be formed. By applying the drive pulse PS24 to the piezo elements 417, small-sized ink droplets are ejected from the head 41. The drive pulse PS24 therefore corresponds to a unit signal that defines the period from the start until the finish of the operation for ejecting ink when a small dot is to be formed. The drive pulse PS25 is applied to the piezo elements 417 when a large dot is to be formed. That is, the drive pulse PS25 also defines the start and finish of the operation for ejecting ink when a large dot is to be formed. The drive pulse PS25 also corresponds to a unit signal. It should be noted that the drive pulse PS25 has the same waveform as the drive pulse PS21 and the drive pulse PS23.

In this embodiment, the period T222 has the same start timing and length as the period T213 in the first drive signal COM_A. In other words, the combined length of the period T211 and the period T212 of the first drive signal COM_A is the same as the length of the period T221 of the second drive signal COM_B.

Of these drive pulses PS21 to PS25, the drive pulses PS21 to PS23 of the first drive signal COM_A correspond to the "unit signals". The drive pulses PS24 and PS25 of the second drive signal COM_B correspond to the "other unit signals".

The first drive signal COM_A and the second drive signal COM_B can be applied to the piezo elements 417 per each waveform section. That is, a portion of the first drive signal COM_A or the second drive signal COM_B can be selectively applied to the piezo elements 417. It is also possible to combine a portion of the first drive signal COM_A and a portion of the second drive signal COM_B and apply this to the piezo elements 417.

In this example, at the start timing of the repeating cycle T (the timing of the latch pulse of the latch signal LAT), it is possible to switch the drive signal COM that is applied to the piezo elements 417 from the first drive signal COM_A to the second drive signal COM_B, or vice versa. Similarly, it is possible to switch the drive signal COM that is applied to the piezo elements 417 at the timing of the border between the second waveform section SS212 and the third waveform section SS213 of the first drive signal COM_A, that is, at the timing of the border between the first waveform section SS221 and the second waveform section SS222 of the second drive signal COM_B (the timing of the change pulse of the first change signal CH_A and the timing of the change pulse of the second change signal CH_B).

Further, in this example, it is possible to select whether or not to apply the first waveform section SS211 of the first drive signal COM_A or the first waveform section SS221 of the second drive signal COM_B to the piezo elements 417 at the start timing of the repeating cycle T (the timing of the latch pulse of the latch signal LAT). Further, at the timing of the first change pulse of the first change signal CH_A, it is possible to select whether or not to apply the second waveform section SS212 of the first drive signal COM_A to the piezo elements 417.

It should be noted that the control for applying these waveform sections to the piezo elements 417 is described in greater detail later.

<(2) Head Controller HC>

Figure 19:
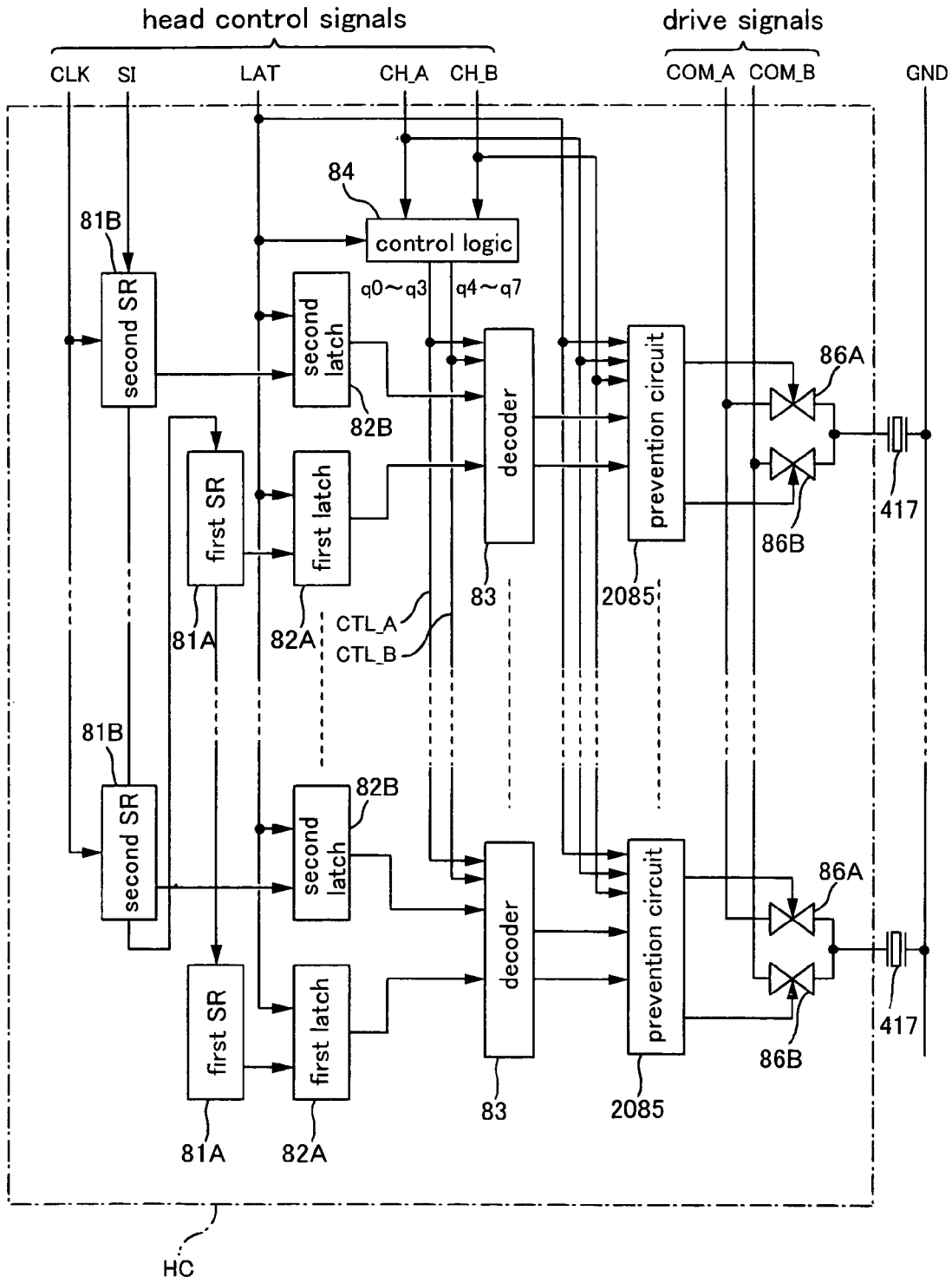
FIG. 19 is a block diagram that illustrates a configuration of a head controller.
Figure 20:
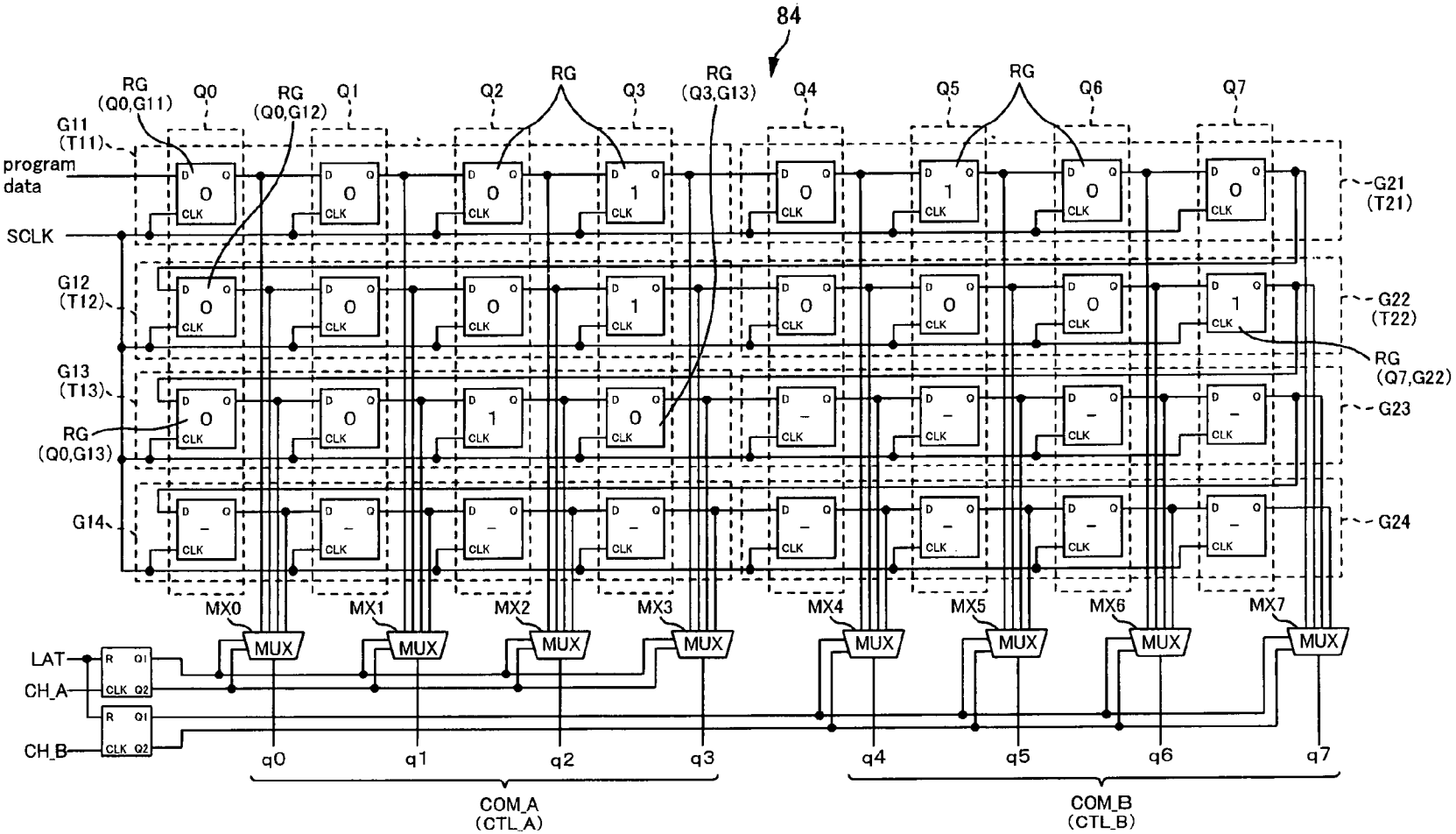
FIG. 20 is an explanatory diagram of a control logic.
Figure 21:
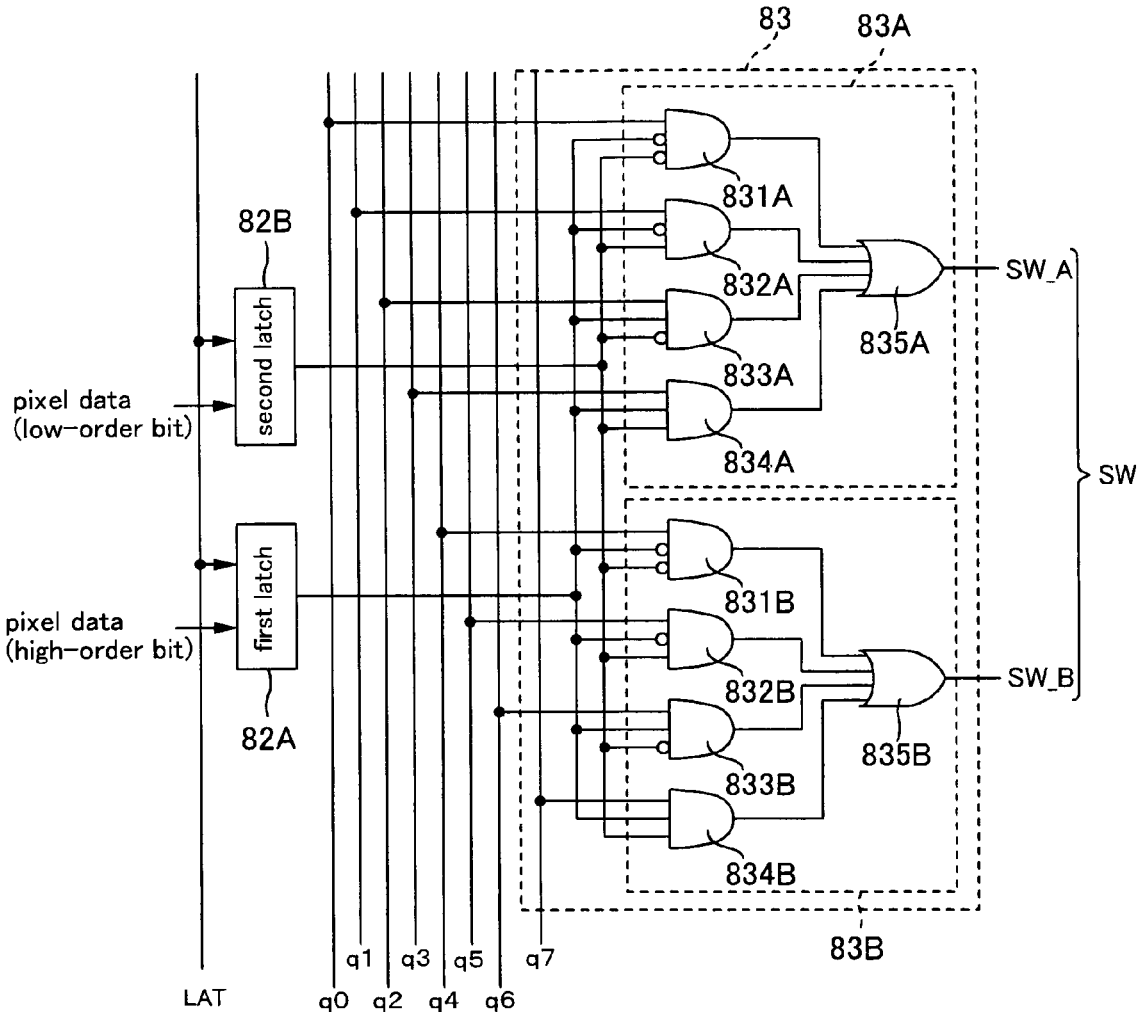
FIG. 21 is an explanatory diagram of a decoder.

The head controller HC is described next. Here, FIG. 19 is a block diagram illustrating the configuration of the head controller HC. FIG. 20 is an explanatory diagram of a control logic 84. FIG. 21 is an explanatory diagram of a decoder 83.

As shown in FIG. 19, the head controller HC is provided with a first shift register 81A, a second shift register 81B, a first latch circuit 82A, a second latch circuit 82B, a decoder 83, a control logic 84, a prevention circuit 2085, a first switch 86A, and a second switch 86B. Each of the sections other than the control logic 84 (that is, the first shift register 81A, the second shift register 81B, the first latch circuit 82A, the second latch circuit 82B, the decoder 83, the prevention circuit 2085, the first switch 86A, and the second switch 86B) is provided for each one of the piezo elements 417. Because a piezo element 417 is provided for each nozzle Nz from which ink is ejected, each of these sections is therefore provided for each nozzle Nz.

The head controller HC performs control for ejecting ink based on the pixel data SI from the printer-side controller 60. That is, the head controller HC controls the first switch 86A and the second switch 86B based on the print data and causes the necessary waveform sections of the first drive signal COM_A and the second drive signal COM_B to be selectively applied to the piezo elements 417. In this embodiment, the pixel data SI are made of two bits, and are delivered to the recording head 41 in synchronization with the clock signal CLK. The high-order bit group of the pixel data SI is set in the first shift registers 81A, and the low-order bit group is set in the second shift registers 81B. The first shift registers 81A are electrically connected to the first latch circuits 82A, and the second shift registers 81B are electrically connected to the second latch circuits 82B. When the latch signal LAT from the printer-side controller 60 becomes the H level, the first latch circuits 82A latch the high-order bit of the corresponding pixel data SI and the second latch circuits 82B latch the low-order bit of that pixel data SI. Each pixel data SI that has been latched by the first latch circuit 82A and the second latch circuit 82B (the pair of the high-order bit and the low-order bit) is input to the decoder 83.

The decoder 83 performs a decoding operation based on the high-order bit and the low-order bit of the pixel data SI, and outputs switch control signals SW (first switch control signal SW_A and second switch control signal SW_B; see FIG. 21) for controlling the first switch 86A and the second switch 86B. The switch control signals SW are output based on the combination of the selection data stored on the control logic 84 and the pixel data SI that have been latched by the first latch circuit 82A and the second latch circuit 82B.

Here, the control logic 84 and the selection data stored on the control logic 84 are described next. As shown in FIG. 20, the control logic has a plurality of registers RG each capable of storing one bit of data. Each register RG is constituted by a D-FF (delay flip flop) circuit or the like, and stores predetermined selection data.

For the sake of simplifying the description, in FIG. 20, the registers RG are disposed in a matrix of four registers in the column direction (vertical direction) and eight registers in the row direction (horizontal direction). The four registers RG belonging to the same column are grouped together, and starting from the group on the left are assigned numbers Q0 through Q7. The registers RG are divided between register groups located on the left side in the row direction (groups Q0 to Q3) and register groups located on the right side in the row direction (groups Q4 to Q7). Regarding the register groups located on the left side, the four registers belonging to the same row are grouped together and assigned numbers G11 to G14 in order from the group located at the top. The same goes for the register groups located on the right side, where the groups are assigned numbers G21 to G24 in order from the group located at the top.

The above groupings are made based on the role of the registers RG. First, the registers RG belonging to the groups Q0 to Q3 located on the left side in the row direction are capable of storing first selection data for the first drive signal COM_A. Similarly, the registers RG belonging to the groups Q4 to Q7 located on the right side in the row direction are capable of storing second selection data for the second drive signal COM_B. Furthermore, the registers RG belonging to the same column can store selection data used for the same gradation value. To describe this more specifically, the registers RG belonging to the group Q0 and the group Q4 are capable of storing selection data that correspond to the pixel data SI for no-dot formation (data value [00]). The registers RG belonging to the group Q1 and the group Q5 are capable of storing selection data that correspond to the pixel data SI for a small dot (data value [01]). Similarly, the registers RG belonging to the group Q2 and the group Q6 are capable of storing selection data that correspond to the pixel data SI for a medium dot (data value [10]), and the registers RG belonging to the group Q3 and the group Q7 are capable of storing selection data that correspond to the pixel data SI for a large dot (data value [11]).

The registers RG belonging to the same row can store selection data of the same waveform section. More specifically, the registers RG belonging to the group G11 can store selection data for the first waveform section SS211 generated in period T211. Likewise, the registers RG belonging to the group G12 can store selection data for the second waveform section SS212 generated in period T212. The registers RG belonging to the group G13 can store selection data for the third waveform section SS213 generated in period T213.

It should be noted that the registers RG belonging to the group G14 are not used in this embodiment. If the first drive signal COM_A is made of four waveform sections, then the registers RG of this group G14 store the selection data for a fourth waveform section.

The registers RG belonging to the group G21 store the selection data for the first waveform section SS221 generated in period T221, and the registers RG belonging to the group G22 store the selection data for the second waveform section SS222 generated in period T222. In this embodiment, the registers RG belonging to the group G23 and the registers RG belonging to the group G24 are not used.

To summarize the above, the registers RG of the control logic 84 can be said to store selection data determined by factors including the type of the corresponding drive signal (first drive signal COM_A, second drive signal COM_B), the corresponding pixel data SI (data value [00] through data value [11]), and the corresponding waveform section (for example, first waveform section SS211 or second waveform section SS222). For example, the register RG (Q0, G11) belonging to both group Q0 and group G11 stores selection data corresponding to the first waveform section SS211 of the first drive signal COM_A in pixel data SI for no-dot formation (data value [00]). The register RG (Q3, G13) belonging to both group Q3 and group G13 stores selection data corresponding to the third waveform section SS213 of the first drive signal COM_A in pixel data SI for a large dot (data value [11]). Similarly, the register RG (Q7, G22) belonging to both group Q7 and group G22 stores selection data corresponding to the second waveform section SS222 of the second drive signal COM_B in pixel data SI for a large dot (data value [11]).

Due to multiplexers MX0 through MX7, the selection data stored on the registers RG are sequentially selected at a timing defined by the latch pulse of the latch signal LAT, the change pulse of the first change signal CH_A, and the change pulse of the second change signal CH_B. That is, the timing defined by these pulses corresponds to the switch timing of the selection data. The selection data that are selected by the multiplexers MX0 to MX7 are then output through the control signal line groups CTL_A for the first drive signal COM_A and the control signal line group CTL_B for the second drive signal COM_B as first selection data q0 to q3 for the first drive signal COM_A and second selection data q4 to q7 for the second drive signal COM_B.

Here, the first selection data q0 are selection data corresponding to a gradation value for no dot. The first selection data q1 are selection data corresponding to a gradation value for a small dot. Likewise, the first selection data q2 are selection data corresponding to a gradation value for a medium dot, and the first selection data q3 are selection data corresponding to a gradation value for a large dot. On the other hand, the second selection data q4 are selection data corresponding to a gradation value for no dot, and the second selection data q5 are selection data corresponding to a gradation value for a small dot. Further, the second selection data q6 are selection data corresponding to a gradation value for a medium dot, and the second selection data q7 are selection data corresponding to a gradation value for a large dot.

It should be noted that the values of each register RG are set by serial transfer, using the program data and the clock SCLK in FIG. 20. Incidentally, when performing this setting, the first selection data q0 and the second selection data q4, which control the same gradation, are not both set to the data value [1]. That is because if this were to occur, the first drive signal generation section 70A and the second drive signal generation section 70B would short circuit.

The decoder 83 is described next. The decoder 83 selects selection data, from among the first selection data q0 to q3 and the second selection data q4 to q7, that correspond to the pixel data SI that have been latched, and outputs these as a switch control signal SW. The decoder 83 has a first decoding section 83A that outputs a first switch control signal SW_A and a second decoding section 83B that outputs a second switch control signal SW_B.

The first decoding section 83A has four AND gates 831A to 834A, and a single OR gate 835A. Each AND gate 831A to 834A has three input terminals and one output terminal, and, as its input, receives one of the first selection data q0 to q3, the data of the high-order bit of the pixel data SI, and the data of the low-order bit of the pixel data SI. The AND gates 831A to 834A differ in the manner in which they receive the data of the high-order bit and the data of the low-order bit of the pixel data SI as its input.

That is, the AND gate 831A receives the first selection data q0*d* for no-dot formation, the inverted data of the high-order bit, and the inverted data of the low-order bit of the pixel data SI. Thus, if the pixel data SI are the data value [00], then the output from the AND gate 831A is in accordance with the first selection data q0 for no-dot formation. The AND gate 832A receives the first selection data q1 for a small dot, the inverted data of the high-order bit, and the data of the low-order bit of the pixel data SI. Thus, if the pixel data SI are the data value [01], then the output from the AND gate 832A is in accordance with the first selection data q1 for a small dot. Similarly, the AND gate 833A receives the first selection data q2 for a medium dot, the data of the high-order bit, and the inverted data of the low-order bit of the pixel data SI. Thus, if the pixel data SI are the data value [10], then the output from the AND gate 833A is in accordance with the first selection data q2 for a medium dot. The AND gate 834A receives the first selection data q3 for a large dot, the data of the high-order bit, and the data of the low-order bit of the pixel data SI. Thus, if the pixel data SI are the data value [11], then the output from the AND gate 834A is in accordance with the first selection data q3 for a large dot.

The OR gate 835A has four input terminals and one output terminal. Its four input terminals receive the output of the AND gates 831A to 834A, respectively. The OR gate 835A outputs a first switch control signal SW_A. That is, it outputs selection data, of among the first selection data q0 to q3, that corresponds to the latched pixel data SI as the first switch control signal SW_A.

The second decoding section 83B also has four AND gates 831B to 834B and a single OR gate 835B. The second decoding section 83B has the same configuration as the first decoding section 83A. That is, the AND gate 831B receives the second selection data q4 for no-dot formation, the inverted data of the high-order bit, and the inverted data of the low-order bit of the pixel data SI. The AND gate 832B receives the second selection data q5 for a small dot, the inverted data of the high-order bit, and the data of the low-order bit of the pixel data SI. The AND gate 833B receives the second selection data q6 for a medium dot, the data of the high-order bit, and the inverted data of the low-order bit of the pixel data SI. The AND gate 834B receives the first selection data q7 for a large dot, the data of the high-order bit, and the data of the low-order bit of the pixel data SI. The OR gate 835B receives the output of the four AND gates 831B to 834B. The OR gate 835B then outputs selection data, of among the second selection data q4 to q7, that corresponds to the latched pixel data SI as a second switch control signal SW_B.

The first switch control signal SW_A and the second switch control signal SW_B that are output from the decoder 83 are input to a first switch 86A and a second switch 86B. The first switch 86A and the second switch 86B switch between an ON state and an OFF state due to a change in their resistance. For example, in the ON state their resistance is on the order of 100 Ω, whereas in the OFF state their resistance is several tens of MΩ or more. When the first switch 86A and the second switch 86B are used, it is difficult for switching noise to occur when switching between the states of the first switch 86A and the second switch 86B. It is therefore possible to reliably prevent problems such as a flow-through current flowing when switching the drive signal COM.

The first drive signal COM_A from the drive signal generation circuit 70 is applied to the input side of the first switch 86A, and the second drive signal COM_B from the drive signal generation circuit 70 is applied to the input side of the second switch 86B. A piezo element 417 is electrically connected to the output side of both the first switch 86A and the second switch 86B. The first switch 86A and the second switch 86B are switches that are provided for each drive signal COM that is generated, and selectively apply the waveform sections SS211 to SS213 making up the first drive signal COM_A and the waveform sections SS221 and SS222 making up the second drive signal COM_B to the corresponding piezo element 417.

The first switch control signal SW_A controls the operation of the first switch 86A, and the second switch control signal SW_B controls the operation of the second switch 86B. That is, the first switch control signal SW_A corresponds to the switch control signal for the first switch 86A. Likewise, the second switch control signal SW_B corresponds to an other switch control signal for the second switch 86B. Specifically, if the first switch control signal SW_A is the data value [1], then the first switch 86A becomes on and the first drive signal COM_A is applied to the piezo elements 417. If the first switch control signal SW_A is the data value [0], then the first switch 86A becomes off and thus the first drive signal COM_A is not applied to the piezo element 417. Similarly, if the second switch control signal SW_B is the data value [1], then the second switch 86B becomes on and the second drive signal COM_B is applied to the piezo element 417. If the second switch control signal SW_B is the data value [0], then the second switch 86B becomes off and thus the second drive signal COM_B is not applied to the piezo element 417.

It should be noted that the piezo elements 417 act like capacitors. Thus, if application of the drive signal COM is stopped, then the piezo element 417 retains the potential immediately before that stoppage. Consequently, during the time that application of the drive signal COM is stopped, the piezo element 417 maintains the deformed state that it was in immediately prior to that stoppage of application of the drive signal COM.

In this embodiment, the prevention circuit 2085 is disposed between the decoder 83 and the first switch 86A and the second switch 86B. The prevention circuit 2085 corresponds to a controller for preventing the first drive signal COM_A and the second drive signal COM_B from being simultaneously applied to a single piezo element 417. That is, the prevention circuit 2085 puts both the first switch 86A and the second switch 86B in an OFF state when switching the drive signal that is to applied to the piezo element 417 from one of the first drive signal COM_A and the second drive signal COM_B to the other. That is, the prevention circuit 2085 forcibly puts the first switch 86A in an OFF state at a timing that the content of the first switch control signal SW_A is changed. Similarly, the prevention circuit 2085 forcibly puts the second switch 86B in an OFF state at the timing that the content of the second switch control signal SW_B is changed. It should be noted that the prevention circuit 2085 is described in further detail later.

<(2) Gradation Control>

Figure 22:
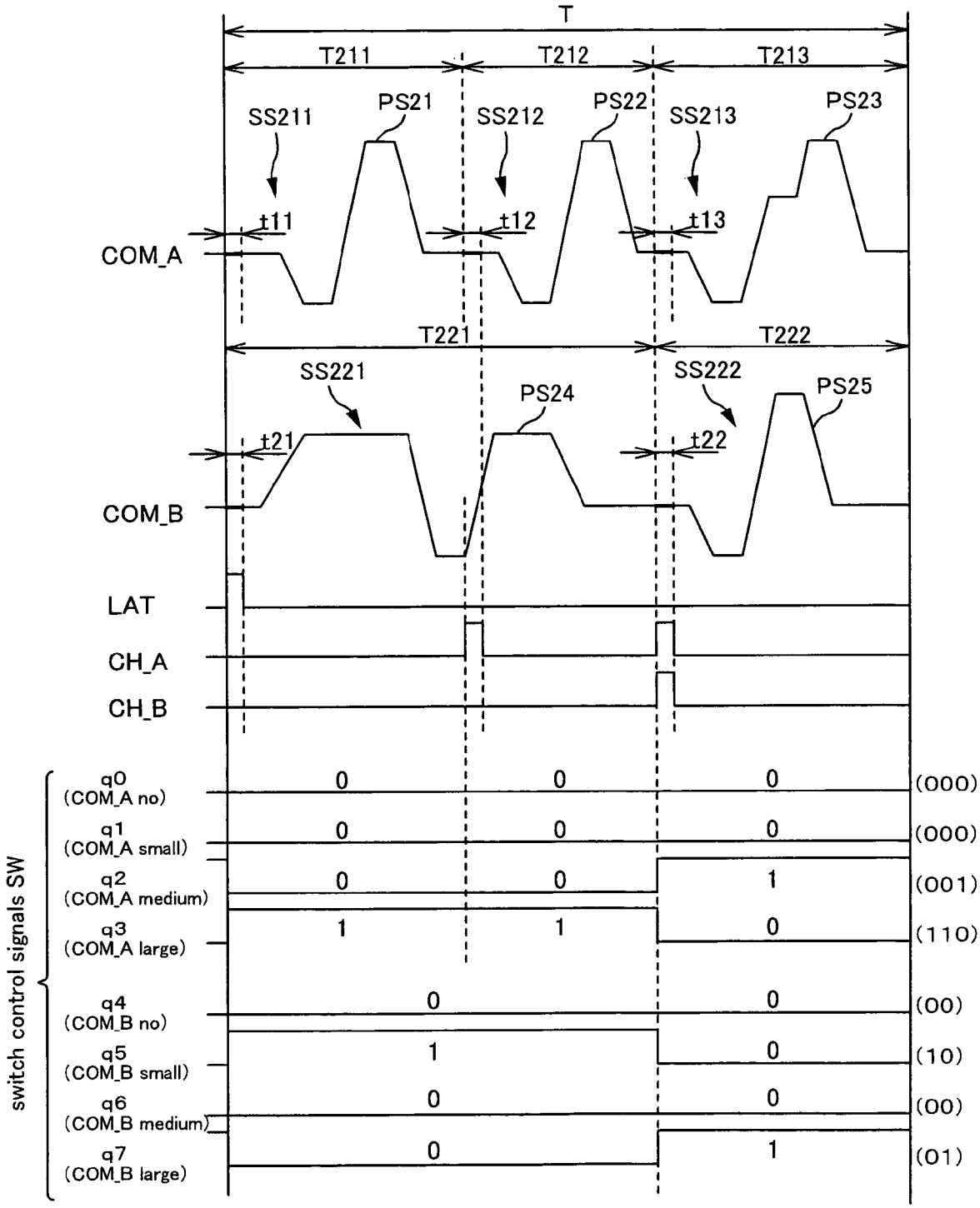
FIG. 22 is a diagram that describes a first drive signal, a second drive signal, and necessary control signals.
Figure 23:
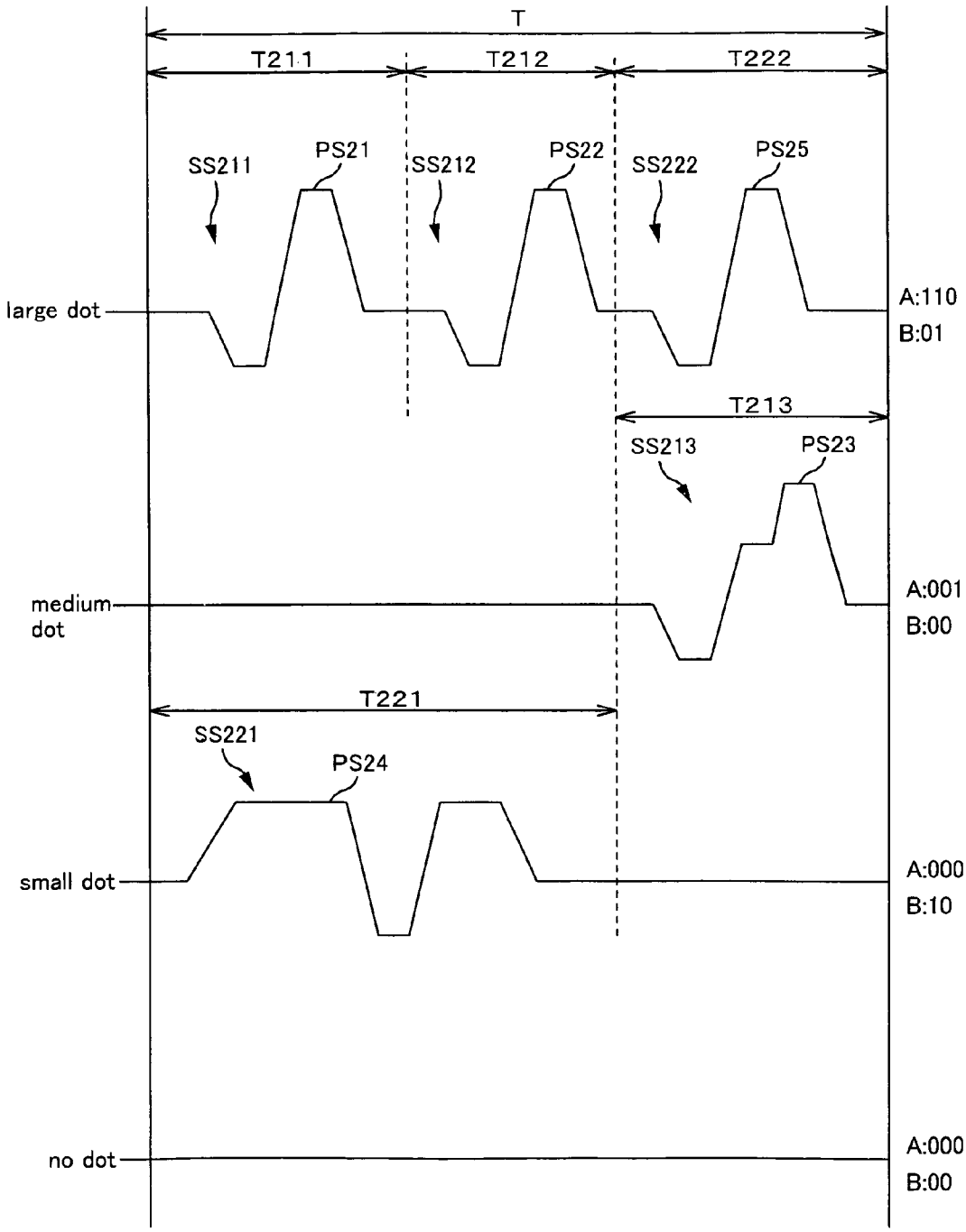
FIG. 23 is a diagram that illustrates waveform sections that are applied to piezo elements when forming a large dot, when forming a medium dot, and when forming a small dot.

Gradation control in the printer 1 is described next. Here, FIG. 22 is a diagram that describes the first drive signal COM_A, the second drive signal COM_B, and the necessary control signals. FIG. 23 is a diagram that describes the waveform sections that are applied to a piezo element 417 when forming a large dot, when forming a medium dot, and when forming a small dot. With this gradation control, the operation of the first switch 86A and the operation of the second switch 86B are controlled based on the first switch control signal SW_A and the second switch control signal SW_B, as mentioned above.

The case of forming a large dot (pixel data SI of [11]) is described first. In this case, the decoder 83 selects the first selection data q3 and the second selection data q7 based on the pixel data SI that indicate the formation of a large dot. Then, the first selection data q3 are output as the first switch control signal SW_A and the second selection data q7 are output as the second switch control signal SW_B. In this embodiment, the first switch control signal SW_A becomes the data [110] according to the time series T211, T212, and T213, and the second switch control signal SW_B becomes the data value [01] according to the time series T221 and T222. Thus, as shown in the uppermost stage of FIG. 23, the first drive signal COM_A is applied to the piezo element 417 in periods T211 and T212, and the second drive signal COM_B is applied to the piezo element 417 in period T222. That is, the drive signal COM that is applied to the piezo element 417 is switched in periods T212 and T222. As a result, the drive pulse PS21 of the first waveform section SS211 of the first drive signal COM_A, the drive pulse PS22 of the second waveform section SS212 of the first drive signal COM_A, and the drive pulse PS25 of the second waveform section SS222 of the second drive signal COM_B are applied to the piezo element 417 in order, causing the ejection of an amount of ink that corresponds to a large dot from the nozzle Nz.

The case of forming a medium dot (pixel data SI having the data value [10]) is described next. In this case, the decoder 83 selects the first selection data q2 and the second selection data q6 in response to pixel data SI that indicate the formation of a medium dot, and outputs these as the first switch control signal SW_A and the second switch control signal SW_B. In this embodiment, the first switch control signal SW_A becomes the data value [001], and the second switch control signal SW_B becomes the data value [00]. Thus, as shown in the upper middle stage of FIG. 23, the first drive signal COM_A is applied to the piezo element 417 in period T213, and the second drive signal COM_B is not applied to the piezo element 417. Consequently, the drive pulse PS23 of the third waveform section SS213 of the first drive signal COM_A is applied to the piezo element 417, causing the ejection of an amount of ink that corresponds to a medium dot from the nozzle Nz.

The case of forming a small dot (pixel data SI having the data value [01]) is described next. In this case, the decoder 83 selects the first selection data q1 and the second selection data q5 in response to pixel data SI that indicate the formation of a small dot, and outputs these as the first switch control signal SW_A and the second switch control signal SW_B. In this embodiment, the first switch control signal SW_A becomes the data value [000], and the second switch control signal SW_B becomes the data value [10]. Thus, as shown in the lower middle stage of FIG. 23, the second drive signal COM_B is applied to the piezo element 417 in period T221, and the first drive signal COM_A is not applied to the piezo element 417. Consequently, the drive pulse PS24 of the first waveform section SS221 of the second drive signal COM_B is applied to the piezo element 417, causing the ejection of an amount of ink that corresponds to a small dot from the nozzle Nz.

It should be noted that in the case of no dot formation (pixel data SI having the data value [00]), the decoder 83 selects the first selection data q0 and the second selection data q4 in response to pixel data SI that indicate no dot formation, and outputs these as the first switch control signal SW_A and the second switch control signal SW_B. In this embodiment, the first switch control signal SW_A becomes the data value [000], and the second switch control signal SW_B becomes the data value [00].

Thus, as shown in the lowermost stage of FIG. 23, neither the first drive signal COM_A nor the second drive signal COM_B is applied to the piezo element 417.

===(2) Overview of the Second Embodiment===

<(2) Switch Control Signals SW>

Figure 24A:
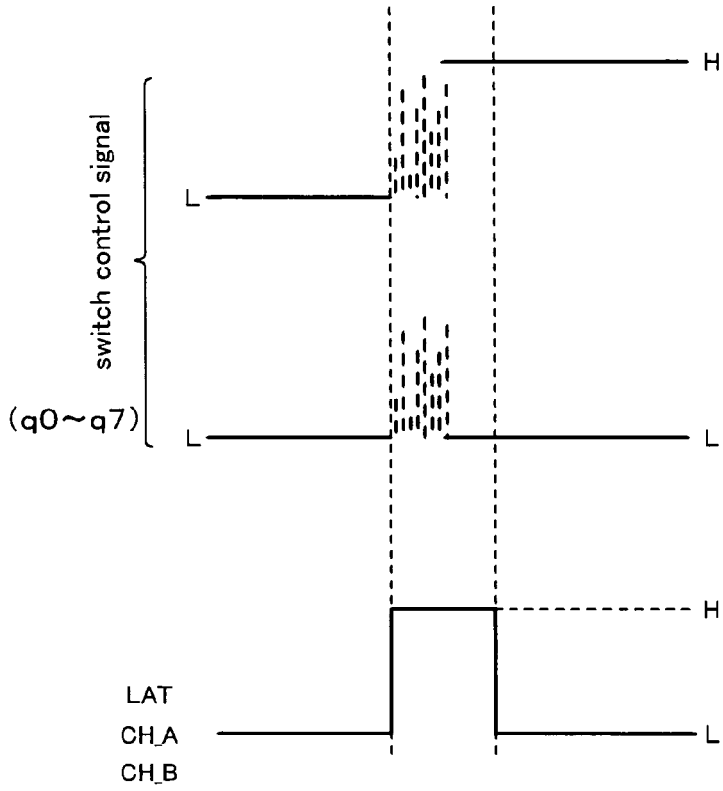
FIG. 24A schematically illustrates the change in voltage of a switch control signal at a switch timing, and FIG. 24B schematically illustrates a state in which a first switch and a second switch have been put in the ON state simultaneously.
Figure 24B:
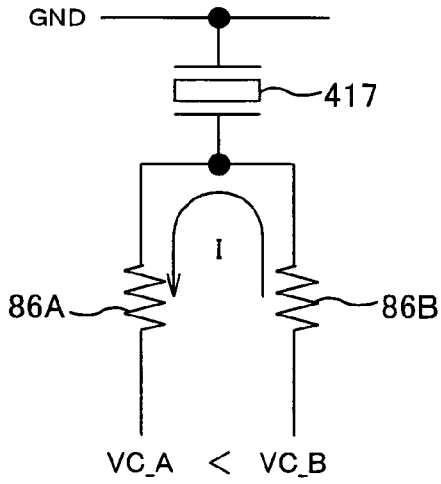

The purpose of the above description is to describe the configuration of the printer 1, and assumes ideal conditions. Thus, the first switch control signal SW_A and the second switch control signal SW_B did not simultaneously indicate the ON level (for example, the data value [1]). However, when the printer 1 is operated in practice, there is the possibility that an undesirable logic will occur, for example, and cause the first switch control signal SW_A and the second switch control signal SW_B to simultaneously become the ON level. Here, FIG. 24A is a schematic diagram that illustrates the change in voltage of the switch control signals SW at the switch timing. FIG. 24B is a diagram that schematically illustrates an instance in which the first switch 86A and the second switch 86B have been turned ON simultaneously.

As shown in FIG. 24A, the content of the switch control signals SW (first switch control signal SW_A, second switch control signal SW_B) are updated at the occasion of the latch pulse of the latch signal LAT, the change pulse of the first change signal CH_A, and the change pulse of the second change signal CH_B (hereinafter, these pulses are collectively referred to as "timing pulses"). At the time of this update, there is the possibility for a period to occur in which the switch control signal SW is undetermined and the logic level that it will take is unclear. There are various conceivable reasons as to why undesirable logic levels occur, one being the operation of the logic circuit. As mentioned above, the decoder 83 and the control logic 84 have constitutional elements such as numerous gates (AND gates 831A to 834A, 831B to 834B, OR gates 835A and 835B), registers RG, and multiplexers MX0 to MX7. When these constitutional elements are operated, the constitutional elements normally have different delay times. Thus, until the state is finally determined, there is a possibility that an undesirable logic level may occur.

It should be noted that undesirable logic levels can occur both when the content of the switch control signal SW changes before and after the switch timing as well as when it stays the same. As mentioned above, the selection data for each waveform section are stored on the registers RG of the control logic 84. Thus, even if the content of the switch control signal SW is the same before and after the switch timing, the selection data on which that content is based are stored on different registers RG. For example, the three data values of the selection data q0 are all [0] in the periods T211, T212, and T213 of the repeating cycle T. However, the data used in period T211 are stored on the register RG (Q0, G11), the data used in period T212 are stored on the register PG (Q0, G12), and the data used in period T213 are stored on the register RG (Q0, G13). Thus, it is necessary for the multiplexer MX0 to switch the register RG from which to read the selection data q0 at the occasion of the change pulse of the first change signal CH_A, and there is a possibility that this switching operation may result in an undesired logic level at the time of switching.

At the timing at which switching between the first drive signal COM_A and the second drive signal COM_B occurs, there is the possibility that an undesirable logic level will occur and cause both the first switch control signal SW_A and the second switch control signal SW_B to be in the ON level. In the example of FIG. 22, there is a possibility that these switch control signals SW_A and SW_B will both enter the ON level in the period that the latch pulse of the latch signal LAT is generated. There is also a possibility that the switch control signals SW_A and SW_B will both become the ON level during a period in which the change pulse of the first change signal CH_A and the change pulse of the second change signal CH_B are generated simultaneously. Specifically, there is a possibility that the switch control signals SW_A and SW_B will both be in the ON level in the period during which the second change pulse of the first change signal CH_A is generated, that is, in the period during which the change pulse of the second change signal CH_B is generated.

When the switch control signals SW_A and SW_B both are the ON level, the corresponding switches 86A and 86B become on. As illustratively shown in FIG. 24B, in the ON state, the resistance values of the switches 86A and 86B both drop to approximately 100 Ω. For design reasons, at this switch timing the voltage of the first drive signal COM_A and the voltage of the second drive signal COM_B match the intermediate voltage VC, which serves as the reference. In practice, however, there may be discrepancies in the printer 1 between the first drive signal generation section 70A and the second drive signal generation section 70B, causing the intermediate voltage VC_A of the first drive signal COM_A and the intermediate voltage VC_B of the second drive signal COM_B to differ from one another. In this case, current flows to the side with the lower intermediate voltage VC. If, for example, the intermediate voltage VC_A of the first drive signal COM_A were lower than the intermediate voltage VC_B of the second drive signal COM_B, then a current I would flow toward the first drive signal generation section 70A. This current I is not only a current that is not necessary but also has a possibility to reach a high value, and thus may have an adverse effect on the first drive signal generation section 70A.

<(2) First Switch 86A, Second Switch 86B>

Figure 25A:
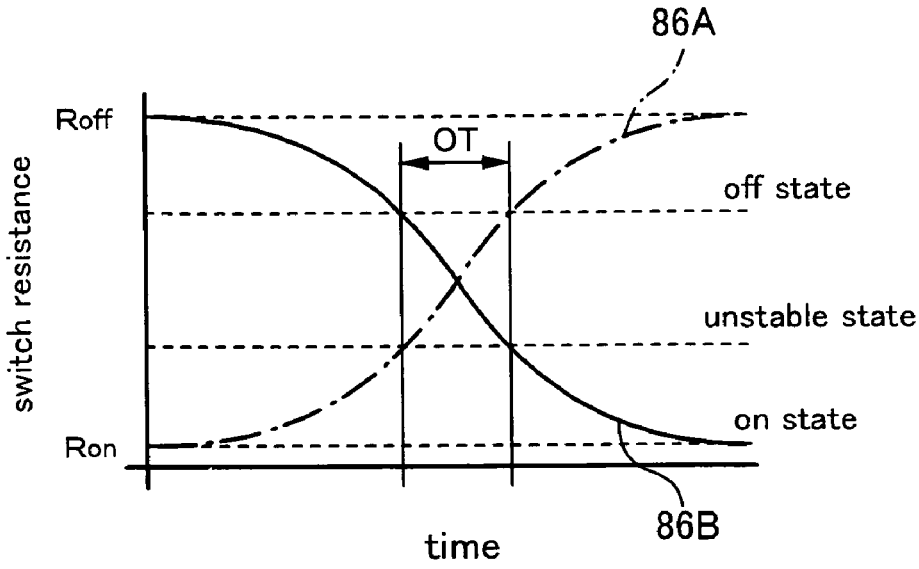
FIG. 25A is a diagram for describing a change in the state of the first switch and the second switch.
Figure 25B:
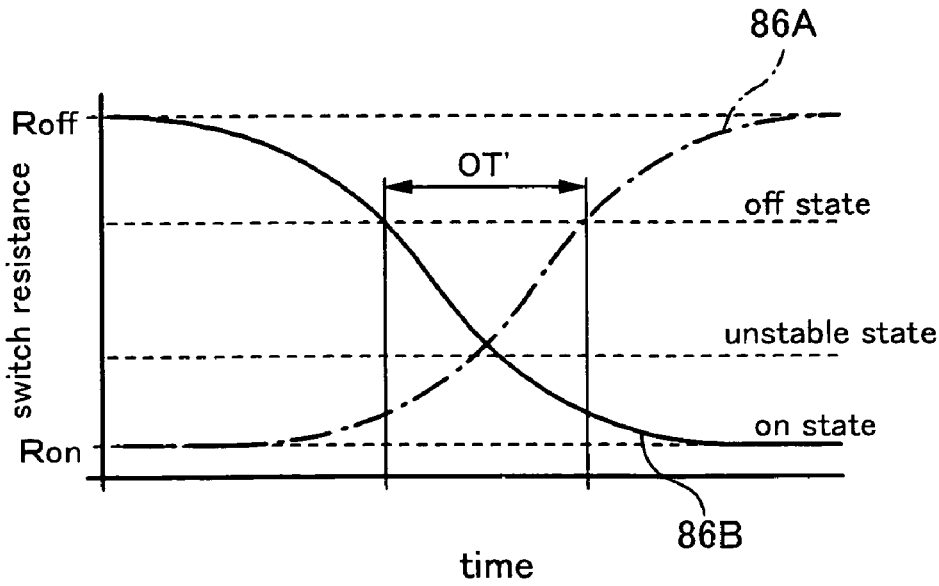
FIG. 25B is a diagram for describing another change in state of the first switch and the second switch.

There is also a possibility that the first switch 86A and the second switch 86B will simultaneously be in the ON state when the first switch 86A and the second switch 86B are switched between the ON and OFF states. Here, FIG. 25A is a diagram that illustrates the change in state of the first switch 86A and the second switch 86B. FIG. 25B is a diagram that illustrates another change in state of the first switch 86A and the second switch 86B.

The first switch 86A and the second switch 86B are switched between the ON and OFF states by changing their resistance, and thus for example, as shown in FIG. 25A, they change between an OFF state, an unstable state, and an ON state in correspondence with their resistance. Here, the unstable state is a state that can become either the ON state or the OFF state. Thus, in a case where, as shown by the long-short dashed line in the drawing, the first switch 86A is switched from the OFF state to the ON state, and as shown by the solid line in the drawing, the second switch 86B is switched from the ON state to the OFF state, then there is a possibility that both the first switch 86A and the second switch 86B will be in the ON state over the period indicated by the OT marking. Further, if there is a discrepancy between the timing at which the first switch 86A becomes off and the timing at which the second switch 86B becomes on, then as indicated by the marking OT', there is an increased likelihood that the first switch 86A and the second switch 86B both will be in the ON state. If the first switch 86A and the second switch 86B both are in the ON state, then, as illustrated in FIG. 24B, a flow-through current will occur between the drive circuits and may have an adverse effect.

Accordingly, in this embodiment, such adverse effects are prevented by the prevention circuit 2085, which acts as a controller, controlling the operations of the first switch 86A, which controls the application of the first drive signal COM_A to the piezo element 417, and the second switch 86B, which controls the application of the second drive signal COM_B to the piezo element 417. That is, the prevention circuit 2085 puts both the first switch 86A and the second switch 86B into the OFF state when switching the drive signal COM that is to be applied to the piezo element 417 from one of the first drive signal COM_A and the second drive signal COM_B to the other. Adopting such a configuration allows prevention of the problem of a flow-through current flowing when the drive signal COM is switched, even if there is a difference between the voltage of the first drive signal COM_A and the second drive signal COM_B.

===(2) Prevention Circuit===

<(2) Configuration of the Prevention Circuit 2085>

Figure 26:
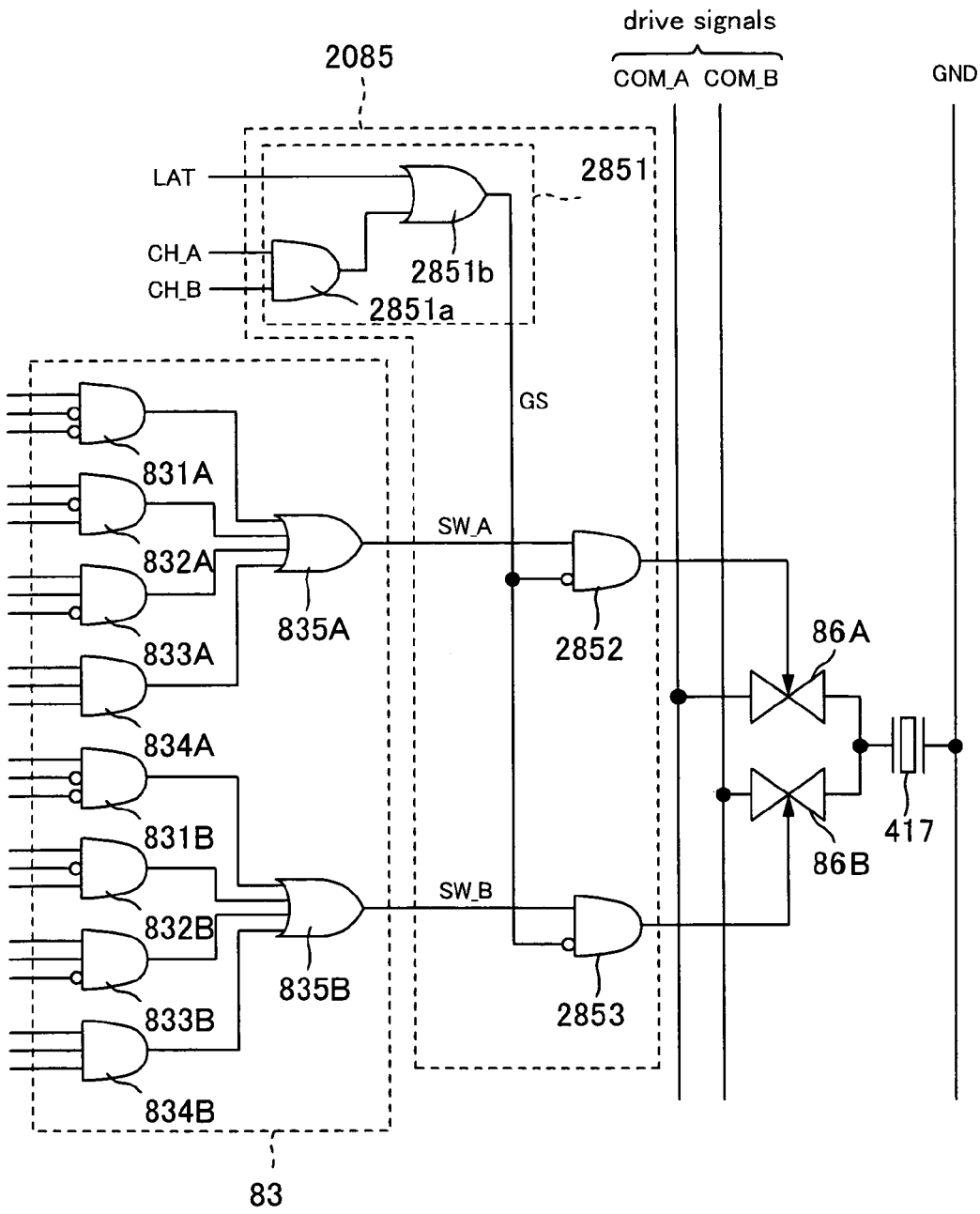
FIG. 26 is a diagram that shows a configuration of a prevention circuit.
Figure 27A:
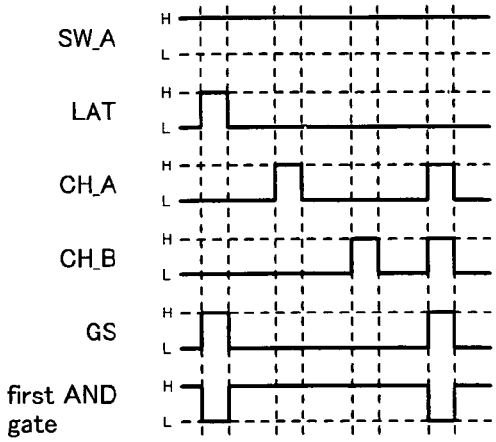
FIG. 27A is a diagram for describing the relationship between a first switch control signal and an output of a first AND gate.
Figure 27B:
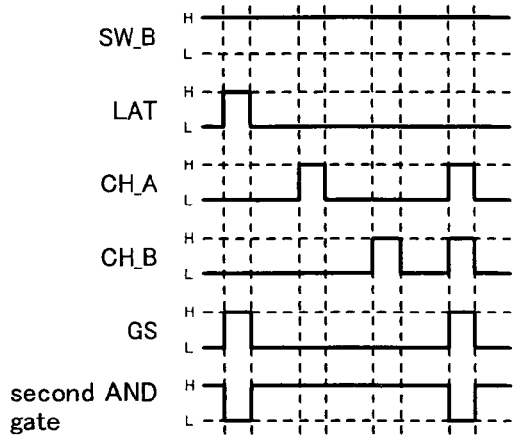
FIG. 27B is a diagram for describing the relationship between a second switch control signal and an output of a second AND gate.
Figure 28:
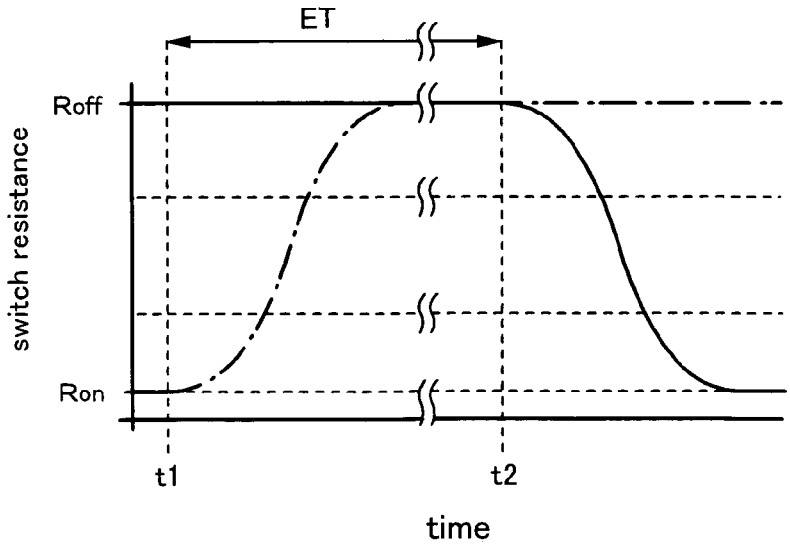
FIG. 28 schematically shows the relationship between timings of the rising edge and the falling edge of a timing pulse, and the change in resistance value of the first switch and the second switch.

The configuration of the prevention circuit 2085 is described next. Here, FIG. 26 is a diagram that shows the configuration of the prevention circuit. FIG. 27A is a diagram for describing the relationship between the first switch control signal SW_A and the output of a first AND gate 2852. FIG. 27B is a diagram for describing the relationship between the second switch control signal SW_B and the output of a second AND gate 2853. FIG. 28 is a diagram that schematically illustrates the relationship between the rising edge and the falling edge of the timing pulse and the change in resistance of the first switch 86A and the second switch 86B.

The prevention circuit 2085 has a gate control signal output section 2851, a first AND gate 2852, and a second AND gate 2853. The gate control signal output section 2851 outputs a gate control signal GS based on the latch signal LAT, the first change signal CH_A, and the second change signal CH_B. Here, the gate control signal GS is a signal for determining whether or not to output the first switch control signal SW_A and the second switch control signal SW_B to the first switch 86A and the second switch 86B. That is, the gate control signal GS is a signal for determining whether to enable or disable the first switch control signal SW_A and the second switch control signal SW_B. The gate control signal output section 2851 has an AND gate 2851*a* and an OR gate 2851*b*. The AND gate 2851*a* has two input terminals and one output terminal. The first change signal CH_A is input to one of its input terminals and the second change signal CH_B is input to its other input terminal. The OR gate 2851*b* also has two input terminals and one output terminal. The latch signal LAT is input to one of its input terminals and the signal from the AND gate 2851*a* is input to its other input terminal.

The gate control signal GS that is output from the gate control signal output section 2851 becomes H level if the latch signal LAT is at H level (the level when the data value is [1]). The gate control signal GS also becomes H level when the first change signal CH_A and the second change signal CH_B both are at H level. In all other cases the gate control signal GS is at L level. In other words, the gate control signal GS becomes H level at the times where there is a possibility that the drive signal COM that is to be applied to the piezo element 417 will be switched from one of the first drive signal COM_A and the second drive signal COM_B to the other.

The first AND gate 2852 corresponds to the first gate of the controller. The first AND gate 2852 has two input terminals and one output terminal. The first switch control signal SW_A is input to one of its input terminals, and the inverted gate control signal GS is input to its other input terminal. The second AND gate 2853 corresponds to the second gate of the controller. The second AND gate 2853 also has two input terminals and one output terminal. The second switch control signal SW_B is input to one of its input terminals, and the inverted gate control signal GS is input to its other input terminal. The first AND gate 2852 and the second AND gate 2853 output the first switch control signal SW_A and the second switch control signal SW_B if the gate control signal GS is at the L level (this corresponds to the predetermined level). That is, the first switch control signal SW_A and the second switch control signal SW_B are enabled.

On the other hand, if the gate control signal GS is at the H level (this corresponds to the other predetermined level), then the output of the first AND gate 2852 and the second AND gate 2853 is set to the L level, irrespective of the first switch control signal SW_A and the second switch control signal SW_B. That is, the first AND gate 2852 outputs a first OFF control signal for putting the first switch 86A into the OFF state. Similarly, the second AND gate 2853 outputs a second OFF control signal for putting the second switch 86B into the OFF state. As a result, the first switch control signal SW_A and the second switch control signal SW_B are disabled.

The gate control signal GS becomes the H level when the drive signal COM that is applied to the piezo element 417 is switched from one of the first drive signal COM_A and the second drive signal COM_B to the other. Specifically, it changes from the L level to the H level at the timing of the rising edge of the timing pulses (latch pulse, change pulses), and changes from the H level to the L level at the timing of the falling edge thereof. Thus, the output from the first AND gate 2852 and the second AND gate 2853 is at L level over the period during which the drive signal COM is being switched. The signal that is output from the first AND gate 2852 is input to the first switch 86A and the signal that is output by the second AND gate 2853 is input to the second switch 86B. As a result, the first switch 86A and the second switch 86B both are put into the OFF state for the duration of the period during which the drive signal COM is being switched.

Here, the period during which the first switch 86A and the second switch 86B both are put into the OFF state, that is, the period ET from the timing t1 of the rising edge to the timing t2 of the falling edge of the timing pulse, is set longer than the time necessary to change the resistance value at which the first switch 86A and the second switch 86B are ON to the resistance value at which they are OFF. Thus, the first switch, 86A and the second switch 86B both are off at the moment that the drive signal COM to be applied to the piezo element 417 is switched. After that, the switch on the side to which the drive signal COM is to be applied is set to the ON state. In this way, the first switch 86A and the second switch 86B are switched to the ON state after first passing through the OFF state, and thus the problem of both switches being in the ON state at the same time can be reliably prevented. Thus, the flow-through current I that flows due to the difference in intermediate voltages VC can be reliably prevented.

In this embodiment, the period during which the first switch 86A and the second switch 86B are put into the OFF state is determined using the timing pulses mentioned above. Specifically, the timing of the forward edge and the timing of the rear edge of the timing pulse are taken as a reference for control of the first switch 86A and the second switch 86B. Thus, the respective timing at which the first switch 86A and the second switch 86B are put into the ON state and the OFF state can be matched to one another. As a result, it is possible to reliably prevent the problem of the first switch 86A and the second switch 86B being in the ON state simultaneously.

Further, in this embodiment, the prevention circuit 2085 is made of logic circuits such as AND gates and OR gates. The operation of the first AND gate 2852 and the second AND gate 2853 is controlled by the gate control signal GS. This feature allows its structure to be made simple, making it suited for high-speed processing.

===(2) Alternative Embodiment===

Figure 29:
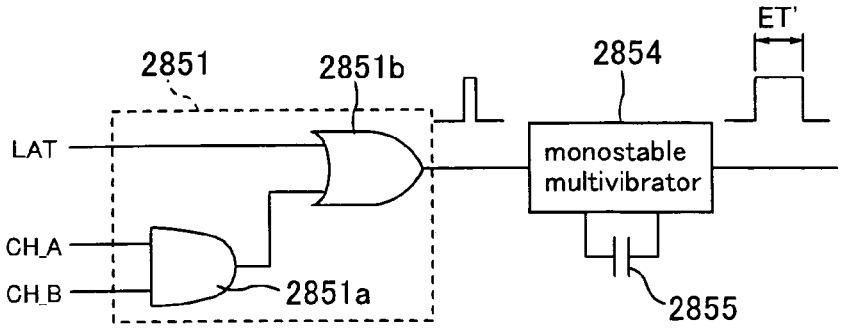
FIG. 29 is a diagram for describing another embodiment.

It should be noted that the prevention circuit 2085 of the second embodiment discussed above determines the period in the which the first switch 86A and the second switch 86B are put into the OFF state using the rising edge and the falling edge of the timing pulse. Thus, there is no degree of freedom with regard to setting the period in which they are put into the OFF state, and thus it was necessary to adopt a design with which the latch pulse LAT, the first change signal CH_A, and the second change signal CH_B have a suitable pulse width. If the period of the OFF state could be set without regard to the timing pulses, then it would be possible to optimize the off time, and this is favorable. An alternative embodiment having such a configuration is described below. Here, FIG. 29 is a diagram for describing this alternative embodiment.

This other embodiment differs from the second embodiment discussed above in that a monostable multivibrator 854 is provided between the gate control signal output section 2851 and the first AND gate 2852. The monostable multivibrator 854 outputs an H-level signal for the duration of a predetermined period based on the timing pulse. That is, the monostable multivibrator 854 functions as a timer. The time ET' during which the signal output by the monostable multivibrator 854 is at H level, that is, the period during which the first switch 86A and the second switch 86B are to be in the OFF state, can be adjusted by changing the capacity of a capacitor 855 connected to the monostable multivibrator 854. Consequently, in this embodiment it is possible to optimize the period during which the first switch 86A and the second switch 86B are put into the OFF state. It is also possible to precisely determine the period during which they are to be put into the OFF state.

===(2) Other Embodiments===

The foregoing embodiments primarily describe a printing system 100 that includes a printer 1, but they also include the disclosure of methods of applying drive signals and liquid ejection systems, etc. The foregoing embodiments are for the purpose of elucidating the present invention, and are not to be interpreted as limiting the present invention. The invention can of course be altered and improved without departing from the gist thereof, and includes equivalents. In particular, the embodiments mentioned below also fall within the scope of the invention.

<(2) Gate Control Signal Output Section>

Figure 30:
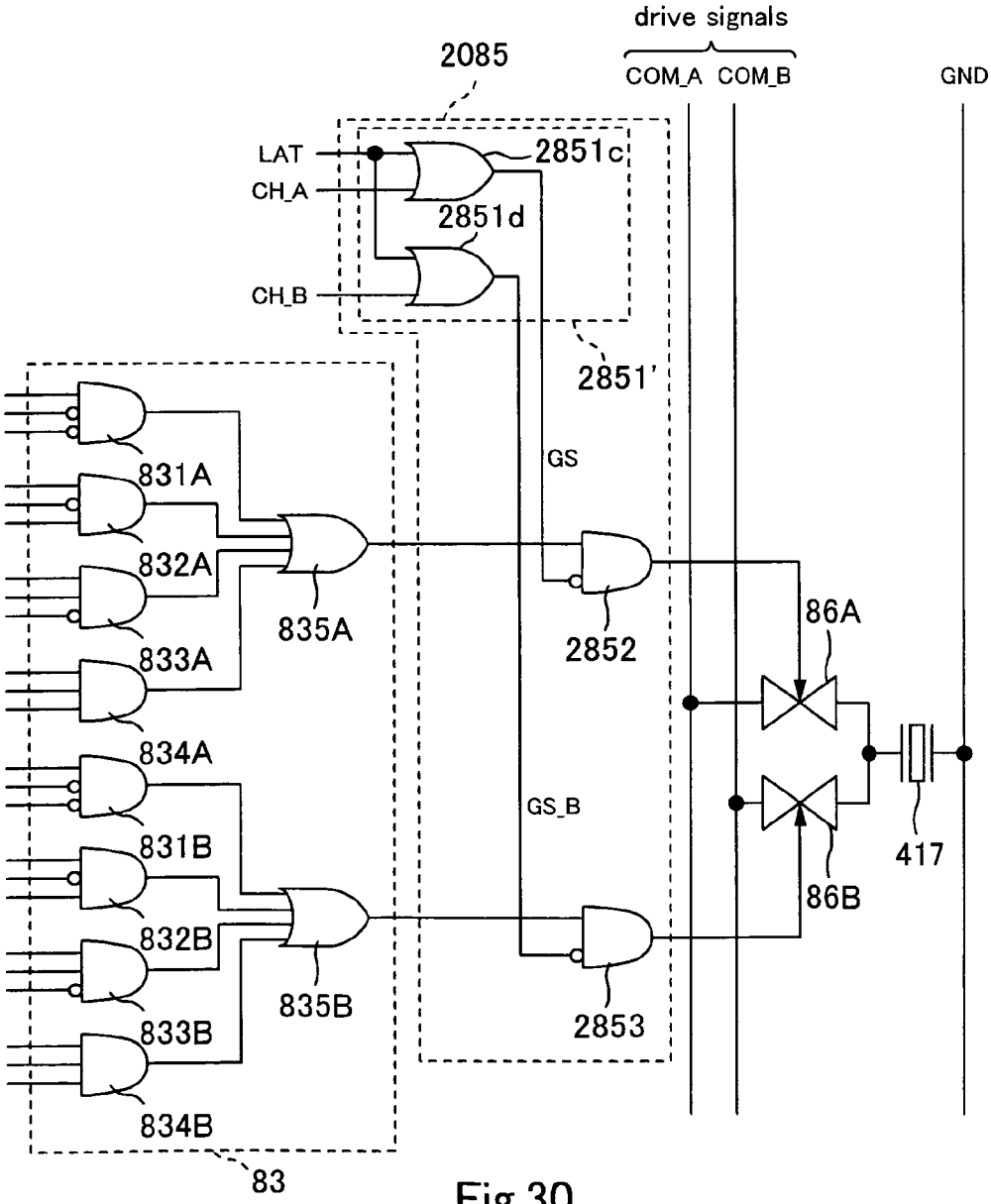
FIG. 30 is a diagram for describing a gate control signal output section in the other embodiment.
Figure 31A:
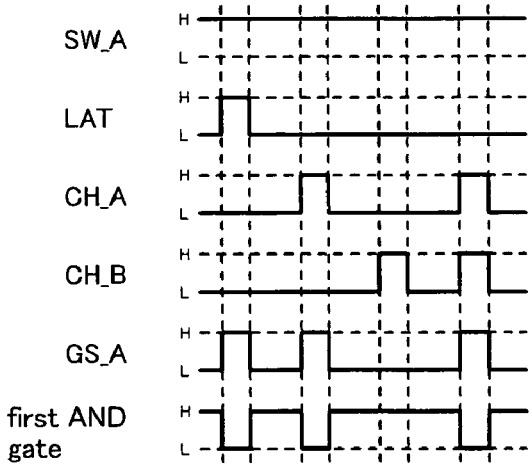
FIG. 31A is a diagram for describing the relationship between the first switch control signal and the output of the first AND gate.
Figure 31B:
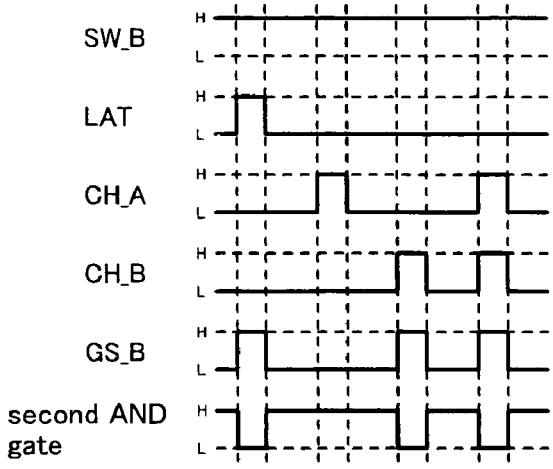
FIG. 31B is a diagram for describing the relationship between the second switch control signal and the output of the second AND gate.

In the second embodiment and the alternative embodiment, the gate control signal output section 2851 has a first AND gate 2852 and a second AND gate 2853, which output a common gate control signal GS. There is no limitation to this embodiment, however. Here, FIG. 30 illustrates a gate control signal output section 2851' according to another embodiment. FIG. 31A is a diagram that describes the relationship between the first switch control signal SW_A and the output of the first AND gate 2852. FIG. 31B is a diagram that describes the relationship between the second switch control signal SW_B and the output of the second AND gate 2853.

The gate control signal output section 2851' outputs a first gate control signal GS_A for the first AND gate 2852 and a second gate control signal GS_B for the second AND gate 2853. That is, the gate control signal output section 2851' has a first OR gate 2851*c* and a second OR gate 2851*d*.

The first OR gate 2851*c* has two input terminals and one output terminal. The latch signal LAT is input to one of the input terminals, and the first change signal CH_A is input to the other input terminal. Thus, the first gate control signal GS_A that is output from the first OR gate 2851*c* becomes H level in synchronization with either the latch pulse of the latch signal LAT or the change pulse of the first change signal CH_A.

The second OR gate 2851*d* has two input terminals and one output terminal. The latch signal LAT is input to one of the input terminals, and the second change signal CH_B is input to the other input terminal. Thus, the second gate control signal GS_B that is output from the second OR gate 2851*d* becomes H level in synchronization with either the latch pulse of the latch signal LAT or the change pulse of the second change signal CH_B.

This embodiment attains the same actions and effects as those discussed earlier in the second embodiment.

Further, these examples adopt a configuration in which the first switch 86A and the second switch 86B are controlled using the gate control signal output sections 2851 and 2851', but there is no limitation to these configurations. That is, it is only necessary that the first switch 86A and the second switch 86B can both be put into the OFF state.

<(2) Drive Elements>

In the above embodiment, ink was ejected using the piezo elements 417. However, the elements for effecting the ejection of ink are not limited to piezo elements 417. For example, as long as the elements are capable of executing an operation for ejecting ink, other types of elements, including heat-generating elements or magnetostrictive elements, also can be used.

<(2) Drive Signal COM>

The foregoing embodiment offered an example of a printer 1 that outputs two types of drive signals COM, namely the first drive signal COM_A and the second drive signal COM_B, but there is no limitation to this configuration. That is, it is also possible to adopt a printer 1 that is capable of simultaneously generating three or more types of drive signals COM.

<(2) Regarding the Ink>

The foregoing embodiment is an embodiment of a printer 1, and thus the nozzles Nz eject dye ink or pigment ink in liquid form. However, as long as the ink that is ejected from the nozzles Nz is a liquid, then there is no limitation to such inks.

<(2) Other Application Examples>

A printer 1 was described in the above embodiment, but this is not a limitation. For example, it is also possible to adopt the same technology as that of the embodiment to various types of liquid ejection apparatuses that employ inkjet technology, such as a color filter manufacturing device, a dyeing device, a fine processing device, a semiconductor manufacturing device, a surface processing device, a three-dimensional shape forming machine, a liquid vaporizing device, an organic EL manufacturing device (particularly a macromolecular EL manufacturing device), a display manufacturing device, a film formation device, and a DNA chip manufacturing device, for example. The methods therefor and manufacturing methods thereof are also within the scope of application.

(3) Third Embodiment

===(3) Target of the Description===

<(3) Liquid Ejection Apparatus>

The discussion in the section <Liquid Ejection Apparatus> of the third embodiment is substantially the same as the discussion of the section <Liquid Ejection Apparatus> in the first embodiment, and thus will not be repeated here.

===(3) Configuration of the Printing System===

<(3) Overall Configuration>

The discussion of the section <Overall Configuration> in the third embodiment is substantially the same as the discussion in the section <Overall Configuration> in the first embodiment, and thus will not be repeated here.

<(3) Computer>

The discussion of the section <Configuration of the Computer 110> in the third embodiment is substantially the same as the discussion of the section <Configuration of the Computer 110> in the first embodiment, and thus is not repeated here.

===(3) Printer===

The discussion of the sections <Configuration of the Printer 1>, <Paper Carry Mechanism 20>, <Carriage Movement Mechanism 30>, <Head Unit 40>, <Detector Group 50>, <Printer-Side Controller 60>, <Drive Signal Generation Circuit 70>, and <Printing Operation> of the third embodiment are substantially the same as the discussion of those sections in the first embodiment, and thus is not repeated here.

Additionally, the discussion of the sections <Drive Signal Generation Circuit 70>, <Regarding the Generated Drive Signals COM>, <Head Controller HC>, and <Gradation Control> in the third embodiment are substantially the same as the discussion of those sections in the second embodiment, and thus are not repeated here.

===(3) Overview of the Third Embodiment===

<(3) Switch Control Signals SW>

Figure 32A:
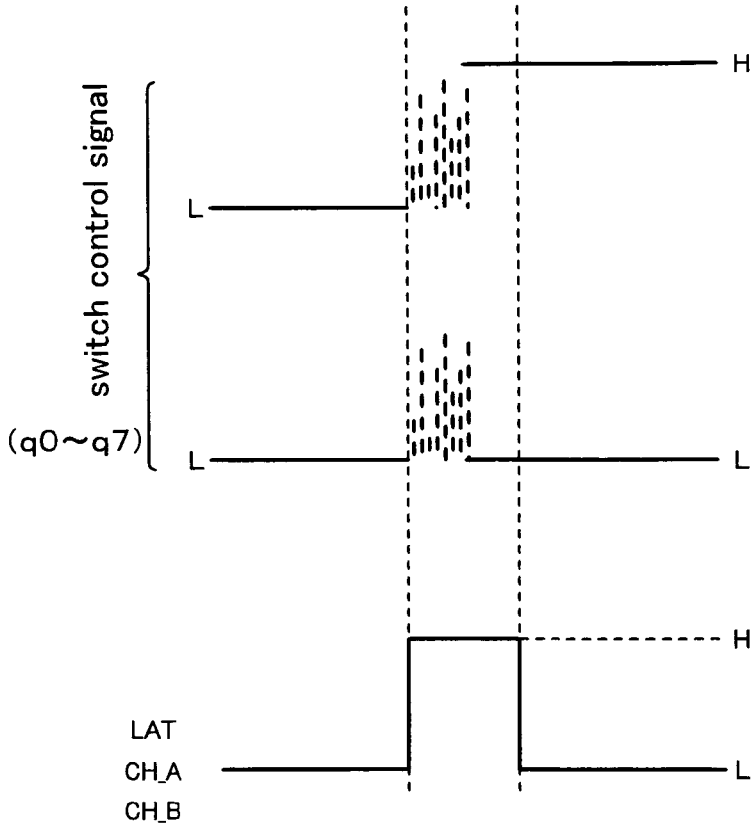
FIG. 32A is a schematic diagram that schematically illustrates a change in voltage of a switch control signal at a switch timing, and FIG. 32B schematically illustrates a state in which a first switch and a second switch have been put in the ON state simultaneously.
Figure 32B:
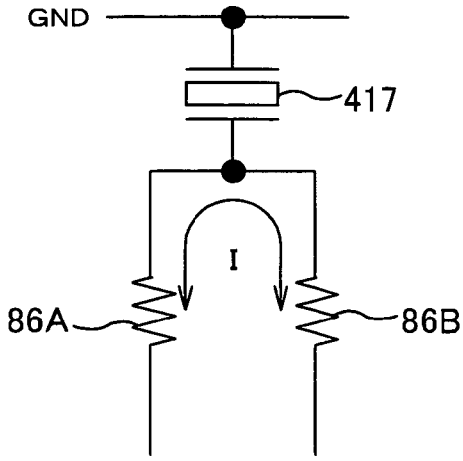

The purpose of the above description was to describe the configuration of the printer 1, and assumes ideal conditions. Thus, the first switch control signal SW_A and the second switch control signal SW_B did not simultaneously indicate the ON level (for example, the data value [1]). When the printer 1 is put into practice, however, there is the possibility that during the transitional state of switching, the first switch control signal SW_A and the second switch control signal SW_B may simultaneously become the ON level. Here, FIG. 32A is a schematic diagram that illustrates the change in voltage of the switch control signals SW at the switch timing. FIG. 32B is a diagram that schematically illustrates an instance in which the first switch 86A and the second switch 86B are turned ON simultaneously.

As shown in FIG. 32A, the content of the switch control signals SW (first switch control signal SW_A and the second switch control signal SW_B) are updated at the occasion of the latch pulse of the latch signal LAT, the change pulse of the first change signal CH_A, and the change pulse of the second change signal CH_B. At the time of this update, there is a possibility for an undesirable logic level to occur in the switch control signal SW during the switch transition. There are various conceivable causes as to why undesirable logic levels occur, one of these being the operation of the logic circuit. As described above, the decoder 83 and the control logic 84 include constitutional elements such as numerous gates (AND gates 831A to 834A, 831B to 834B, OR gates 835A and 835B), registers RG, and multiplexers MX0 to MX7. When these constitutional elements are operated, normally their delay times are different. Thus, up to the point that the state is finally determined, there is the possibility that an undesirable logic level will occur.

It should be noted that an undesirable logic level can occur both when the content of the switch control signal SW is changed before and after the switch timing as well as when it remains unchanged. As mentioned above, the selection data for each waveform section are stored on the registers RG of the control logic 84. Thus, even if the content of the switch control signal SW is the same before and after the switch timing, the selection data on which that content is based are stored on different registers RG. For example, the three data values of the selection data q0 are all [0] in periods T211, T212, and T213 of the repeating cycle T. However, the data used in period T211 are stored on the register RG (Q0, G11), the data used in period T212 are stored on the register RG (Q0, G12), and the data used in period T213 are stored on the register RG (Q0, G13). Thus, it is necessary for the multiplexer MX0 to switch the register RG from which to read the selection data q0 at the occasion of the change pulse of the first change signal CH_A, and there is a possibility that this switching operation may result in an undesired logic level at the time of switching.

When an undesirable logic level occurs in the switch control signal SW, there is a possibility that the switch corresponding to that switch control signal SW will become on. For example, when an undesirable logic level occurs in the first switch control signal SW_A, the first switch 86A becomes on. Likewise, when an undesirable logic level occurs in the second switch control signal SW_B, the second switch 86B becomes on. Here, if one of the switches is already in the ON state, then when the other switch becomes on, the resistance values of the switches 86A and 86B both drop to approximately 100Ω, as illustratively shown in FIG. 32B. Due to this, the first drive signal generation section 70A and the second drive signal generation section 70B become electrically connected through the first switch 86A and the second switch 86B. This problem also may occur at other nozzles as well, and in a worst case, the first drive signal generation section 70A and the second drive signal generation section 70B will short at a resistance of 100Ω/number of nozzles.

At this time, if the first drive signal COM_A and the second drive signal COM_B have different voltages, there is a possibility that this voltage difference will cause an unanticipated current I to flow. For example, in the case of pixel data SI for a small dot, the timing at which the content of the first switch control signal SW_A is switched comes within the period T221, during which the first waveform section SS221 of the second drive signal COM_B is applied to the piezo element 417. That is, the first change pulse of the first change signal CH_A is generated at the boundary between period T211 and period T212. As mentioned above, at this switch timing, there is a possibility that the first switch 86A will enter the ON state due to an undesirable logic level. When the first switch 86A becomes on, the difference between the voltage of the second drive signal COM_B (in this example, the voltage in a range from the minimum voltage to the intermediate voltage) and the voltage of the first drive signal COM_A (in this example, the intermediate voltage) leads to flowing of an unanticipated current I (hereinafter, also called the flow-through current I). This flow-through current I has the possibility of negatively affecting the drive signal generation sections 70A and 70B. Also, when both switches are on at the same time, the waveform of the small dot is disrupted, and this may not allow the ejection of ink to be performed suitably.

Accordingly, in this embodiment, in order to prevent this adverse effect, a prevention circuit 2085 that serves as a controller controls the operation of the first switch 86A, which controls the application of the first drive signal COM_A to the piezo element 417, and the second switch 86B, which controls the application of the second drive signal COM_B to the piezo elements 417.

The prevention circuit 2085 forcibly puts one of the switches (for example, the first switch 86A) into the OFF state for a predetermined period (for example, the period during which the first change pulse of the first change signal CH_A is generated) during the period from the end of generation of a drive pulse (for example, a drive pulse PS21) of one drive signal COM (for example, the first drive signal COM_A) until the start of generation of the next drive pulse (for example, the drive pulse PS22).

The prevention circuit 2085 also forcibly puts the other switch (for example, the second switch 86B) into the OFF state for an other predetermined period (for example, the period during which the first change pulse of the second change signal CH_B is generated) during the period from the end of generation of an other drive pulse (for example, a drive pulse PS24) of the other drive signal COM (for example, the second drive signal COM_B) to the start of generation of the next other drive pulse (for example, the drive pulse PS25).

By providing this prevention circuit 2085, one switch is forcibly turned off during a predetermined period, and the other switch is turned off during another predetermined period. As a result, the two switches can be prevented from being in the ON state at the same time, and this allows the problem of a flow-through current I flowing to be prevented.

===(3) Prevention Circuit===

<(3) Configuration of the Prevention Circuit 2085>

Figure 33:
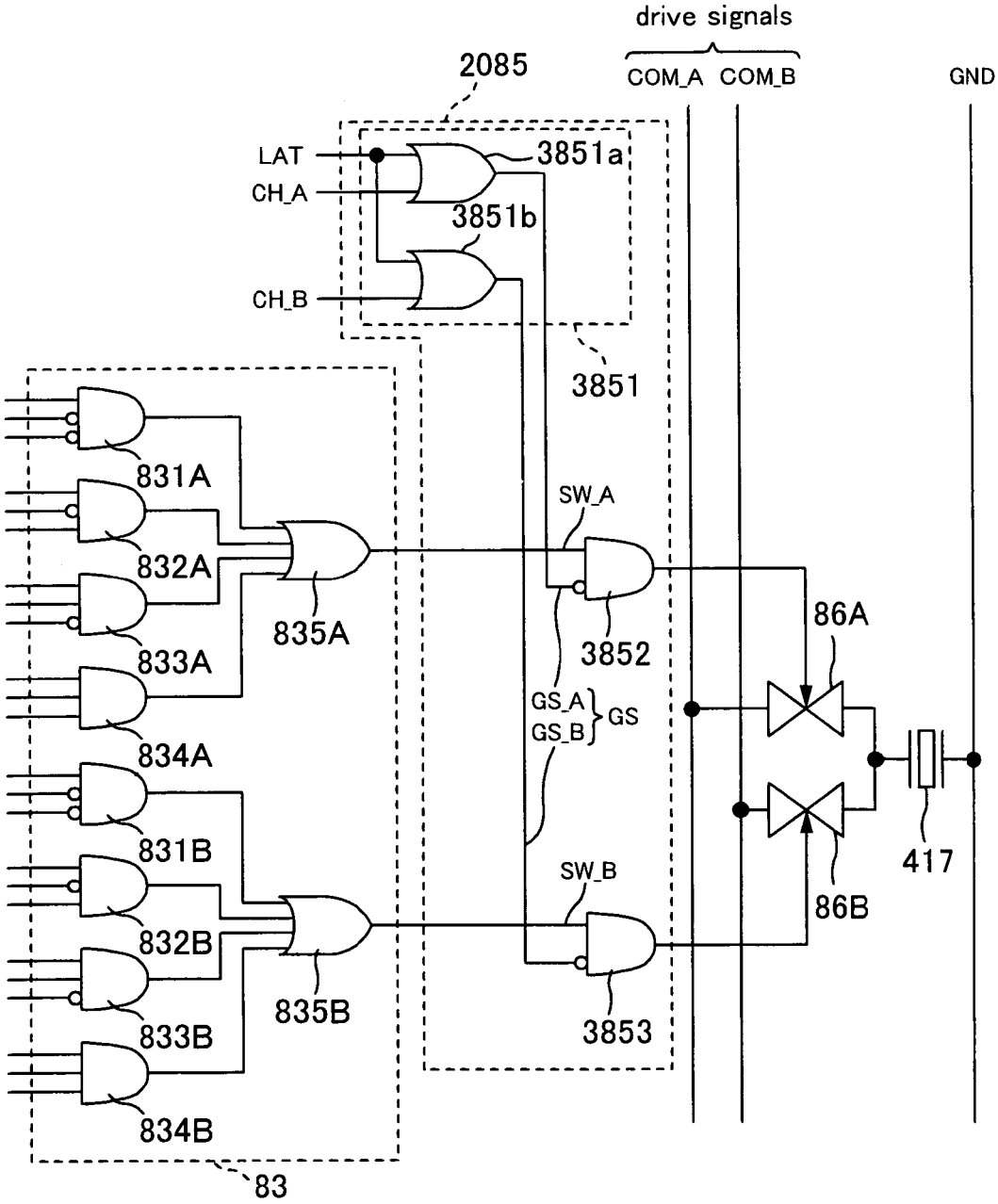
FIG. 33 is a diagram that shows a configuration of a prevention circuit.
Figure 34A:
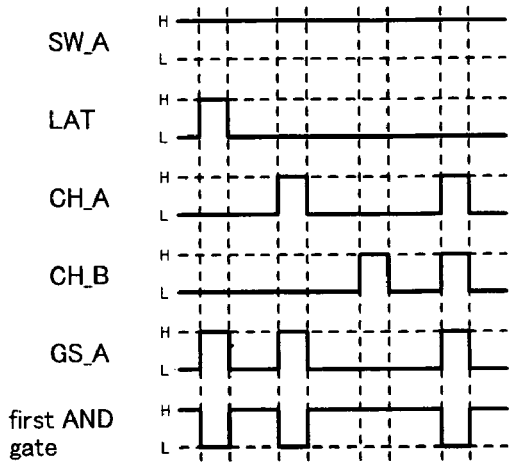
FIG. 34A is a diagram for describing the relationship between a first switch control signal and an output of a first AND gate.
Figure 34B:
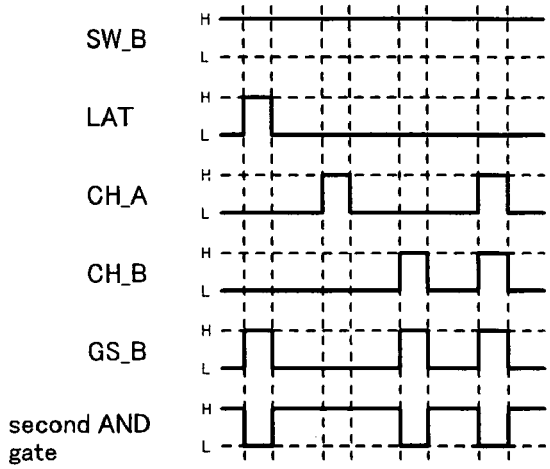
FIG. 34B is a diagram for describing the relationship between a second switch control signal and an output of a second AND gate.

The configuration of the prevention circuit 2085 is described next. Here, FIG. 33 is a diagram that shows the configuration of the prevention circuit. FIG. 34A is a diagram for describing the relationship between the first switch control signal SW_A and the output of a first AND gate 3852. FIG. 34B is a diagram for describing the relationship between the second switch control signal SW_B and the output of a second AND gate 3853.

The prevention circuit 2085 has a gate control signal output section 3851, a first AND gate 3852, and a second AND gate 3853. The gate control signal output section 3851 outputs a gate control signal GS based on the latch signal LAT, the first change signal CH_A, and the second change signal CH_B. Here, the gate control signal GS is a signal for determining whether or not to output the first switch control signal SW_A and the second switch control signal SW_B to the first switch 86A and the second switch 86B. That is, the gate control signal GS is a signal for determining whether to enable or disable the first switch control signal SW_A and the second switch control signal SW_B.

The gate control signal output section 3851 has a first OR gate 3851*a* and a second OR gate 3851*b*.

The first OR gate 3851*a* outputs a first gate control signal GS_A for the first switch 86A (this corresponds to the gate control signal for the first switch). The first OR gate 3851*a* has two input terminals and one output terminal. The latch signal LAT is input to one of the input terminals, and the first change signal CH_A is input to its other input terminal. The first gate control signal GS_A that is output from the first OR gate 3851*a* becomes H level if the latch signal LAT is at H level (level of the data value [1]). It also becomes the H level if the first change signal CH_A is at H level. In all other instances, the first gate control signal GS_A is at L level. That is, as shown in FIG. 34A, the first gate control signal GS_A is at H level over the period that either the latch pulse of the latch signal LAT or the change pulse of the first change signal CH_A is being generated. Consequently, the first gate control signal GS_A can also be said to include a first timing pulse that is based on these latch pulse and change pulses (this corresponds to the timing pulse for the first switch control signal).

The first timing pulse defines the periods t11, t12, and t13 (see FIG. 22) during which the selection data are changed in the first drive signal COM_A. That is, it is at H level over these periods t11, t12, and t13. Here, the waveform sections SS211 to SS213 making up the first drive signal COM_A each have a drive pulse PS. That is, the first waveform section SS211 has a drive pulse PS21, the second waveform section SS212 has a drive pulse PS22, and the third waveform section SS213 has a drive pulse PS23. Thus, it can be said that the first timing pulse is generated over a predetermined period from the end of generation of one drive pulse PS to the start of generation of the next drive pulse PS.

The second OR gate 3851*b* outputs a second gate control signal GS_B for the second switch 86B (this corresponds to the other gate control signal for the second switch). The second OR gate 3851*b* also has two input terminals and one output terminal. The latch signal LAT is input to one of the input terminals, and the second change signal CH_B is input to the other input terminal. The second gate control signal GS_B becomes the H level if either one of the latch signal LAT or the second change signal CH_B is at H level. That is, as shown in FIG. 34B, the second gate control signal GS_B has a second timing pulse that is based on the latch pulse of the latch signal LAT and the change pulse of the second change signal CH_B (this corresponds to the other timing pulse for the second switch control signal).

The second timing pulse is at H level over periods t21 and t22 (see FIG. 22) during which the selection data are changed in the second drive signal COM_B. Thus, the second timing pulse is generated over an other predetermined period in the second drive signal COM_B from the end of generation of one drive pulse PS to the start of generation of the next drive pulse PS.

The first AND gate 3852 corresponds to the gate circuit in the controller. The first AND gate 3852 has two input terminals and one output terminal. The first switch control signal SW_A is input to one of its input terminals, and the inverted first gate control signal GS_A is input to its other input terminal. The first AND gate 3852 outputs the first switch control signal SW_A if the first gate control signal GS_A is at L level (this corresponds to the predetermined level). That is, the first switch control signal SW_A is enabled. On the other hand, the output of the first AND gate 3852 becomes L level if the first gate control signal GS_A is at H level (this corresponds to the other predetermined level), that is, during the period that the first timing pulse is being generated, regardless of the first switch control signal SW_A. As a result, a first OFF control signal for putting the first switch 86A into the OFF state (this corresponds to the OFF control signal for the first switch) is output from the first AND gate 3852.

The second AND gate 3853 corresponds to the other gate circuit in the controller. The second AND gate 3853 also has two input terminals and one output terminal. The second switch control signal SW_B is input to one input terminals, and the inverted second gate control signal GS_B is input to the other input terminal. The second AND gate 3853 outputs the second switch control signal SW_B if the second gate control signal GS_B is at L level (this corresponds to the predetermined level). That is, the second switch control signal SW_B is enabled. On the other hand, the output of the second AND gate 3853 is at L level if the second gate control signal GS_B is at H level (this corresponds to the other predetermined level), that is, during the period that the second timing pulse is being generated, regardless of the second switch control signal SW_B. As a result, a second OFF control signal for putting the second switch 86B into the OFF state (this corresponds to the other OFF control signal for the second switch) is output from the second AND gate 3853.

Then, the first switch 86A is forcibly put in the OFF state by the first OFF control signal. That is, it is put into the OFF state regardless of the content of the first switch control signal SW_A. Thus, even if the occurrence of an undesirable logic level causes the first switch control signal SW_A to become H level, the first switch 86A can be prevented from entering the ON state due to this logic level. For example, even if the first switch control signal SW_A becomes the ON level in period t12, the first switch 86A stays in the OFF state. Here, in the case of pixel data SI for a small dot, the second switch 86B is in the ON state during this period t12, and because the first switch 86A is forcibly put into the OFF state, it is possible to prevent the first switch 86A and the second switch 86B from both being in the ON state at the same time, and this allows the problem of a flow-through current I flowing to be prevented. It also becomes possible to prevent the drive signal from becoming distorted.

In this embodiment, the first AND gate 3852 is controlled by the first gate control signal GS_A. The first timing pulse of the first gate control signal GS_A is generated in synchronization with the latch pulse of the latch signal LAT and the change pulse of the first change signal CH_A. The content of the first switch control signal SW_A is switched when the latch pulse and the change pulse occur. Thus, by controlling the first AND gate 3852 through the first gate control signal GS_A, it is possible to match the timing at which the first switch 86A is turned off with the timing at which the first switch control signal SW_A is switched. Specifically, the first switch control signal SW_A can be disabled at the timing of the rising edge of the first timing pulse, thereby putting the first switch 86A in the OFF state, and the first switch control signal SW_A can be enabled at the timing of the falling edge of the first timing pulse. As a result, the problem of a flow-through current I flowing can be reliably prevented. Further, it is also possible to inhibit distortion in the waveform.

The second switch 86B is like this also. That is, the second switch 86B is forcibly put into the OFF state due to the second OFF control signal, regardless of the content of the second switch control signal SW_B. Thus, even if noise has caused the second switch control signal SW_B to become H level, the second switch 86B can be prevented from entering the ON state. For example, the second switch 86B is put into the OFF state in periods t21 and t22. Here, in this embodiment, the period t21 is aligned with the period t11 of the first drive signal COM_A. Also, the period t22 is aligned with the period t13 of the first drive signal COM_A.

In this case, ideally, the voltage of the first drive signal COM_A and the voltage of the second drive signal COM_B are aligned with the intermediate voltage, which is the start voltage of the drive pulses PS. If the intermediate voltage of the first drive signal COM_A and the intermediate voltage of the second drive signal COM_B are the same, then no unanticipated current I will flow even if the first switch 86A and the second switch 86B are in the ON state simultaneously. In practice, however, discrepancies between the first drive signal generation section 70A and the second drive signal generation section 70B occur and may cause a discrepancy between the intermediate voltage of the first drive signal COM_A and the intermediate voltage of the second drive signal COM_B. If there is a discrepancy between these intermediate voltages, this voltage difference causes a flow-through current I to flow. With the present embodiment, however, even in a case such as this, the problem of a flow-through current I flowing can be reliably prevented.

It should be noted that in this embodiment, the switch timing of the second switch control signal SW_B is synchronized with the switch timing of the first switch control signal SW_A, but the same actions and effects as those discussed with regard to the first drive signal COM_A can be attained even if the two drive signals are not synchronized.

Further, in this embodiment, the prevention circuit 2085 is made of logic circuits such as AND gates and OR gates, and the operations of the first AND gate 3852 and the second AND gate 3853 are controlled by gate control signals GS. This has the effect of simplifying the structure and making it suited for high-speed operations.

It should be noted that in this embodiment, a gate control signal output section 3851 is provided for each nozzle, but there is no limitation to this configuration. For example, it is also possible to provide a single gate control signal output section 3851, and its output, i.e., the gate control signal GS, may be used in common by the circuits corresponding to each of the nozzles.

===(3) Other Embodiments===

The foregoing embodiment primarily describes a printing system 100 that includes a printer 1, but it also includes the disclosure of methods of applying drive signals and liquid ejection systems, etc. The foregoing embodiment is for the purpose of elucidating the present invention, and is not to be interpreted as limiting the present invention. The invention can of course be altered and improved without departing from the gist thereof, and includes equivalents. In particular, the embodiments mentioned below also fall within the scope of the invention.

<(3) Prevention Circuit 2085>

Figure 35:
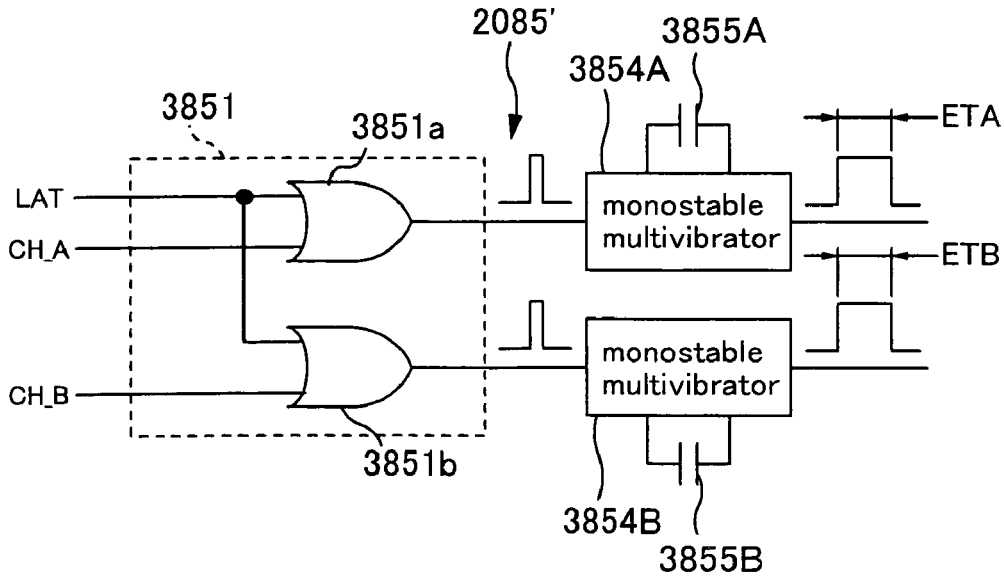
FIG. 35 is a diagram for describing the primary elements in a prevention circuit according to a modified example.

The prevention circuit 2085 of the third embodiment discussed above determined the period in which the first switch 86A and the second switch 86B are turned off using the rising edge and the falling edge of the timing pulse. Thus, there is no degree of freedom with regard to setting the period in which they are turned off. If the period of the OFF state could be set without regard to the timing pulses, then it would be possible to optimize the off time, and this is favorable. A modified example having such a configuration is described below. Here, FIG. 35 is a diagram that illustrates the main components of a prevention circuit 2085' of this modified example.

This modified example differs from the third embodiment discussed above in that monostable multivibrators 3854A and 3854B are provided between the gate control signal output section 3851 and the first AND gate 3852. That is, the first monostable multivibrator 3854A outputs an H-level signal for the duration of a predetermined period based on the timing pulse of the first timing signal. The second monostable multivibrator 3854B outputs an H-level signal for the duration of another predetermined period based on the timing pulse of the second timing signal.

The monostable multivibrators 3854A and 3854B function as timers. That is, the first monostable multivibrator 3854A functions as a first timer for the first switch 86A, and the second monostable multivibrator 3854B functions as a second timer for the second switch 86B. As regards the signal that is output by the first monostable multivibrator 3854A, the time ETA during which it is at H level corresponds to the period during which the first switch 86A is in the OFF state. Likewise, as regards the signal that is output by the second monostable multivibrator 3854B, the time ETB during which it is at H level corresponds to the period during which the second switch 86B is in the OFF state. These periods during which the first switch 86A and the second switch 86B are put in the OFF state can be adjusted by changing the capacity of capacitors 3855A and 3855B to which they are connected, for example. Consequently, in this embodiment, it is possible to optimize the period during which the first switch 86A and the second switch 86B are put into the OFF state. It is also possible to precisely set the period during which they are in the OFF state.

<(3) Drive Elements>

In the above embodiment, ink was ejected using piezo elements 417. However, the elements for causing the ejection of ink are not limited to piezo elements 417. For example, as long as the elements are capable of executing an operation for ejecting ink, other types of elements, including heat-generating elements and magnetostrictive elements, also can be used.

<(3) Drive Signal COM>

The foregoing embodiment offered an example of a printer 1 that outputs two types of drive signals COM, namely the first drive signal COM_A and the second drive signal COM_B, but there is no limitation to this configuration. That is, it is also possible to adopt a printer 1 that is capable of simultaneously generating three or more types of drive signals COM.

<(3) Regarding the Ink>

The foregoing embodiment is an embodiment of a printer 1, and thus the nozzles Nz eject dye ink or pigment ink in liquid form. However, as long as the ink that is ejected from the nozzles Nz is a liquid, then there is no limitation to such inks.

<(3) Other Application Examples>

A printer 1 was described in the above embodiment, but this is not a limitation. For example, it is also possible to adopt the same technology as that of the embodiment to various types of liquid ejection apparatuses that employ inkjet technology, such as a color filter manufacturing device, a dyeing device, a fine processing device, a semiconductor manufacturing device, a surface processing device, a three-dimensional shape forming machine, a liquid vaporizing device, an organic EL manufacturing device (particularly a macromolecular EL manufacturing device), a display manufacturing device, a film formation device, and a DNA chip manufacturing device, for example. The methods therefor and manufacturing methods thereof are also within the scope of application.

(4) Fourth Embodiment

===(4) Target of the Description===

The discussion of the section <Liquid Ejection Apparatus> in the fourth embodiment is substantially the same as the discussion of the section <Liquid Ejection Apparatus> in the first embodiment, and thus is not repeated here.

===(4) Configuration of the Printing System===

The discussion of the section <Overall Configuration> in the fourth embodiment is substantially the same as the discussion of the section <Overall Configuration> in the first embodiment, and thus is not repeated here.

===(4) Computer===

<(4) Configuration of the Computer 110>

Figure 36:
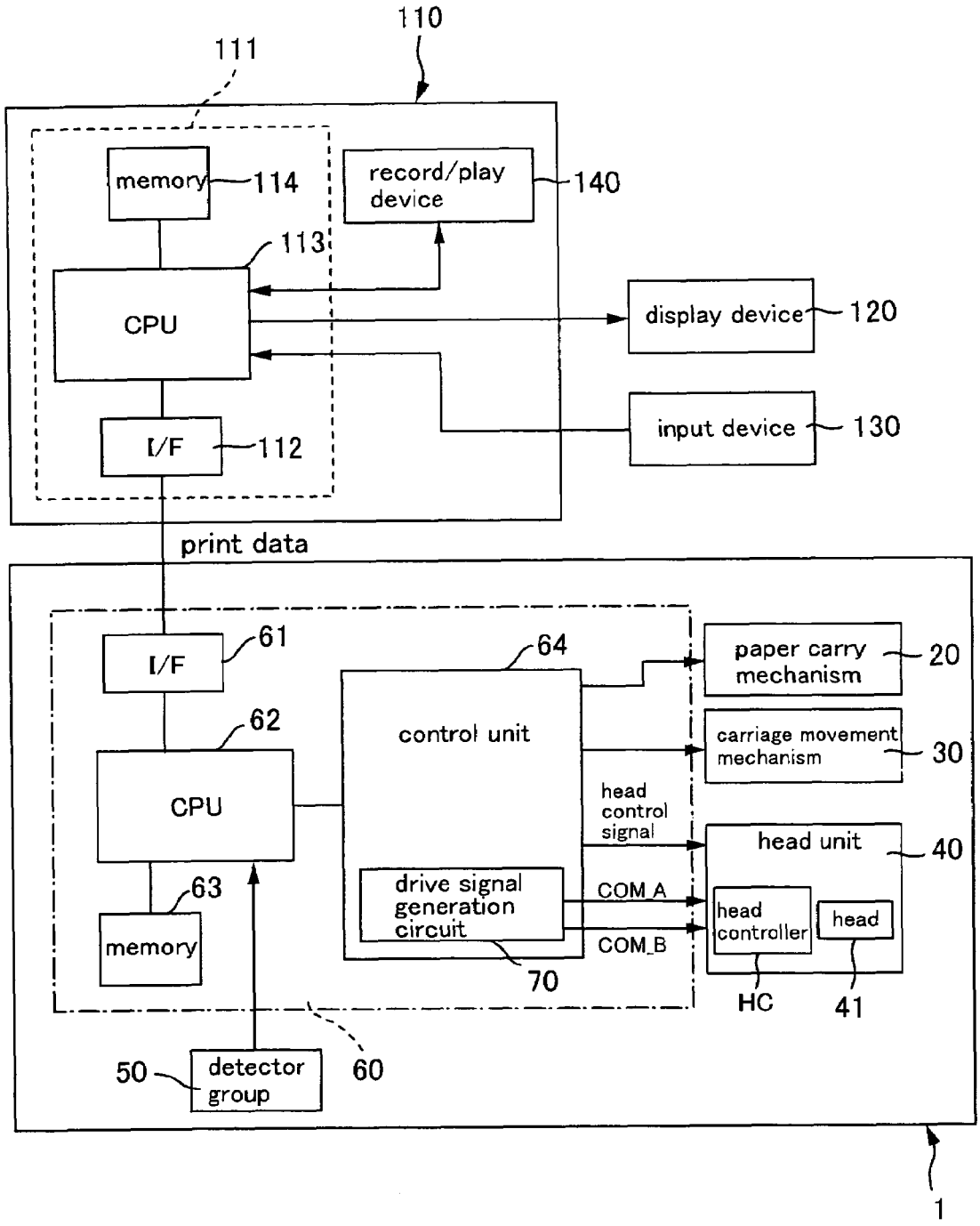
FIG. 36 is a block diagram for describing a configuration of a computer and a printer.

FIG. 36 is a block diagram that describes the configuration of the computer 110 and the printer 1. A brief description of the configuration of the computer 110 will be made first. The computer 110 has the record/play device 140 described above, and a host-side controller 111. The record/play device 140 is communicably connected to the host-side controller 111, and for example is attached to the housing of the computer 110. The host-side controller 111 performs various controls in the computer 110, and is also communicably connected to the display device 120 and the input device 130 described above. The host-side controller 111 has an interface section 112, a CPU 113, and a memory 114. The interface section 112 is interposed between the computer 110 and the printer 1, and sends and receives data between the two. The CPU 113 is a computation processing device for performing overall control of the computer 110. The memory 114 is for reserving a working area and an area for storing computer programs used by the CPU 113, and is constituted by a RAM, EEPROM, ROM, or magnetic disk device, for example. Examples of computer programs that are stored on the memory 114 include the application program and printer driver discussed above. The CPU 113 performs various controls in accordance with the computer programs stored on the memory 114.

The printer driver makes the computer 110 convert image data into print data, and sends these print data to the printer 1. The print data are data in a form that can be interpreted by the printer 1, and have various command data and pixel data SI (see FIG. 42, etc.). Command data are data for giving commands to make the printer 1 execute specific operations. The command data include command data that commands to supply paper, command data that indicate a carry amount, and command data that commands to discharge paper. The pixel data SI are data relating to the pixels of the image to be printed.

Here, a pixel refers to a unit element making up an image, and images are formed by arranging these pixels in rows in two dimensions. The pixel data of the print data are data relating to the dots that are formed on the paper S (for example, they are gradation values). In this embodiment, the pixel data SI of the print data are each made of two bits of data. That is, the pixel data SI are a data value [00] corresponding to no dot, a data value [01] corresponding to a small dot, a data value [10] corresponding to the formation of a medium dot, or a data value [11] corresponding to a large dot. The printer 1 can thus form dots in four gradation levels. It should be noted that the pixel data of the image data before conversion to print data are 256-gradation RGB data or CMYK data. Additionally, the pixels in the print image are matrix-like squares virtually set on the paper S, and indicate a region in which a dot is to be formed on the paper S. That is, the print image is an image that is formed by an innumerable number of dots.

===(4) Printer===

<(4) Configuration of the Printer 1>

Figure 37A:
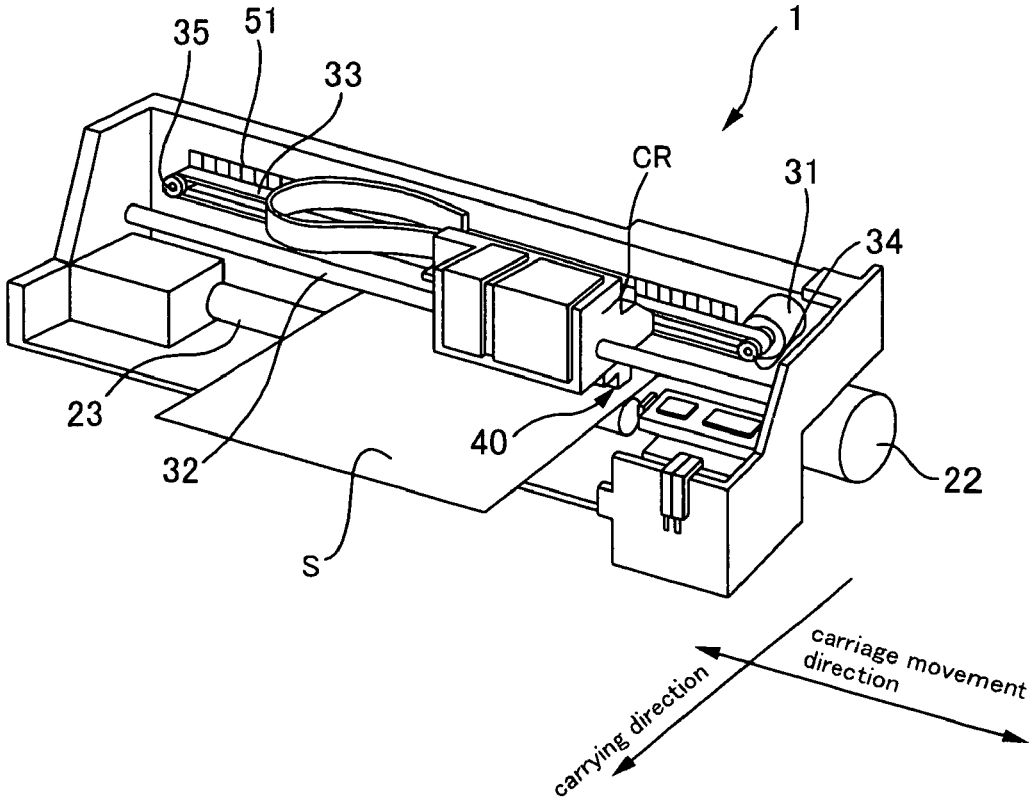
FIG. 37A shows a configuration of the printer according to an embodiment.
Figure 37B:
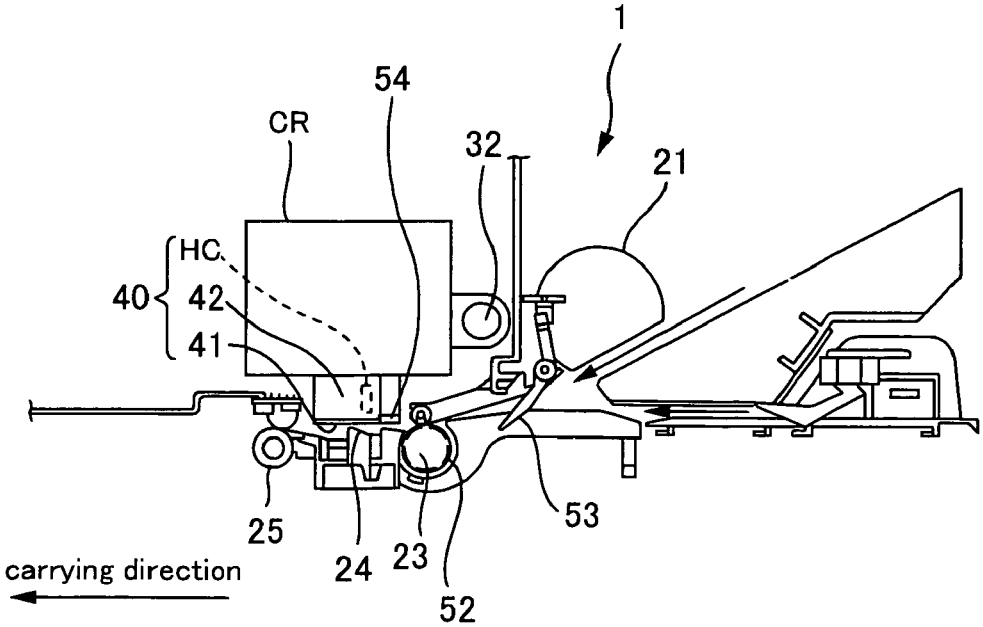
FIG. 37B is a lateral view that illustrates a configuration of the printer in that embodiment.

FIG. 37A is a diagram that shows the configuration of the printer 1 of this embodiment. FIG. 37B is a lateral view illustrating the configuration of the printer 1 of this embodiment. It should be noted that FIG. 36 also is referred to in the following description.

The printer 1 has a paper carry mechanism 20, a carriage movement mechanism 30, a head unit 40, a detector group 50, and a printer-side controller 60. It should be noted that the head unit 40 has a head controller HC and a head 41.

In the printer 1, the printer-side controller 60 controls the control targets, that is, the paper carry mechanism 20, the carriage movement mechanism 30, the head unit 40 (the head controller HC and the head 41), and the drive signal generation circuit 70. Thus, the printer-side controller 60 causes an image to be printed on a paper S based on the print data obtained from the computer 110. The detectors of the detector group 50 monitor conditions within the printer 1. The detectors output the result of this detection to the printer-side controller 60. The printer-side controller 60 receives the detection results from the detectors and controls the control targets based on those detection results.

<(4) Paper Carry Mechanism 20>

The paper carry mechanism 20 corresponds to the medium carry section for carrying media. The paper carry mechanism 20 feeds the paper S to a printable position, as well as carries the paper S by a predetermined carry amount in the carrying direction. The carrying direction is a direction that intersects the carriage movement direction. The paper carry mechanism 20 has a paper feed roller 21, a carry motor 22, a carry roller 23, a platen 24, and a discharge roller 25. The paper feed roller 21 is a roller for automatically sending a paper S that has been inserted into a paper insertion opening into the printer 1, and in this example has a cross-sectional shape that resembles the letter D. The carry motor 22 is a motor for carrying the paper S in the carrying direction, and its operation is controlled by the printer-side controller 60. The carry roller 23 is a roller for carrying the paper S that has been delivered by the paper feed roller 21 up to a printable region. The operation of the carry roller 23 also is controlled by the carry motor 22. The platen 24 is a member that supports the paper S from its rear during printing. The discharge roller 25 is a roller for carrying the paper S for which printing has finished.

<(4) Carriage Movement Mechanism 30>

The carriage movement mechanism 30 is for moving a carriage CR, to which the head unit 40 is attached, in a carriage movement direction. The carriage movement direction includes the direction of movement from one side to the other side and the direction of movement from that other side to the one side. It should be noted that because the head unit 40 includes the head 41, the carriage movement direction corresponds to the movement direction of the head 41, and the carriage movement mechanism 30 corresponds to a head movement section that moves the head 41 in the movement direction. The carriage movement mechanism 30 has a carriage motor 31, a guide shaft 32, a timing belt 33, a drive pulley 34, and a driven pulley 35. The carriage motor 31 corresponds to the drive source for moving the carriage CR. The operation of the carriage motor 31 is controlled by the printer-side controller 60. The drive pulley 34 is attached to the rotation shaft of the carriage motor 31, and is disposed on one end side in the carriage movement direction. The driven pulley 35 is disposed on the other end side in the carriage movement direction on the side opposite from the drive pulley 34. The timing belt 33 is connected to the carriage CR and is engaged between the drive pulley 34 and the driven pulley 35. The guide shaft 32 supports the carriage CR in a manner that permits movement thereof. The guide shaft 32 is attached in the carriage movement direction. Thus, operation of the carriage motor 31 causes the carriage CR to move in the carriage movement direction along the guide shaft 32.

<(4) Head Unit 40>

The head unit 40 is for ejecting ink toward the paper S. The head unit 40 is attached to the carriage CR. The head 41 of the head unit 40 is provided on the lower surface of a head case 42, and the head controller HC of the head unit 40 is provided within the head case 42. It should be noted that the head controller HC is described in greater detail later.

Figure 38:
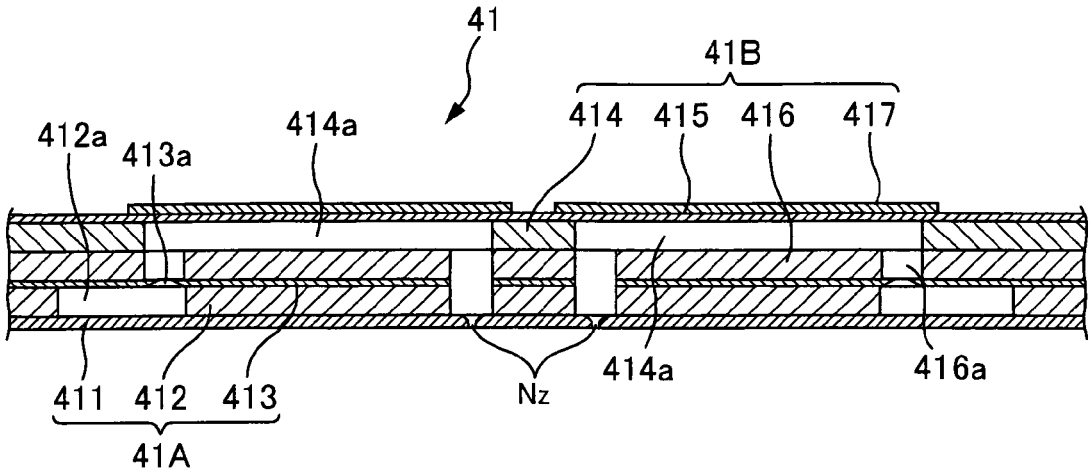
FIG. 38 is a cross-sectional view for describing a structure of a head.

FIG. 38 is a cross-sectional diagram for describing the structure of the head 41. The illustrative head 41 shown here has a channel unit 41A and an actuator unit 41B. The channel unit 41A has a nozzle plate 411 in which nozzles Nz are provided, a storage chamber formation substrate 412 in which open portions that become ink storage chambers 412*a* are formed, and a supply opening formation substrate 413 in which ink supply openings 413*a* are formed. The actuator unit 41B has a pressure chamber formation substrate 414 in which open portions that become pressure chambers 414*a* are formed, a vibration plate 415 that defines a portion of the pressure chambers 414*a*, a lid member 416 in which open portions that become supply-side communication openings 416*a* are formed, and piezo elements 417 formed on the surface of the vibration plate 415. A series of channels leading from the ink storage chambers 412*a* to the nozzles Nz through the pressure chambers 414*a* are formed in the head 41. At the time of use, the channels become filled with ink, and by deforming the piezo elements 417, ink can be ejected from the corresponding nozzles Nz. Thus, in the head 41, the piezo elements 417 correspond to the elements that can execute an operation for ejecting ink.

From the nozzles Nz, it is possible to eject a plurality of types of ink having differing quantities. For example, from each nozzle Nz it is possible to eject three different ink types, these being a large ink droplet of a quantity that allows the formation of a large dot, a medium ink droplet of a quantity that allows the formation of a medium dot, and a small ink droplet of a quantity that allows the formation of a small dot. Thus, the printer 1 can achieve four gradation levels for each pixel on the paper S, these being no dot formation, a small dot, a medium dot, and a large dot.

<(4) Detector Group 50>

The detector group 50 is for monitoring conditions within the printer 1. As shown in FIG. 37A and FIG. 37B, the detector group 50 includes a linear encoder 51, a rotary encoder 52, a paper detector 53, and an optical sensor 54. The linear encoder 51 is for detecting the position of the carriage CR (head 41, nozzles Nz) in the carriage movement direction. The rotary encoder 52 is for detecting the amount of rotation of the carry roller 23. The paper detector 53 is for detecting the position of the front end of the paper S being printed. The optical sensor 54 is provided on the carriage CR and is capable of detecting whether or not a paper S is present in the opposing position, and for example, can detect the width of the paper S by detecting the edge sections of the paper S while moving.

<(4) Printer-Side Controller 60>

The printer-side controller 60 performs control of the printer 1. The printer-side controller 60 has an interface section 61, a CPU 62, a memory 63, and a control unit 64. The interface section 61 sends and receives data to and from the computer 110, which is an external device. The CPU 62 is a computation processing device for performing the overall control of the printer 1. The memory 63 is for reserving a working area and an area for storing the programs of the CPU 62, and is constituted by a storage element such as a RAM, EEPROM, or ROM. The CPU 62 controls the control unit 64 in accordance with the computer programs stored on the memory 63. The control unit 64 outputs signals to the control targets in order to control those control targets. Thus, the CPU 62 controls the paper carry mechanism 20 and the carriage movement mechanism 30 via the control unit 64. The control unit 64 is provided with a drive signal generation circuit 70 that is for generating drive signals COM. The configuration, etc., of the drive signal generation circuit 70 is discussed later.

The control unit 64, in accordance with commands from the CPU 62, outputs head control signals for controlling the operation of the head 41 and generates drive signals COM with drive signal generation circuit 70. The head control signals include a transfer clock CLK, pixel data SI, a latch signal LAT, a fist change signal CH_A, a second change signal CH_B, and a setting signal (described later).

<(4) Drive Signal Generation Circuit 70>

The drive signal generation circuit 70 is for generating drive signals COM, and corresponds to the drive signal generation section. The drive signals COM of this embodiment are used in common for all of the piezo elements 417 corresponding to a single nozzle row.

Figure 39:
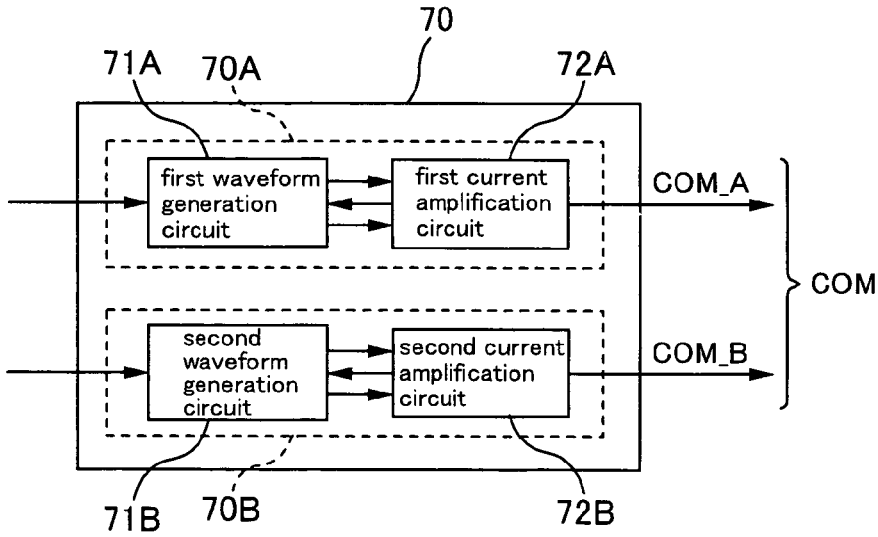
FIG. 39 is a block diagram for describing a configuration of a drive signal generation circuit.

FIG. 39 is a block diagram that describes the configuration of the drive signal generation circuit 70. The drive signal generation circuit 70 is capable of simultaneously generating a plurality of types of drive signals COM. The drive signal generation circuit 70 of this embodiment has a first drive signal generation section 70 that generates a first drive signal COM_A and a second drive signal generation section 70B that generates a second drive signal COM_B. The first drive signal generation section 70A has a first waveform generation circuit 71A, and a first current amplification circuit 72A that amplifies the current of the signal that is generated by the first waveform generation circuit 71A. The second drive signal generation section 70B has a second waveform generation circuit 71B and a second current amplification circuit 72B. It should be noted that the first waveform generation circuit 71A and the second waveform generation circuit 71B have the same structure, and that the first current amplification circuit 72A and the second current amplification circuit 72B have the same structure.

A DAC value, which is a signal from the CPU 62, is input to the first drive signal generation section 70A and the second drive signal generation section 70B. The first waveform generation circuit 71A and the second waveform generation circuit 71B each have a D/A converter, and output an analog signal that corresponds to the DAC value. That is, the DAC value is information that indicates the voltage of the drive signals that are to be output from the first drive signal generation section 70A and the second drive signal generation section 70B. The DAC value is updated at a very short update frequency, and is a type of generation information for generating the drive signals COM.

The method of ejecting ink droplets using the first drive signal COM_A and the second drive signal COM_B of the present embodiment is discussed later.

<(4) Print Process>

Figure 40:
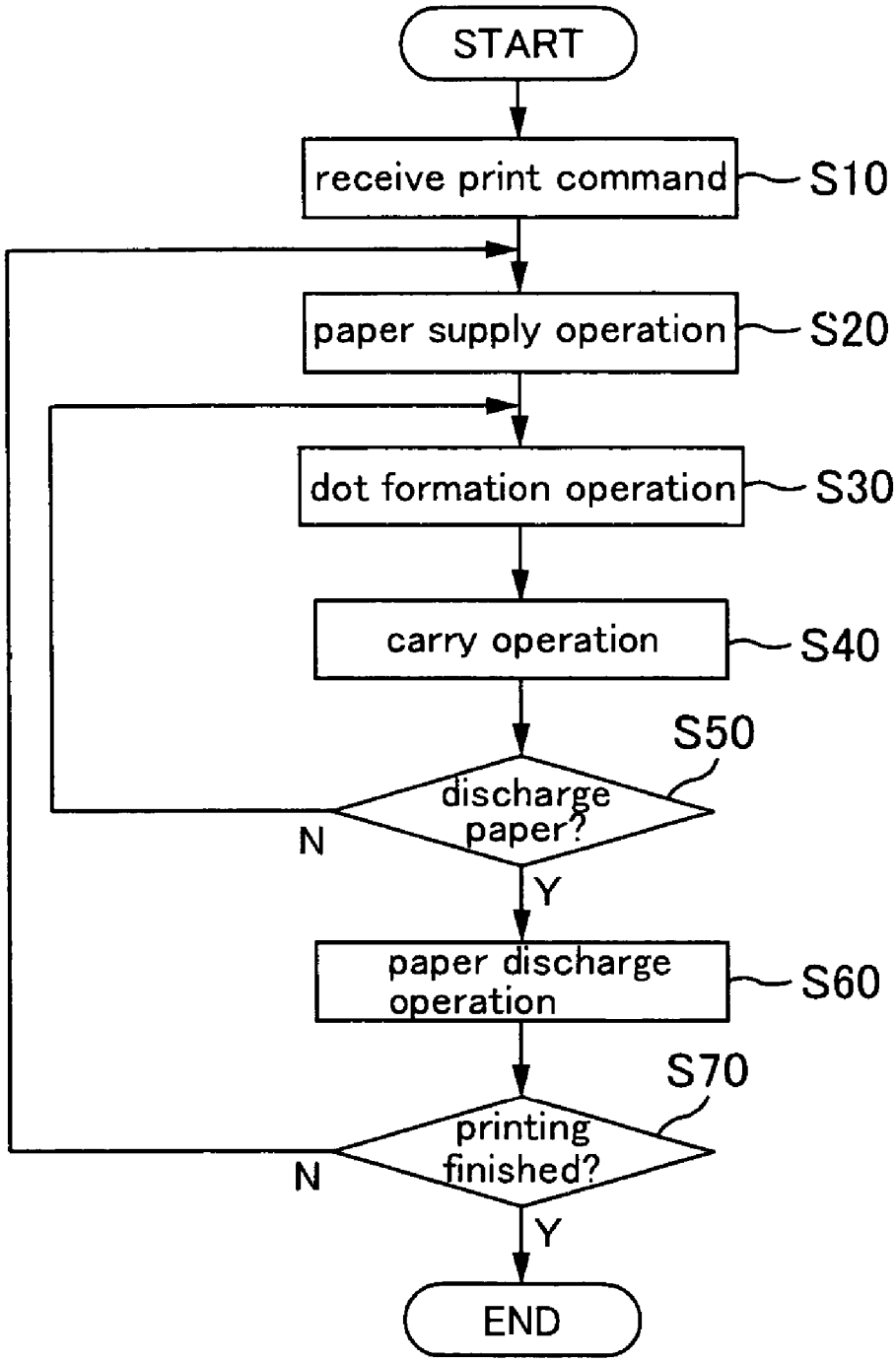
FIG. 40 is a flowchart for describing a printing process.

FIG. 40 is a flowchart describing the printing operation. In the printer 1 having the above configuration, the printer-side controller 60 controls the control target sections (paper carry mechanism 20, carriage movement mechanism 30, head unit 40, drive signal generation circuit 70) in accordance with a computer program that is stored on the memory 63, thereby performing the processing of those sections. The computer program thus has codes for controlling the control target sections in order to execute the processing of those sections.

The printing operation includes a print command receiving operation (S10), a paper supply operation (S20), a dot formation operation (S30), a carry operation (S40), a paper discharge determination (S50), a paper discharge process (S60), and a determination of whether or not printing has finished (S70). These operations are briefly described below.

The print command receiving operation (S10) is an operation of receiving a print command from the computer 110. In this operation, the printer-side controller 60 receives a print command through the interface section 61.

The paper supply operation (S20) is an operation of moving the paper S, which is the object to be printed, to position it at a print start position (the so-called indexed position). In this operation, the printer-side controller 60 drives the carry motor 22, for example, to rotate the paper feed roller 21 and the carry roller 23.

The dot formation operation (S30) is an operation for forming dots on the paper S. In this operation, the printer-side controller 60 drives the carriage motor 31 and outputs control signals to the drive signal generation circuit 70 and the head 41. As a result, ink is ejected from the nozzles Nz during movement of the head 41, forming dots on the paper S.

The carry operation (S40) is an operation of moving the paper S in the carrying direction. In this operation, the printer-side controller 60 drives the carry motor 22 to rotate the carry roller 23. Through this carry operation, it becomes possible to form dots at positions that are different from those dots formed through the previous dot formation operation.

The paper discharge determination (S50) is an operation of determining whether or not it is necessary to discharge the paper S, which is the object being printed. This determination is made by the printer-side controller 60 based on whether or not there are print data, for example.

The paper discharge process (S60) is a process of discharging the paper S, and is performed if "discharge paper" is the result of the above-mentioned paper discharge determination. In this case, the printer-side controller 60 rotates the paper discharge roller 25 so as to discharge the paper S, for which printing has finished, to the outside.

The print end determination (S70) is a determination regarding whether or not to continue printing. This determination also is performed by the printer-side controller 60.

===(4) Ink Ejection Method Using Two Drive Signals According to a First Reference Example===

Reference examples (a first reference example and a second reference example) are described in order to provide a more complete understanding of the present embodiment.

<(4) Regarding the Generated Drive Signals COM>

Figure 41:
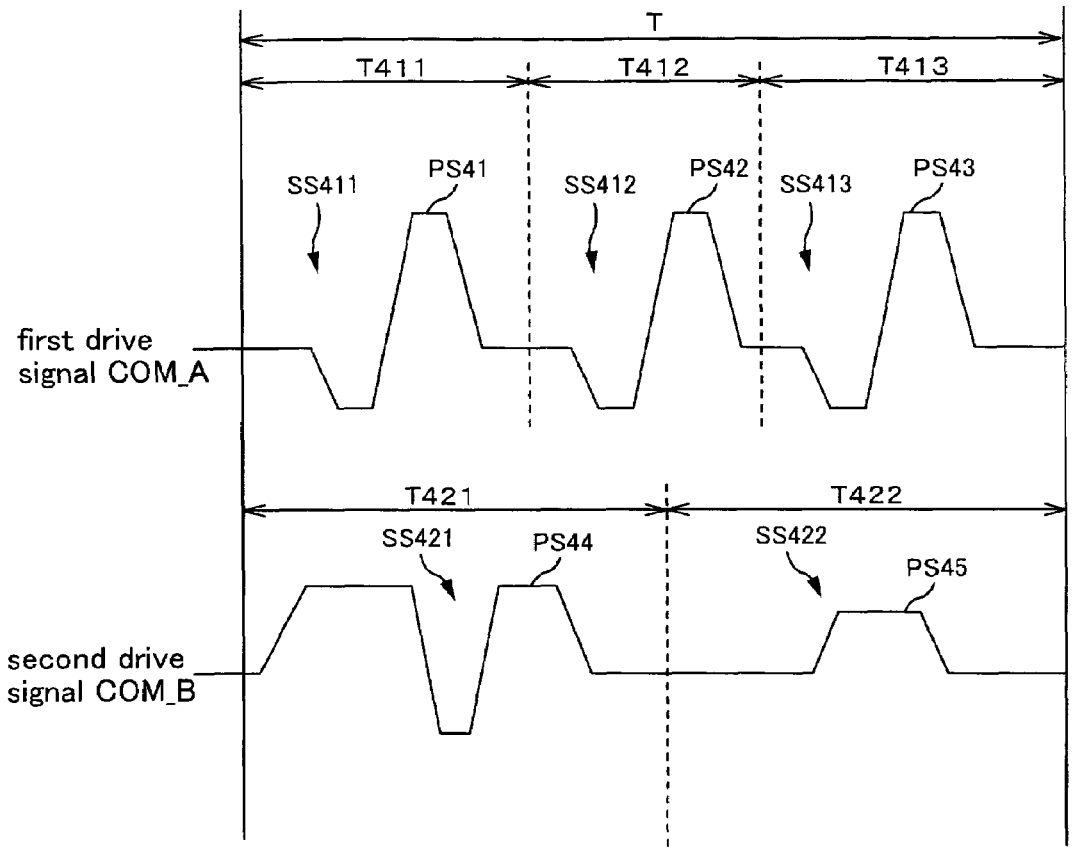
FIG. 41 is an explanatory diagram of two types of drive signals COM.

FIG. 41 is an explanatory diagram of the two types of drive signals COM that are generated by the drive signal generation circuit 70. The drive signal generation circuit 70 generates a first drive signal COM_A and a second drive signal COM_B.

The first drive signal COM_A has a first waveform section SS411 that is generated in a period T411 of a repeating cycle T, a second waveform section SS412 that is generated in a period T412, and a third waveform section SS413 that is generated in a period T413. Here, the first waveform section SS411 has a drive pulse PS41. Similarly, the second waveform section SS412 has a drive pulse PS42 and the third waveform section SS413 has a drive pulse PS43. The drive pulse PS41, the drive pulse PS42, and the drive pulse PS43 are applied to the piezo elements 417 when a large dot is to be formed, and have the same waveform. It should be noted that the drive pulse PS42 is applied to the piezo elements 417 also when a medium dot is to be formed.

The second drive signal COM_B has a first waveform section SS421 that is generated in a period T421, and a second waveform section SS422 that is generated in a period T422. In the second drive signal COM_B, the first waveform section SS421 has a drive pulse PS44 and the second waveform section SS422 has a drive pulse PS45. Here, the drive pulse PS44 is applied to the piezo elements 417 when a small dot is to be formed. The drive pulse PS45 is applied to the piezo elements 417 when no dot is to be formed. It should be noted that when the drive signal PS45 is applied to the piezo elements 417, ink droplets are not ejected from the head 41, but the ink within the ink storage chamber 412*a* and the pressure chamber 414*a* of the head 41 is slightly vibrated, and this prevents the ink from clogging the nozzles Nz.

<(4) Head Controller HC>

Figure 42:
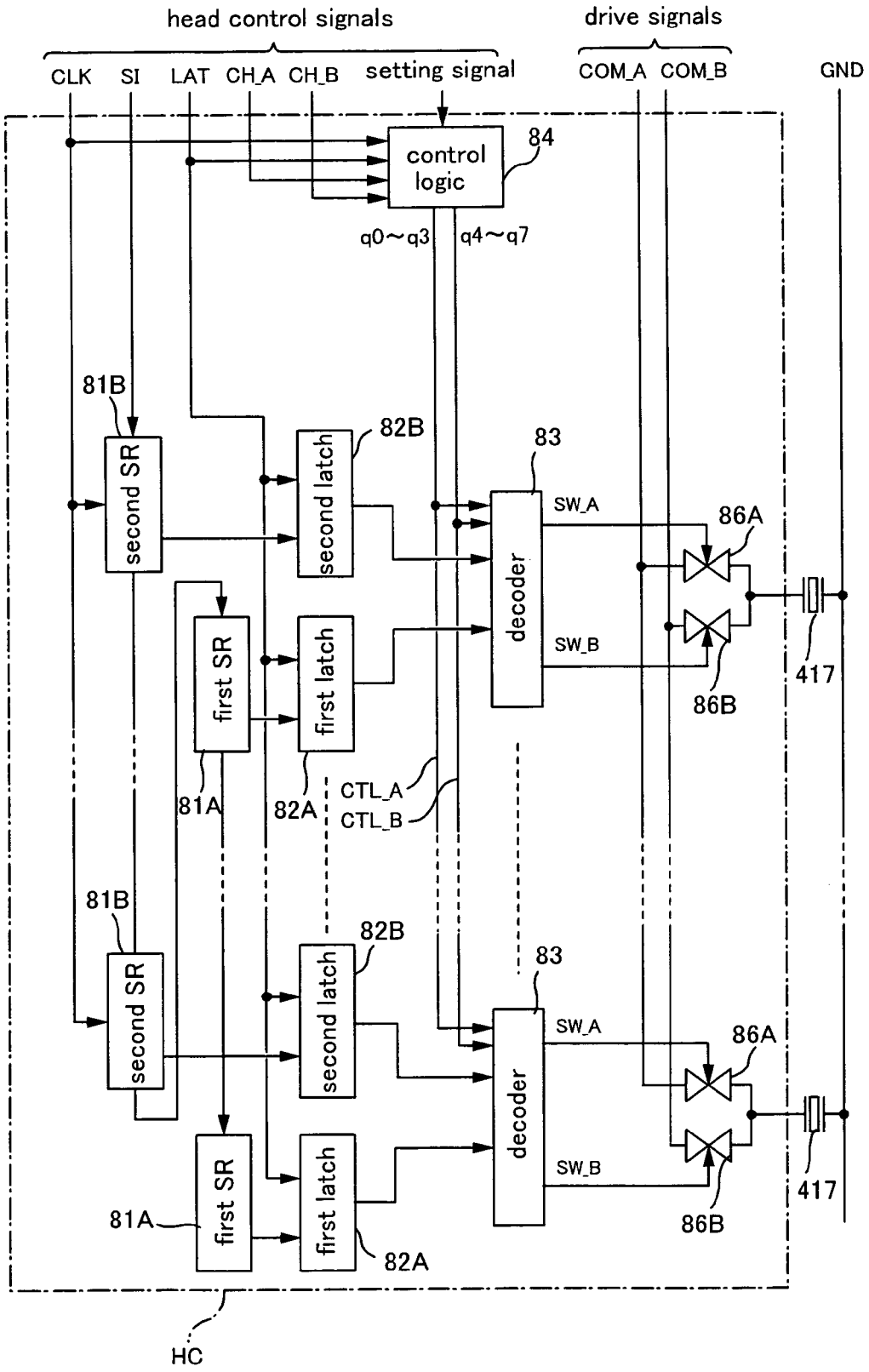
FIG. 42 is a block diagram for describing a configuration of a head controller.

FIG. 42 is a block diagram that describes the configuration of the head controller HC.

The head controller HC is provided with a first shift register 81A, a second shift register 81B, a first latch circuit 82A, a second latch circuit 82B, a decoder 83, a control logic 84, a first switch 86A, and a second switch 86B. Each of the sections other than the control logic 84 (that is, the first shift register 81A, the second shift register 81B, the first latch circuit 82A, the second latch circuit 82B, the decoder 83, the first switch 86A, and the second switch 86B) is provided for each one of the piezo elements 417.

The head controller HC performs control for ejecting ink based on the pixel data SI from the printer-side controller 60. That is, the head controller HC controls the first switch 86A and the second switch 86B based on print data and causes the necessary waveform sections of the first drive signal COM_A and the second drive signal COM_B to be selectively applied to the piezo elements 417. Here, each pixel data SI is made of two bits, and is delivered to the recording head 41 in synchronization with the clock signal CLK. The high-order bit group of the pixel data SI is set in the first shift registers 81A, and the low-order bit group is set in the second shift registers 81B. The first shift registers 81A are electrically connected to the first latch circuits 82A, and the second shift registers 81B are electrically connected to the second latch circuits 82B. When the latch signal LAT from the printer-side controller 60 becomes the H level, the first latch circuits 82A latch the high-order bit of the corresponding pixel data SI and the second latch circuits 82B latch the low-order bit of that pixel data SI. Each pixel data SI that has been latched by the first latch circuit 82A and the second latch circuit 82B (the pair of the high-order bit and the low-order bit) is input to the decoder 83. The decoder 83 selects one selection signal pair (for example, the selection signal q0 and the selection signal q4) of the selection signals q0 to q7 that are output from the logic circuit 84 according to the pixel data SI that have been latched by the first latch circuit 82A and the second latch circuit 82B, and outputs that selected pair of selection signals as a first switch control signal SW_A and a second switch control signal SW_B. The first drive signal COM_A is input to the first switch 86A, and the second drive signal COM_B is input to the second switch 86B. The switches are turned on and off in accordance with the switch control signals, and selectively apply the waveform sections included in the drive signals COM to the piezo elements 417.

<(4) Control Logic 84 of the First Reference Example>

Figure 43:
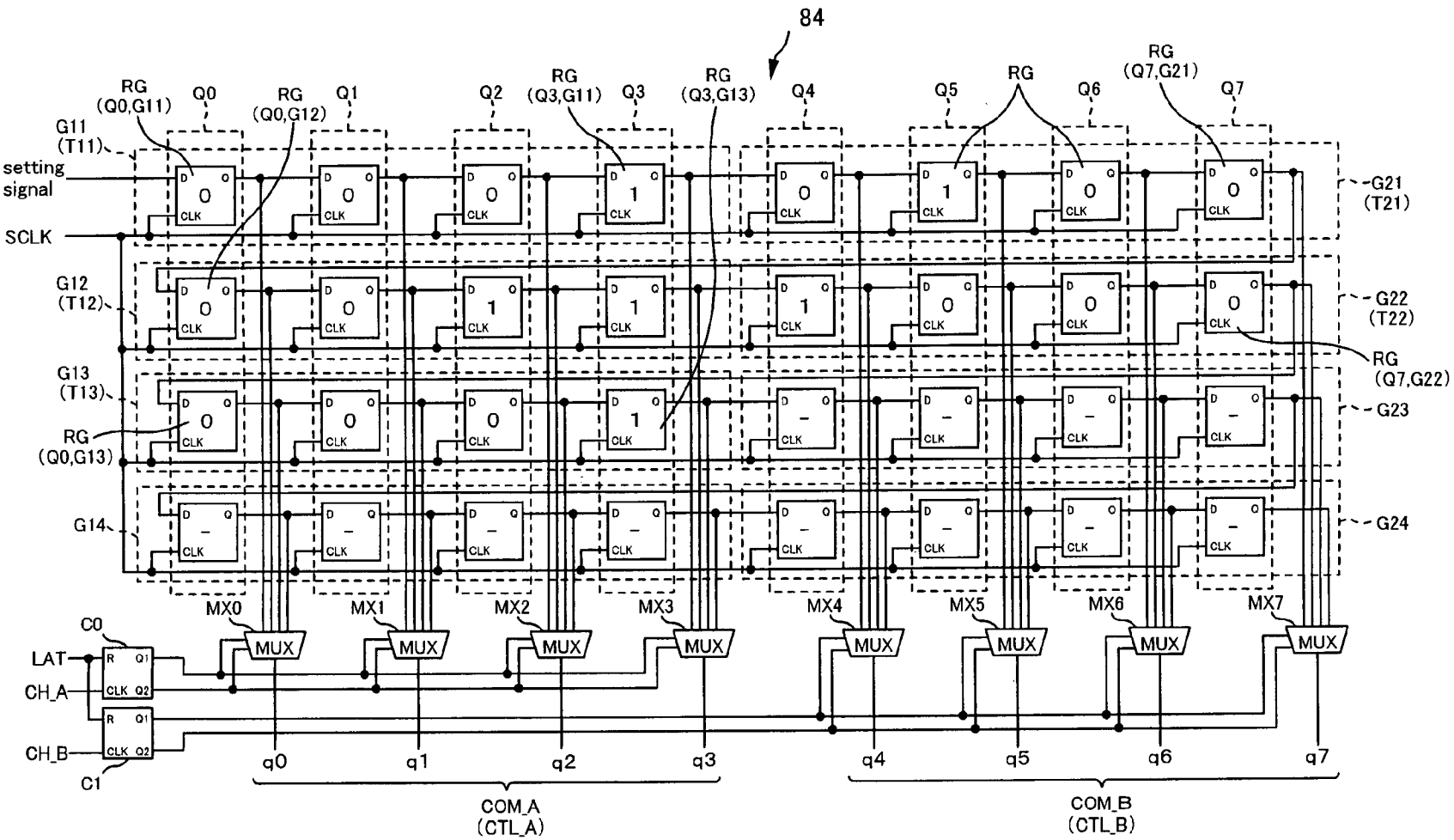
FIG. 43 is an explanatory diagram of a control logic.
Figure 44:
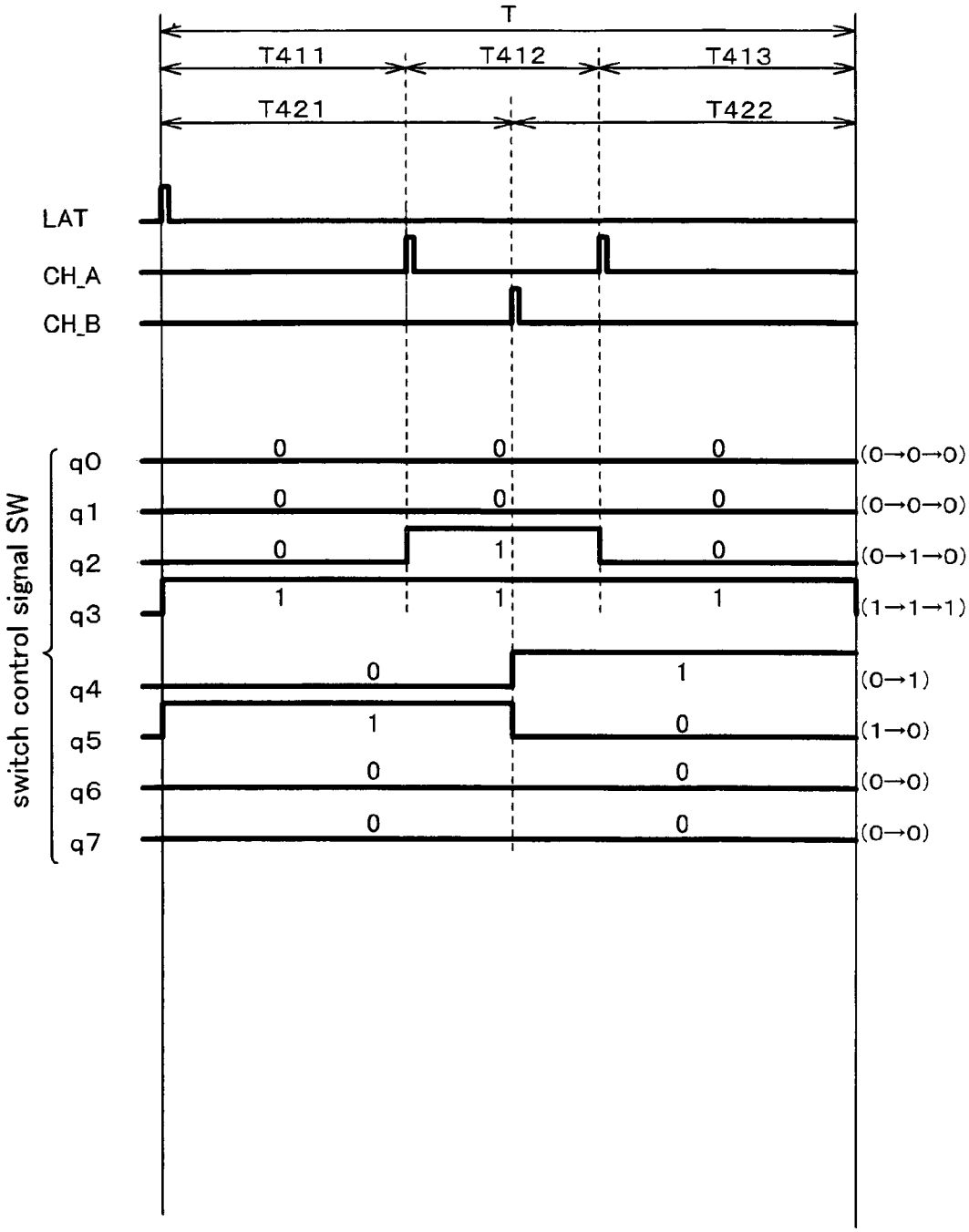
FIG. 44 is an explanatory diagram of head control signals and selection signals.

FIG. 43 is an explanatory diagram of the control logic 84 of the first reference example. FIG. 44 is an explanatory diagram of the head control signals (latch signal LAT, first change signal CH_A, and second change signal CH_B) that are input to the control logic 84, and the selection signals q0 to q7 that are output from the control logic 84.

The control logic 84 has a plurality of registers RG each capable of storing one bit of data. Each register RG is constituted by a D-FF (delay flip flop) circuit or the like. Each register RG stores predetermined selection data based on the setting signal from the printer-side controller 60. The selection data are consecutively updated at a predetermined timing. The content of the selection data is updated when the print mode is changed, for example.

For the sake of simplifying the description, in FIG. 43, the registers RG are disposed in a matrix of four registers in the column direction (vertical direction) and eight registers in the row direction (horizontal direction). The four registers RG belonging to the same column are grouped together, and starting from the group on the left are assigned numbers Q0 through Q7. The registers RG are divided into register groups located on the left side in the row direction (groups Q0 to Q3) and register groups located on the right side in the row direction (groups Q4 to Q7). Regarding the register groups located on the left side, the four registers RG belonging to the same row are grouped together and assigned numbers G11 to G14 in order from the group located at the top. The same applies for the register groups located on the right side, with the groups being assigned numbers G21 to G24 in order from the group located at the top.

The above groupings are made based on the role of the registers RG. First, the registers RG belonging to the groups Q0 to Q3 located on the left side in the row direction store selection data for setting the first selection data q0 to q3 for the first drive signal COM_A. Similarly, the registers RG belonging to the groups Q4 to Q7 located on the right side in the row direction store selection data for setting the second selection data q4 to q7 for the second drive signal COM_B.

Furthermore, the registers RG belonging to the same column can store the selection signals of the same waveform section. To describe this more specifically, the registers RG belonging to group G 1 store selection data for the first waveform section SS411, which is generated in period T411. The registers RG belonging to group G12 store selection data for the second waveform section SS412, which is generated in period T412. Similarly, the registers RG belonging to group G13 store selection data for the third waveform section SS413, which is generated in period T413. It should be noted that the registers RG belonging to group G14 are not used in this reference example. In a case where the first drive signal COM_A is made of four waveform sections, the registers RG of this group G14 will store the selection data for a fourth waveform section. On the other hand, the registers belonging to group G21 store the selection data for the first waveform section SS421, which is generated in period T421, and the registers belonging to group G22 store the selection data for the second waveform section SS422, which is generated in period T422. In this reference example, the registers RG belonging to group G23 and the registers RG belonging to group G24 are not used.

The registers RG of the control logic 84 can be said to store selection data determined by factors including the type of the corresponding drive signal COM (first drive signal COM_A, second drive signal COM_B), the corresponding pixel data SI (data value [00] through data value [11]), and the corresponding waveform section (for example, first waveform section SS411 or second waveform section SS422). For example, the register RG (Q0, G11) belonging to both group Q0 and group G11 stores selection data corresponding to the first waveform section SS411 of the first drive signal COM_A in pixel data SI for no-dot formation (data value [00]). The register RG (Q3, G13) belonging to both group Q3 and group G13 stores selection data corresponding to the third waveform section SS413 of the first drive signal COM_A in pixel data SI for a large dot (data value [11]). Similarly, the register RG (Q7, G22) belonging to both group Q7 and group G22 stores selection data corresponding to the second waveform section SS422 of the second drive signal COM_B in pixel data SI for a large dot.

Due to multiplexers MX0 through MX7, the selection data stored on the registers RG are sequentially updated at a timing defined by the latch pulse of the latch signal LAT, and the change pulse of the first change signal CH_A or the second change signal CH_B. Here, a two-bit control is input to the multiplexers MX0 to MX3 from the first counter C0, and this two-bit control input is switched at the timing defined by the latch pulse of the latch signal LAT and the change pulse of the first change signal CH_A. Likewise, a two-bit control is input to the multiplexers MX4 to MX7 from the second counter C1, and this two-bit control input is switched at the timing defined by the latch pulse of the latch signal LAT and the change pulse of the second change signal CH_B. Thus, the multiplexers MX0 to MX7 select selection data at the timing of the forward edge of the latch pulse and the change pulses. Then, the selection data that have been selected by the multiplexers MX0 to MX7 are output as first selection signals q0 to q3 for the first drive signal COM_A and second selection signals q4 to q7 for the second drive signal COM_B.

As shown in FIG. 43, in this first reference example, a one-bit selection data value of [0] or [1] is stored on each register RG. When the control logic 84 in which selection data have been set in this manner receives a latch signal LAT, a first change signal CH_A, and a second change signal CH_B such as those shown in FIG. 44, it outputs selection signals q0 to q7 such as those shown in FIG. 44.

For example, attention is paid to the registers of group Q2. An L-level signal is output as the selection signal q2 in correspondence with the selection data [0] stored on the register RG (Q2, G11) belonging to group G11, during the period T411 from input of the initial latch signal LAT until input of the first change signal CH_A. Also, an H-level signal is output as the selection signal q2 in correspondence with the selection data [1] stored on the register RG (Q2, G12) belonging to group G12, during the period T412 from input of the initial first change signal CH_A until input of the second first change signal CH_A. Then, an L-level signal is output as the selection signal q2 in correspondence with the selection data [0] stored on the register RG (Q2, G13) belonging to group G13, during the period T413 from input of the second first change signal CH_A until input of the next latch signal LAT. As a result, the selection signal q2 is a signal that changes from 0 (L level) to 1 (H level) and then back to 0 (L level) during the period T. That is, the selection data stored on the registers RG of the group 2 become data for setting the selection signal q2.

<(4) Decoder 83>

Figure 45:
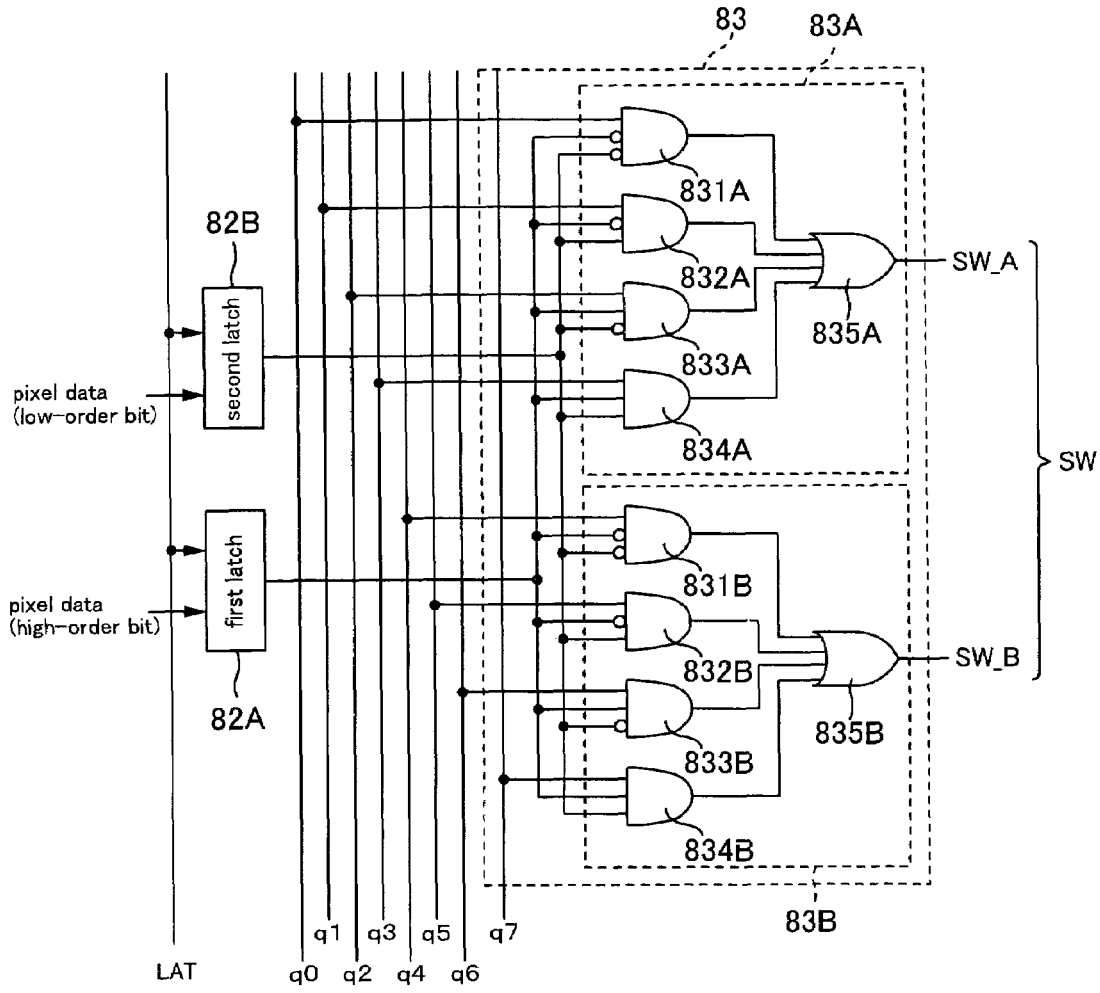
FIG. 45 is an explanatory diagram of a decoder.

FIG. 45 is an explanatory diagram of the decoder 83. FIG. 46 is an explanatory diagram of the relationship between the two-bit pixel data input to the decoder 83 and the first switch control signal SW_A and the second switch control signal SW_B that are output from the decoder 83.

The decoder 83 selects the selects selection signals, from among the first selection signals q0 to q3 and from the second selection signals q4 to q7, that correspond to the latched pixel data SI, and outputs these as the switch control signal SW. The decoder 83 has a first decoding section 83A that outputs the first switch control signal SW_A and a second decoding section 83B that outputs the second switch control signal SW_B.

The first decoding section 83A has four AND gates 831A to 834A and a single OR gate 835A. Each AND gate 831A to 834A has three input terminals and one output terminal, and receives one of the first selection signals q0 to q3, the data of the high-order bit of the pixel data SI, and the data of the low-order bit of the pixel data SI. The AND gates 831A to 834A each receives the data of the high-order bit of the pixel data SI and the data of the low-order bit of the pixel data SI differently. That is, the AND gate 831A receives the first selection signal q0 for no dot formation, the inverted data of the high-order bit of the pixel data SI, and the inverted data of the low-order bit of the pixel data SI. Thus, if the pixel data SI are the data [00], then the output from the AND gate 831A is in accordance with the first selection signal q0 for no dot formation. Likewise, the AND gate 832A receives the first selection signal q1 for a small dot, the inverted data of the high-order bit of the pixel data SI, and the data of the low-order bit of the pixel data SI. Thus, if the pixel data SI are the data [01], then the output from the AND gate 832A is in accordance with the first selection signal q1 for a small dot. The AND gate 833A receives the first selection signal q2 for a medium dot, the data of the high-order bit of the pixel data SI, and the inverted data of the low-order bit of the pixel data SI. Thus, if the pixel data SI are the data [10], then the output from the AND gate 833A is in accordance with the first selection signal q2 for a medium dot. Further, the AND gate 834A receives the first selection signal q3 for a large dot, the data of the high-order bit of the pixel data SI, and the data of the low-order bit of the pixel data SI. Thus, if the pixel data SI are the data [11], then the output from the AND gate 834A is in accordance with the first selection signal q3 for a large dot.

The OR gate 835A has four input terminals and one output terminal. At its four input terminals it receives the output from the AND gates 831A to 834A. The first switch control signal SW_A is output from the OR gate 835A. That is, a first selection signal q0 to q3 that corresponds to the pixel data SI that have been latched is selected and output as the first switch control signal SW_A.

The second decoding section 83B has the substantially the same structure as the first decoding section. A second selection signal q4 to q7 that corresponds to the pixel data SI that have been latched is selected and output from the OR gate 835B of the second decoding section 83B as the second switch control signal SW_B.

<(4) Gradation Control>

Figure 47:
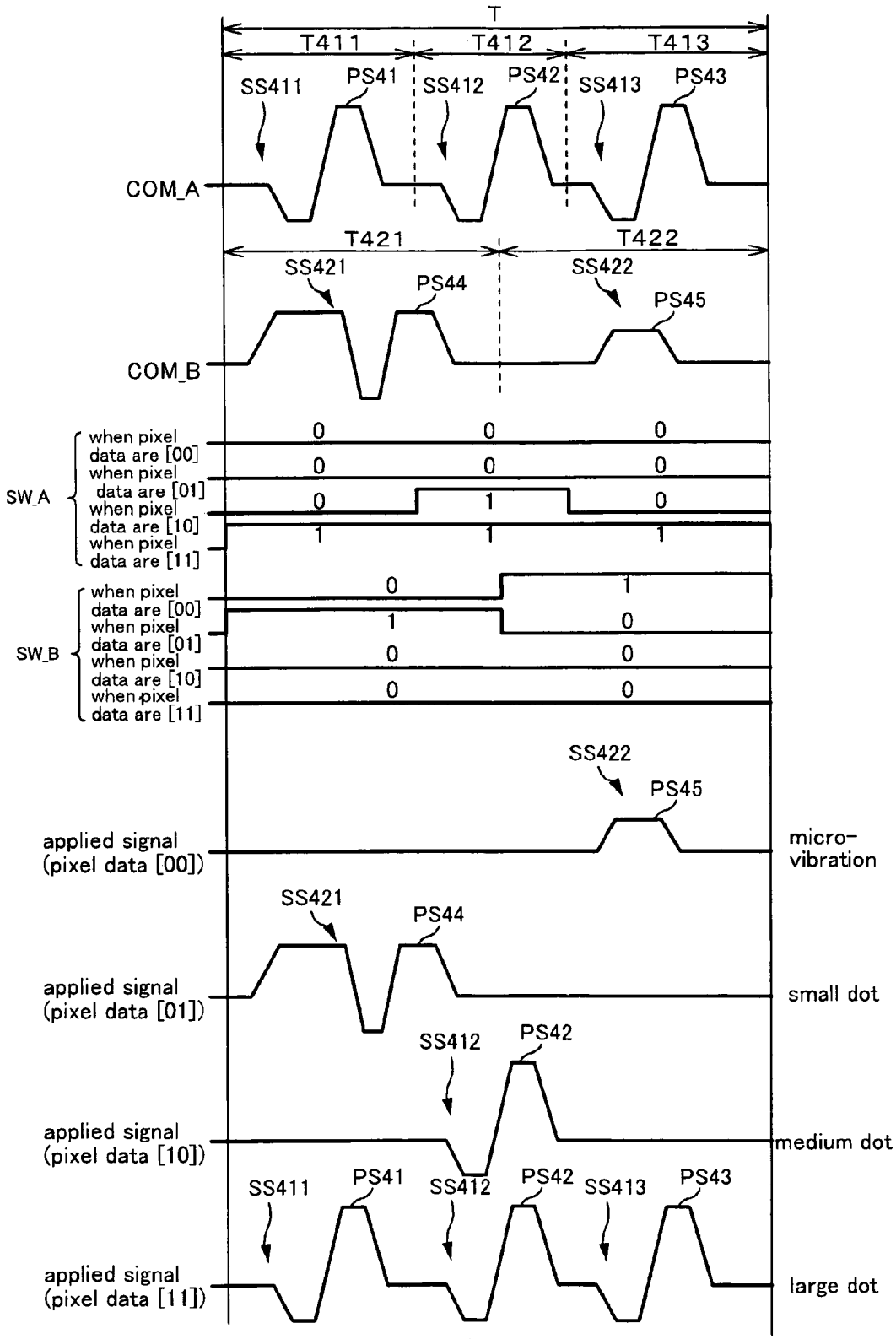
FIG. 47 is an explanatory diagram of the relationship between the drive signals, the switch control signals, and application signals that are applied to piezo elements.

FIG. 47 is an explanatory diagram illustrating the relationship between the first drive signal COM_A, the second drive signal COM_B, the first switch control signal SW_A, the second switch control signal SW_B, and the applied signal that is applied to the piezo element 417.

The case of forming a large dot (pixel data SI having the data [11]) is described first. If the pixel data [11] have been latched, the first selection signal q3 is output as the first switch control signal SW_A and the second selection signal q7 is output as the second switch control signal SW_B. Thus, the first switch 86A is ON in period T411, period T412, and period T413, and the second switch 86B is OFF over the period T. As a result, the drive pulse PS41 of the first waveform section SS411 of the first drive signal COM_A, the drive pulse PS42 of the second waveform section SS412 of the first drive signal COM_A, and the drive pulse PS43 of the third waveform section SS413 of the first drive signal COM_A are applied in that order to the piezo element 417, causing the ejection of an ink droplet of an amount of ink that corresponds to a large dot (large ink droplet) from the nozzle Nz.

The case of forming a medium dot (pixel data SI having the data [10]) is described next. If the pixel data [10] have been latched, the first selection signal q2 is output as the first switch control signal SW_A and the second selection signal q6 is output as the second switch control signal SW_B. Thus, the first switch 86A is in the ON state in period T412 and is in the OFF state in the other periods, and the second switch 86B is OFF over the period T. As a result, the drive pulse PS42 of the second waveform section SS412 of the first drive signal COM_A is applied to the piezo element 417, causing the ejection of an ink droplet of an ink amount that corresponds to a medium dot (medium ink droplet) from the nozzle Nz.

The case of forming a small dot (pixel data SI having the data [01]) is described next. If the pixel data [01] have been latched, the first selection signal q1 is output as the first switch control signal SW_A and the second selection signal q5 is output as the second switch control signal SW_B. Thus, the first switch 86A is in the OFF state over the period T, and the second switch 86B is ON in period T421 and is off in period T422. As a result, the drive pulse PS44 of the first waveform section SS421 of the second drive signal COM_B is applied to the piezo element 417, causing the ejection of a an ink droplet of an ink amount that corresponds to a small dot (small ink droplet) from the nozzle Nz.

The case of no dot formation (pixel data SI having the data [00]) is described next. If the pixel data [00] have been latched, the first selection signal q0 is output as the first switch control signal SW_A and the second selection signal q4 is output as the second switch control signal SW_B. Thus, the first switch 86A is off over the period T, and the second switch 86B is OFF in period T421 and is ON in period T422. As a result, the drive pulse PS45 of the second waveform section SS422 of the second drive signal COM_B is applied to the piezo element 417. In this case, although no ink droplet will be ejected from the nozzle Nz, the driving of the piezo element 417 will cause slight vibration of the ink and agitates the ink within the nozzle.

In the first reference example, if no dot is to be formed, then the combination of the selection signal q0 and the selection signal q4 are selected as the switch control signals from among the selection signals q0 to q7 that are output from the control logic 84. Similarly, if a small dot is to be formed, then the combination of the selection signal q1 and the selection signal q5 are selected as the switch control signals, if a medium dot is to be formed, then the combination of the selection signal q2 and the selection signal q6 are selected as the switch control signals, and if a large dot is to be formed, then the combination of the selection signal q3 and the selection signal q7 are selected as the switch control signals.

It should be noted that in this first reference example, when forming dots, one of the first switch 86A and the second switch 86B is off over the period T, and thus only one of the first drive signal COM_A and the second drive signal COM_B is selected. Thus, in the first reference example, when forming dots, there are no instances in which a waveform section included in the first drive signal COM_A and a waveform section included in the second drive signal COM_B are applied to the same piezo element 417 in the period T. Further, the first switch 86A and the second switch 86B will not be in the ON state at the same time (if both switches were in the ON state simultaneously, then an unexpected current I would flow between the signal line of the first drive signal COM_A and the signal line of the second drive signal COM_B (see FIG. 48), and this has the possibility of damaging the apparatus).

===(4) Second Reference Example===

<(4) Effect Due to Noise>

In the first reference example discussed above, the printer-side controller 60 outputs a setting signal so that only the selection data [0] is set in the registers RG belonging to group Q0, group Q1, group Q6, and group Q7 of the control logic 84 (see FIG. 43). However, there is still a possibility that an incorrect selection data value will be set to a register RG of the logic circuit 84, even if the printer-side controller 60 outputs a setting signal in this manner.

This problem is thought to occur primarily due to noise. The setting signal that is output from the printer-side controller 60 is input to the head controller HC, which is provided in the carriage CR, via a flexible cable that connects the body of the printer and the carriage CR. This flexible cable includes not only the signal line for the head control signals such as the clock signal and the setting signal, but also the signal line for the first drive signal COM_A and the signal line for the second drive signal COM_B. Because a large current flows through the signal lines for the drive signals in order to drive the piezo elements 417, there is a possibility that electromagnetic noise will occur in the surrounding area. Thus, there is the possibility that the clock signal and the setting signal that are output from the printer-side controller 60 will be affected by noise in the flexible cable and cause incorrect selection data to be set to a register RG of the control logic 84.

Figure 49A:
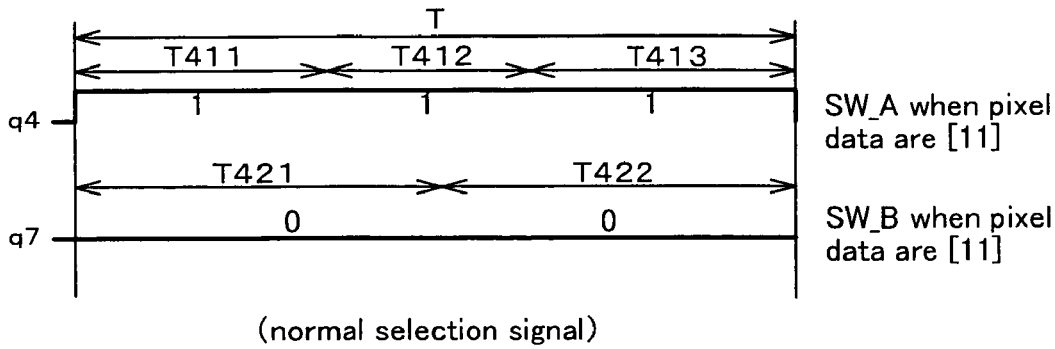
FIG. 49A is an explanatory diagram of a normal selection signal q4 and selection signal q7.
Figure 49B:
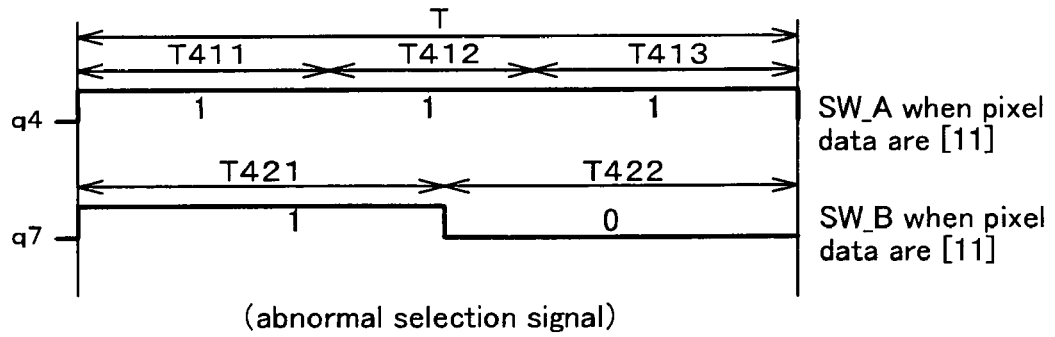
FIG. 49B is an explanatory diagram of an abnormal selection signal q4 and selection signal q7.

FIG. 49A is an explanatory diagram illustrating a normal selection signal q4 and selection signal q7. FIG. 49B is an explanatory diagram illustrating an abnormal selection signal q4 and selection signal q7. When normal, the selection signal q4 and the selection signal q7 will not both take the value 1 (H level) at the same time. However, when abnormal selection data are set to the register RG (Q7, G21) belonging to group Q7 of the control logic 84, then the selection signal q4 and the selection signal q7 simultaneously take the value 1 (H level) in the period T421.

In this way, when the selection signal q4 and the selection signal q7, which constitute a pair, both take the value 1 simultaneously, then when the pixel data that have been latched are the data [11], the first switch 86A and the second switch 86B become ON simultaneously. When these two switches become ON at the same time, an unexpected current I flows between the signal line for the first drive signal COM_A and the signal line for the second drive signal COM_B (see FIG. 48), and this may damage the apparatus.

In the second reference example, the configuration is such that both switches are prevented from being on at the same time. The configuration of the second reference example differs from that of the first reference example in the configuration of the control logic 84, and in all other aspects the two are the same. Thus, the following discussion focuses on the control logic 84 of the second reference example.

<(4) Control Logic 84 of the Second Reference Example>

Figure 50:
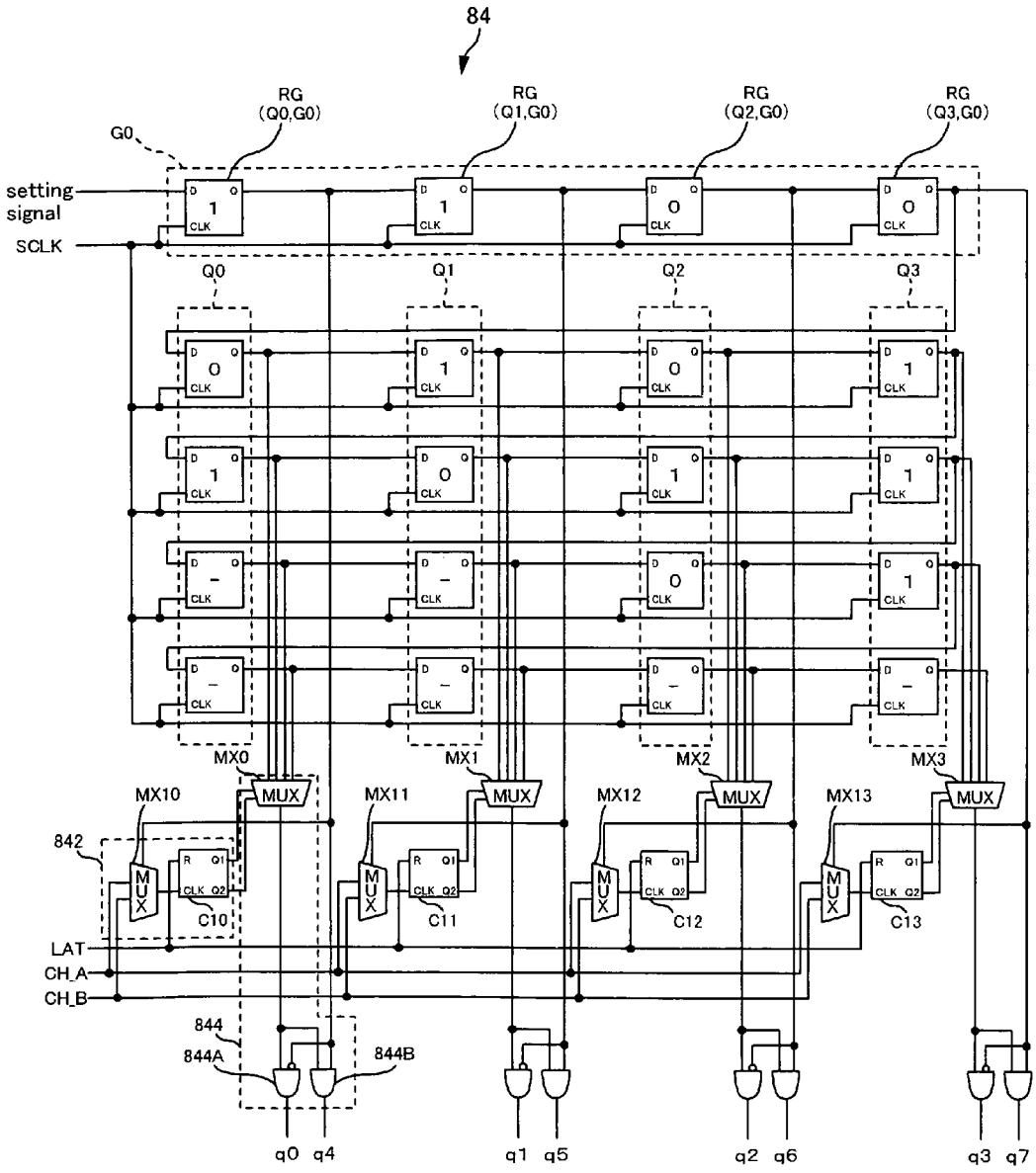
FIG. 50 is an explanatory diagram of a control logic of a second reference example.
Figure 51A:
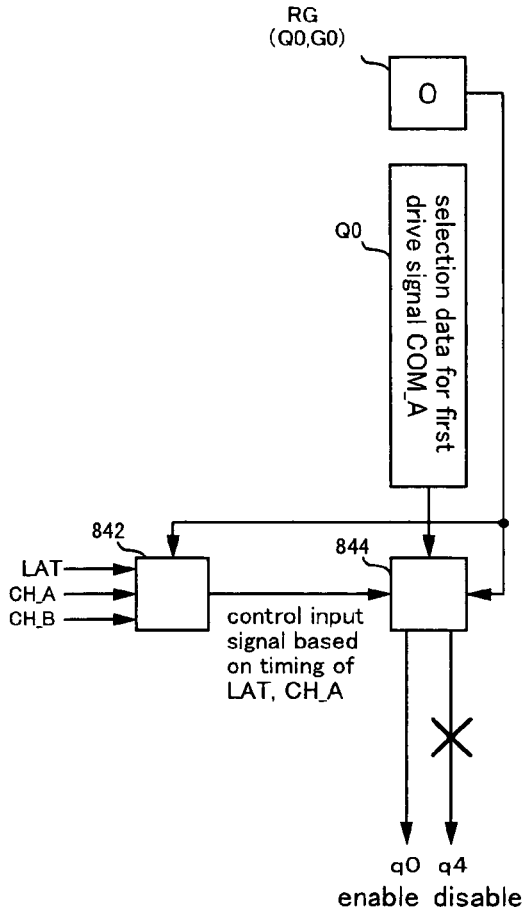
FIG. 51A is an explanatory diagram of an operation of a control logic 84 when the drive waveform selection data value is [0]
Figure 51B:
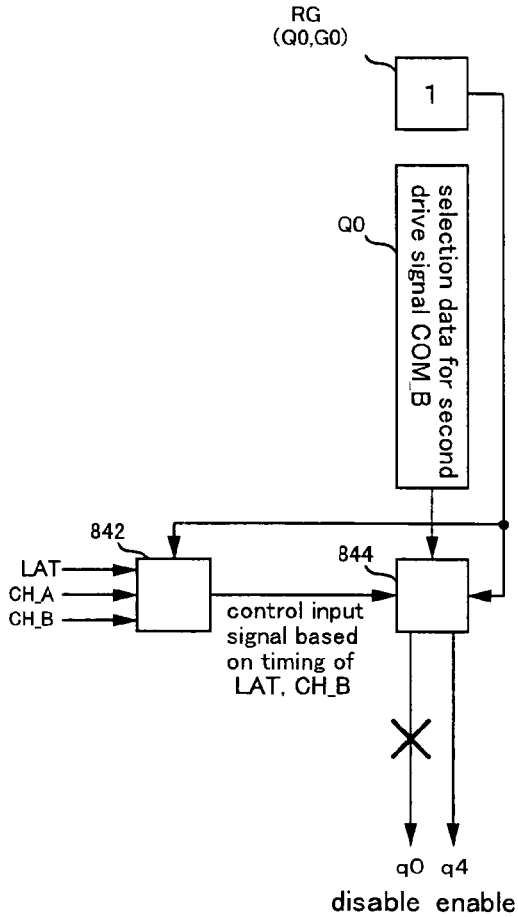
FIG. 51B is an explanatory diagram of an operation of the control logic 84 when the drive waveform selection data value is [1].

FIG. 50 is an explanatory diagram of the control logic 84 of the second reference example. FIG. 51A is an explanatory diagram illustrating the operation of the control logic 84 when the drive signal selection data value is [0]. FIG. 51B is an explanatory diagram illustrating the operation of the control logic 84 when the drive signal selection data value is [1].

The configuration of the control logic 84 of the second reference example differs from the configuration of the control logic 84 of the first reference example in the following aspects. First, in the second reference example, four additional registers RG for storing data for selecting a drive signal (drive signal selection data) are provided. These four registers RG are shown as the registers RG of a group G0 in FIG. 50. On the other hand, in the second reference example, the registers RG of group Q4 and group Q7 have been omitted. Further, in the second reference example, the configuration of, for example, a timing control section 842 for performing an input of control to the multiplexer MX0 to the multiplexer MX3, and an output section 844 for creating two selection signals from the selection data stored on the four registers RG are different from those of the first reference example. The configuration of the second reference example is described in further detail below.

The registers RG belonging to group G0, like the registers RG belonging to groups Q0 to Q3, are constituted by D-FF (delay flip flop) circuits that can store one bit of data each. Data are set to the registers RG belonging to group G0 in accordance with a setting signal from the printer-side controller 60, which is also how data are set to the registers RG belonging to groups Q0 to Q3.

The timing controller 842 has multiplexers MX10 to MX13 and counters C10 to C13. The timing controller 842 inputs control to the multiplexers MX10 to MX13. Here, a timing controller 842 that is made of the multiplexer MX10 and the counter C10 is described. The first change signal CH_A and the second change signal CH_B are input to the multiplexer MX10. The multiplexer MX10 switches the signal that it outputs based on the control input of the drive signal selection data stored on the register RG (Q0, G0) of group G0. If the drive signal selection data value is [0], then it outputs the first change signal CH_A, and if the drive signal selection data value is [1], then it outputs the second change signal CH_B. The signal that is output from the multiplexer MX10 is input to the clock terminal of the counter C10. The counter C10 is reset by the latch pulse of the latch signal LAT, and each time the change pulse of the change signal is output from the multiplexer MX10, it raises the two-bit output. The timing controller 842 outputs this two-bit signal to the multiplexer MX0 of the output section 844.

The output section 844 has multiplexers MX0 through MX3 and AND gates. The output section 844 outputs the selection signals q0 to q7 to the decoder 83. An output section 844 that is made of the multiplexer MX0, an AND gate 844A, and an AND gate 844B is described here.

Selection data are input from the registers RG of group Q0 to the multiplexer MX0. Then, the multiplexer MX0 switches the signal that is output based on the two-bit information from the counter C10 of the timing controller 842. Thus, the multiplexer MX0 selects selection data at the timing of the latch pulse and the change pulses.

The AND gate 844A and the AND gate 844B receive the signal that is output from the multiplexer MX0. The AND gate 844A receives the inverted data of the drive signal selection data stored on the register RG (Q0, G0) in group G0. On the other hand, the AND gate 844B receives the drive signal selection data stored on the register RG (Q0, G0) in group G0. Thus, if the drive signal selection data is the value [0], then the signal output from the multiplexer MX0 is the selection signal q0, and the selection q4 becomes [0] (L level). On the other hand, if the drive signal selection data is the value [1], then the selection signal q0 becomes [0] (L level), and the signal that is output from the multiplexer MX0 becomes the selection signal q4.

That is, if the drive signal selection data is the value [0], then the AND gate 844A of the output section 844 outputs the selection signal q0, which is switched at the timing of the latch signal LAT and the first change signal CH_A, and the AND gate 844B outputs the selection signal q4, which is maintained at the value [0] (L level). On the other hand, if the drive signal selection data is the value [1], then the AND gate 844A of the output section 844 outputs the selection signal q0, which is maintained at the value [0] (L level), and the AND gate 844B outputs the selection signal q4, which is switched at the timing of the latch signal LAT and the second change signal CH_B.

Thus, the selection data that are set to the registers RG of group Q0 become data for setting the selection signal q0 if the drive signal selection data value is [0], and become data for setting the selection signal q4 if the drive signal selection data value is [1]. Here, the selection signal q0 becomes the first switch control signal SW_A (a signal for selecting a waveform section of first drive signal COM_A) when the pixel data are [00], and the selection signal q4 becomes the second switch control signal SW_B (a signal for selecting a waveform section of second drive signal COM_B) when the pixel data are [00]. Consequently, the selection data that are set to the registers RG of group Q0 become data for selecting a waveform section of the first drive signal COM_A if the drive signal selection data value is [0], and become data for selecting a waveform section of the second drive signal COM_B if the drive signal selection data value is [1].

In this way, with the second reference example, one of the two selection signals constituting a pair is enabled, and the other selection signal is disabled, depending on the drive signal selection data stored on the registers RG belonging to group G0. Thus, even if noise causes an error in the data stored on a register belonging to group G0 or the data stored on a register belonging to one of groups Q0 to Q3, the two selection signals constituting a pair will not both be the value [1] (H level) at the same time. Thus, with the second reference example, the first switch control signal and the second switch control signal are prevented from entering the ON state simultaneously. Further, with the second reference example, because one of the two selections signals constituting a pair is disabled, it is possible to reduce the storage capacity by that amount of selection data, and thus the number of registers RG can be reduced.

===(4) Fourth Embodiment===

<(4) Switching the Drive Signal During the Period T>

In the second reference example discussed above, the drive signal is not switched during the period T. For example, in the case of forming a large dot or forming a medium dot, only the drive pulses of the first drive signal are applied to the piezo element 417, and the drive pulses of the second drive signal COM_B are not applied to the piezo element 417. In the case of forming a small dot or in the case of no dot formation, only the drive pulses of the second drive signal COM_B are applied to the piezo element 417, and the drive pulses of the first drive signal COM_A are not applied to the piezo element 417. In this way, in the second reference example, the drive pulse of the first drive signal COM_A and the drive pulse of the second drive signal COM_B are not applied to the same piezo element 417 in the period T.

In the second reference example, the degree of freedom with regard to the design of the drive signals COM is limited due to this restriction. Also, when forming a large dot, for example, only the waveform sections included in the first drive signal COM_A are applied to the piezo element 417, and thus the heat that is generated is concentrated on the first drive signal generation section 70A. Further, although combining the ink amount corresponding to a particular drive pulse of the first drive signal COM_A and the ink amount corresponding to a particular drive pulse of the second drive signal COM_B may result in an ink amount that is suited for particular pixel data, the second reference example would not allow for such a combination. Accordingly, the present embodiment adopts a configuration with which the first switch control signal and the second switch control signal are prevented from turning ON at the same time but also with which it is possible to switch the drive signal during the period T.

Figure 52:
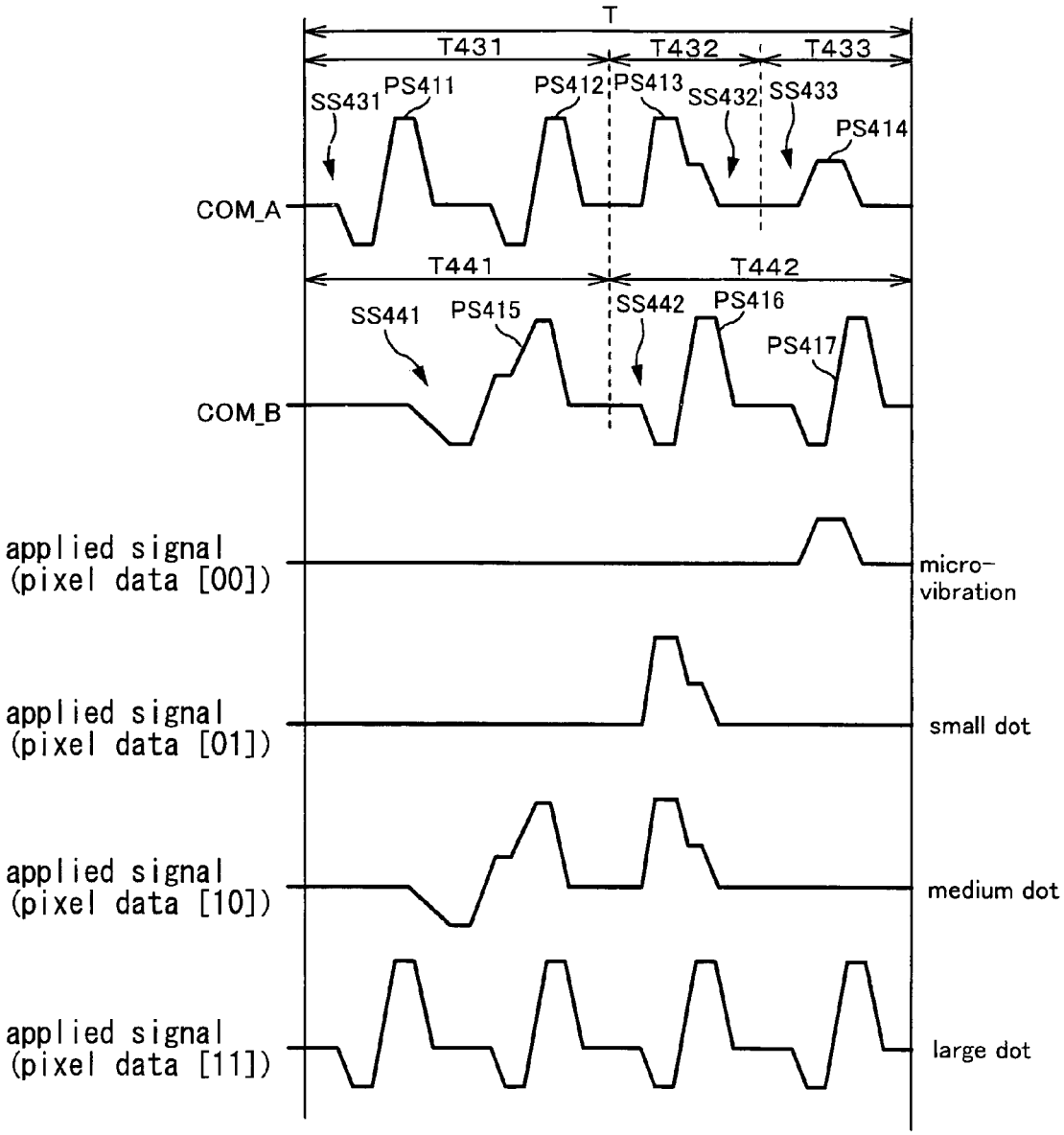
FIG. 52 is an explanatory diagram of the relationship between the drive signals and the application signals that are applied to the piezo elements in the forth embodiment.

FIG. 52 is an explanatory diagram of the relationship between the drive signals of the present embodiment and the applied signal that is applied to the piezo elements. In contrast to the examples discussed above, in this embodiment the drive signal is switched during the period T. For example, in the case of forming a large dot, a waveform section (first waveform section SS431) of the first drive signal COM_A and a waveform section (second waveform section SS442) of the second drive signal COM_B are applied to the piezo element 417. In the case of forming a medium dot, a waveform section (first waveform section SS441) of the second drive signal COM_B and a waveform section (second waveform section SS432) of the first drive signal COM_A are applied to the piezo element 417. In this way, in the present embodiment, waveform sections of different drive signals can be applied to the piezo element 417 during the period T.

The present embodiment is described in detail below. However, compared to the second reference example discussed above, it differs only in the various signals (drive signals COM and switch signal CSW (discussed later), etc.) and the configuration of the control logic 84, and in other aspects of its configuration, the two are the same. Thus, the following discussion focuses on the drive signals COM and the control logic 84 of the present embodiment.

<(4) Regarding the Various Signals of this Embodiment>

Figure 53:
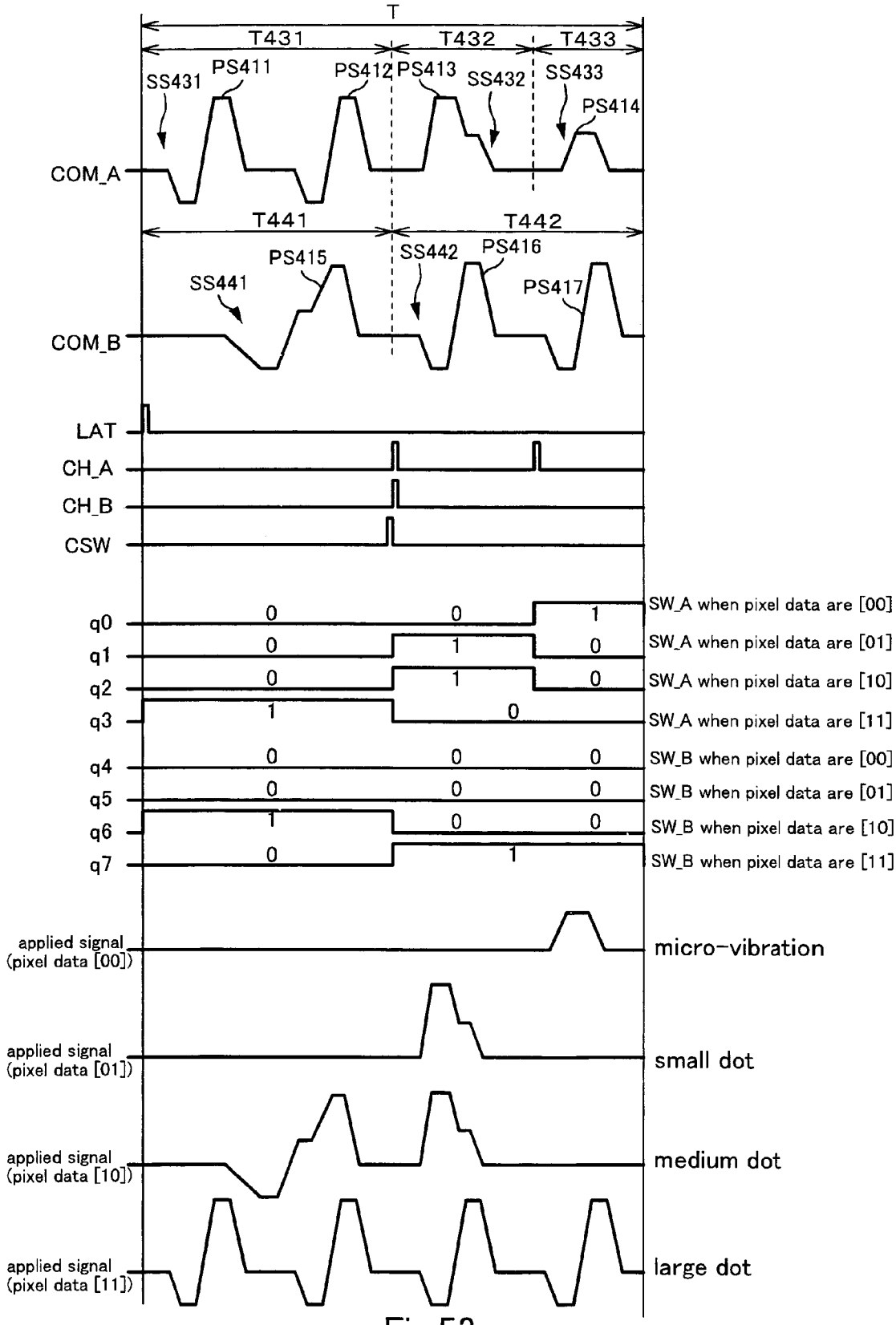
FIG. 53 is an explanatory diagram of the waveforms of the various signals in the forth embodiment.

FIG. 53 is an explanatory diagram of the waveforms of the various signals of the present embodiment. Compared to the reference examples discussed above, a switch signal CSW has been added. Also, the waveforms of the drive signals COM, etc., are different.

The first drive signal COM_A of this embodiment includes a first waveform section SS431 that is generated in the period T431, a second waveform section SS432 that is generated in the period T432, and a third waveform section SS433 that is generated in the period T433, of the repeating cycle T. Here, the first waveform section SS431 has a drive pulse PS411 and a drive pulse PS412. The second waveform section SS432 has a drive pulse PS413 and the third waveform section SS433 has a drive pulse PS414. The drive pulse PS411 and the drive pulse PS412 are applied to the piezo element 417 when forming a large dot, and have the same waveform. The drive pulse PS413 is applied to the piezo element 417 when forming a medium dot or a small dot. The drive pulse PS414 is applied to the piezo element 417 when no dot is to be formed. However, when the drive pulse PS414 is applied to the piezo element 417, although no ink droplet is ejected from the head 41, the ink within the ink storage chamber 412*a* and the pressure chamber 414*a* of the head 41 is gently vibrated to prevent ink from clogging within the nozzle Nz.

The second drive signal COM_B in this embodiment has a first waveform section SS441 that is generated in a period T441 and a second waveform section SS442 that is generated in a period T442. In the second drive signal COM_B, the first waveform section SS441 has a drive pulse PS415 and the second waveform section SS442 has a drive pulse PS416 and a drive pulse PS417. Here, the drive pulse PS415 is applied to the piezo element 417 when a medium dot is to be formed. The drive pulse PS416 and the drive pulse PS417 are applied to the piezo element 417 when a large dot is to be formed. It should be noted that the period T441 is identical to the period T431.

That is, in this embodiment, the waveform sections that are applied to the piezo element 417 when a large dot is to be formed are included in both the first drive signal COM_A and the second drive signal COM_B. Similarly, the waveform sections that are applied to the piezo element 417 when a medium dot is to be formed are included in both the first drive signal COM_A and the second drive signal COM_B.

Like the reference examples discussed above, the latch signal LAT, the first change signal CH_A, and the second change signal CH_B are input to the control logic 84. The latch signal LAT is a signal that indicates the start of the repeating cycle T. The first change signal CH_A is a signal that indicates the period during which the first selection signals q0 to q3 for selecting the waveform section of the first drive signal COM_A go ON and OFF. The second change signal $CH_{}_B$ is a signal that indicates the period during which the second selection signals q4 to q7 for selecting a waveform section of the second drive signal COM_B go ON and OFF.

In this embodiment, the switch signal CSW is input to the control logic 84 as a head control signal from the control unit 64 of the printer-side controller 60. The switch signal CSW is a signal that indicates the timing for switching the drive signal that is applied to the piezo element 417. The switch signal CSW has a rising pulse at a timing when the period T431 has passed. In other words, it has a rising pulse at a timing when the period T441 has passed.

<(4) Configuration of the Control Logic 84 of the Embodiment>

Figure 54:
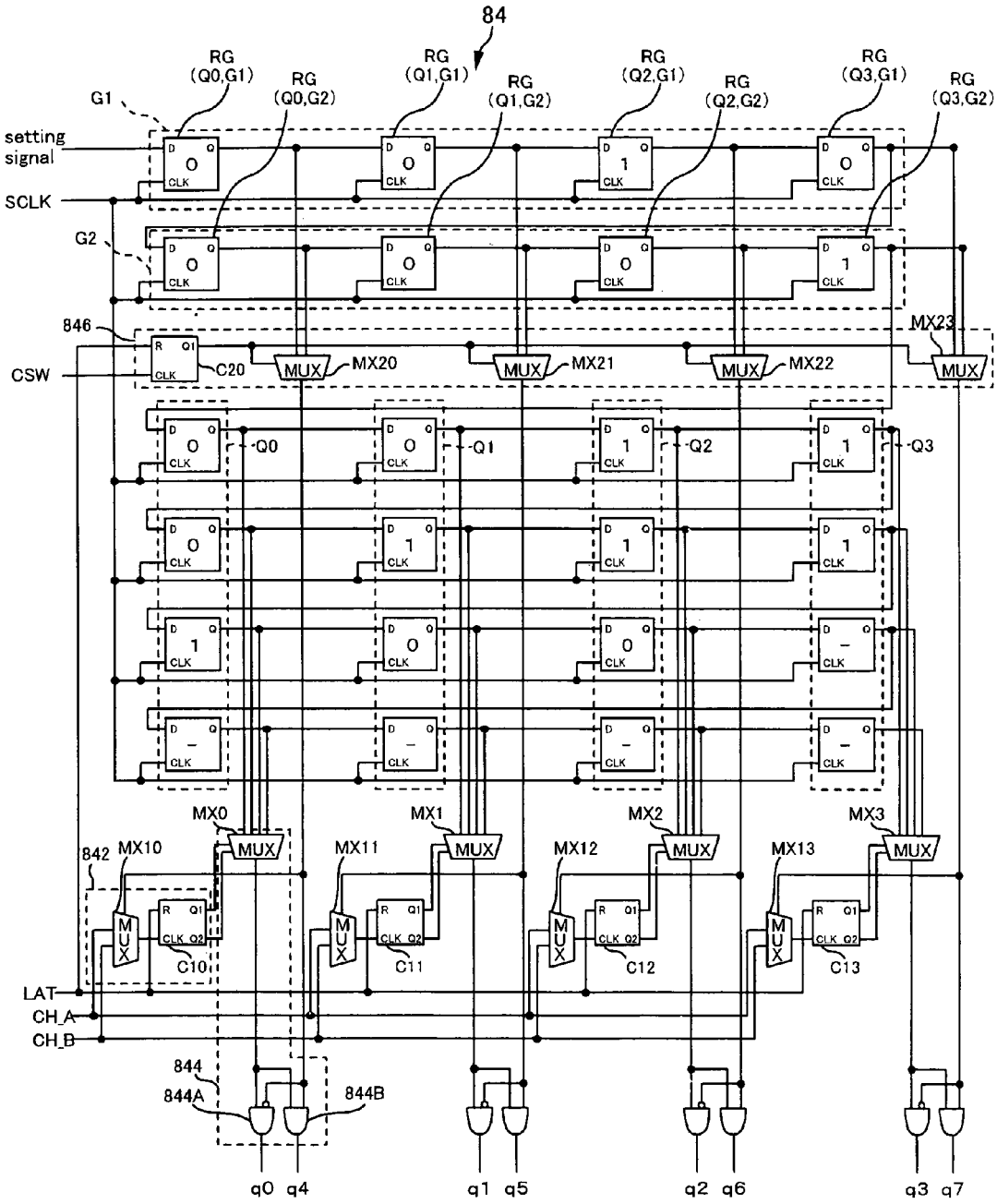
FIG. 54 is an explanatory diagram of the control logic 84 in the forth embodiment.
Figure 55A:
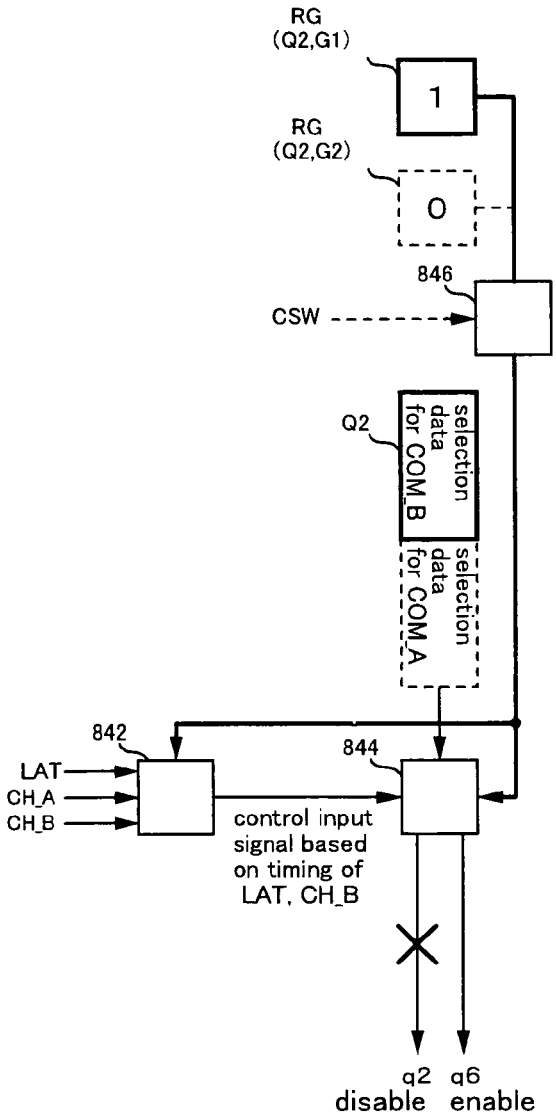
FIG. 55A is an explanatory diagram of an operation of the control logic 84 prior to input of a switch signal CSW.
Figure 55B:
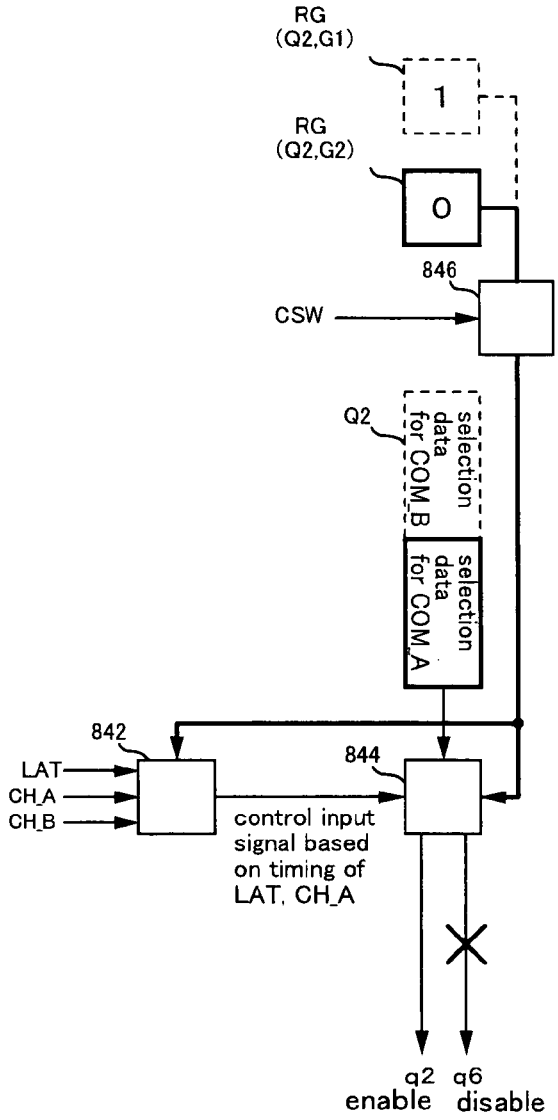
FIG. 55B is an explanatory diagram of the operation of the control logic 84 after input of the switch signal CSW.

FIG. 54 is an explanatory diagram of the control logic 84 of the present embodiment. FIG. 55A is an explanatory diagram of the operation of the control logic 84 before the switch signal CSW is input. FIG. 55B is an explanatory diagram of the operation of the control logic 84 after the switch signal CSW has been input.

The configuration of the control logic 84 of this embodiment differs from that of the control logic 84 of the second reference example in the following regard. First, in this embodiment, there are eight additional registers RG for storing drive signal selection data (in the second reference example, there are four). These eight registers RG are divided among two groups, a group G1 and a group G2, as shown in FIG. 54. Further, this embodiment differs from the second reference example discussed above in that it is further provided with a drive signal switch section 846.

The registers RG belonging to group, G1 and group G2, like the registers RG belonging to group G0 of the second reference example, are constituted by D-FF circuits that can store one bit of data each. Data are set to the registers RG belonging to group G1 and group G2 in the same manner as the registers RG belonging to group G0 of the second reference example, that is, based on a setting signal from the printer-side controller 60.

The drive signal selection data stored on the registers RG belonging to group G1 indicate which drive signal to select in response to each pixel data in the period from input of the latch signal LAT until input of the switch signal CSW. The drive signal selection data stored on the registers RG belonging to group G2 indicate which drive signal to select in the period from input of the switch signal CSW until the end of the repeating cycle T.

The drive signal switch section 846 has a counter C20 and multiplexers MX20 to MX23. The drive signal switch section 846 switches to the drive signal that should be selected in correspondence with the pixel data before and after input of the switch signal CSW. The latch signal LAT and the switch signal CSW are input to the counter C20. The counter C20 is reset by the latch pulse of the latch signal LAT and outputs the value [0], and then when the pulse of the switch signal CSW is input, it outputs the value [1]. The output of the counter C20 is input as control to the multiplexers MX20 to MX23. The multiplexers MX20 to MX23 switch the signal that they output based on the signal from the counter C20. For example, when the value [0] is output from the counter C20, the multiplexer MX20 outputs a signal that corresponds to the drive signal selection data stored on the register RG (Q0, G1) of group G1. On the other hand, when the value [1] is output from the counter C20, the multiplexer MX20 outputs a signal that corresponds to the drive signal selection data stored on the register RG (Q0, G2) of group G2. In this way, the multiplexers MX20 to MX23 output a signal that corresponds to the drive signal selection data stored on a register RG of group G1 before input of the switch signal CSW, and output a signal that corresponds to the drive signal selection data stored on a register RG of group G2 after input of the switch signal CSW. The drive signal switch section 846 outputs the signals output from the multiplexers MX20 to MX23 to the timing controller 842 and the output section 844.

If the signal that is input to the timing controller 842 from the drive signal switch section 846 is the value [0], then the multiplexers MX10 to MX13 output the first change signal CH_A. On the other hand, if the signal that is input to the timing controller 842 from the drive signal switch section 846 is the value [1], then the multiplexers MX10 to MX13 output the second change signal CH_B. Thus, for example, before input of the switch signal CSW, the counter C10 raises the two-bit output to the multiplexer MX0 at the timing of the pulse of the change signal (either CH_A or CH_B) corresponding to the drive signal selection data stored on the register RG (Q0, G1) of group G1. After the switch signal CSW has been input, the counter C10 raises the two-bit output to the multiplexer MX0 at the timing of the pulse of the change signal (either CH_A or CH_B) corresponding to the drive signal selection data stored on the register RG (Q0, G2) of group G2.

If the signal that is input to the output section 844 from the drive signal switch section 846 is the value [0], then the output signals from the multiplexers MX0 to MX3 are the selection signals q0 to q3, respectively, and the selection signals q4 to q7 each becomes [0] (L level). On the other hand, if the signal that is input to the output section 844 from the drive signal switch section 846 is the value [1], then the output signals from the multiplexers MX0 to MX3 are the selection signals q4 to q7, respectively, and the selection signals q0 to q3 each becomes [0] (L level). It should be noted that the multiplexers MX0 to MX3 of the drive signal switch section 846 change registers RG in correspondence with the control input from the counters C10 to C13 and output the selection data stored on the registers RG.

<(4) Operation of the Control Logic 84 of the Present Embodiment>

First, in this embodiment, data have been set to the registers RG as in FIG. 54. Here, the operation of the control logic 84 when outputting the selection signals q2 and q6 is described using FIGS. 54, 55A, and 55B.

Before Input of the Switch Signal CSW

Before input of the switch signal CSW, the counter C20 of the drive signal switch section 846 is reset due to the latch pulse of the latch signal LAT, and outputs the value [0]. Due to this, the multiplexer MX22 outputs a signal that is at H level in correspondence with the drive signal selection data stored on the register RG (Q2, G1) in group G1. That is, the drive signal switch section 846 outputs a signal corresponding to the drive signal selection data stored on the register RG (Q2, G1).

The H-level signal that is output from the drive signal switch section 846 is input to the timing controller 842. When it receives the H-level signal, the timing controller 842 raises the two-bit output of the counter C12 at the timing of the second change signal CH_B. Then, the timing controller 842 inputs this signal, whose value changes at the timing of the second change signal CH_B, as a control signal to the multiplexer MX2 of the output section 844. In this embodiment, when the latch signal LAT is input to the timing controller 842, the counter C12 of the timing controller 842 is reset, and the timing controller 842 outputs a value [0] to the output section 844.

The signal that is output from the timing controller 842 is input as control to the multiplexer MX2 of the output section 844. When a value [0] is input to the multiplexer MX2 as control, the multiplexer MX2 selects the initial register RG of group Q2 and outputs an H-level signal corresponding to the selection data stored on this register RG.

The H-level signal that is output from the drive signal switch section 846 is also input to the output section 844. Since this signal that the output section 844 receives from the drive signal switch section 846 is at H level, the output section 844 sets the selection signal q2 to [0] (L level), and outputs the H-level signal from the multiplexer MX2 as the selection signal q6.

As a result, at the start of the repeating cycle T, the control logic 84 outputs a selection signal q2 whose value is [0] (L level) and a selection signal q6 whose value is [1] (H level). It should be noted that in this embodiment, a second change signal CH_B is not set in the period T441. Thus, in the period T441 of the repeating cycle T, the control logic 84 outputs a selection signal q2 whose value is [0] (L level) and a selection signal q6 whose value is [1] (H level). If a second change signal CH_B had been set in the period T431 (or the period T441), then after the second change signal CH_B had been input, a signal that corresponds with the selection data stored on the second register RG of group Q2 would have been output as the selection signal q6.

Because the selection signal q6 is at H level in the period T441, when a medium dot is to be formed (when the pixel data SI are the data [10]), the second switch 86B becomes ON in period T441 and the waveform section SS441 of the second drive signal COM_B is applied to the piezo element 417. It should be noted that in the period T441, the selection signal q2 does not become H level, and thus in this period, the first switch 86A is in the OFF state, and this means that the two switches will not both be in the ON state. Even if incorrect data had been set to a register RG of group G1 or to a register RG of group Q2, at least one of the selection signal q2 and the selection signal Q6 would be [0] (L level), and thus the two switches would not both be in the ON state.

After Input of the Switch Signal CSW

After input of the switch signal CSW, the counter C20 of the drive signal switch section 846 is incremented due to the switch signal CSW and outputs the value [1]. Due to this, the multiplexer MX22 outputs a signal that is at L level in correspondence with the drive signal selection data stored on the register RG (Q2, G2) in group G2. That is, the drive signal switch section 846 outputs a signal corresponding to the drive signal selection data stored on the register RG (Q2, G2).

When an L-level signal is input to the timing controller 842, the timing controller 842 raises the two-bit output of the counter C12 at the timing of the first change signal CH_A. Since there is a pulse of the first change signal CH_A at the start of period T432, the timing controller 842 outputs the value [1] to the output section 844 during the period T432. Also, because there is a pulse of the first change signal CH_A at the start of the period T433, the timing controller 842 outputs the value [2] to the output section 844 during the period T433.

When the value [1] is input as control to the multiplexer MX2 of the output section 844, the multiplexer MX2 selects the second register RG of the group Q2 and outputs an H-level signal that corresponds to the selection data stored on this register RG. When the value [2] is input as control to the multiplexer MX2 of the output section 844, the multiplexer MX2 selects the third register RG of the group Q2 and outputs an L-level signal that corresponds to the selection data stored on this register RG. That is, the multiplexer MX2 of the output section 844 outputs an H-level signal during period T432 and outputs an L-level signal during period T433.

The L-level signal that is output from the drive signal switch section 846 is input to the output section 844. Since this signal that the output section 844 receives from the drive signal switch section 846 is at L level, the output section 844 outputs the signal from the multiplexer MX2 as the selection signal q2, setting the selection signal q2 to [0] (L level).

As a result, during the period T432, the control logic 84 outputs a selection signal q2 whose value is [1] (H level) and a selection signal q6 whose value is [0] (L level). For the same reason, during the period T433, the control logic 84 outputs a selection signal q2 whose value is [0] (L level) and a selection signal q6 whose value is [0] (L level).

Because the selection signal q2 is H level in the period T432, when a medium dot is to be formed (when the pixel data SI are the data [10]), the first switch 86A is in the ON state in period T432, and the waveform section SS432 of the first drive signal COM_A is applied to the piezo element 417. Likewise, because the selection signal q2 is at L level in the period T433, when a medium dot is to be formed (when the pixel data SI are the data [10]), the first switch 86A is in the OFF state in period T433, and the waveform section SS433 of the first drive signal COM_A is not applied to the piezo element 417. It should be noted that in the periods T432 and T433, the selection signal q6 does not become H level, and thus during these periods the second switch 86B is in the OFF state, keeping the two switches from both being in the ON state. Even if incorrect data had been set to a register RG of group G1 or to a register RG of group Q2, at least one of the selection signal q2 and the selection signal Q6 would be [0] (L level), and thus the two switches would not both be in the ON state.

Here it should be pointed out that there are no pulses in the first change signal CH_A and the second change signal CH_B prior to the switch signal CSW. Further, only one of the first change signal CH_A and the second change signal CH_B has a pulse after the switch signal CSW. This is not a limitation, however. For example, it is also possible to vary the number of pulses included in the first change signal CH_A and the second change signal CH_B before and after the switch signal CSW, and the timing of their pulses can be made different. In this way, the various signals of the embodiment can be suitably improved.

Figure 56:
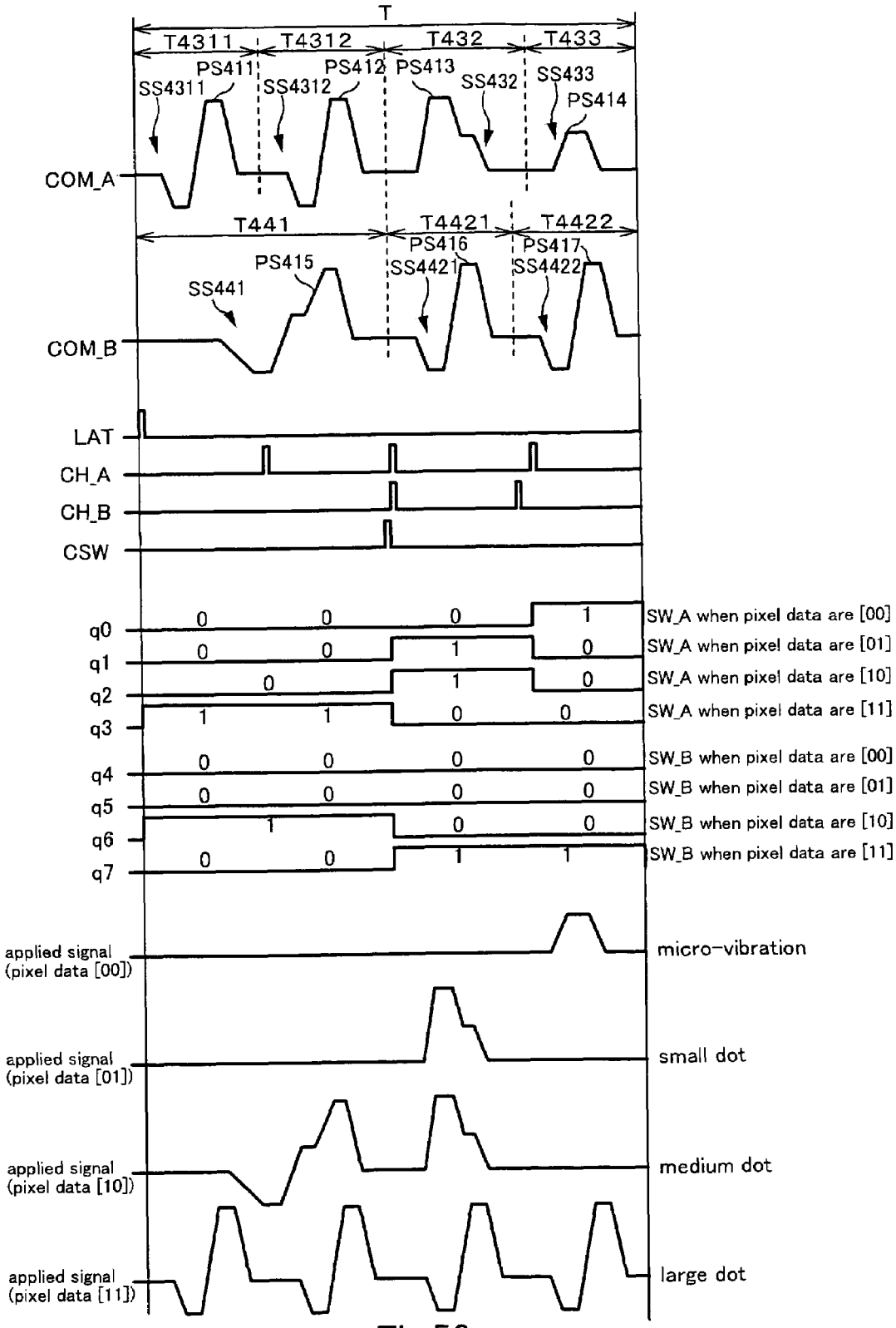
FIG. 56 is an explanatory diagram of a modified example of the waveforms of the various signals.
Figure 57:
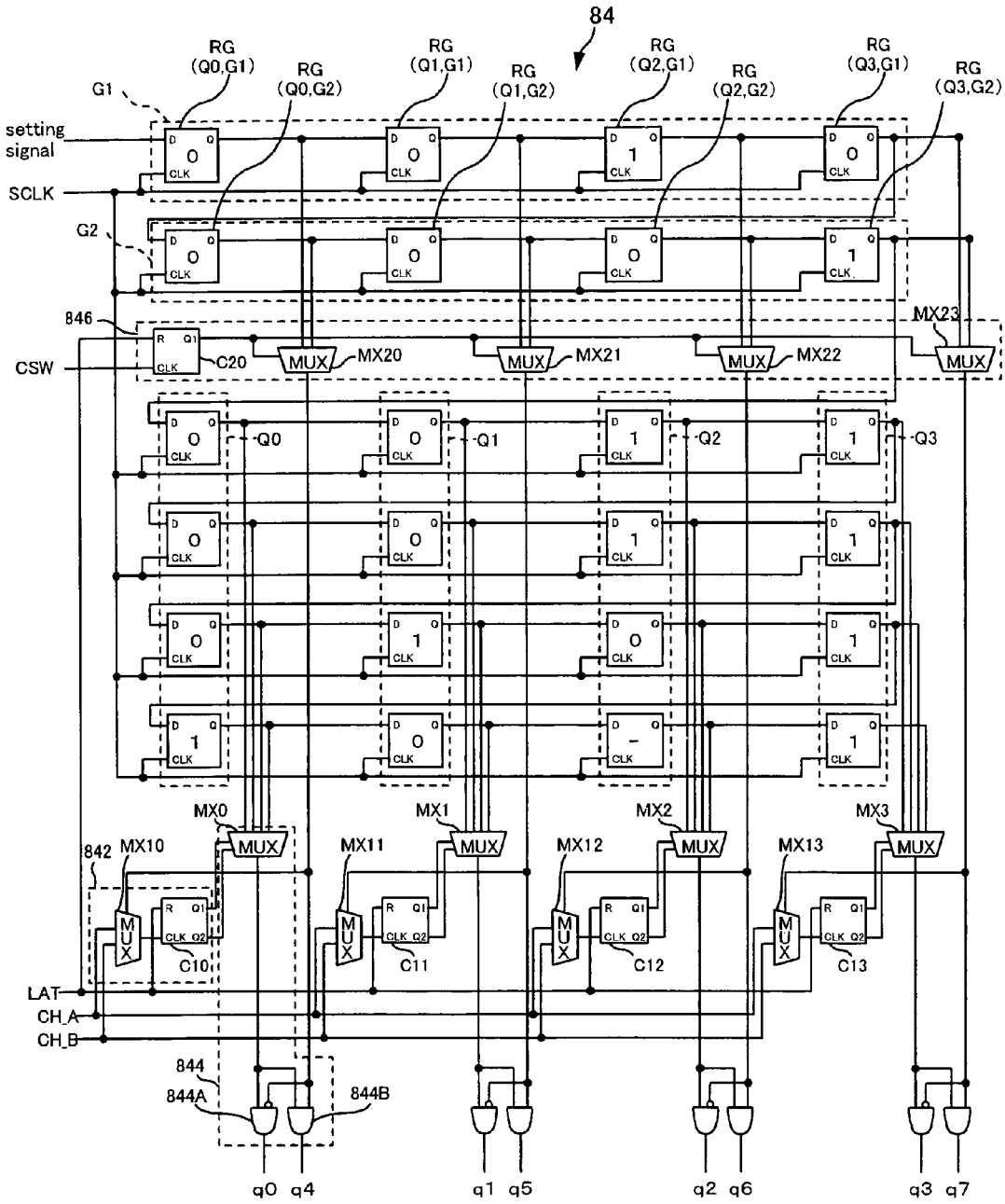
FIG. 57 is an explanatory diagram of the settings of registers RG in that modified example.

For example, FIG. 56 is an explanatory diagram of a modified example of the waveforms of the various signals. FIG. 57 is an explanatory diagram of the settings of the registers RG in this modified example. It should be noted that for brevity of description, the first drive signal COM_A and the second drive signal COM_B are given the same waveforms as in FIG. 54.

In this modified example, the first change signal CH_A has a pulse prior to the switch signal CSW. Then after the switch signal CSW, there is a pulse in the second change signal CH_B. The timing at which this pulse occurs in the second change signal CH_B is different from the timing at which the pulse occurs in the first change signal CH_A. Even under these circumstances, it is possible to apply the same signals as those in the embodiment discussed above to the piezo elements 417.

In this modified example, the drive pulse PS411 of a waveform section SS4311 and the drive pulse PS412 of a waveform section SS4312 can be selected separately and applied to the piezo elements 417. For example, in FIG. 57, if the selection data stored on the second register RG of group Q1 is changed from the value [0] to the value [1], then in response to the pixel data [01], the drive pulse PS412 can be applied to the piezo element 417 without applying the drive pulse PS411. Similarly, in this modified example, the drive pulse PS416 of a waveform section SS4421 and the drive pulse PS417 of a waveform section SS4422 can be selected separately and applied to the piezo elements 417.

Here it should be noted that the selection data for selecting the initial waveform after the input of the switch signal CSW is stored on the third registers RG in group Q0, group Q1, and group Q3, but in group Q2 is stored on the second register RG. However, it is also possible to alter the configuration of the control logic 84 such that the selection data for selecting the initial waveform after input of the switch signal CSW are stored on the third register RG in all of the groups. In this case, if the switch signal CSW is input when the multiplexer MX2 is selecting the first register RG, the multiplexer MX2 selects the third register RG (that is, it skips the second register RG). In other words, the configuration may be that, when a pulse of the switch signal CSW is input, the values of the counters C10 to C13 are always changed to the value [2]. That is, when the switch signal CSW is input, the counters C10 to C13 may load the value [2] due to the timing of that pulse. By doing this, the role of the registers RG belonging to the groups Q0 to Q3 becomes clear.

===(4) Other Embodiments===

The foregoing embodiment primarily describes a printing system 100 that includes a printer 1, but it also includes the disclosure of methods of applying drive signals COM and liquid ejection systems, etc. The foregoing embodiment is for the purpose of facilitating understanding of the present invention, and is not to be interpreted as limiting the present invention. The invention can of course be altered and improved without departing from the gist thereof, and includes equivalents. In particular, the embodiments mentioned below also are within the scope of the invention.

<(4) Drive Signal COM>

The foregoing embodiment offered an example of a printer 1 that simultaneously generates two types of drive signals COM, namely the first drive signal COM_A and the second drive signal COM_B, but there is no limitation to this configuration. That is, it is also possible to adopt a printer 1 that is capable of simultaneously generating three or more types of drive signals COM. Further, the first drive signal COM_A and the second drive signal COM_B only constitute one example, and other waveforms are also possible.

<(4) Regarding the Switch Signal CSW>

In the foregoing embodiment, there was only a single pulse in the switch signal CSW during the repeating cycle T. However, this is not a limitation. For example, it is also possible for there to be two pulses in the switch signal CSW during the repeating cycle T. In this case, the cycle T is divided into three periods by the pulses of the switch signal CSW, and thus it is necessary to store drive signal selection data to be selected in each period. Thus, if the switch signal CSW includes two pulses, then in order to generate the selection signals q0 to q7, it is necessary to increase the number of registers RG for storing drive signal selection data to twelve registers (in the embodiment described above, there were eight).

<(4) Regarding the Ink>

The foregoing embodiment is an embodiment of a printer 1, and thus the nozzles Nz eject dye ink or pigment ink in liquid form. However, as long as the ink that is ejected from the nozzles Nz is a liquid, then there is no limitation to such inks.

<(4) Other Application Examples>

A printer 1 was described in the above embodiment, but this is not a limitation. For example, it is also possible to adopt the same technology as that of the embodiment to various types of liquid ejection apparatuses that employ inkjet technology, such as a color filter manufacturing device, a dyeing device, a fine processing device, a semiconductor manufacturing device, a surface processing device, a three-dimensional shape forming machine, a liquid vaporizing device, an organic EL manufacturing device (particularly a macromolecular EL manufacturing device), a display manufacturing device, a film formation device, and a DNA chip manufacturing device, for example. For this reason, the liquid that is ejected is not limited to ink. For example, if the embodiment is adopted for a semiconductor manufacturing device, then it is also possible for a processing liquid to be ejected from the nozzles. The methods therefor and manufacturing methods thereof are also within the scope of application.

(4) IN SUMMARY (4-1) The printer described above (one example of "liquid ejection apparatus") has a head 41, a drive signal generation circuit 70, and a head controller HC (see FIG. 36). The head 41 includes a plurality of nozzles Nz for ejecting ink droplets (one example of "liquid droplet"), and a plurality of piezo elements (one example of "element") each provided in correspondence with a nozzle (see FIG. 38 and FIG. 42). The drive signal generation circuit 70 generates a first drive signal COM_A and a second drive signal COM_B, and both drive signals COM includes a plurality of waveform sections (see FIG. 52). The head controller controls the ON/OFF states of a first switch 86A and a second switch 86B to apply a drive signal COM to the piezo elements 417 (see FIG. 53).

Figure 48:
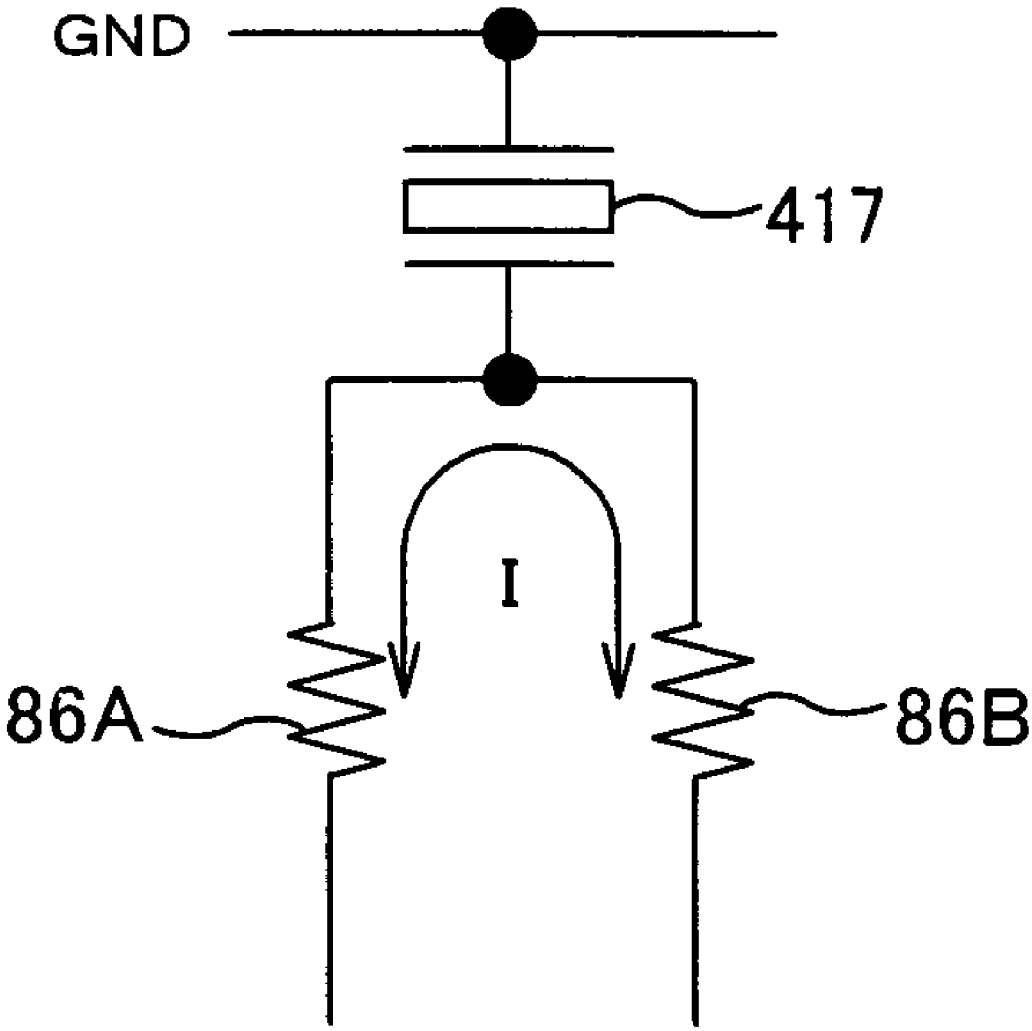
FIG. 48 is a diagram for schematically describing a state in which a first switch and a second switch have been put in the ON state simultaneously.

If the first switch 86A and the second switch 86B both were in the ON state at the same time, then there is a possibility that an unanticipated current I would flow between the signal line for the first drive signal COM_A and the signal line for the second drive signal COM_B, and this may damage the apparatus (see FIG. 48). In the first reference example, there is also a possibility that both switches will be ON at the same time when incorrect data are set to the registers RG.

On the other hand, with the configuration of the second reference example, the two switches are prevented from both being ON at the same time even if incorrect data have been set to the registers RG. With the configuration of the second reference example described above, however, it is not possible to switch drive signals during the repeating cycle T. Thus, for example, when forming large dots, the generation of heat is concentrated only on the first drive signal generation section 70A, which generates the first drive signal COM_A. Further, even when a combination of an ink amount ejected due to a particular drive pulse of the first drive signal COM_A and an ink amount ejected due to a particular drive pulse of the second drive signal COM_B would result in an ink amount that is suited for particular pixel data, the second reference example would not allow for such a combination.

Accordingly, in the printer of this embodiment, registers RG (one example of "memory") that store drive signal selection data and selection data for selecting a waveform section are provided in the control logic 84. The drive signal that should be selected in a period before a switch signal CSW is input (the period T431 or the period T441) is determined based on the drive signal selection data stored on the registers RG of group G1 (one example of "first drive-signal selection data"). Further, the drive signal that should be selected in a period after a switch signal CSW is input (the periods T432 and T433 or T442) is determined based on the drive signal selection data stored on the registers RG of group G2 (one example of "second drive-signal selection data"). Also, whether or not to apply the waveform section included in the selected drive signal to the piezo element is determined based on the selection data stored on the registers RG of the groups Q0 to Q3 (one example of "waveform section selection data").

With this configuration, it is possible to switch the drive signal during the repeating cycle T, as well as prevent the first switch 86A and the second switch 86B from both being in the ON state at the same time.

In the above embodiment, when forming a large dot and when forming a medium dot, a waveform section that is included in the first drive signal COM_A and a waveform section that is included in the second drive signal COM_B are both applied to the piezo element 417. Thus, the first drive signal generation section 70A and the second drive signal generation section 70B both generate heat substantially evenly.

(4-2) In the above embodiment (FIG. 53), there are two waveform sections included in the first drive signal COM_A in the period before input of the switch signal CSW. However, in the same period, there is only one waveform section included in the second drive signal COM_B. That is, in the same period, the number of waveform sections included in the first drive signal COM_A and the number of waveform sections included in the second drive signal COM_B is different, and this allows liquid droplets of different sizes to be formed in the same period.

(4-3) According to the above embodiment (FIG. 53), in the period before input of the switch signal CSW, the period during which the piezo element 417 is driven by the waveform section SS431 included in the first drive signal COM_A and the period during which the piezo element 417 is driven by the waveform section SS441 included in the second drive signal COM_B are different. Likewise, in the period after input of the switch signal CSW, the period during which the piezo element 417 is driven by the waveform section SS432 or the waveform section SS433 included in the first drive signal COM_A and the period during which the piezo element 417 is driven by the waveform section SS442 included in the second drive signal COM_B are different. In this way, it is possible to form liquid droplets having different sizes in the same period.

(4-4) In the above embodiment, the head controller HC includes the first switch 86A and the second switch 86B. Further, when one of the switches is in the ON state, the head controller HC puts the other switch in the OFF state. By doing this, it is possible to prevent the two switches from both being in the ON state at the same time.

(4-5) The head controller HC controls the ON/OFF states of the switches based on drive signal selection data stored on the registers RG belonging to group G1 and group G2. For example, when drive signal selection data having the value [0] has been set to the register RG (Q2, G1) of group G1, then in the period T431 (or the period T441), the selection signal q6 is always maintained at [0] (L level), which always keeps the second switch 86B in the OFF state. Likewise, when drive signal selection data having the value [1] has been set to the register RG (Q2, G1) of group G1, then in the period T431 (or the period T441), the selection signal q2 is always maintained at [0] (L level), thereby always keeping the first switch 86A in the OFF state.

(4-6) In the printer described above, the carriage CR can be moved relative to the body of the apparatus. On the other hand, it is necessary to transmit the head control signals (latch signal LAT, first change signal CH_A, second change signal CH_B, clock signal CLK, pixel data SI, setting signal) and the drive signals (first drive signal COM_A, second drive signal COM_B) to the head controller HC, which is provided in/on the carriage CR, from the printer-side controller 60 and the drive signal generation circuit 70 of the body of the apparatus (see FIG. 36, FIG. 40) Accordingly, in the printer described above, these signals are transmitted over a flexible cable (one example of "cable"). Here, a large current for driving the piezo elements flows through the signal line for the first drive signal COM_A and the signal line for the second drive signal COM_B, and thus there is a possibility that electromagnetic noise will occur in the surrounding area. When the setting signal is affected by noise, there is a possibility that incorrect data will be set to the registers RG (one example of "memory") of the control logic 84.

However, the configuration of the above embodiment allows the two switches to be prevented from both being in the ON state at the same time, even if the setting signal is affected by noise and as a result sets incorrect data to the registers RG.

(4-7) There is also a possibility that incorrect data will be set to the registers RG of the control logic 84 if the clock signal CLK for transfer, which is used when setting the data to the registers RG, is affected by noise. However, with the configuration of the above embodiment, it is possible to prevent both switches from entering the ON state at the same time.

(4-8) Because piezo elements (one example of "piezoelectric element") are used, it is necessary to set a high voltage for the drive signals COM, and thus, in the above embodiment in particular, electromagnetic noise is prone to occur around the signal lines over which the drive signals are transferred. With the configuration of the above embodiment, however, it is possible to prevent both switches from entering the ON state at the same time. It should be noted that the voltage for driving the control logic and the printer-side controller, for example, is approximately 5V, whereas the voltage change of the drive signal COM is approximately 40V.

What is claimed is:

1. A liquid ejection apparatus comprising:

an element that can execute an operation for ejecting liquid;

a drive signal generation section that generates a first drive signal and a second drive signal;

a first switch that controls application of said first drive signal to said element;

a second switch that controls application of said second drive signal to said element; and a controller that puts both said first switch and said second switch into an OFF state when switching the drive signal that is to be applied to said element from said first drive signal to said second drive signal, wherein said first switch controls application of said first drive signal to said element based on a first switch control signal, wherein said second switch controls application of said second drive signal to said element based on a second switch control signal, and wherein said controller puts both said first switch and said second switch into the OFF state, regardless of said first switch control signal and said second switch control signal.

2. A liquid ejection apparatus according to claim 1, wherein said controller puts both said first switch and said second switch into the OFF state based on a timing pulse that defines a switch timing of said first switch control signal and said second switch control signal.

3. A liquid ejection apparatus according to claim 2, wherein said controller disables said first switch control signal and said second switch control signal at a timing of a forward edge of said timing pulse, and enables said first switch control signal and said second switch control signal at a timing of a rear edge of said timing pulse.

4. A liquid ejection apparatus according to claim 2, wherein said controller disables said first switch control signal and said second switch control signal based on said timing pulse, and enables said first switch control signal and said second switch control signal after a predetermined time has passed from when said disablement has been effected.

5. A liquid ejection apparatus according to claim 4, wherein said controller has a timer that measures said predetermined time.

6. A liquid ejection apparatus according to claim 1, wherein said controller comprises:

a first gate to which said first switch control signal and a gate control signal are input, wherein if said gate control signal is at a predetermined level, then said first gate outputs said first switch control signal to said first switch, and if said gate control signal is at an other predetermined level, then said first gate disables said first switch control signal and outputs, to said first switch, a first OFF control signal for putting said first switch into an OFF state; and a second gate to which said second switch control signal and said gate control signal are input, wherein if said gate control signal is at said predetermined level, then said second gate outputs said second switch control signal to said second switch, and if said gate control signal is at said other predetermined level, then said second gate disables said second switch control signal and outputs a second OFF control signal, to said second switch, for putting said second switch into an OFF state; and wherein said controller sets said gate control signal to said other predetermined level over a period during which said first switch and said second switch are to be put into the OFF state.

7. A liquid ejection apparatus according to claim 1, wherein said first switch switches between an ON state and an OFF state due to a change in a resistance value; and wherein said second switch switches between an ON state and an OFF state due to a change in a resistance value.

8. A liquid ejection apparatus according to claim 1, wherein said liquid is a liquid ink for printing.

9. A method of applying drive signals, comprising:

generating a first drive signal and a second drive signal;

putting, into an ON state, a first switch that controls application of said first drive signal to an element that can execute an operation for ejecting liquid, and applying said first drive signal to said element;

putting both said first switch and a second switch that controls application of said second drive signal to said element into an OFF state; and putting said second switch into an ON state and applying said second drive signal to said element, wherein said first switch controls application of said first drive signal to said element based on a first switch control signal, wherein said second switch controls application of said second drive signal to said element based on a second switch control signal, and wherein both said first switch and said second switch are put into the OFF state, regardless of said first switch control signal and said second switch control signal.

10. A liquid ejection method comprising:

generating a first drive signal and a second drive signal;

putting, into an ON state, a first switch that controls application of said first drive signal to an element that can execute an operation for ejecting liquid, and applying said first drive signal to said element;

putting both said first switch and a second switch that controls application of said second drive signal to said element into an OFF state; and putting said second switch into an ON state and applying said second drive signal to said element, wherein said first switch controls application of said first drive signal to said element based on a first switch control signal, wherein said second switch controls application of said second drive signal to said element based on a second switch control signal, and wherein said controller puts both said first switch and said second switch into the OFF state, regardless of said first switch control signal and said second switch control signal.

* * * * *